US011253001B2

(12) United States Patent
Atkins et al.

(10) Patent No.: US 11,253,001 B2
(45) Date of Patent: Feb. 22, 2022

(54) VAPORIZER DEVICE WITH VAPORIZER CARTRIDGE

(71) Applicant: JUUL Labs, Inc., San Francisco, CA (US)

(72) Inventors: Ariel Atkins, San Francisco, CA (US); Christopher L. Belisle, Somerset, WI (US); Brandon Cheung, San Francisco, CA (US); Steven Christensen, Burlingame, CA (US); Dylan E. Entelis, Los Angeles, CA (US); Alexander M. Hoopai, San Francisco, CA (US); Eric Joseph Johnson, San Francisco, CA (US); Jason King, San Francisco, CA (US); Esteban Leon Duque, Berkeley, CA (US); Matthew J. Malone, Los Angeles, CA (US); James Monsees, San Francisco, CA (US); Nathan N. Ng, San Francisco, CA (US); Claire O'Malley, San Francisco, CA (US); Matthew Rios, San Francisco, CA (US); Christopher James Rosser, Cambridge (GB); Zachary T. Scott, Oakland, CA (US); Andrew J. Stratton, Royston (GB); Alim Thawer, Cambridge (GB); Norbert Wesely, San Francisco, CA (US); James P. Westley, Cambridge (GB)

(73) Assignee: JUUL Labs, Inc., San Francisco, CA (US)

( * ) Notice: Subject to any disclaimer, the term of this patent is extended or adjusted under 35 U.S.C. 154(b) by 0 days.

(21) Appl. No.: 16/805,672

(22) Filed: Feb. 28, 2020

(65) Prior Publication Data

US 2020/0275696 A1 Sep. 3, 2020

Related U.S. Application Data

(63) Continuation-in-part of application No. 16/653,455, filed on Oct. 15, 2019, now Pat. No. 10,905,835, and
(Continued)

(51) Int. Cl.
*A24F 40/10* (2020.01)
*A24F 40/42* (2020.01)
(Continued)

(52) U.S. Cl.
CPC ..... *A24F 40/42* (2020.01); *A24F 40/10* (2020.01); *A24F 40/44* (2020.01); *A24F 40/46* (2020.01); *A24F 40/485* (2020.01); *A24F 40/50* (2020.01)

(58) Field of Classification Search
CPC ..... A24F 40/10; A24F 40/40; A24F 40/42; A24F 40/46; A24F 47/008
See application file for complete search history.

(56) References Cited

U.S. PATENT DOCUMENTS 6,155,268 A 12/2000 Takeuchi
6,909,840 B2 6/2005 Harwig et al.
(Continued)

FOREIGN PATENT DOCUMENTS

CA 2469408 C 1/2014
CN 103859604 A 6/2014
(Continued)

OTHER PUBLICATIONS

U.S. Appl. No. 16/653,455, filed Oct. 15, 2019, US 2020-0114094.
(Continued)

*Primary Examiner* — Michael J Felton
*Assistant Examiner* — Sonny V Nguyen
(74) *Attorney, Agent, or Firm* — Mintz Levin Cohn Ferris Glovsky and Popeo, P.C.

(57) ABSTRACT

A cartridge may include a cartridge housing, a reservoir and a wick housing disposed inside the cartridge housing, a
(Continued)

heating element, and a wicking element. The cartridge housing may be configured to extend below an open top of a receptacle in the vaporizer device when the cartridge is coupled with the vaporizer device. The reservoir may be configured to contain a vaporizable material. The heating element may include a heating portion disposed at least partially inside the wick housing and a contact portion disposed at least partially outside the wick housing. The contact portion may include cartridge contacts that form an electric coupling with receptacle contacts in the receptacle. The wicking element may be disposed within the wick housing and proximate to the heating portion of the heating element. The wicking element may be configured to draw the vaporizable material to the wick housing for vaporization by the heating element.

29 Claims, 78 Drawing Sheets

Related U.S. Application Data a continuation-in-part of application No. 16/656,360, filed on Oct. 17, 2019.

(60) Provisional application No. 62/812,148, filed on Feb. 28, 2019, provisional application No. 62/812,161, filed on Feb. 28, 2019, provisional application No. 62/913,135, filed on Oct. 9, 2019, provisional application No. 62/915,005, filed on Oct. 14, 2019, provisional application No. 62/930,508, filed on Nov. 4, 2019, provisional application No. 62/947,496, filed on Dec. 12, 2019, provisional application No. 62/981,498, filed on Feb. 25, 2020.

(51) Int. Cl.

| | |
|---|---|
| ***A24F 40/46*** | (2020.01) |
| ***A24F 40/44*** | (2020.01) |
| ***A24F 40/485*** | (2020.01) |
| *A24F 40/50* | (2020.01) |

(56) References Cited

U.S. PATENT DOCUMENTS

| | | | | |
|---|---|---|---|---|
| 7,367,334 | B2 | 5/2008 | Faison, Jr. et al. | |
| 8,528,569 | B1 | 9/2013 | Newton | |
| 8,752,545 | B2 | 6/2014 | Buchberger | |
| 8,881,737 | B2 | 11/2014 | Collett et al. | |
| 8,948,578 | B2 | 2/2015 | Buchberger | |
| 9,504,279 | B2 | 11/2016 | Chen | |
| 9,549,573 | B2 | 1/2017 | Monsees et al. | |
| 9,623,205 | B2 | 4/2017 | Buchberger | |
| 9,687,027 | B2 | 6/2017 | Poston et al. | |
| 9,802,011 | B2 | 10/2017 | Davidson et al. | |
| 9,986,761 | B2 | 6/2018 | Thorens et al. | |
| 9,986,762 | B2 | 6/2018 | Alarcon et al. | |
| 9,999,250 | B2 | 6/2018 | Minskoff et al. | |
| 10,034,988 | B2 | 7/2018 | Wensley et al. | |
| 10,045,568 | B2 | 8/2018 | Monsees et al. | |
| 10,085,481 | B2 | 10/2018 | Verleur et al. | |
| 10,085,485 | B2 | 10/2018 | Hunt et al. | |
| 10,104,915 | B2 | 10/2018 | Bowen et al. | |
| 10,130,123 | B2 | 11/2018 | Hatton et al. | |
| 10,131,532 | B2 | 11/2018 | Murison et al. | |
| 10,159,282 | B2 | 12/2018 | Monsees et al. | |
| 10,188,148 | B2 | 1/2019 | Althorpe et al. | |
| 10,194,693 | B2 | 2/2019 | Wensley et al. | |
| 10,206,429 | B2 | 2/2019 | Davis et al. | |
| 10,420,374 | B2 | 9/2019 | Liu | |
| 10,426,199 | B2 | 10/2019 | Turner et al. | |
| 10,517,331 | B2 | 12/2019 | Atkins et al. | |
| 2003/0215335 | A1 | 11/2003 | Crivelli | |
| 2006/0047368 | A1 | 3/2006 | Maharajh et al. | |
| 2009/0133691 | A1 | 5/2009 | Yamada et al. | |
| 2009/0230117 | A1 | 9/2009 | Fernando et al. | |
| 2010/0253281 | A1 | 10/2010 | Li | |
| 2011/0226236 | A1* | 9/2011 | Buchberger | A61M 15/0086 128/200.23 |
| 2013/0042865 | A1 | 2/2013 | Monsees et al. | |
| 2013/0087160 | A1 | 4/2013 | Gherghe | |
| 2013/0104916 | A1 | 5/2013 | Bellinger et al. | |
| 2013/0192615 | A1 | 8/2013 | Tucker et al. | |
| 2013/0284192 | A1 | 10/2013 | Peleg et al. | |
| 2013/0306064 | A1* | 11/2013 | Thorens | A24F 40/40 128/202.21 |
| 2013/0306065 | A1 | 11/2013 | Thorens et al. | |
| 2014/0190496 | A1 | 7/2014 | Wensley et al. | |
| 2014/0261487 | A1 | 9/2014 | Chapman et al. | |
| 2014/0353856 | A1 | 12/2014 | Dubief | |
| 2015/0114409 | A1 | 4/2015 | Brammer et al. | |
| 2015/0144145 | A1 | 5/2015 | Chang et al. | |
| 2015/0181944 | A1* | 7/2015 | Li | A24F 47/008 131/329 |
| 2015/0208729 | A1* | 7/2015 | Monsees | A24F 40/42 131/329 |
| 2015/0216237 | A1 | 8/2015 | Wensley et al. | |
| 2015/0237916 | A1 | 8/2015 | Farine et al. | |
| 2015/0264979 | A1 | 9/2015 | Thorens et al. | |
| 2015/0305408 | A1 | 10/2015 | Liu | |
| 2015/0313287 | A1 | 11/2015 | Verleur et al. | |
| 2015/0320116 | A1 | 11/2015 | Bleloch et al. | |
| 2015/0327596 | A1 | 11/2015 | Alarcon et al. | |
| 2015/0357839 | A1 | 12/2015 | Cai et al. | |
| 2016/0015082 | A1 | 1/2016 | Liu | |
| 2016/0057811 | A1 | 2/2016 | Alarcon et al. | |
| 2016/0150824 | A1 | 6/2016 | Memari et al. | |
| 2016/0150828 | A1 | 6/2016 | Goldstein et al. | |
| 2016/0192709 | A1 | 7/2016 | Liu | |
| 2016/0262454 | A1 | 9/2016 | Sears et al. | |
| 2016/0302485 | A1 | 10/2016 | Alima | |
| 2016/0309786 | A1* | 10/2016 | Holtz | H05B 3/16 |
| 2016/0331035 | A1 | 11/2016 | Cameron | |
| 2016/0332754 | A1 | 11/2016 | Brown et al. | |
| 2016/0341419 | A1 | 11/2016 | Fluhrer | |
| 2016/0366725 | A1 | 12/2016 | Tucker et al. | |
| 2016/0366945 | A1 | 12/2016 | Rado | |
| 2017/0043106 | A1 | 2/2017 | Hyland et al. | |
| 2017/0043910 | A1* | 2/2017 | Hopps | A45C 13/007 |
| 2017/0045994 | A1 | 2/2017 | Murison et al. | |
| 2017/0056883 | A1 | 3/2017 | Aarts et al. | |
| 2017/0135399 | A1 | 5/2017 | Gavrielov et al. | |
| 2017/0164657 | A1 | 6/2017 | Batista | |
| 2017/0188629 | A1 | 7/2017 | Dickens et al. | |
| 2017/0196263 | A1 | 7/2017 | Sur | |
| 2017/0208865 | A1 | 7/2017 | Nettenstrom et al. | |
| 2017/0231276 | A1 | 8/2017 | Mironov et al. | |
| 2017/0258134 | A1 | 9/2017 | Kane | |
| 2017/0259170 | A1 | 9/2017 | Bowen et al. | |
| 2017/0280779 | A1 | 10/2017 | Qiu | |
| 2017/0303597 | A1 | 10/2017 | Tsui | |
| 2017/0325504 | A1 | 11/2017 | Liu | |
| 2017/0354186 | A1 | 12/2017 | Johnson et al. | |
| 2017/0367402 | A1 | 12/2017 | Lau et al. | |
| 2017/0367407 | A1 | 12/2017 | Althorpe et al. | |
| 2018/0016040 | A1 | 1/2018 | Ewing et al. | |
| 2018/0027877 | A1 | 2/2018 | Tucker et al. | |
| 2018/0027879 | A1 | 2/2018 | Gavrielov et al. | |
| 2018/0027883 | A1 | 2/2018 | Zuber et al. | |
| 2018/0035721 | A1 | 2/2018 | Cypher et al. | |
| 2018/0049466 | A1 | 2/2018 | Cypher et al. | |
| 2018/0077967 | A1* | 3/2018 | Hatton | A61M 11/00 |
| 2018/0116292 | A1 | 5/2018 | Atkins et al. | |
| 2018/0117268 | A1 | 5/2018 | Selby et al. | |
| 2018/0125120 | A1* | 5/2018 | Gavrielov | H05B 3/44 |
| 2018/0132536 | A1* | 5/2018 | Henry, Jr. | A61M 15/06 |
| 2018/0146711 | A1* | 5/2018 | Mazur | A61M 11/02 |
| 2018/0184722 | A1 | 7/2018 | Murison et al. | |
| 2018/0199627 | A1 | 7/2018 | Bowen et al. | |
| 2018/0220707 | A1* | 8/2018 | Biel | A61M 15/06 |
| 2018/0279682 | A1* | 10/2018 | Guo | H05B 3/04 |

(56) References Cited

U.S. PATENT DOCUMENTS

| | | | |
|---|---|---|---|
| 2018/0279685 | A1 | 10/2018 | Thorens et al. |
| 2018/0280637 | A1 | 10/2018 | Mayle et al. |
| 2018/0296777 | A1 | 10/2018 | Terry et al. |
| 2019/0046745 | A1 | 2/2019 | Nettenstrom et al. |
| 2019/0099561 | A1 | 4/2019 | Nettenstrom |
| 2019/0104764 | A1* | 4/2019 | Tucker ..... H05B 3/04 |
| 2019/0166913 | A1 | 6/2019 | Trzecieski |
| 2019/0246693 | A1* | 8/2019 | Nettenstrom ..... A61M 15/002 |
| 2019/0373953 | A1 | 12/2019 | Atkins et al. |
| 2020/0022417 | A1 | 1/2020 | Atkins et al. |
| 2020/0046033 | A1 | 2/2020 | Robert et al. |
| 2020/0107585 | A1 | 4/2020 | Atkins et al. |
| 2020/0114094 | A1 | 4/2020 | Atkins et al. |
| 2020/0128874 | A1 | 4/2020 | Atkins et al. |

FOREIGN PATENT DOCUMENTS

| | | | |
|---|---|---|---|
| CN | 105011375 | A | 11/2015 |
| CN | 207011686 | U | 2/2018 |
| CN | 108158039 | A | 6/2018 |
| CN | 208113970 | U | 11/2018 |
| CN | 109259313 | A | 1/2019 |
| CN | 109588779 | A | 4/2019 |
| CN | 110226778 | A | 9/2019 |
| CN | 105473012 | B | 6/2020 |
| EP | 2404515 | A1 | 1/2012 |
| EP | 3170414 | A1 | 5/2017 |
| EP | 3117860 | B1 | 1/2019 |
| EP | 3488715 | A2 | 5/2019 |
| EP | 3664631 | A2 | 6/2020 |
| EP | 3694357 | A1 | 8/2020 |
| JP | 2013/113551 | A | 6/2013 |
| JP | 2015-198985 | A | 11/2015 |
| JP | 2017511703 | A | 4/2017 |
| JP | 2018-509158 | A | 4/2018 |
| JP | 2018-523976 | A | 8/2018 |
| UA | 88052 | C2 | 9/2009 |
| WO | WO-2013060781 | A1 | 5/2013 |
| WO | WO-2013083635 | A1 | 6/2013 |
| WO | WO-2014047948 | A1 | 4/2014 |
| WO | WO-2014150979 | A2 | 9/2014 |
| WO | WO-2015042412 | A1 | 3/2015 |
| WO | WO-2015120588 | A1 | 8/2015 |
| WO | WO-2016000233 | A1 | 1/2016 |
| WO | WO-2016023173 | A1 | 2/2016 |
| WO | WO-2016023809 | A1 | 2/2016 |
| WO | WO-2016/079155 | A1 | 5/2016 |
| WO | WO-2016079151 | A1 | 5/2016 |
| WO | WO-2016082158 | A1 | 6/2016 |
| WO | WO-2016090602 | A1 | 6/2016 |
| WO | WO-2016108694 | A1 | 7/2016 |
| WO | WO-2016109929 | A1 | 7/2016 |
| WO | WO-2016109933 | A1 | 7/2016 |
| WO | WO-2016109942 | A1 | 7/2016 |
| WO | WO-2016115691 | A1 | 7/2016 |
| WO | WO-2016119496 | A1 | 8/2016 |
| WO | WO-2016122417 | A1 | 8/2016 |
| WO | WO-2016123763 | A1 | 8/2016 |
| WO | WO-2016138665 | A1 | 9/2016 |
| WO | WO-2016145072 | A1 | 9/2016 |
| WO | WO-2016145613 | A1 | 9/2016 |
| WO | WO-2016149932 | A1 | 9/2016 |
| WO | WO-2017054424 | A1 | 4/2017 |
| WO | WO-2017082728 | A1 | 5/2017 |
| WO | WO-2017085240 | A1 | 5/2017 |
| WO | WO-2017093535 | A1 | 6/2017 |
| WO | WO-2017121296 | A1 | 7/2017 |
| WO | WO-2017139595 | A1 | 8/2017 |
| WO | WO-2017139963 | A1 | 8/2017 |
| WO | WO-2017163046 | A1 | 9/2017 |
| WO | WO-2017163051 | A1 | 9/2017 |
| WO | WO-2017163052 | A1 | 9/2017 |
| WO | WO-2018/122380 | A1 | 7/2018 |
| WO | WO-2018172765 | A1 | 9/2018 |
| WO | WO-2018197515 | A1 | 11/2018 |
| WO | WO-2018202403 | A1 | 11/2018 |
| WO | WO-2019073010 | A1 | 4/2019 |
| WO | WO-2019173923 | A1 | 9/2019 |
| WO | WO-2019232086 | A1 | 12/2019 |
| WO | WO-2020020788 | A1 | 1/2020 |
| WO | WO-2020025644 | A1 | 2/2020 |

OTHER PUBLICATIONS

U.S. Appl. No. 16/657,857, filed Oct. 18, 2019, US 2020-0120991.
U.S. Appl. No. 16/656,360, filed Oct. 17, 2019, US 2020-0128874.
U.S. Appl. No. 16/653,455, filed Oct. 15, 2019, U.S. Pat. No. 10,905,835.
U.S. Appl. No. 17/161,590, filed Jan. 28, 2021.

* cited by examiner

VAPORIZER DEVICE WITH VAPORIZER CARTRIDGE

CROSS REFERENCE TO RELATED APPLICATIONS

This application claims priority to U.S. Provisional Application No. 62/913,135, entitled "HEATING ELEMENT" and filed on Oct. 9, 2019, U.S. Provisional Application No. 62/812,148, entitled "RESERVOIR OVERFLOW CONTROL WITH CONSTRICTION POINTS and filed on Feb. 28, 2019, U.S. Provisional Application No. 62/812,161, entitled "CARTRIDGE FOR A VAPORIZER DEVICE" and filed on Feb. 28, 2019, U.S. Provisional Application No. 62/915,005, entitled "CARTRIDGE FOR A VAPORIZER DEVICE" and filed on Oct. 14, 2019, U.S. Provisional Application No. 62/930,508, entitled "VAPORIZER DEVICE" and filed on Nov. 4, 2019, U.S. Provisional Application No. 62/947,496, entitled "VAPORIZER DEVICE" and filed on Dec. 12, 2019, and U.S. Provisional Application No. 62/981,498, entitled "VAPORIZER DEVICE WITH VAPORIZER CARTRIDGE" and filed on Feb. 25, 2020. The disclosures of the foregoing applications are incorporated herein by reference in their entirety.

This application is a continuation-in-part of U.S. patent application Ser. No. 16/653,455, entitled "HEATING ELEMENT" and filed on Oct. 15, 2019, and U.S. patent application Ser. No. 16/656,360, entitled "CARTRIDGE FOR A VAPORIZER DEVICE" and filed on Oct. 17, 2019, the disclosures of which are incorporated herein by reference in their entirety.

TECHNICAL FIELD

The subject matter described herein relates generally to vaporizer devices and more specifically to a vaporizer device configured to couple with a vaporizer cartridge.

BACKGROUND

Vaporizer devices, which can also be referred to as vaporizers, electronic vaporizer devices or e-vaporizer devices, can be used for delivery of an aerosol (or "vapor") containing one or more active ingredients by inhalation of the aerosol by a user of the vaporizing device. For example, electronic cigarettes, which may also be referred to as e-cigarettes, are a class of vaporizer devices that are typically battery powered and that may be used to simulate the experience of cigarette smoking, but without burning of tobacco or other substances.

In use of a vaporizer device, the user inhales an aerosol, commonly called vapor, which may be generated by a heating element that vaporizes (which generally refers to causing a liquid or solid to at least partially transition to the gas phase) a vaporizable material, which may be liquid, a solution, a solid, a wax, or any other form as may be compatible with use of a specific vaporizer device. The vaporizable material used with a vaporizer can be provided within a cartridge (e.g., a part of the vaporizer that contains the vaporizable material in a reservoir) that includes a mouthpiece (e.g., for inhalation by a user).

To receive the inhalable aerosol generated by a vaporizer device, a user may, in certain examples, activate the vaporizer device by taking a puff, by pressing a button, or by some other approach. A puff, as the term is generally used (and also used herein), refers to inhalation by the user in a manner that causes a volume of air to be drawn into the vaporizer device such that the inhalable aerosol is generated by a combination of vaporized vaporizable material with the air.

A typical approach by which a vaporizer device generates an inhalable aerosol from a vaporizable material involves heating the vaporizable material in a vaporization chamber (or a heater chamber) to cause the vaporizable material to be converted to the gas (or vapor) phase. A vaporization chamber generally refers to an area or volume in the vaporizer device within which a heat source (e.g., conductive, convective, and/or radiative) causes heating of a vaporizable material to produce a mixture of air and vaporized vaporizable material to form a vapor for inhalation by a user of the vaporization device.

In some vaporizer device embodiments, the vaporizable material can be drawn out of a reservoir and into the vaporization chamber via a wicking element (a wick). Such drawing of the vaporizable material into the vaporization chamber can be due, at least in part, to capillary action provided by the wick, which pulls the vaporizable material along the wick in the direction of the vaporization chamber. However, as vaporizable material is drawn out of the reservoir, the pressure inside the reservoir is reduced, thereby creating a vacuum and acting against the capillary action. This can reduce the effectiveness of the wick to draw the vaporizable material into the vaporization chamber, thereby reducing the effectiveness of the vaporization device to vaporize a desired amount of vaporizable material, such as when a user takes a puff on the vaporizer device. Furthermore, the vacuum created in the reservoir can ultimately result in the inability to draw all of the vaporizable material into the vaporization chamber, thereby wasting vaporizable material. As such, improved vaporization devices and/or vaporization cartridges that improve upon or overcome these issues is desired.

The term vaporizer device, as used herein consistent with the current subject matter, generally refers to portable, self-contained, devices that are convenient for personal use. Typically, such devices are controlled by one or more switches, buttons, touch sensitive devices, or other user input functionality or the like (which can be referred to generally as controls) on the vaporizer, although a number of devices that may wirelessly communicate with an external controller (e.g., a smartphone, a smart watch, other wearable electronic devices, etc.) have recently become available. Control, in this context, refers generally to an ability to influence one or more of a variety of operating parameters, which may include without limitation any of causing the heater to be turned on and/or off, adjusting a minimum and/or maximum temperature to which the heater is heated during operation, various games or other interactive features that a user might access on a device, and/or other operations.

Various vaporizable materials having a variety of contents and proportions of such contents can be contained in the cartridge. Some vaporizable materials, for example, may have a smaller percentage of active ingredients per total volume of vaporizable material, such as due to regulations requiring certain active ingredient percentages. As such, a user may need to vaporize a large amount of vaporizable material (e.g., compared to the overall volume of vaporizable material that can be stored in a cartridge) to achieve a desired effect.

SUMMARY

In certain aspects of the current subject matter, challenges associated with the presence of liquid vaporizable materials in or near certain susceptible components of an electronic vaporizer device may be addressed by inclusion of one or more of the features described herein or comparable/equivalent approaches as would be understood by one of ordinary skill in the art. In one aspect, there is provided a cartridge for a vaporizer device. The cartridge may include: a cartridge housing, the cartridge housing configured to extend below an open top of a receptacle in the vaporizer device when the cartridge is coupled with the vaporizer device; a reservoir disposed within the cartridge housing, the reservoir configured to contain a vaporizable material; a wick housing disposed within the cartridge housing; a heating element, the heating element including a heating portion disposed at least partially inside the wick housing and a contact portion disposed at least partially outside the wick housing, the contact portion including one or more cartridge contacts configured to form an electric coupling with one or more receptacle contacts in the receptacle of the vaporizer device; and a wicking element disposed within the wick housing and proximate to the heating portion of the heating element, the wicking element configured to draw the vaporizable material from the reservoir to the wick housing for vaporization by the heating element.

In some variations, one or more features disclosed herein including the following features may optionally be included in any feasible combination. The contact portion may be further configured to form a mechanical coupling with the receptacle of the vaporizer device. The mechanical coupling may secure the cartridge in the receptacle of the vaporizer device.

In some variations, the receptacle may be a first portion of a body of the vaporizer device having a smaller cross-sectional dimension than a second portion of the body of the vaporizer device. A recessed area may be formed between the cartridge housing and the second portion of the body of the vaporizer device when the cartridge is coupled with the vaporizer device.

In some variations, the receptacle may include one or more air inlets that form a fluid coupling with one or more slots in a bottom of the wick housing when the cartridge is coupled with the vaporizer device. The one or more slots may be configured to allow air entering the one or more air inlets to further enter the wick housing. The one or more air inlets may be disposed in the recessed area. The one or more air inlets may have a diameter of between approximately 0.6 millimeters and 1.0 millimeters.

In some variations, an interior of each of the one or more slots may include at least one step formed by an inner dimension of the one or more slots being less than a dimension of the one or more slots at the bottom of the wick housing. The at least one step may provide a constriction point at which a meniscus forms to prevent the vaporizable material in the wick housing from flowing out of the one or more slots. The dimension of the one or more slots at the bottom of the wick housing may be approximately 1.2 millimeters long by 0.5 millimeters wide. The inner dimension of the one or more slots may be approximately 1 millimeters long by 0.3 millimeters wide.

In some variations, the heating portion of the heating element and the contact portion of the heating element may be formed by folding a substrate material. The substrate material may be cut to include one or more tines for forming the heating portion of the heating element. The substrate material may be further cut to include one or more legs for forming the contact portion of the heating element.

In some variations, the contact portion of the heating element may be formed by folding each of the one or more legs to form at least a first joint, a second joint, and a third joint. The first joint may be disposed between the second joint and the third joint. The second joint may be disposed between a tip of each of the one or more legs and the first joint.

In some variations, the one or more cartridge contacts may be disposed at the second joint. The heating element may be secured to the wicking housing by a first mechanical coupling between an exterior of the wick housing and a portion of each of the one or more legs between the first joint and the third joint. The cartridge may be secured to the receptacle of the vaporizer device by a second mechanical coupling between the second joint and the receptacle of the vaporizer device.

In some variations, the one or more cartridge contacts may be disposed at the first joint. The heating element may be secured to the wick housing by a first mechanical coupling between an exterior of the wick housing and a portion of each of the one or more legs between the tip and the second joint. The cartridge may be secured to the receptacle of the vaporizer device by a second mechanical coupling between the first joint and the receptacle of the vaporizer device.

In some variations, the reservoir may include a storage chamber and a collector. The collector may include an overflow channel configured to retain a volume of the vaporizable material in fluid contact with the storage chamber. One or more microfluidic features may be disposed along a length of the overflow channel. Each of the one or more microfluidic features may be configured to provide a constriction point at which a meniscus forms to prevent air entering the reservoir from passing the vaporizable material in the overflow channel.

In some variations, the cartridge housing may include an airflow passageway leading to an outlet for an aerosol that is formed by the heating element vaporizing the vaporizable material. The collector may include a central tunnel in fluid communication with the airflow passageway. A bottom surface of the collector may include a flow controller configured to mix the aerosol generated by the heating element vaporizing the vaporizable material.

In some variations, an interior surface of the airflow passageway may include one or more channels that extend from the outlet to the wicking element. The one or more channels may be configured to collect a condensate formed by the aerosol and direct at least a portion the collected condensate towards the wicking element.

In some variations, the flow controller may include a first channel and a second channel. The first channel may be offset from the second channel. A first interior surface of the first channel may be sloped in a different direction from a second interior surface of the second channel to direct a first column of the aerosol entering the central tunnel through the first channel in a different direction than a second column of the aerosol entering the central tunnel through the second channel.

In some variations, the bottom surface of the controller may further include one or more wick interfaces. The one or more wick interfaces may be in fluid communication with one or more wick feeds in the collector. The one or more wick feeds may be configured to deliver, to the wicking element disposed in the wick housing, at least a portion of the vaporizable material contained in the storage chamber.

In some variations, the wick housing may be disposed at least partially inside the receptacle of the vaporizer device when the cartridge is coupled with the vaporizer device. A flange is disposed at least partially around an upper perimeter of the wick housing. The flange may extend over at least a portion of a rim of the cartridge receptacle.

In another aspect, there is provided a vaporizer device. The vaporizer cartridge may include: a receptacle comprising a first portion of a body of the vaporizer device, the receptacle including one or more receptacle contacts, the receptacle configured to receive a wick housing of a cartridge containing a vaporizable material when the cartridge is coupled with the vaporizer device, a housing of the cartridge extending below an open top of the receptacle when the cartridge is coupled with the vaporizer device, the one or more receptacle contacts configured to form an electric coupling with one or more cartridge contacts comprising a contact portion of a heating element in the cartridge, the contact portion disposed at least partially outside the wick housing; a power source disposed at least partially within a second portion of the body of the vaporizer device; and a controller configured to control a discharge of an electric current from the power source to the heating element included in the cartridge when the cartridge is coupled with the vaporizer device, the electric current being discharged to the heating element to vaporize at least a portion of the vaporizable material saturating a wicking element disposed within the wick housing and proximate to a heating portion of the heating element.

In some variations, one or more features disclosed herein including the following features may optionally be included in any feasible combination. The receptacle may be further configured to form a mechanical coupling with the contact portion of the heating element, and wherein the mechanical coupling secures the cartridge in the receptacle of the vaporizer device.

In some variations, the first portion of the body of the vaporizer device may have a smaller cross-sectional dimension than the second portion of the body of the vaporizer device. A recessed area may be formed between the second portion of the body of the vaporizer device and the cartridge housing when the cartridge is coupled with the vaporizer device.

In some variations, the receptacle may include one or more air inlets that form a fluid coupling with one or more slots in a bottom of the wick housing when the cartridge is coupled with the vaporizer device. The one or more slots may be configured to allow air entering the one or more air inlets to further enter the wick housing. The one or more air inlets may be disposed in the recessed area. The one or more air inlets may have a diameter betweem approximately 0.6 millimeters and 1.0 millimeters.

In some variations, the receptacle may be disposed within the first portion of the body of the vaporizer device such that a top rim of the receptacle is substantially flush with a top rim of the first portion of the body of the vaporizer device.

In some variations, the receptacle may be configured receive a portion of the wick housing such that a flange disposed at least partially around an upper perimeter of the wick housing extends over at least a portion of the top rim of the cartridge receptacle and/or the top rim of the first portion of the body of the vaporizer device. The receptacle may be approximately 4.5 millimeters deep.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1:
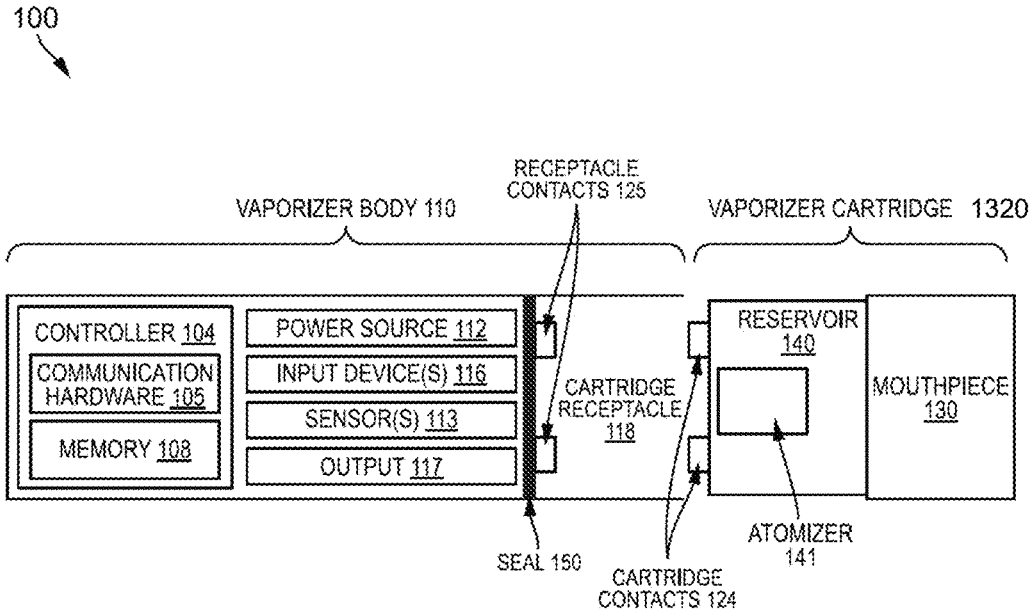
FIG. 1 depicts a block diagram illustrating an example of a vaporizer consistent with implementations of the current subject matter.

Implementations of the current subject matter include devices relating to vaporizing of one or more materials for inhalation by a user. The term "vaporizer" is used generically in the following description to refer to a vaporizer device. Examples of vaporizers consistent with implementations of the current subject matter include electronic vaporizers, electronic cigarettes, e-cigarettes, or the like. Such vaporizers are generally portable, hand-held devices that heat a vaporizable material to provide an inhalable dose of the material.

The vaporizable material used with a vaporizer may optionally be provided within a cartridge (e.g., a part of the vaporizer that contains the vaporizable material in a reservoir or other container and that can be refillable when empty or disposable in favor of a new cartridge containing additional vaporizable material of a same or different type). A vaporizer may be a cartridge-using vaporizer, a cartridge-less vaporizer, or a multi-use vaporizer capable of use with or without a cartridge. For example, a multi-use vaporizer may include a heating chamber (e.g., an oven) configured to receive a vaporizable material directly in the heating chamber and also to receive a cartridge or other replaceable device having a reservoir, a volume, or the like for at least partially containing a usable amount of vaporizable material.

In various implementations, a vaporizer may be configured for use with liquid vaporizable material (e.g., a carrier solution in which an active and/or inactive ingredient(s) are suspended or held in solution or a neat liquid form of the vaporizable material itself) or a solid vaporizable material. A solid vaporizable material may include a plant material that emits some part of the plant material as the vaporizable material (e.g., such that some part of the plant material remains as waste after the vaporizable material is emitted for inhalation by a user) or optionally can be a solid form of the vaporizable material itself (e.g., a "wax") such that all of the solid material can eventually be vaporized for inhalation. A liquid vaporizable material can likewise be capable of being completely vaporized or can include some part of the liquid material that remains after all of the material suitable for inhalation has been consumed.

In some aspects, leakage of liquid vaporizable material out of the vaporizer cartridge and/or other part of a vaporizer may occur. Additionally, consistency of manufacturing quality of a heating element of the vaporizer may be especially important during scaled and/or automated manufacturing processes. Further, vaporizer use may operate with particular power requirements that may result in shorter battery run time, can result in shorter run time at lower temperatures, can result in faster battery aging, and may affect battery performance.

Implementations of the current subject matter may also provide advantages and benefits in regard to these issues. For example, various features are described herein for controlling airflow as well as flow of the vaporizable material, which may provide advantages and improvements relative to existing approaches, while also introducing additional benefits as described herein. The vaporizer devices and/or cartridges described herein include one or more features that control and improve airflow in the vaporization device and/or cartridge, thereby improving the efficiency and effectiveness of vaporizing the liquid vaporizable material by the vaporizer device without introducing additional features that might lead to leaks of liquid vaporizable material or accumulation of condensate collecting along one or more internal channels and outlets.

For example, a heating element may be stamped from a sheet of material and may be bent to conform to a shape of at least a portion of a wicking element. Configurations of the heating element may allow for more consistent and enhanced quality manufacturing of the heating element and may help to reduce tolerance issues that may arise during manufacturing processes when assembling a heating element having multiple components. The heating element may also improve the accuracy of measurements taken from the heating element (e.g., a resistance, a current, a temperature, etc.) due at least in part to the improved consistency in manufacturability of the heating element having reduced tolerance issues. A stamped and shaped heating element may desirably help to minimize heat losses and helps to ensure that the heating element may behave predictably to be heated to the appropriate temperature.

To further illustrate, FIG. 1 depicts a block diagram illustrating an example of a vaporizer 100. As shown in FIG. 1, the vaporizer 100 may include a power source 112 (e.g., a non-rechargeable primary battery, a rechargeable secondary battery, a fuel cell, and/or the like) and a controller 104 (e.g., a processor, circuitry, etc. capable of executing logic). The controller 104 may be configured to control the delivery of heat to an atomizer 141 to cause a vaporizable material to be converted from a condensed form (e.g., a solid, a liquid, a solution, a suspension, a part of an at least partially unprocessed plant material, etc.) to a gas phase. For example, the controller 104 may control the delivery of heat to the atomizer 141 by at least controlling a discharge of current from the power source 112 to the atomizer 141. The controller 104 may be part of one or more printed circuit boards (PCBs) consistent with certain implementations of the current subject matter.

After conversion of the vaporizable material to the gas phase, and depending on the type of vaporizer, the physical and chemical properties of the vaporizable material, and/or other factors, at least some of the gas-phase vaporizable material may condense to form particulate matter in at least a partial local equilibrium with the gas phase as part of an aerosol. The vaporizable material in the condensed phase (e.g., the particulate matter) in at least partial local equilibrium with the vaporizable material in the gas phase may form some or all of an inhalable dose provided by the vaporizer 100 for a given puff or draw on the vaporizer 100. It will be understood that the interplay between the vaporizable material in the gas phase and in the condensed phase in an aerosol generated by the vaporizer 100 can be complex and dynamic, as factors such as ambient temperature, relative humidity, chemistry, flow conditions in airflow paths (both inside the vaporizer and in the airways of a human or other animal), mixing of the gas-phase or aerosol-phase vaporizable material with other air streams, etc. may affect one or more physical parameters of an aerosol. In some vaporizers, and particularly for vaporizers for delivery of more volatile vaporizable materials, the inhalable dose may exist predominantly in the gas phase (i.e., formation of condensed phase particles may be very limited).

To enable the vaporizer 100 to be used with liquid vaporizable materials (e.g., neat liquids, suspensions, solutions, mixtures, etc.), the atomizer 141 may include a wicking element (also referred to herein as a wick) formed from one or more materials capable of causing fluid motion by capillary pressure. The wicking element may convey a quantity of the liquid vaporizable material to a part of the atomizer 141 that includes a heating element (also not shown in FIG. 1). The wicking element is generally configured to draw liquid vaporizable material from a reservoir configured to contain (and that may in use contain) the liquid vaporizable material such that the liquid vaporizable material may be vaporized by heat generated by the heating element. The wicking element may also optionally allow air to enter the reservoir to replace the volume of liquid removed. In other words, capillary action may pull liquid vaporizable material into the wicking element for vaporization by the heating element (described below), and air may, in some implementations of the current subject matter, return to the reservoir through the wick to at least partially equalize pressure in the reservoir. Other approaches to allowing air back into the reservoir to equalize pressure are also within the scope of the current subject matter as discussed in greater detail below.

The heating element can be or include one or more of a conductive heater, a radiative heater, and a convective heater. One type of heating element is a resistive heating element, which can be constructed of or at least include a material (e.g., a metal or alloy, for example a nickel-chromium alloy, or a non-metallic resistor) configured to dissipate electrical power in the form of heat when electrical current is passed through one or more resistive segments of the heating element. In some implementations of the current subject matter, an atomizer can include a heating element that includes resistive coil or other heating element wrapped around, positioned within, integrated into a bulk shape of, pressed into thermal contact with, or otherwise arranged to deliver heat to a wicking element to cause a liquid vaporizable material drawn by the wicking element from a reservoir to be vaporized for subsequent inhalation by a user in a gas and/or a condensed (e.g., aerosol particles or droplets) phase. Other wicking element, heating element, and/or atomizer assembly configurations are also possible, as discussed further below.

Alternatively and/or additionally, the vaporizer 100 may be configured to create an inhalable dose of gas-phase and/or aerosol-phase vaporizable material via heating of a non-liquid vaporizable material, such as for example a solid-phase vaporizable material (e.g., a wax or the like) or plant material (e.g., tobacco leaves and/or parts of tobacco leaves) containing the vaporizable material. Accordingly, the heating element (or elements) may be part of or otherwise incorporated into or in thermal contact with the walls of an oven or other heating chamber into which the non-liquid vaporizable material is placed. Alternatively, the heating element (or elements) may be used to heat air passing through or past the non-liquid vaporizable material to cause convective heating of the non-liquid vaporizable material. In still other examples, a resistive heating element or elements may be disposed in intimate contact with plant material such that direct conductive heating of the plant material occurs from within a mass of the plant material (e.g., as opposed to by conduction inward from the walls of an oven).

The heating element may be activated (e.g., a controller, which is optionally part of a vaporizer body as discussed below, may cause current to pass from the power source through a circuit including the resistive heating element, which is optionally part of a vaporizer cartridge as discussed below), in association with a user puffing (e.g., drawing, inhaling, etc.) on a mouthpiece 130 of the vaporizer to cause air to flow from an air inlet, along an airflow path that passes an atomizer (e.g., wicking element and heating element), optionally through one or more condensation areas or chambers, to an air outlet in the mouthpiece. Incoming air passing along the airflow path passes over, through, etc. the atomizer, where gas phase vaporizable material is entrained into the air. As noted above, the entrained gas-phase vaporizable material may condense as it passes through the remainder of the airflow path such that an inhalable dose of the vaporizable material in an aerosol form can be delivered from the air outlet (e.g., in a mouthpiece 130 for inhalation by a user).

The heating element may be activated in response to detecting a puff and/or determining that a puff is imminent. For example, puff detection may be performed based on one or more of signals generated by one or more sensors 113 included in the vaporizer 100 such as, for example, one or more pressure sensors (e.g., configured to measure pressure along the airflow path relative to ambient pressure, changes in absolute pressure, and/or the like), motion sensors, flow sensors, capacitive sensors (e.g., configured to detect contact between a lip of the user and the vaporizer 100). Alternatively and/or additionally, a puff (or an imminent puff) may be detected in response to detecting a user interacting with one or more input devices 116 included in the vaporizer 100 (e.g., buttons or other tactile control devices of the vaporizer 100), receipt of signals from a computing device in communication with the vaporizer 100, and/or the like. It should be appreciated that puff detection including the determination of an imminent occurrence of a puff may be performed using a variety of techniques.

In some implementations of the current subject matter, the vaporizer 100 may be configured to connect (e.g., wirelessly or via a wired connection) to a computing device (or optionally two or more devices) in communication with the vaporizer. To this end, the controller 104 may include communication hardware 105. The controller 104 may also include a memory 108. A computing device can be a component of a vaporizer system that also includes the vaporizer 100, and can include its own communication hardware, which can establish a wireless communication channel with the communication hardware 105 of the vaporizer 100. For example, a computing device used as part of a vaporizer system may include a general purpose computing device (e.g., a smartphone, a tablet, a personal computer, some other portable device such as a smartwatch, or the like) that executes software to produce a user interface for enabling a user of the device to interact with a vaporizer. In other implementations of the current subject matter, such a device used as part of a vaporizer system can be a dedicated piece of hardware such as a remote control or other wireless or wired device having one or more physical or soft (e.g., configurable on a screen or other display device and selectable via user interaction with a touch-sensitive screen or some other input device like a mouse, pointer, trackball, cursor buttons, or the like) interface controls. The vaporizer can also include one or more output 117 features or devices for providing information to the user.

A computing device that is part of a vaporizer system as defined above can be used for any of one or more functions, such as controlling dosing (e.g., dose monitoring, dose setting, dose limiting, user tracking, etc.), controlling sessioning (e.g., session monitoring, session setting, session limiting, user tracking, etc.), controlling nicotine delivery (e.g., switching between nicotine and non-nicotine vaporizable material, adjusting an amount of nicotine delivered, etc.), obtaining locational information (e.g., location of other users, retailer/commercial venue locations, vaping locations, relative or absolute location of the vaporizer itself, etc.), vaporizer personalization (e.g., naming the vaporizer, locking/password protecting the vaporizer, adjusting one or more parental controls, associating the vaporizer with a user group, registering the vaporizer with a manufacturer or warranty maintenance organization, etc.), engaging in social activities (e.g., games, social media communications, interacting with one or more groups, etc.) with other users, or the like. The terms "sessioning", "session", "vaporizer session," or "vapor session," are used generically to refer to a period devoted to the use of the vaporizer. The period can include a time period, a number of doses, an amount of vaporizable material, and/or the like.

In the example in which a computing device provides signals related to activation of the heating element, or in other examples of coupling of a computing device with the vaporizer 100 for implementation of various control or other functions, the computing device may execute one or more computer instructions sets to provide a user interface and underlying data handling. In one example, detection by the computing device of user interaction with one or more user interface elements can cause the computing device to signal the vaporizer 100 to activate the heating element, either to a full operating temperature for creation of an inhalable dose of vapor/aerosol. Other functions of the vaporizer may be controlled by interaction of a user with a user interface on a computing device in communication with the vaporizer 100.

The temperature of a heating element of a vaporizer may depend on a number of factors, including an amount of electrical power delivered to the heating element and/or a duty cycle at which the electrical power is delivered, conductive heat transfer to other parts of the electronic vaporizer and/or to the environment, latent heat losses due to vaporization of a vaporizable material from the wicking element and/or the atomizer as a whole, and convective heat losses due to airflow (e.g., air moving across the heating element or the atomizer as a whole when a user inhales on the electronic vaporizer). As noted above, to reliably activate the heating element or heat the heating element to a desired temperature, the vaporizer 100 may, in some implementations of the current subject matter, make use of signals from a pressure sensor to determine when a user is inhaling. The pressure sensor can be positioned in the airflow path and/or can be connected (e.g., by a passageway or other path) to an airflow path connecting an inlet for air to enter the device and an outlet via which the user inhales the resulting vapor and/or aerosol such that the pressure sensor experiences pressure changes concurrently with air passing through the vaporizer device from the air inlet to the air outlet. In some implementations of the current subject matter, the heating element may be activated in association with a user's puff, for example by automatic detection of the puff, for example by the pressure sensor detecting a pressure change in the airflow path.

Typically, the pressure sensor (as well as any other sensors 113) can be positioned on or coupled (e.g., electrically or electronically connected, either physically or via a wireless connection) to the controller 104 (e.g., a printed circuit board assembly or other type of circuit board). To take measurements accurately and maintain durability of the vaporizer 100, a resilient seal 150 may optionally separate an airflow path from other parts of the vaporizer 100. The seal 150, which can be a gasket, may be configured to at least partially surround the pressure sensor such that connections of the pressure sensor to internal circuitry of the vaporizer are separated from a part of the pressure sensor exposed to the airflow path. In an example of a cartridge-based vaporizer, the seal 150 may also separate parts of one or more electrical connections between a vaporizer body 110 and a vaporizer cartridge 1320 (not shown in FIG. 1) from one or more other parts of the vaporizer body 110. Such arrangements of the seal 150 in the vaporizer 100 can be helpful in mitigating against potentially disruptive impacts on vaporizer components resulting from interactions with environmental factors such as water in the vapor or liquid phases, other fluids such as the vaporizable material, etc. and/or to reduce escape of air from the designed airflow path in the vaporizer. Unwanted air, liquid or other fluid passing and/or contacting circuitry of the vaporizer can cause various unwanted effects, such as alter pressure readings, and/or can result in the buildup of unwanted material, such as moisture, the vaporizable material, etc. in parts of the vaporizer where they may result in poor pressure signal, degradation of the pressure sensor or other components, and/or a shorter life of the vaporizer. Leaks in the seal 150 can also result in a user inhaling air that has passed over parts of the vaporizer device containing or constructed of materials that may not be desirable to be inhaled.

The vaporizer 100 may be, as noted, a cartridge-based vaporizer. Accordingly, in addition to the controller 104, the power source 112 (e.g., battery), the one more sensors 113, one or more charging contacts 124, and the seal 150, FIG. 1 show the vaporizer body 110 of the vaporizer 100 as including a cartridge receptacle 118 configured to receive at least part of the vaporizer cartridge 1320 for coupling with the vaporizer body 110 through one or more of a variety of attachment structures. In some examples, the vaporizer cartridge 1320 may include a reservoir 140 for containing a liquid vaporizable material and a mouthpiece 130 for delivering an inhalable dose to a user. The atomizer 141 including, for example, the wicking element and the heating element, may be disposed at least partially within the vaporizer cartridge 1320. Optionally, the heating element and/or the wicking element can be disposed within the vaporizer cartridge 1320 such that walls enclosing the cartridge receptacle 118 surround all or at least part of the heating element and/or the wicking element when the vaporizer cartridge 1320 is fully connected to the vaporizer body 110. In some implementations of the current subject matter, the portion of the vaporizer cartridge 1320 that inserts into the cartridge receptacle 118 of the vaporizer body 110 may be positioned internal to another part of the vaporizer cartridge 1320. For example, the insertable part of the vaporizer cartridge 1320 may be at least partially surrounded by some other part, such as for example an outer shell, of the vaporizer cartridge 1320.

Alternatively, at least a portion of the atomizer 141 (e.g., one or both of the wicking element and the heating element) may be disposed in the vaporizer body 110 of the vaporizer 100. In implementations in which a portion of the atomizer 141 (e.g., heating element and/or wicking element) is part of the vaporizer body 110, the vaporizer 100 can be configured to deliver liquid vaporizer material from the reservoir 140 in the vaporizer cartridge 1320 to the atomizer part(s) included in the vaporizer body 110.

As mentioned above, removal of the vaporizable material 102 from the reservoir 140 (e.g., via capillary draw by the wicking element) can create at least a partial vacuum (e.g., a reduced pressure created in a part of the reservoir that has been emptied by consumption of liquid vaporizable material) relative to ambient air pressure in the reservoir 140, and such vacuum may interfere with the capillary action provided by the wicking element. This reduced pressure may, in some examples, be sufficiently large in magnitude to reduce the effectiveness of the wicking element for drawing liquid vaporizable material 102, thereby reducing the effectiveness of the vaporizer 100 to vaporize a desired amount of vaporizable material 102, such as when a user takes a puff on the vaporizer 100. In extreme cases, a vacuum created in the reservoir 140 could result in the inability to draw all of the vaporizable material 102 from the reservoir 140, thereby leading to incomplete usage of the vaporizable material 102. One or more venting features may be included in association with a vaporizer reservoir 140 (regardless of positioning of the reservoir 140 in the vaporizer cartridge 1320 or elsewhere in a vaporizer) to enable at least partial equalizing (optionally completely equalizing) of pressure in the reservoir 140 with ambient pressure (e.g., pressure in ambient air outside of the reservoir 140) to alleviate this issue.

In some cases, while allowing pressure equalization within the reservoir 140 improves efficiency of delivery of the liquid vaporizable material to the atomizer 141, it may do so by causing the otherwise empty void volume (e.g., space emptied by use of the liquid vaporizable material 1302) within the reservoir 140 to be filled with air. As discussed in further detail below, this air-filled void volume may subsequently experience pressure changes relative to ambient air, which may result, under certain conditions, in leakage of liquid vaporizable material 1302 out of the reservoir 140 and ultimately outside of the vaporizer cartridge 1320 and/or other part of a vaporizer that contains the reservoir 140. For example, a negative pressure event in which the pressure inside the vaporizer cartridge 1320 is sufficiently high to displace at least a portion of the vaporizable material 1302 in the reservoir 140 may be triggered by various environmental factors such as, for example, a change in ambient temperature, altitude, and/or volume of the cartridge 1320. Implementations of the current subject matter may also eliminate or at least minimize the leakage of the vaporizable material 1302.

Figure 2A:
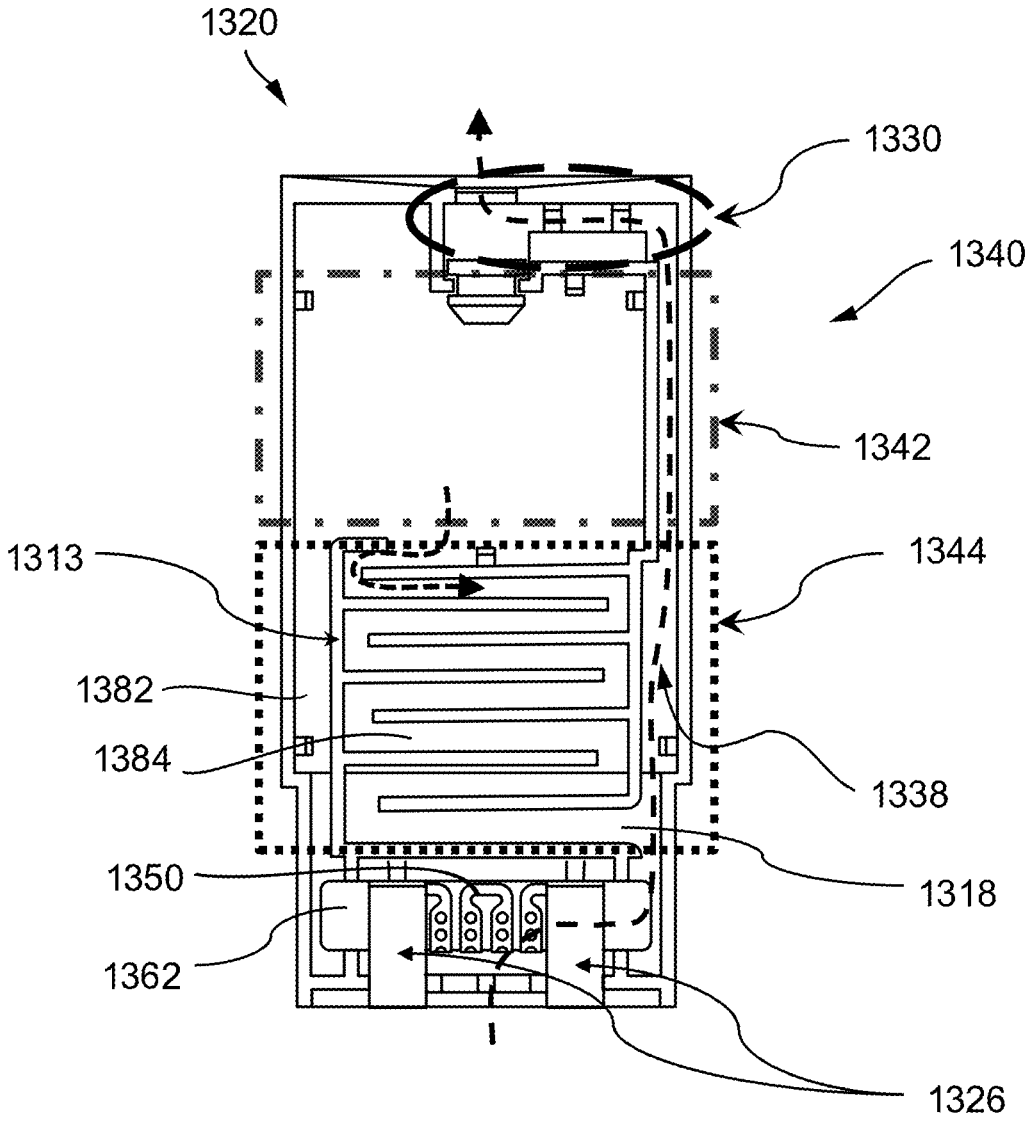
FIG. 2A depicts a planar cross-sectional view of an example of a cartridge having a storage chamber and an overflow volume consistent with implementations of the current subject matter.
Figure 2B:
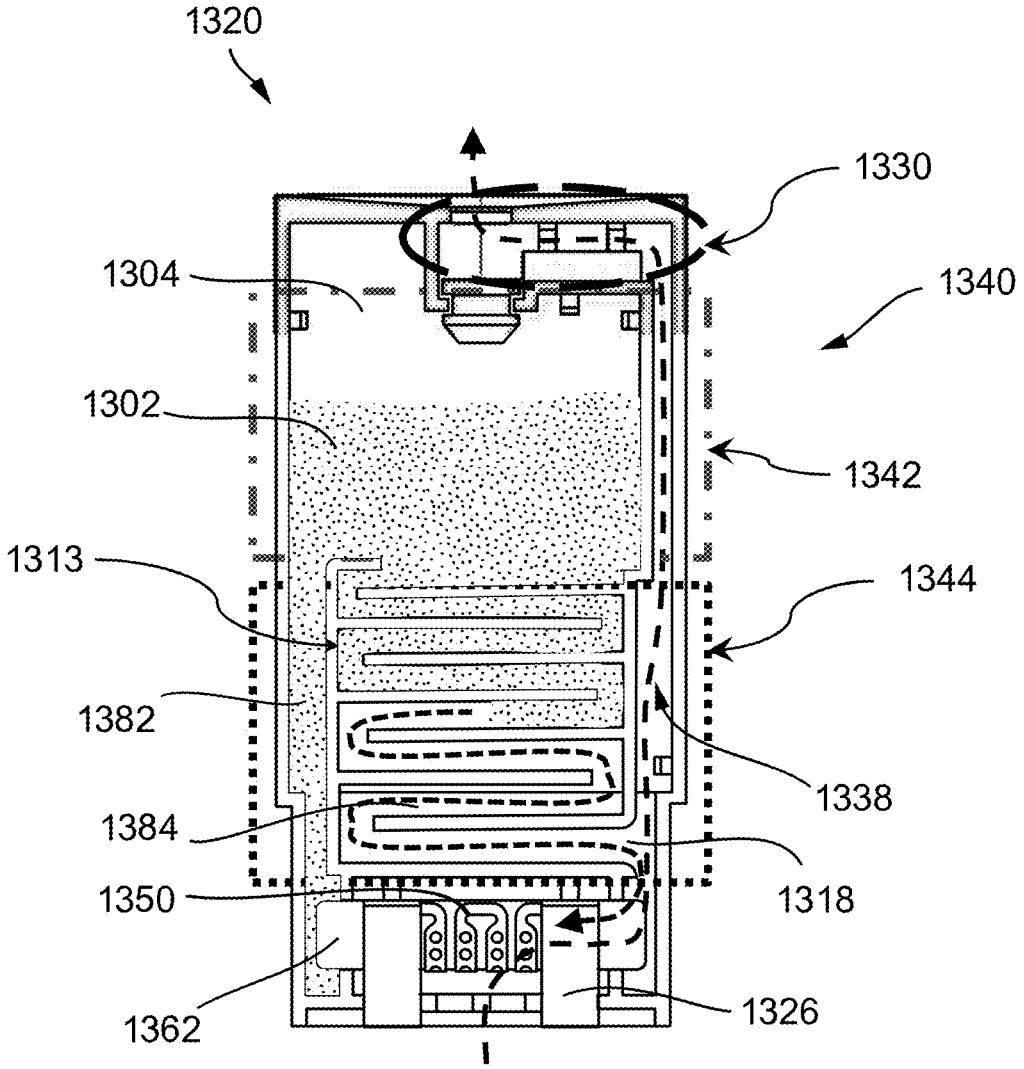
FIG. 2B depicts a planar cross-sectional view of an example of a cartridge having a storage chamber and an overflow volume consistent with implementations of the current subject matter.

FIGS. 2A-B depict a planar cross-sectional view of an example of the vaporizer cartridge 1320 consistent with implementations of the current subject matter. As shown in FIGS. 2A-B, the cartridge 1320 may include a mouthpiece or mouthpiece area 1330, a reservoir 1340 containing the vaporizable material 1302, and an atomizer (not shown individually). The atomizer may include a heating element 1350 and a wicking element 1362, together or separately, depending on implementation, such that the wicking element 1362 is thermally or thermodynamically coupled to the heating element 1350 for the purpose of vaporizing a vaporizable material 1302 drawn from or stored in the wicking element 1362.

Contacts 1326 may be included, in one embodiment, to provide for an electrical connection between the heating element 1350 and a power source (e.g., the power source 112 shown in FIG. 1). An airflow passageway 1338, defined through or on a side of the reservoir 1340, may connect an area in the cartridge 1320 that houses the wicking element 1362 (e.g., a wick housing not shown separately) to an opening that leads to the mouthpiece or mouthpiece area 1330 to provide a route for the vaporized vaporizable material 1302 to travel from the heating element 1350 area to the mouthpiece area 1330.

As provided above, the wicking element 1362 may be coupled to an atomizer or to the heating element 1350 (e.g., a resistive heating element or coil) that is connected to one or more electrical contacts (e.g., the plates 1326). The heating element 1350 (and/or other heating elements described herein in accordance with one or more implementations) may have various shapes and/or configurations and may include one or more heating elements 1350, 1350, or features thereof, as provided in more detail below.

In accordance with one or more example implementations, the heating element 1350 of the cartridge 1320 may be made (e.g., stamped) from a sheet of material and either crimped around at least a portion of a wicking element 1362 or bent to provide a preformed element configured to receive the wicking element 1362. For example, the wicking element 1362 may be pushed into the heating element 1350. Alternatively and/or additionally, the heating element 1350 may be held in tension and pulled over the wicking element 1362.

The heating element 1350 may be bent such that the heating element 1350 secures the wicking element 1362 between at least two or three portions of the heating element 1350. Moreover, the heating element 1350 may be bent to conform to a shape of at least a portion of the wicking element 1362. Configurations of the heating element 1350 may allow for more consistent and enhanced quality manufacturing of the heating element 1350. Consistency of manufacturing quality of the heating element 1350 may be especially important during scaled and/or automated manufacturing processes. For example, the heating element 1350 in accordance with one or more implementations may help to reduce tolerance issues that may arise during manufacturing processes when assembling a heating element 1350 having multiple components.

Additionally, discussed further below in regards to an included embodiment relating to a heating element formed of crimped metal, the heating element 1350 may be entirely and/or selectively plated with one or more materials to enhance heating performance of the heating element 1350. Plating all or a portion of the heating element 1350 may help to minimize heat losses. Plating may also help in concentrating heat to a portion of the heating element 1350, thereby providing a heating element 1350 that is more efficiently heated and further reducing heat losses. Selective plating may help to direct the current provided to the heating element 1350 to the proper location. Selective plating may also help to reduce the amount of plating material and/or costs associated with manufacturing the heating element 1350.

As noted above, the heating element 1350, in one embodiment, may be configured to receive at least a portion of the wicking element 1362 such that the wicking element 1362 is disposed at least partially inside the heating element 1350 (e.g., a heating portion of the heating element 1350). For example, the wicking element 1362 may extend near or next to plates 1326 and through resistive heating elements in contact with plates 1326. A wick housing may surround at least a portion of a heating element 1350 and connect a heating element 1350 directly or indirectly to an airflow passageway 1338. The vaporizable material 1302 may be drawn by the wicking element 1362 through one or more passageways connected to a reservoir 1340. In one embodiment, one or both of the primary passageway 1382 or an overflow channel 1104 (see FIG. 5A) may be utilized to help route or deliver vaporizable material 1302 to one or both ends of a wicking element 1362 or radially along a length of a wicking element 1362.

As provided in further detail below, particularly with reference to FIGS. 2A-B, exchange of air and liquid vaporizable material 1302 into and out of the reservoir 1340 of the vaporizer cartridge 1320 may be advantageously controlled by incorporated a structure referred to as a collector 1313. The inclusion of the collector 1313 may also improve a volumetric efficiency of the cartridge 1320, defined as a volume of liquid vaporizable material that is eventually converted to an inhalable aerosol relative to a total volume of the liquid vaporizable material included in the cartridge 1320 (which may correspond to a capacity of the cartridge 1320 itself).

In accordance with some implementations, the cartridge 1320 may include the reservoir 1340 that is at least partially defined by at least one wall (which can optionally be a wall that is shared with an outer shell of the cartridge) configured to contain a liquid vaporizable material 1302. The reservoir 1340 may include a storage chamber 1342 and an overflow volume 1344, which may include or otherwise contain the collector 1313. The storage chamber 1342 may contain the vaporizable material 1302 and the overflow volume 1344 may be configured to collect and/or retain at least a portion of the vaporizable material 1302, when one or more factors cause the vaporizable material 1302 in the reservoir storage chamber 1342 to travel into the overflow volume 1344. In some implementations of the current subject matter, the cartridge 1320 may be initially filled with the vaporizable material 1302 such that void space within the collector 1313 is pre-filled with the vaporizable material 1302.

In some example embodiments, the volumetric size of the overflow volume 1344 may be configured to be equal to, approximately equal to, or greater than the amount of increase in the volume of the content (e.g., vaporizable material 1302 and air) contained in the storage chamber 1342, when the volume of the content in the storage chamber 1342 expands due to a maximum expected change in pressure that the reservoir 1340 may undergo relative to an ambient pressure.

Depending on changes in ambient pressure, temperature, and/or other factors, the cartridge 1320 may experience a change from a first pressure state to a second pressure state (e.g., a first relative pressure differential between the interior of the reservoir and ambient pressure and a second relative pressure differential between the interior of the reservoir and ambient pressure). For example, in the first pressure state, the pressure inside the cartridge 1320 may be less than an ambient pressure external to the cartridge 1320. Contrastingly, in the second pressure state, the pressure inside the cartridge 1320 may exceed the ambient pressure. When the cartridge 1320 is in an equilibrium state, the pressure inside the cartridge 1320 may be substantially equal to the ambient pressure external to the cartridge 1320.

In some aspects, the overflow volume 1344 may have an opening to the exterior of cartridge 1320 and may be in communication with the reservoir storage chamber 1342 so that the overflow volume 1344 may act as a venting channel to provide for the equalization of pressure in the cartridge 1320, collect and at least temporarily retain the vaporizable material 1302 entering the overflow volume 1344 (e.g., from the storage chamber 1342 in response to variations in a pressure differential between the storage chamber 1342 and ambient pressure), and/or optionally reversibly return at least a portion of the vaporizable material 1302 collected in the overflow volume 1344.

As used herein, a "pressure differential" may refer to a difference between a pressure within an internal part of the cartridge 1320 and an ambient pressure external to the cartridge 1320. Drawing the vaporizable material 1302 from the storage chamber 1342 to the atomizer for conversion to vapor or aerosol phases may reduce the volume of the vaporizable material 1302 remaining in the storage chamber 1342. Absent a mechanism for returning air into the storage chamber 1342 (e.g., to increase the pressure inside the cartridge 1320 to achieve a substantial equilibrium with ambient pressure), low pressure or even a vacuum may develop within the cartridge 1320. The low pressure or vacuum may interfere with the capillary action of the wicking element 1362 to draw additional quantities of the vaporizable material 1302 to the heating element 1350.

Alternatively, the pressure inside of the cartridge 1320 can also increase and exceed the ambient pressure external to the cartridge 1320 due to various environmental factors such as, for example, a change in ambient temperature, altitude, and/or volume of the cartridge 1320. This increase in internal pressure may occur, for example, after air is returned into the storage chamber 1342 to achieve an equilibrium between the pressure inside the cartridge 1320 and the ambient pressure external to the cartridge 1320. However, it should be appreciated that a sufficient change in one or more environmental factors may cause the pressure in the cartridge 1320 to increase from below ambient pressure to above ambient pressure (e.g., transition from the first pressure state to the second pressure state) without any additional air entering the cartridge 1320 to first achieve an equilibrium between the pressure inside the cartridge 1320 and ambient pressure. The resulting negative pressure event in which the pressure inside the cartridge 1320 undergoes a sufficient increase may displace at least a portion of the vaporizable material 1302 in the storage chamber 1342. Absent a mechanism for collecting and/or retaining the displaced vaporizable material 1302 within the cartridge 1320, the displaced vaporizable material 1302 may leak from the cartridge 1320.

Continuing to refer to FIGS. 2A and 2B, the reservoir 1340 may be implemented to include a first area and a second area that is separable from the first area, such that the volume of the reservoir 1340 is divided into the storage chamber 1342 and the overflow volume 1344. The storage chamber 1342 may be configured to store the vaporizable material 1302 and may be further coupled to the wicking element 1362 via one or more primary passageways 1382. In some examples, a primary passageway 1382 may be very short in length (e.g., a pass-through hole from a space containing the wicking element 1362 or other parts of an atomizer). In other examples, the primary passageway 1382 may be part of a longer fluid path between the storage chamber 1342 and the wicking element 1362. The overflow volume 1344 may be configured to collect and at least temporarily retain one or more portions of the vaporizable material 1302 that may enter the overflow volume 1344 from the storage chamber 1342 in the second pressure state in which the pressure in the storage chamber 1342 is greater than ambient pressure, as provided in further detail below.

In the first pressure state, the vaporizable material 1302 may be stored in the storage chamber 1342 of the reservoir 1340. As noted, the first pressure state may exist, for example, when the ambient pressure external to the cartridge 1320 is approximately the same as or more than the pressure inside the cartridge 1320. In this first pressure state, the structural and functional properties of the primary passageway 1382 and the overflow channel 1104 are such that the vaporizable material 1302 may flow from the storage chamber 1342 toward the wicking element 1362 by way of the primary passageway 1382. For example, capillary action of the wicking element 1362 may draw the vaporizable material 1302 into proximity with the heating element 1350. Heat generated by the heating element 1350 may act on the vaporizable material 1302 to convert the vaporizable material 1302 to a gas phase.

In one embodiment, in the first pressure state, none or a limited quantity of the vaporizable material 1302 may flow into the collector 1313, for example, into the overflow channel 1104 of the collector 1313. Contrastingly, when the cartridge 1320 transitions from the first pressure state to the second pressure state, the vaporizable material 1302 may flow from the storage chamber 1342 into the overflow volume 1344 of the reservoir 1340. By collecting and at least temporarily retaining the vaporizable material 1302 entering the collector 1313, the collector 1313 may prevent or limit an undesirable (e.g., excessive) flow of the vaporizable material 1302 out of the reservoir 1340. As noted, the second pressure state may exist when the ambient pressure external to the cartridge 1320 is less than the pressure inside the cartridge 1320. This pressure differential may cause an expanding air bubble inside the storage chamber 1342, which may displace a portion of the vaporizable material 1302 inside the storage chamber 1342. The displaced portion of the vaporizable material 1302 may be collected and at least temporarily retained by the collector 1313 instead of exiting the cartridge 1320 to cause undesirable leakage.

Advantageously, flow of the vaporizable material 1302 may be controlled by way of routing the vaporizable material 1302 driven from the storage chamber 1342 to the overflow volume 1344 in the second pressure state. For example, the collector 1313 within the overflow volume 1344 may include one or more capillary structures configured to collect and at least temporarily retain that contain at least some (and advantageously all) of the excess liquid vaporizable material 1302 pushed out of the storage chamber 1342 without allowing the liquid vaporizable material 1302 to reach an outlet of the collector 1313 where the liquid vaporizable material 1302 may exit the collector 1313 to cause undesirable leakage. The collector 1313 may also advantageously include capillary structures that enable the liquid vaporizable material pushed into the collector 1313 (e.g., by excess pressure in the storage chamber 1342 relative to ambient pressure) to be reversibly drawn back into the storage chamber 1342 when the pressure inside the storage chamber 1342 reduces and/or equalizes relative to ambient pressure. In other words, the overflow channel 1104 of the collector 1313 may have microfluidic features or properties that prevent air and liquid from bypassing each other during filling and emptying of the collector 1313. That is, microfluidic features may be used to manage the flow of the vaporizable material 1302 both into and out of the collector 1313 (i.e., provide flow reversal features). In doing so, these microfluidic features may prevent or reduce leakage of the vaporizable material 1302 as well as the entrapment of air bubbles in the storage chamber 1342 and/or the overflow volume 1344.

Depending on the implementation, the microfluidic features or properties noted above may be related to the size, shape, surface coating, structural features, and/or capillary properties of the wicking element 1362, the primary passageway 1382, and/or the overflow channel 1104. For example, the overflow channel 1104 in the collector 1313 may optionally have different capillary properties than the primary passageway 1382 leading to the wicking element 1362 such that a certain volume of the vaporizable material 1302 may be allowed to pass from the storage chamber 1342 into the overflow volume 1344, during the second pressure state in which at least a portion of the vaporizable material 1302 inside the storage chamber 1342 is displaced from the storage chamber 1342.

In one example implementation, the overall resistance of the collector 1313 to allowing liquid to flow out of the collector 1313 may be larger than an overall resistance of the wicking element 1362, for example, to allow the vaporizable material 1302 to primarily flow through the primary passageway 1382 toward the wicking element 1362 during the first pressure state.

The primary passageway 1382 may provide a capillary pathway through or into the wicking element 1362 for the vaporizable material 1302 stored in reservoir 1340. The capillary pathway (e.g., the primary passageway 1382) may be large enough to permit a wicking action or capillary action to replace the vaporized vaporizable material 1302 in the wicking element 1362 but small enough to prevent leakage of the vaporizable material 1302 out of the cartridge 1320 when excess pressure inside the cartridge 1320 displaces at least a portion of the vaporizable material 1302 from the storage chamber 1342. The wick housing or the wicking element 1362 may be treated to prevent leakage. For example, the cartridge 1320 may be coated after filling to prevent leakage or evaporation through the wicking element 1362. Any appropriate coating may be used, including, for example, a heat-vaporizable coating (e.g., a wax or other material) and/or the like.

When a user inhales from the mouthpiece area 1330 of the cartridge 1320, air may flow into the cartridge 1320 through an inlet or opening in operational relationship with the wicking element 1362. The heating element 1350 may be activated in response to a signal generated by the one or more sensors 113 (shown in FIG. 1). As noted, the one or more sensors 113 may include at least one of pressure sensor, motion sensor, flow sensor, or other mechanism capable of detecting a puff and/or an imminent puff including, for example, by detecting changes in the airflow passageway 1338. When the heating element 1350 is activated, the heating element 1350 may undergo a temperature increase as a result of a current flowing through the plates 1326 or through another electrically resistive part of the heating element 1350 that acts to convert electrical energy to heat energy. It should be appreciated that activating the heating element 1350 may include the controller 104 (e.g., shown in FIG. 1) controlling the power source 112 to discharge an electric current from the power source 112 to the heating element 1350.

In one embodiment, the generated heat may be transferred to at least a portion of the vaporizable material 1302 in the wicking element 1362 through conductive, convective, and/or radiative heat transfer such that at least a portion of the vaporizable material 1302 drawn into the wicking element 1362 is vaporized. Depending on implementation, air entering the cartridge 1320 may flow over (or around, near, etc.) the wicking element 1362 and the heated elements in the heating element 1350 and may strip away the vaporized vaporizable material 1302 into the airflow passageway 1338, where the vapor may optionally be condensed and delivered in aerosol form, for example, through an opening in the mouthpiece area 1330.

Referring to FIG. 2B, the storage chamber 1342 may be connected to the airflow passageway 1338 (i.e., via the overflow channel 1104 of overflow volume 1344) for the purpose of allowing the portions of the liquid vaporizable material 1302 driven from the storage chamber 1342 by increased pressure in the storage chamber 1342 relative to ambient to be retained in the overflow volume 1344 without escaping from the vaporizer cartridge 1320. While the implementations described herein relate to the vaporizer cartridge 1320 including the reservoir 1340, it will be understood that the approaches described are also compatible with and contemplated for use in a vaporizer without a separable cartridge.

Returning to the example, air, which may be admitted to the storage chamber 1342 when the pressure inside the vaporizer cartridge 1320 is lower than ambient pressure, may increase the pressure inside the vaporizer cartridge 1320 and may cause the vaporizer cartridge 1320 to transition to the second pressure state in which the pressure inside the vaporizer cartridge 1320 exceed the ambient pressure external to the vaporizer cartridge 1320. Alternatively and/or additionally, the vaporizer cartridge 1320 may transition to the second pressure state in response to a change in ambient temperature, a change in ambient pressure (e.g., due to a change in external conditions such as altitude, weather, and/or the like), and/or a change in the volume of the vaporizer cartridge 1320 (e.g., when the vaporizer cartridge 1320 is compacted by an external force such as squeezing). The increase in the pressure inside the storage chamber 1342, for example, in the case of a negative pressure event, may at least expand the air occupying the void space of the storage chamber 1342, thereby displacing at least a portion of the liquid vaporizable material 1302 in the storage chamber 1342. The displaced portion of the vaporizable material 1302 may travel through at least some part of the overflow channel 1104 in the collector 1313. Microfluidic features of the overflow channel 1104 can cause the liquid vaporizable material 1302 to move along a length of the overflow channel 1104 in the collector 1313 only with a meniscus fully covering the cross-sectional area of the overflow channel 1104 transverse to the direction of flow along the length.

In some implementations of the current subject matter, the microfluidic features can include a cross-sectional area sufficiently small that for the material from which walls of the overflow channel 1104 are formed and the composition of the liquid vaporizable material 1302, the liquid vaporizable material 1302 preferentially wets the overflow channel 1104 around an entire perimeter of the overflow channel 1104. For an example in which the liquid vaporizable material 1302 includes one or more of propylene glycol and vegetable glycerin, wetting properties of such a liquid are advantageously considered in combination with the geometry of the second passageway 1384 and materials form which the walls of the overflow channel 1104 are formed. In this manner, as the sign (e.g., positive, negative, or equal) and magnitude of the pressure differential between the storage chamber 1340 and ambient pressure varies, a meniscus is maintained between the liquid vaporizable material 1302 present in the overflow channel 1104 and air entering from the ambient atmosphere to prevent the vaporizable material 1302 and the air from moving past one another. As pressure in the storage chamber 1342 drops sufficiently relative to ambient pressure and if there is sufficient void volume in the storage chamber 1342 to allow it, the vaporizable material 1302 present in the overflow channel 1104 of the collector 1313 may be withdrawn into the storage chamber 1342 sufficiently to cause the leading liquid-air meniscus to reach a gate or port between the overflow channel 1104 of the collector 1313 and the storage chamber 1342. At such time, if the pressure differential in the storage chamber 1342 relative to ambient pressure is sufficiently negative to overcome surface tension maintaining the meniscus at the gate or port, the meniscus may be freed from the gate or port walls to form one or more air bubbles, which are then released into the storage chamber 1342 with sufficient volume to equalize the pressure inside the storage chamber 1342 relative to ambient pressure.

When air admitted into the storage chamber 1340 as discussed above (or otherwise becomes present therein) experiences an elevated pressure condition relative to ambient (e.g., due to a drop in ambient pressure such as might occur in an airplane cabin or other high altitude locations, when a window of a moving vehicle is opened, when a train or vehicle leaves a tunnel, etc. or an elevation in internal pressure in the storage chamber 1340 such as might occur due to local heating, mechanical pressure that distorts a shape and thereby reduces a volume of the storage chamber 1340, etc., or the like), the above-described process may be reversed. Liquid passes through the gate or port into the overflow channel 1104 of the collector 1313 and a meniscus forms at the leading edge of a column of the vaporizable material 1302 passing into the overflow channel 1104 to prevent air from bypassing and flowing counter to the progression of the vaporizable material 1302.

By maintaining this meniscus due to the presence of the aforementioned microfluidic properties, when the elevated pressure in the storage chamber 1340 is later reduced, the column of vaporizable material 1302 may be withdrawn back into the storage chamber 1340, and optionally until the meniscus reaches the gate or port. If the pressure differential sufficiently favors ambient pressure relative to the pressure inside the storage chamber 1342, the above-described bubble formation process may occur until the two pressures equalize. In this manner, the collector 1313 may act as a reversible overflow volume that accepts the vaporizable material 1302 that is pushed out of the storage chamber 1342 under transient conditions of greater storage chamber pressure relative to ambient pressure while allowing at least some (and desirably all or most) of this overflow volume of vaporizable material 1302 to be returned to the storage chamber 1340 for later delivery, for example, to the heating element 1350 for conversion to an inhalable aerosol.

Depending on implementation, the storage chamber 1342 may or may not be connected to the wicking element 1362 via the overflow channel 1104. In embodiments in which the overflow channel 1104 includes a first end coupled with the storage chamber 1342 and a second end overflow channel 1104 leading to the wicking element 1362, any of the vaporizable material 1302 that may exit the overflow channel 1104 at the second end may further saturate the wicking element 1362.

The storage chamber 1342 may optionally be positioned closer to an end of the reservoir 1340 that is near the mouthpiece area 1330. The overflow volume 1344 may be positioned near an end of the reservoir 1340 closer to the heating element 1350, for example, between the storage chamber 1342 and the heating element 1350. The example embodiments shown in the figures are not to be construed as limiting the scope of the claimed subject matter as to the position of the various components disclosed herein. For example, the overflow volume 1344 may be positioned at a top portion, a middle portion, or a bottom portion of the cartridge 1320. The location and positioning of the storage chamber 1342 may be adjusted relative to the position of the overflow volume 1344, such that the storage chamber 1342 may be positioned at the top portion, middle portion, or bottom portion of the cartridge 1320 according to one or more variations.

In one implementation, when the vaporizer cartridge 1320 is filled to capacity, the volume of liquid vaporizable material 1302 may be equal to the internal volume of the storage chamber 1342 plus the overflow volume 1344. The internal volume of the overflow volume may, in some example implementations, correspond to a volume of the overflow channel 1104 between a gate or port connecting the overflow channel 1104 to the storage chamber 1340 and an outlet of the overflow channel 1104. In other words, the vaporizer cartridge 1320 may be initially filled with liquid vaporizable material 1302 such that all or at least some of the internal volume of the collector 1313 is occupied with the liquid vaporizable material 1302. In such an example, liquid vaporizable material 1302 may be delivered to an atomizer (e.g., including the wicking element 1362 and the heating element 1350) as needed for delivery to a user. For example, to deliver a portion of the vaporizable material 1302, the portion of the vaporizable material 1302 may be drawn from the storage chamber 1340, thereby causing any vaporizable material 1302 present in the overflow channel 1104 of the collector 1313 to be drawn back into the storage chamber 1340 because air cannot enter through the overflow channel 1104 due to the meniscus maintained by the microfluidic properties of the overflow channel 1104 (which prevents air from flowing past the vaporizable material 1302 present in the overflow channel 1104). After a sufficient quantity of the vaporizable material 1302 has been delivered to the atomizer from the storage chamber 1340 (e.g., for vaporization and user inhalation) to cause the original volume of the collector 1313 to be drawn into the storage chamber 1340, the above-discussed action occurs. For instance, one or more air bubbles may be released from a gate or port between the secondary passage 1384 and the storage chamber 1340 to equalize pressure inside the storage chamber 1340 (e.g., relative to ambient pressure) as a portion of the vaporizable material 1302 is removed from the storage chamber 1340. When the pressure inside the storage chamber 1340 increases above ambient pressure (e.g., due to the admission of air in the first pressure state, a change in temperature, a change in ambient pressure, a change in a volume of the vaporizer cartridge 1320, and/or the like), a portion of the liquid vaporizable material 1302 inside the storage chamber 1340 may become displaced and thus move out of the storage chamber 1340 past the gate or port into the overflow channel 1104 until the elevated pressure condition in the storage compartment subsides, at which point the liquid vaporizable material 1302 in the overflow channel 1104 may be drawn back into the storage chamber 1340.

In certain embodiments, the overflow volume 1344 may be sufficiently large to contain a percentage of the vaporizable material 1302 stored in the storage chamber 1342, including up to approximately 100% of the capacity of the storage chamber 1342. In one embodiment, the collector 1313 may be configured to contain at least 6% to 25% of the volume of the vaporizable material 1302 storable in the storage chamber 1342. Other ranges are also within the scope of the current subject matter.

The structure of the collector 1313 may be configured, constructed, molded, fabricated or positioned in the overflow volume 1344, in different shapes and having different properties, to allow for overflowing portions of the vaporizable material 1302 to be at least temporarily received, contained or stored in the overflow volume 1314 in a controlled manner (e.g., by way of capillary pressure), thereby preventing the vaporizable material 1302 from leaking out of the cartridge 1320 or excessively saturating the wicking element 1362. It will be understood that the above description referring to the overflow channel 1104 is not intended to be limiting to a single such overflow channel 1104. One, or optionally more than one, the overflow channel 1104 may be connected to the storage chamber 1340 via one or more than one gate or port. In some implementations of the current subject matter, a single gate or port may connect to more than one overflow channel 1104, or a single overflow channel 1104 may split into more than one overflow channel 1104 to provide additional overflow volume or other advantages.

In some implementations of the current subject matter, an air vent 1318 may connect the overflow volume 1344 to the airflow passageway 1338 that ultimately leads to ambient air environment outside of the cartridge 1320. This air vent 1318 may allow for a path for air or bubbles that may have been formed or trapped in the collector 1313 to escape through the air vent 1318, for example during the second pressure state in which the overflow channel 1104 fills with a portion of the vaporizable material 1302 displaced from the storage chamber 1342.

In accordance with some aspects, the air vent 1318 may act as a reverse vent and provide for the equalization of pressure within the cartridge 1320 during a reverting back to an equilibrium state, from the second pressure state, as the overflow of the vaporizable material 1302 returns back to the storage chamber 1342 from the overflow volume 1344. In this implementation, as ambient pressure exceeds the internal pressure in the cartridge 1320, ambient air may flow through the air vent 1318 into the overflow channel 1104 and effectively help push the vaporizable material 1302 temporarily stored in the overflow volume 1344 in a reverse direction back into the storage chamber 1342.

In one or more embodiments, in the first pressure state, the overflow channel 1104 may be at least partially occupied with air. In the second pressure state, the vaporizable material 1302 may enter the overflow channel 1104, for example through an opening (i.e., vent) at a point of interface between the storage chamber 1342 and the overflow volume 1344. As a result, air in the overflow channel 1104 may become displaced (e.g., by the incoming vaporizable material 1302) and may exit through the air vent 1318. In some embodiments, the air vent 1318 may act as or include a control valve (e.g., a selective osmosis membrane, a microfluidic gate, etc.) that allows for air to exit the overflow volume 1344, but blocks the vaporizable material 1302 from exiting from the overflow channel 1104 into the airflow passageway 1338. As noted earlier, the air vent 1318 may act as an air exchange port to allow air to enter and exit the collector 1313 as, for example, the collector 1313 fills with the vaporizable material 1302 displaced by excess pressure in the storage chamber 1342 and empties when the pressure inside the storage chamber 1342 substantially equalizes with ambient pressure. That is, the air vent 1318 may allow air to enter and exit the collector 1313 when during a transition between the first pressure state when the pressure inside the cartridge 1320 is less than the ambient pressure, the second pressure state when the pressure inside the cartridge 1320 exceeds the ambient pressure, and an equilibrium state when the pressure inside the cartridge 1320 and the ambient pressure are substantially the same.

Accordingly, the vaporizable material 1302 may be stored in the collector 1313 until pressure inside the cartridge 1320 is stabilized (e.g., when the pressure inside the cartridge 1320 is substantially equal to ambient pressure or meets a designated equilibrium) or until the vaporizable material 1302 is removed from the overflow volume 1344 (e.g., by being drawn into an atomizer for vaporization). Thus, the level of the vaporizable material 1302 in the overflow volume 1344 may be controlled by managing the flow of vaporizable material 1302 into and out of the collector 1313 as ambient pressure changes. In one or more embodiments, overflow of the vaporizable material 1302 from the storage chamber 1342 into the overflow volume 1344 may be reversed or may be reversible depending on detected changes in environment (e.g., when a pressure event that caused the vaporizable material 1302 overflow subsides or is concluded).

As noted above, in some implementations of the current subject matter, in a state when pressure inside of the cartridge 1320 becomes lower than the ambient pressure (e.g., when transitioning from the second pressure state back to the first pressure state), flow of the vaporizable material 1302 may be reversed in a direction that causes the vaporizable material 1302 to flow from the overflow volume 1344 back into the storage chamber 1342 of the reservoir 1340. Thus, depending on implementation, the overflow volume 1344 may be configured for temporary retention of the overflow portions of the vaporizable material 1302 during the second pressure state when high pressure inside the cartridge 1320 displaces at least a portion of the vaporizable material 1302 from the storage chamber 1342. Depending on an implementation, during or after a reversal back to the first pressure state when the pressure inside the cartridge 1320 is substantially equal to or below ambient pressure, at least some of the overflow of the vaporizable material 1302 retained in the collector 1313 may be returned back to the storage chamber 1342.

To control the vaporizable material 1302 flow in the cartridge 1320, in other implementations of the current subject matter, the collector 1313 may optionally include an absorbent or semi-absorbent material (e.g., material having sponge-like properties) for permanently or semi-permanently collecting or retaining the overflow of the vaporizable material 1302 travelling through the overflow channel 1104. In one example embodiment in which absorbent material is included in the collector 1313, the reverse flow of the vaporizable material 1302 from the overflow volume 1344 back into the storage chamber 1342 may not be as practical or possible as compared to embodiments that are implemented without (or without as much) absorbent material in the collector 1313. That is, the presence of the absorbent or semi-absorbent material may at least partially inhibit the vaporizable material 1302 collected in the overflow volume 1344 from returning back to the storage chamber 1342. Accordingly, the reversibility and/or the reversibility rate of the vaporizable material 1302 to the storage chamber 1342 may be controlled by including more or less densities or volumes of absorbent material in the collector 1313 or by controlling texture of the absorbent material, where such characteristics result in a higher or lower rate of absorption, either immediately or over longer time periods.

Figure 3A:
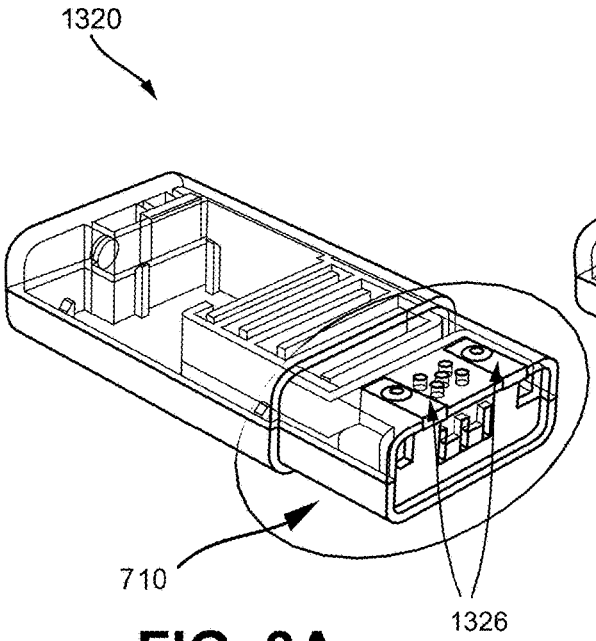
FIG. 3A depicts a perspective view of a cartridge having one example of a connector consistent with implementations of the current subject matter.
Figure 3B:
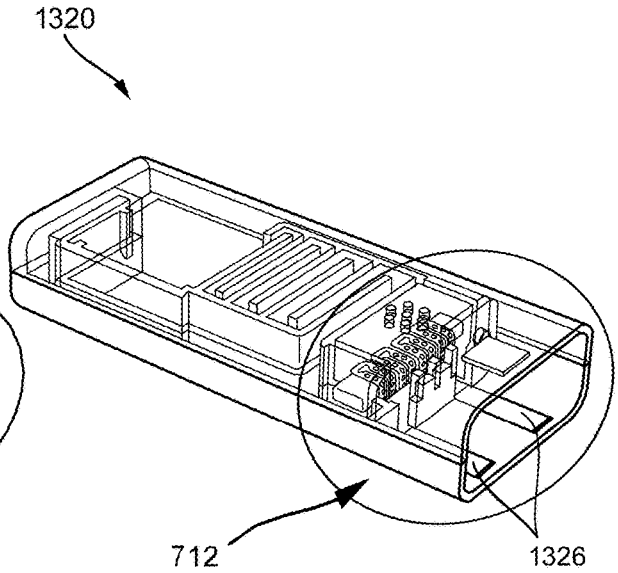
FIG. 3B depicts a perspective view of a cartridge having another example of a connector consistent with implementations of the current subject matter.

FIGS. 3A-D depict various design alternatives for connectors for forming a coupling between the cartridge 1320 and the vaporizer body 110 of the vaporizer 100. FIGS. 3A-B each depict perspective views of various examples of the connectors while FIGS. 3C-D each depict planar cross-sectional side views of various examples of the connectors. The examples of the connectors shown in FIGS. 3A-D may include complementary male connectors (e.g., protrusions) and female connectors (e.g., receptacles). As shown in FIGS. 1, 2A-B, and 3A-D, one end of the cartridge 1320 may include one or more connectors to enable a coupling between the cartridge 1320 and the vaporizer body 110 of the vaporizer 100. For example, one end of the cartridge 1320 may include one or more mechanical connectors, electrical connectors, and fluid connectors configured to provide an electrical coupling, a mechanical coupling, and/or a fluid coupling between the cartridge 1320 and the vaporizer body 110. It should be appreciated that these connectors may be implemented with various configurations.

Figure 3C:
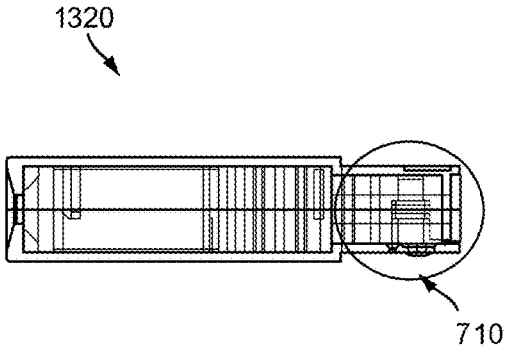
FIG. 3C depicts a planar cross-sectional view of a cartridge having one example of a connector consistent with implementations of the current subject matter.
Figure 3D:
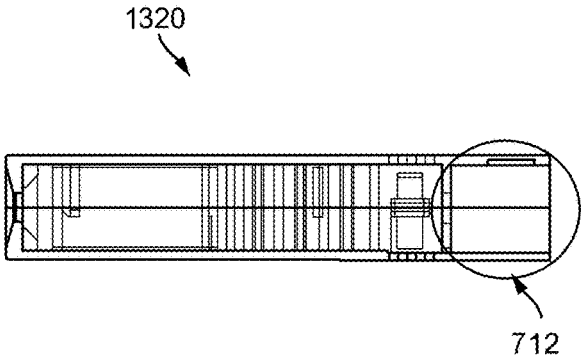
FIG. 3D depicts a planar cross-sectional view of a cartridge having another example of a connector of consistent with implementations of the current subject matter.

In one implementation of the current subject matter shown in FIGS. 1, 3A, and 3C, one end of the cartridge 1320 may include a male connector 710 (e.g., a protrusion) that is configured to couple with a female connector (e.g., the cartridge receptacle 118) in the vaporizer body 110. In this example, when the cartridge 1320 is coupled with the vaporizer body 110, the contacts 1326 disposed on the male connector 710 may form an electric coupling with the corresponding receptacle contacts 125 in the cartridge receptacle 118. Moreover, the contacts 1326 on the male connector 710 may mechanically engage the receptacle contacts 125 in the cartridge receptacle, for example, in a snap-lock fashion, to secure the cartridge 1320 in the cartridge receptacle 118 of the vaporizer body 110. Alternatively, FIGS. 3B and 3D depicts another example in which one end of the cartridge 1320 includes a female connector 712. The female connector 712 may be a receptacle that is configured to receive a corresponding male connector (e.g., a protrusion) on the vaporizer body 110. In this example implementation, the contacts 1326 may be disposed inside the female connector 712 and may be configured to form an electric coupling as well as a mechanical coupling with corresponding contacts on the male connector on the vaporizer body 110.

Figure 3E:
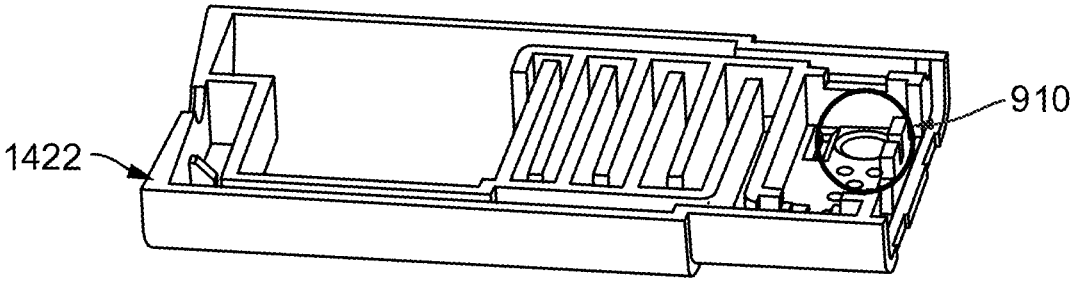
FIG. 3E depicts a perspective cross-sectional view of a cartridge having an example of a connector consistent with implementations of the current subject matter.
Figure 3F:
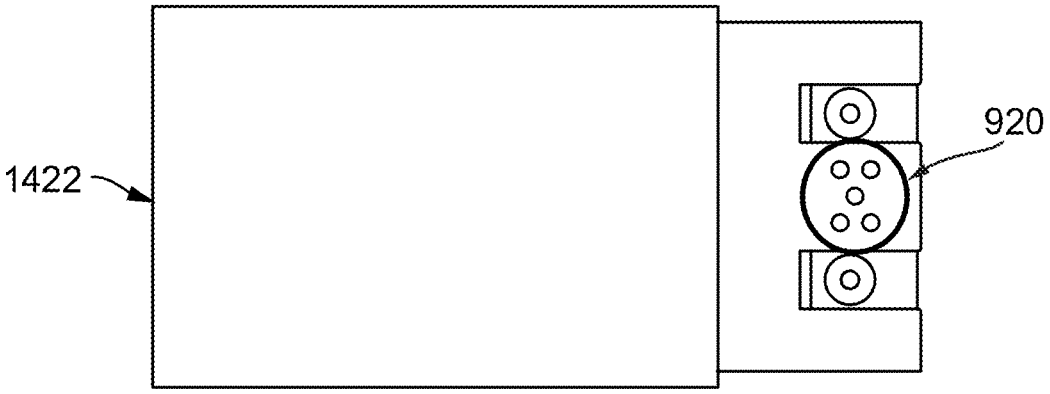
FIG. 3F depicts a planar top view of a cartridge having an example of a connector consistent with implementations of the current subject matter.
Figure 4A:
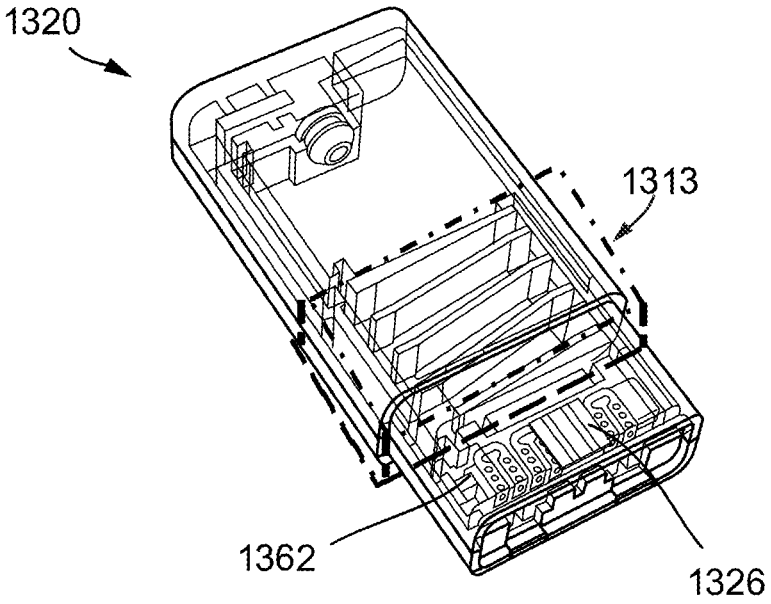
FIG. 4A depicts a closed perspective view of an example of a cartridge consistent with implementations of the current subject matter.
Figure 4B:
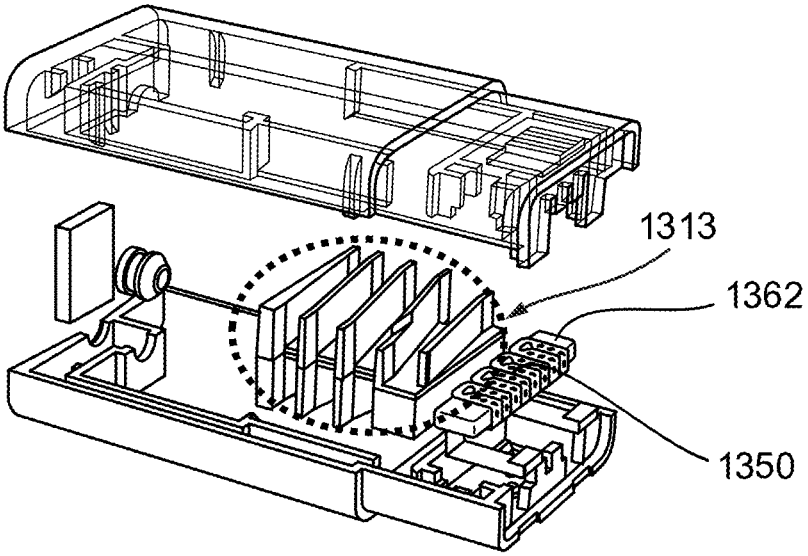
FIG. 4B depicts an exploded perspective view of an example of a cartridge consistent with implementations of the current subject matter.
Figure 4C:
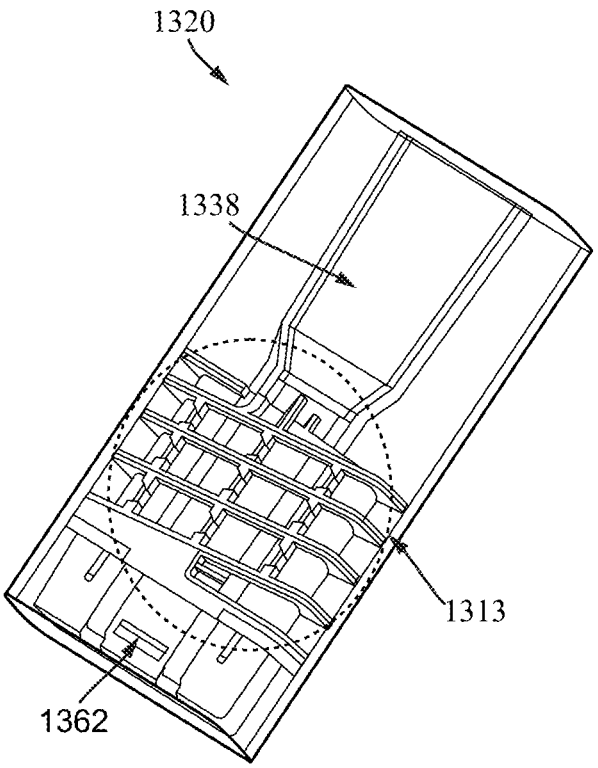
FIG. 4C depicts another closed perspective view of an example of a cartridge consistent with implementations of the current subject matter.
Figure 4D:
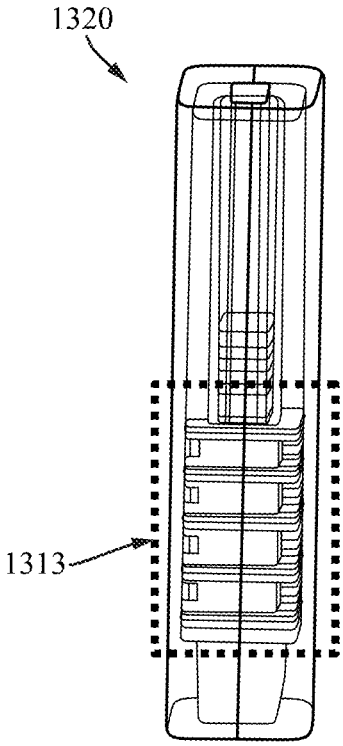
FIG. 4D depicts a closed side view of an example of a cartridge consistent with implementations of the current subject matter.

FIGS. 3E-F depict additional view of the cartridge 1320 having the male connector 710 shown in FIGS. 3A and 3C. Referring to FIG. 3E, which depicts a perspective cross-sectional views of an example of the cartridge 1320, the cartridge 1320 may include a wick housing area 910 configured to accommodate at least the heating element 1350 and the wicking element 1362 of the cartridge 1320. As shown in FIG. 3E, the wick housing area 910 may be disposed, at least partially, within the male connector 710 at one end of the cartridge 1320. As such, when the male connector 710 is inserted in the cartridge receptacle 118 of the vaporizer body 110, the wick housing area 910 including the heating element 1350 and the wicking element 1362 is at least partially disposed inside the cartridge receptacle 118 such that the cartridge receptacle 118 of the vaporizer body 110 may provide additional insulation for the heating element 1350. Meanwhile, FIG. 3F depicts a top planar view of the cartridge 1320. In particular, FIG. 9B shows that the male connector 710 may include one or more vent holes 920 disposed at or proximate to the wick housing area 910. The one or more vent holes 920 may be configured to provide pinpoint vapor evacuation and/or airflow to the wicking element 1362, for example, to help control condensation within the cartridge 1320, to improve capillary action, and/or the like.

FIGS. 4A-D depict an example of the cartridge 1320 consistent with implementations of the current subject matter. As shown in FIGS. 4A-D, the cartridge 1320 may include the collector 1313, the heating element 1350, the wicking element 1362, the contacts 1326, and the airflow passageway 1338. The collector 1313, as noted, may be configured to control the exchange of air and the vaporizable material 1302 into and out of the reservoir 1340 of vaporizer cartridge 1320. The collector 1313 may be disposed within a housing of the cartridge 1320. In some implementations of the current subject matter, the collector 1313 may be configured, designed, manufactured, fabricated, or constructed fully or partially independent from a housing of the cartridge 1320. Furthermore, the collector 1313 may be formed fully or partially independently of the other components of the cartridge 1320 including, for example, the storage chamber 1342, the airflow passageway 1338, the storage chamber 1342, the heating element 1350, the wicking element 1362, and/or the like.

For example, in one implementation of the current subject matter, the cartridge 1320 may have a cartridge housing formed of a monolithic hollow structure having a first end and a second end. The first end (i.e., a first end, also referred to as a receiving end of the cartridge housing) may be configured for insertably receiving at least the collector 1313. In one embodiment, the second end of the cartridge housing may act as a mouthpiece with an orifice or opening. The orifice or opening may be situated opposite of the receiving end of the cartridge housing where the collector 1313 may be insertably received. In some embodiments, the opening may be connected to the receiving end by way of the airflow passageway 1338 that may extend through the body of the cartridge 1320 and the collector 1313, for example. As in other cartridge embodiments consistent with the current disclosure, an atomizer, for example one including the wicking element 1362 and the heating element 1350 as discussed elsewhere herein, may be positioned adjacent to or at least partially in the airflow passageway 1338 such that an inhalable form, or optionally a precursor of the inhalable form, of the liquid vaporizable material 1302 may be released from the atomizer into air passing through the airflow passageway 1338 toward the orifice or opening.

Figure 5A:
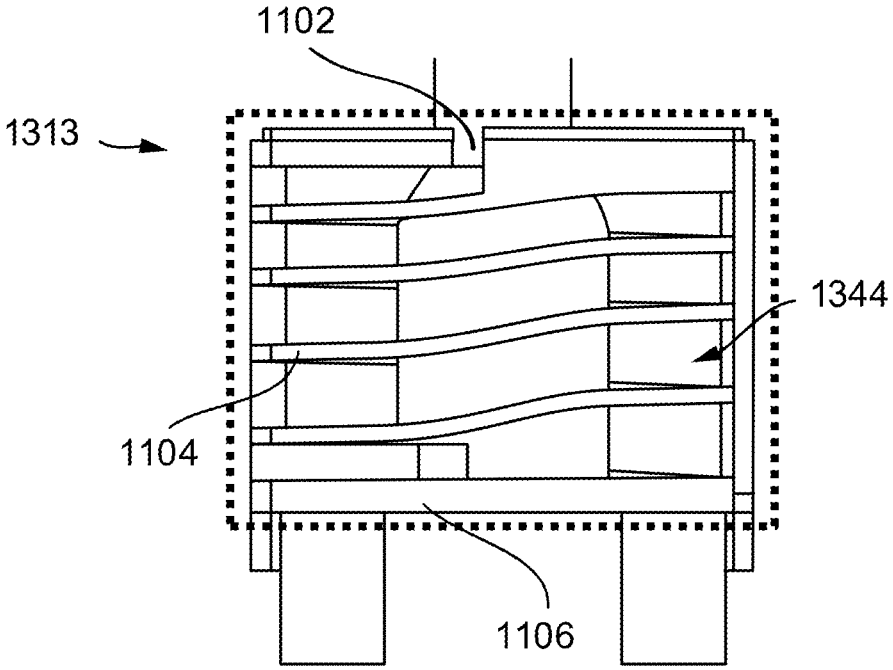
FIG. 5A depicts a side planar view of an example of a collector consistent with implementations of the current subject matter.
Figure 5B:
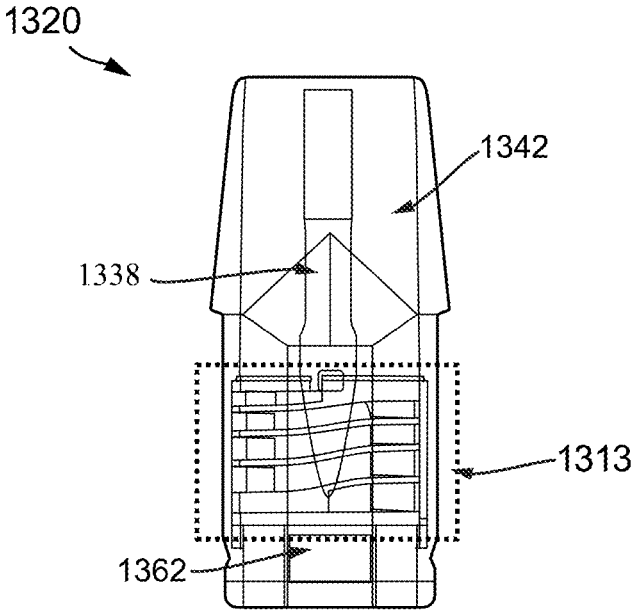
FIG. 5B depicts a side planar view of a cartridge including an example of a collector consistent with implementations of the current subject matter.

In some implementations of the current subject matter, the collector 1313 may have one or more gates and one or more channels configured to control the flow of air and the vaporizable material 1320 into and out of the reservoir 1340. To further illustrate, FIG. 5A depicts a side planar view of an example of the collector 1313 consistent with implementations of the current subject matter. A side planar view of the cartridge 1320 including an example of the collector 1313 is shown in FIG. 5B. The example of the collector 1313 shown in FIGS. 5A-B may include a single gate 1102 and a single overflow channel 1104 although alternate implementations of the collector 1313 may include additional gates and/or channels. In the example of the collector 1313 shown in FIGS. 5A-B, the gate 1102 may be provided at an opening toward a first portion (e.g., upper portion) of the collector 1313 where the collector 1313 is in contact or in fluid communication with the reservoir's storage chamber 1342. The gate 1102 may provide a fluid coupling between the storage chamber 1342 and the overflow volume 1344 formed by a second portion (e.g., a middle portion) of the collector 1313.

In some implementations of the current subject matter, the second portion of the collector 1313 may have a ribbed or multi-fin-shaped structure that forms the overflow channel 1104. The overflow channel 1104 may spiral, taper, and/or slope in a direction away from the gate 1102 and towards an air exchange port 1106. As shown in FIGS. 5A-B, the overflow channel 1104 may be configured to lead or cause at least a portion of the vaporizable material 1302 collected in the overflow volume 1344 to move toward the air exchange port 1106. The vaporizable material 1302 from the storage chamber 1342 may enter the overflow volume 1344 through the gate 1102. The air exchange port 1106 may be connected to ambient air by way of an air path or airflow passageway that is connected to the mouthpiece. This air path or airflow passageway is not explicitly shown in FIGS. 5A-B.

Figure 6B:
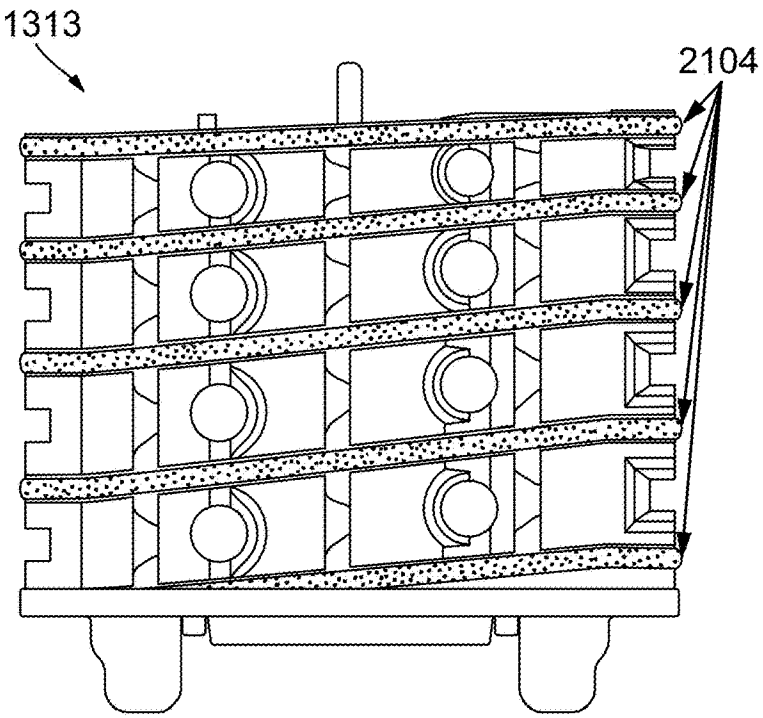
FIG. 6B depicts a side view of another example of a collector consistent with implementations of the current subject matter.
Figure 6A:
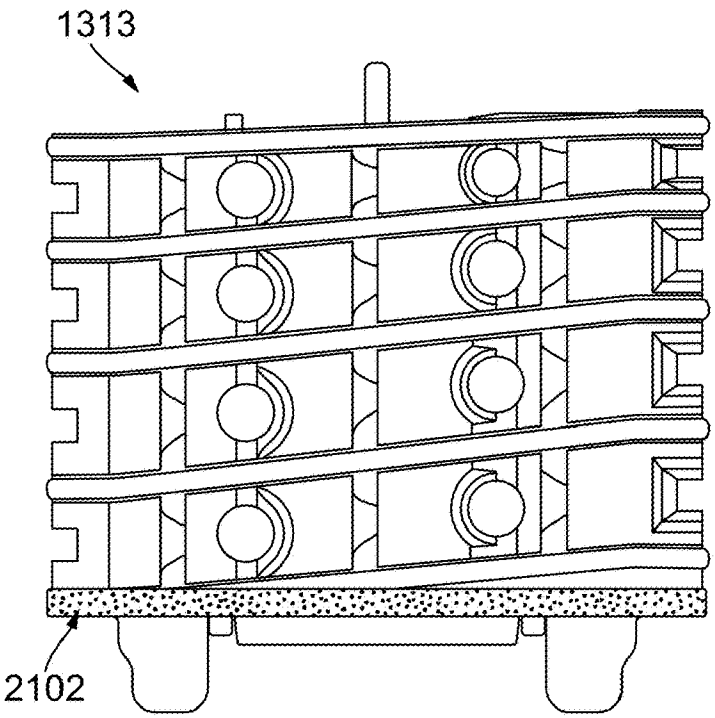
FIG. 6A depicts a side view of an example of a collector consistent with implementations of the current subject matter.

As shown in FIG. 6A, in some implementations of the current subject matter, the collector 1313 may be configured to include a flat rib 2102 that extends out at the lower perimeter of the collector 1313 to create a suitable surface to weld the collector 1313 to the inner walls of the storage chamber 1342, after the collector 1313 has been inserted into a receiving cavity or receptacle in the storage chamber 1342. A full perimeter weld or tack weld option may be employed to firmly fix the collector 1313 within a receiving cavity or receptacle in the storage chamber 1342. Alternatively, a friction-tight and leak-proof coupling may be established without employing a welding technique and/or an adhesive material may be utilized instead of or in addition to the coupling techniques noted above.

Referring now to FIG. 6B, a seal bead profile 2104 may be fashioned at the perimeter of collector 1313 spiral ribs that define an overflow channel 1104, such that the seal bead profile 2104 may support a quick turn injection molding process. Seal bead profile 2104 geometry may be devised in a variety of manners such that the collector 1313 may be inserted into a receiving cavity or receptacle in the storage chamber 1342 in a friction-tight manner, where vaporizable material 1302 may flow through the overflow channel 1104 without any leakage along the seal bead profile 2104.

In some implementations of the current subject matter, the collector 1313 may include a central tunnel 1100 (e.g., shown in FIG. 5D), which may be configured to serve as an airflow channel leading to the mouthpiece. The airflow channel may be connected to the air exchange port 1106, such that the volume inside the overflow channel 1104 of the collector 1313 is connected to ambient air via the air exchange port 1106 and also connected to the volume in the storage chamber 1342 via the gate 1102. As such, in accordance with some implementations of the current subject matter, the gate 1102 may be utilized as a control fluidic valve to mainly control liquid and air flow between the overflow volume 1344 and the storage chamber 1342. The air exchange port 1106 may be utilized to control the flow of air and the vaporizable material 1302 between the overflow volume 1344 and an air path leading to the mouthpiece, for example. It should be appreciated that the overflow channel 1104 may be diagonal, vertical, or horizontal in relationship to the elongated body of the cartridge 1320.

The vaporizable material 1302, at the time the cartridge 1320 is filled, may have at least an initial interface with the collector 1313 by way of the gate 1102. This is because an initial interface between vaporizable material 1302 and the gate 1102 may, for example, prevent air trapped in the overflow channel 1104 from entering the storage chamber 1342. Furthermore, such an interface may initiate a capillary interaction between vaporizable material 1302 and the walls of the overflow channel 1104 such that a limited quantity of vaporizable material 1302 may enter the overflow channel 1104 without disrupting an equilibrium state in which the flow of vaporizable material 1302 into and out of the overflow volume 1344 is negligible. The capillary action (or interaction) between the walls of the overflow channel 1104 and the vaporizable material 1302 may maintain the aforementioned equilibrium state while the cartridge 1320 is in the first pressure state, when the pressure inside the storage chamber 1342 is approximately equal to the ambient pressure.

An equilibrium state and further capillary interaction between vaporizable material 1302 and the walls of the overflow channel 1104 may be established or configured by way of adapting or adjusting the volumetric size of the overflow channel 1104 along the length of the channel. As provided in further detail herein, the diameter (which is used herein to refer generically to a measure of the magnitude of the cross-sectional area of the overflow channel 1104, including implementations of the current subject matter in which the overflow channel 1104 does not have a circular cross-section) of the overflow channel 1104 may be constricted at predetermined interval or points or throughout the length of the entire channel to allow for a sufficiently strong capillary interaction that provides for direct and reverse flows of vaporizable material 1302 into and out of the collector 1313, depending on changes in pressure and further to allow large overall volume of the overflow channel while still maintaining gate points for meniscus formation to prevent air from flowing past liquid in the overflow channel 1104.

The diameter (or cross-sectional area) of the overflow channel 1104 may be sufficiently small or narrow such that the combination of surface tension, caused by cohesion within the vaporizable material 1302, and wetting forces between the vaporizable material 1302 and the walls of the overflow channel 1104 may act to cause the formation of a meniscus that separates the liquid vaporizable material 1302 from air in a dimension traverse to the axis of flow in the overflow channel 1104. This meniscus may prevent the air and the liquid vaporizable material 1302 from passing one another other. It will be understood that menisci have an inherent curvature, so reference to a dimension transverse to the direction of flow is not intended to imply that the air-liquid interface is planar in this or any other dimension.

As shown in FIGS. 2B and 5B, the wicking element 1362 may be in a thermal or thermodynamic connection with the heating element 1350 such that at least a portion of the vaporizable material 1302 drawn into the wicking element 1362 may be vaporized by the heat generated by the heating element 1350. Meanwhile, the air exchange port 1106 may be constructed to enable the flow of air (and/or other gases) out of the overflow channel 1104 while preventing the flow of the vaporizable material 1302 out of the overflow channel 1104.

Referring again to FIGS. 5A-B, direct or reverse flows of the vaporizable material 1302 in the collector 1313 may be controlled (e.g., enhanced or diminished) by way of implementing suitable structures (e.g., microchannel configurations) to introduce and/or exploit the capillary properties that may exist between the vaporizable material 1302 and the retaining walls of the overflow channel 1104. For example, factors associated with length, diameter, inner surface texture (e.g., rough vs. smooth), constriction points, directional tapering of the channel structures, constrictions or material used for constructing or coating the surface of the gate 1102, the overflow channel 1104 or the air exchange port 1106 may positively or negatively affect the rate at which a liquid is drawn into or moves through the overflow channel 1104 by way of capillary action or other influential forces acting on cartridge 1320.

One or more factors noted above, depending on implementation, may be used to control displacement of the vaporizable material 1302 in the overflow channel 1104 to introduce a desirable degree of reversibility, as the vaporizable material 1302 is collected in the channel structures of the collector 1313. As such, in some embodiments, the flow of the vaporizable material 1302 into the collector 1313 may be fully reversible or semi-reversible by way of selectively controlling the various factors noted above and depending on changes in pressure state inside or outside of the cartridge 1320.

As shown in FIGS. 5A-B and 11A-B, in one or more embodiments, the collector 1313 may be formed, constructed, or configured to have a single-channel single-vent structure. In such embodiments, the overflow channel 1104 may be a continuous passageway, tube, channel, or other structure for connecting the gate 1102 to the air exchange port 1106, which may be optionally positioned near the wicking element 1362. Accordingly, in such embodiments, the vaporizable material 1302 may enter or exit the collector 1313 from the gate 1102 and through a singularly constructed channel, where the vaporizable material 1302 flows in a first direction as the overflow volume 1344 is being filled and in a second direction when the overflow volume 1344 is being drained.

To help maintain an equilibrium state and/or to control the flow of the vaporizable material 1302 into the overflow channel 1104, the shape and structural configuration of the overflow channel 1104, the gate 1102, and/or the air exchange port 1106 may be adapted or modified to balance the rate of flow of the vaporizable material 1302 in the overflow channel 1104 at different pressure states. In implementations of the current subject matter, for example, the overflow channel 1104 may be tapered such that a cross-sectional dimensions (e.g., diameter, area, and/or the like) of the overflow channel 1104 decreases towards the gate 1102 while the cross-sectional dimensions (e.g., diameter, area, and/or the like) of the overflow channel 1104 increases towards the air exchange port 1106. That is, the cross-sectional dimensions of the overflow channel 1104 may be at a minimum at the gate 1102 where the overflow channel 1104 is coupled with the storage chamber 1342 while the cross-sectional dimensions of the overflow channel 1104 may be at a maximum at the air exchange port 1106 where the overflow channel 1104 is coupled to the ambient environment outside of the cartridge 1320. It should be appreciated that the tapering of the overflow channel 1104 may be continuous or discrete. Alternatively and/or additionally, one or more constriction points may be disposed along a length of the overflow channel 1104.

The untapered end of the overflow channel 1104 where the cross-sectional dimensions of the overflow channel 1104 is at a minimum may couple to an airflow path from which vaporized vaporizable material 1302 is delivered to the mouthpiece (e.g., the air vent 1318 shown in FIG. 2A, which is connected to the airflow passageway 1338). Moreover, the untapered end of the overflow channel 1104 may also lead to an area near a wick housing 1315 (see, e.g., FIG. 7), such that at least a portion of the vaporizable material 1302 exiting the overflow channel 1104 may saturate the wicking element 1362.

The tapered structure of the overflow channel 1104 may, as needed, reduce or increase restriction on the flow of the vaporizable material 1302 into the collector 1313. For example, in an embodiment where the overflow channel 1104 is tapered toward the gate 1102, a favorable capillary pressure towards a reverse flow is induced in the overflow channel 1104 by the tapering, such that direction of the vaporizable material 1302 flow is out of the collector 1313 and into the storage chamber 1342 when pressure state changes (e.g., when a negative pressure event is eliminated or subsided). Particularly, implementing the overflow channel 1104 with a smaller opening may prevent free flow of the vaporizable material 1302 into the collector 1313. That is, the tapering of the overflow channel 1104 towards the gate 1102 may encourage the vaporizable material 1302 in the overflow channel 1104 to flow out of the gate 1102 (e.g., back into the storage chamber 1342) and discourage the flow of the vaporizable material 1302 through the gate 1102 and into the overflow channel 1104 (e.g., from the storage chamber 1342). Meanwhile, an untapered configuration for the overflow channel 1104 in a direction leading towards the air exchange port 1106 provides for efficient storage of the vaporizable material 1302 in the collector 1313 during the second pressure state when increased pressure inside the cartridge 1320 causes at least a portion of the vaporizable material 1302 from the storage chamber 1342 to flow into the collector 1313 from narrower sections of the overflow channel 1104 into larger volumetric sections of the overflow channel 1104.

As such, the dimension (e.g., diameter) and shape of the collector 1313 may be implemented so that the flow of the vaporizable material 1302 through the gate 1102 and into the overflow channel 1104 is controlled at a desirable rate. For example, during the second pressure state, the dimension and shape of the collector 1313 may be configured to prevent the vaporizable material 1302 from flowing too freely (e.g., beyond a certain flow rate or threshold) into the collector 1313 (e.g., due to excess pressure inside the cartridge 1320 displacing at least a portion of the vaporizable material 1302 from the storage chamber 1342) while favoring a reverse flow back into the storage chamber 1342 (e.g., when the pressure inside the cartridge 1320 and the ambient pressure external to the cartridge 1320 achieves a substantial equilibrium). It is noteworthy that the combination of the interactions between the vent 1318, the overflow channel 1104 in the collector 1313 that make up the overflow volume 1344, and the air exchange port 1106, in one embodiment, may provide for the proper venting of air bubbles that may be introduced into the cartridge due to various environmental factors as well as the controlled flow of the vaporizable material 1302 into and out of the overflow channel 1104.

Referring again to FIG. 5B, a portion of the cartridge 1320 that includes the storage chamber 1342 may also be configured to include a mouthpiece that may be utilized by a user to inhale vaporized vaporizable material 1302. The airflow passageway 1338 may extend through the storage chamber 1342, thereby connecting a vaporization chamber. Depending on implementation, the airflow passageway 1338 may be a straw-shaped structure or hollow cylinder, for example, which forms a channel inside the storage chamber 1342 to allow for passage of vaporized vaporizable material 1302. While the airflow passage may have a circular or at least approximately circular cross-sectional shape, it will be understood that other cross-sectional shapes for the airflow passage are also within the scope of the current disclosure.

A first end of the airflow passageway 1338 may be connected to an opening at a first mouthpiece end of the storage chamber 1342 from which a user may inhale vaporized vaporizable material 1302. A second end of the airflow passageway 1338 (opposite the first end) may be received in an opening at a first end of the collector 1313, as provided in further detail herein. Depending on implementation, the second end of the airflow passageway 1338 may fully or partially extend through a receiving cavity that runs through the collector 1313 and connects to a wick housing, where the wicking element 1362 may be housed.

In some implementations of the current subject matter, the airflow passageway 1338 may be an integral part of a monolithic molded mouthpiece that includes the storage chamber 1342 where the airflow passageway 1338 extends through the storage chamber 1342. In other configurations, the airflow passageway 1338 may be an independent structure that may be separately inserted into the storage chamber 1342. In some configurations, the airflow passageway 1338 may be a structural extension of the collector 1313 or the body of the cartridge 1320 as internally extending from the opening in the mouthpiece portion, for example.

Without limitation, a variety of different structural configurations may be possible for connecting the mouthpiece (and airflow passageway 1338 internal to the mouthpiece) to the air exchange port 1106 in collector 1313. As provided herein, the collector 1313 may be inserted into the body of the cartridge 1320, which may also include and/or act as the storage chamber 1342. In some embodiments, the airflow passageway 1338 may be constructed as an internal sleeve that is an integral part of a monolithic cartridge body, such that an opening in a first end of the collector 1313 may receive a first end of the sleeve structure forming the airflow passageway 1338. It should be appreciated that the mouthpiece may be a single barrel mouthpiece as shown in FIG. 5B or a multi-barrel mouthpiece, for example, a double barrel mouthpiece, in which multiple airflow passageways are provided to deliver a higher dose of the vaporized vaporizable material 1302.

As noted, the collector 1313 may include various mechanisms to control the forward flow and reverse flow of the vaporizable material 1302 into and out of the collector 1313 (e.g., the overflow volume 1344). Some of these factors may include configuring the capillary drive of a fluidic vent, referred to herein as the gate 1102. The capillary drive of the gate 1102 may be, for example, smaller than that of the wicking element 1362 whereas the flow resistance of the collector 1313 may be larger than that of the wicking element 1362. The overflow channel 1104 may have smooth and/or rippled inner surfaces to control the flow rate of the vaporizable material 1302 through the overflow channel 1104. As noted, the overflow channel 1104 may sloped and/or tapered in order to provide the proper capillary interaction and forces to limit the rate of flow through the gate 1102 and into the overflow volume 1344 during a first pressure state to promote a reverse rate of flow through the gate 1102 and out of the overflow volume 1344 during a second pressure state.

Additional modifications to the shape and structure of collector 1313 components may be possible to help further regulate or fine-tune flow of the vaporizable material 1302 into or out of the collector 1313. For example, a smoothly curved spiral channel configuration (i.e., as opposed to a channel with sharp turns or edges) as shown in FIGS. 5A-H may allow for additional features, such as one or more vents, channels, apertures, and/or constricting structures to be included in the collector 1313 at predetermined intervals along the overflow channel 1104. As provided in further detail herein, such additional features, structures, and/or configurations may help provide a higher level of flow control for vaporizable material 1302 along the overflow channel 1104 or through the gate 1102, for example.

For example, as shown in FIGS. 5A-E, a fully or partially sloping spiral surface may be implemented along the interior of the overflow channel 1104 to define one or more sides of the internal volume of the overflow channel 1104 of the collector 1313, such that vaporizable material 1302 may flow freely due to capillary pressure (or the force of gravity) through the overflow channel 1104 as vaporizable material 1302 enters the overflow channel 1104. The central tunnel 1100 may traverse a length of the collector 1313. At a first end, the central tunnel 1100 through the collector 1313 may interact with or connect to the wick housing 1315 (see, e.g., FIG. 7) in which the wicking element 1362 and the heating element 1350 are disposed. At the second end, the central tunnel 1100 may interact with, connect to, or receive one end of a duct or a tube that forms an airflow passageway 1338 in the mouthpiece portion of the cartridge 1320. A first end of the airflow passageway 1338 may connect (e.g., by way of insertion) to the second end of the central tunnel 1100. A second end of the airflow passageway 1338 may include an opening or orifice formed in the mouthpiece area.

In accordance with one or more embodiments, vaporized vaporizable material 1302 generated by the heating element 1350 heating the vaporizable material 1302 may enter through the first end of the central tunnel 1100 in the collector 1313, pass through the central tunnel 1100 and further out of the second end of the central tunnel 1100 into the first end of the airflow passageway 1338. Vaporized vaporizable material 1302 may then travel through the airflow passageway 1338 and exit through the mouthpiece opening formed at the second end of the airflow passageway 1338.

In some implementations of the current subject matter, the gate 1102 may control the flow of vaporizable material 1302 into and out of the overflow channel 1104 in the collector 1313. The air exchange port 1106 may, via a connection path to ambient air, control the flow of air into and out of the overflow channel 1104 to regulate air pressure in the collector 1313, and in turn in the storage chamber 1342 of the cartridge 1320 as provided in further detail herein. In certain embodiments, the air exchange port 1106 may be configured to prevent the vaporizable material 1302 present in the overflow channel 1104 of the collector 1313 (e.g., due to being displaced by excess pressure inside the cartridge 1320) from exiting the overflow channel 1104 and leaking into an airflow passageway (e.g., the central tunnel 1100).

The air exchange port 1106 may be configured to cause the vaporizable material 1302 to exit toward a route that leads to the area in which the wicking element 1362 is housed. This implementation may help avoid leakage of the vaporizable material 1302 into an airflow passageway (e.g., the central tunnel 1100) that leads to the mouthpiece when the vaporizable material 1302 is displaced from the storage chamber 1342. In some implementations, the air exchange port 1106 may have a membrane that allows the ingress and egress of gaseous material (e.g., air bubbles) but prevents vaporizable material 1302 from entering or exiting the collector 1313 through the air exchange port 1106.

Referring now to FIGS. 5C-H, the rate of flow of vaporizable material 1302 into and out of the collector 1313 through the gate 1102 may be directly associated with the volumetric pressure inside the overflow channel 1104. Thus, the rate of flow into and out of the collector 1313, through the gate 1102, may be controlled by way of manipulating the hydraulic diameter (or cross-sectional area) of the overflow channel 1104 such that reducing the overall volume of the overflow channel 1104 (e.g., either uniformly or by way of introducing multiple constrictions points) may lead to increased pressure in the overflow channel 1104 and adjusting the rate of flow into the collector 1313. Accordingly, in at least one implementation, the hydraulic diameter (or cross-sectional area) of the overflow channel 1104 may be decreased (e.g., narrowed, pinched, constricted or restricted), either uniformly or by way of introducing one or more constriction points 1111*a*, along the length of the spiral path of the overflow channel 1104. For example, in the example of the collector 1313 shown in FIGS. 5C-E, the overflow channel 1104 may include multiple downward sloping spirals with various constriction points 1111*a* and 1111*b* disposed along the length of the overflow channel 1104 between the gate 1102 and the air exchange port 1106. The quantity of spirals in the overflow channel 1104 as well as the quantity of constriction points along the length of the overflow channel 1104 may determine the volumetric pressure in the collector 1313. Moreover, the volumetric pressure inside the collector 1313 may be determined by the configuration of the constriction points disposed along the length of the overflow channel 1104.

Figure 5E:
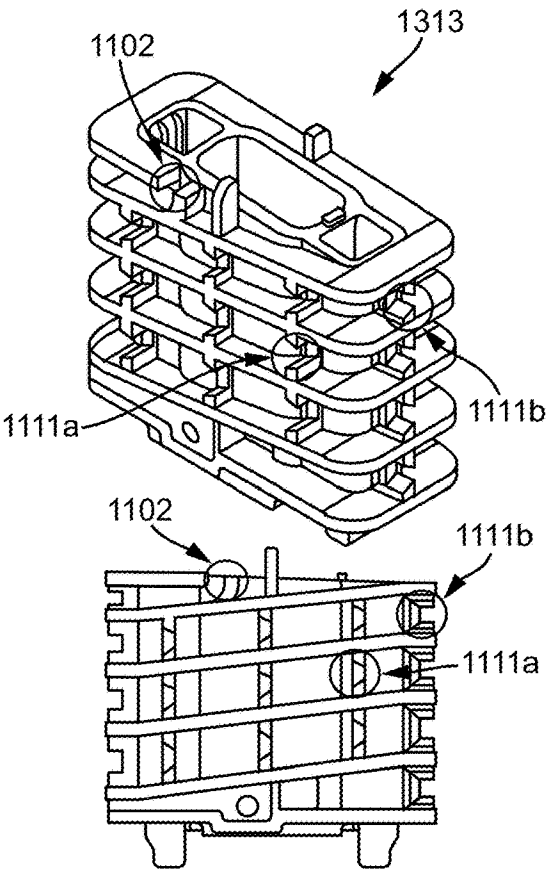
FIG. 5E depicts a perspective view and a side planar view of an example of a collector consistent with implementations of the current subject matter.
Figure 5D:
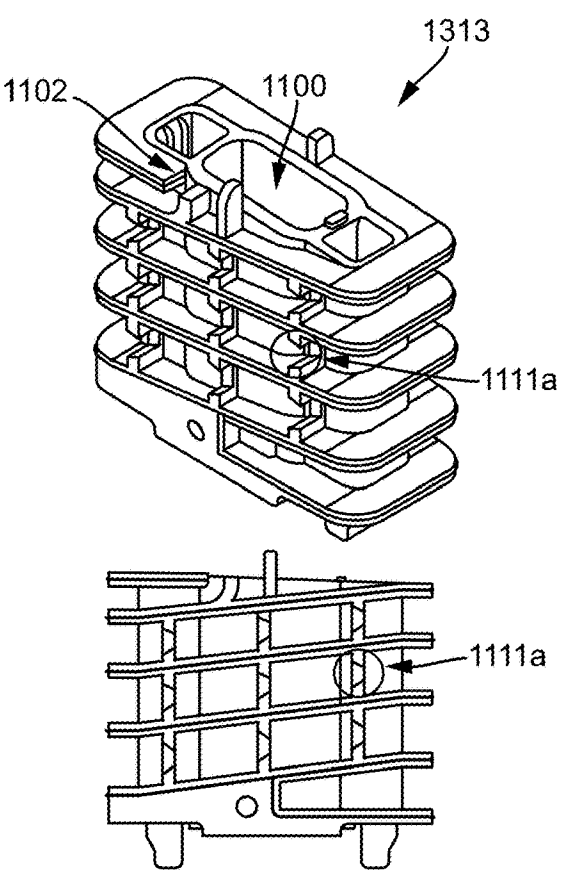
FIG. 5D depicts a perspective view and a side planar view of an example of a collector consistent with implementations of the current subject matter.
Figure 5C:
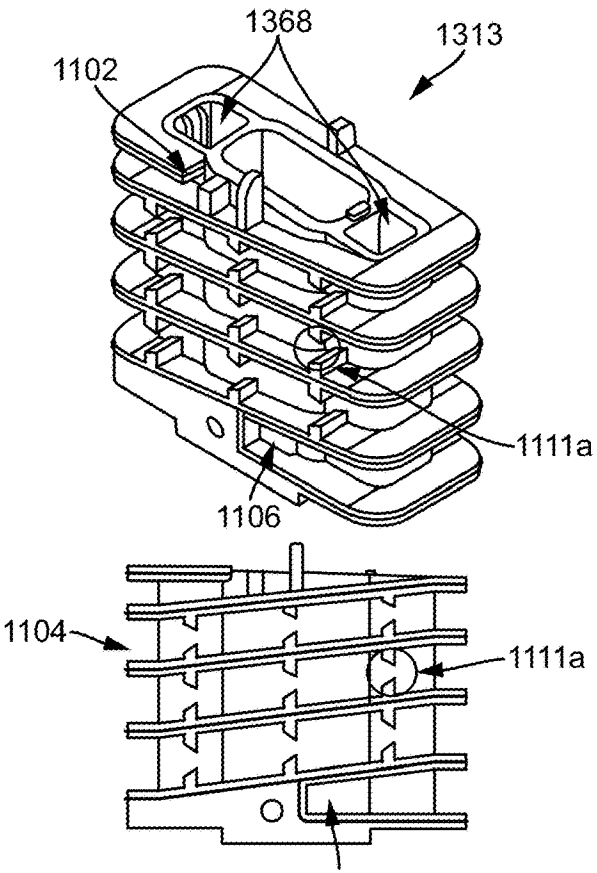
FIG. 5C depicts a perspective view and a side planar view of an example of a collector consistent with implementations of the current subject matter.

For example, as shown in FIG. 5C, the constriction point 1111*a* may be formed by way of bumps, raised edges, protrusions, or constriction points extending from the interior surfaces of the overflow channel 1104 (i.e., the blades of the collector 1313). The shape of the constriction point 1111*a* may be defined as a bump, finger, prong, fin, edge, or any other shape that constricts a cross-sectional area transverse to a flow direction in the overflow channel. In the example shown in FIG. 5C, the constriction point 1111*a* may be in the shape of a shark fin, for example, in which the distal end of the constriction point 1111*a* tapers to an edge. Further as shown in FIG. 5C, the pointed or cantilevered edge of the shark fin shape may be rounded although the cantilevered edge may also be tapered to a sharp end. The shape, size, relative location, and total quantity of constriction points disposed along the length of the overflow channel 1104 may be adjusted to further control the ingress and egress of the liquid vaporizable material 1302 into and out of the overflow channel 1104, for example, by fine-tuning the tendency of a meniscus (e.g., separating the liquid vaporizable material 1302 and air) to form within the overflow channel 1104.

For example, if it is desirable to instead maintain an incoming flow in the overflow channel 1104 at a higher rate than the outgoing flow, then the constriction points maybe shaped to have a flat surface facing the outgoing flow and a rounded surface facing the incoming flow to facilitate formation and retention of a meniscus resisting outward flow of liquid (e.g., away from the storage chamber 1340) while making it easier for the meniscus to break free of the side of the constriction point facing back toward the storage compartment 1340. In this manner, a series of such constriction points may function as a sort of "hydraulic ratchet" system in which return flow of liquid into the storage compartment is microfluidically encouraged relative to outward flow from the storage compartment. This effect may be achieved, at least in part, by the relative tendency of a meniscus to break from the storage chamber side of the constriction points than from the opposite side.

Referring again to FIG. 5C, in one example implementation, in addition to (or instead of) the constriction points extending from the floor or ceilings of the overflow channel 1104, some constriction points may extend from the inner walls of the overflow channel 1104. As shown more clearly in FIG. 5F, a constriction point may extend from an inner wall of the overflow channel 1104 at the same constriction point 1111*a*, where two additional constriction points extend from the floor and the ceiling of the overflow channel 1104 to form a C-shaped constriction point 1111*a*. The example implementation illustrated in FIGS. 5D and 5F may more effectively tune the microfluidic properties of the overflow channel 1104 to encourage liquid flow to retract toward the storage chamber 1340 relative to the implementation in FIG. 5C, because the hydraulic diameter of the overflow channel 1104 is more constricted (i.e., narrowed) at the constriction point 1111*a* shown in FIGS. 5D and 5F.

The constriction points formed along the overflow channel 1104 need not be uniform in shapes, size, frequency, or symmetry. That is, depending on implementation, different constriction points 1111*a* or 1111*b* may be implemented in different sizes, designs, shapes, locations or frequency along the overflow channel 1104. In one example, the shape of a constriction point 1111*a* or 1111*b* may be similar to the shape of the letter C with a round internal diameter. In some embodiments, instead of a forming the internal diameter as a rounded C shape, the internal wall of the constriction point may have corners (e.g., sharp corners) such as those shown in FIGS. 5F and 5G.

In some examples, the overflow channel 1104, at a first level, may have constriction points extending from the ceiling of the overflow channel 1104, whereas at a second level, the constriction points may extend from the floor of the overflow channel 1104. At a third level, the constriction points may extend from the inner walls, for example. Alternatives of the above implementations may be possible by adjusting or changing the number of constriction points and shapes of constriction points or the positioning of the constriction points in different sequences or levels to help control the microfluidic effect on flow in the two directions within the overflow channel 1104. In one example, constriction points 1111*a* may be implemented on one or more (or all) levels, sides, or widths of the collector 1313, for example.

Figure 5F:
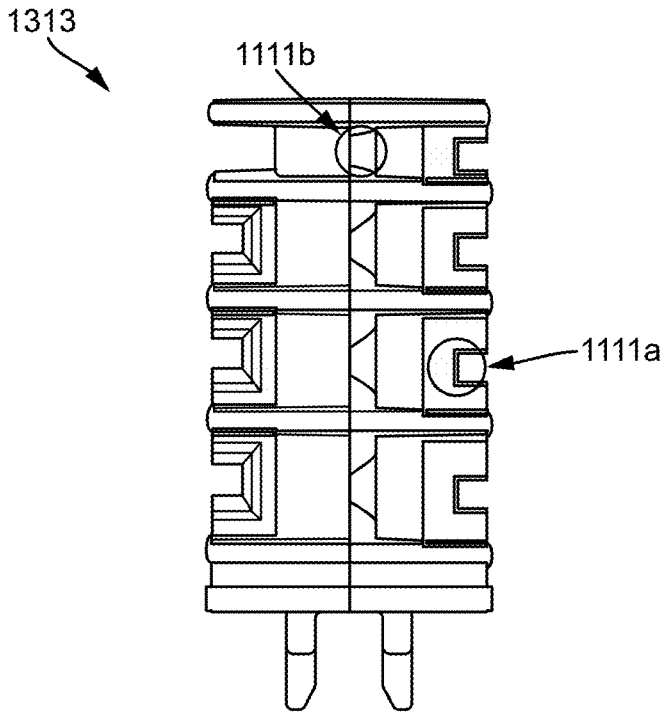
FIG. 5F depicts a side view of an example of a collector consistent with implementations of the current subject matter.
Figure 5G:
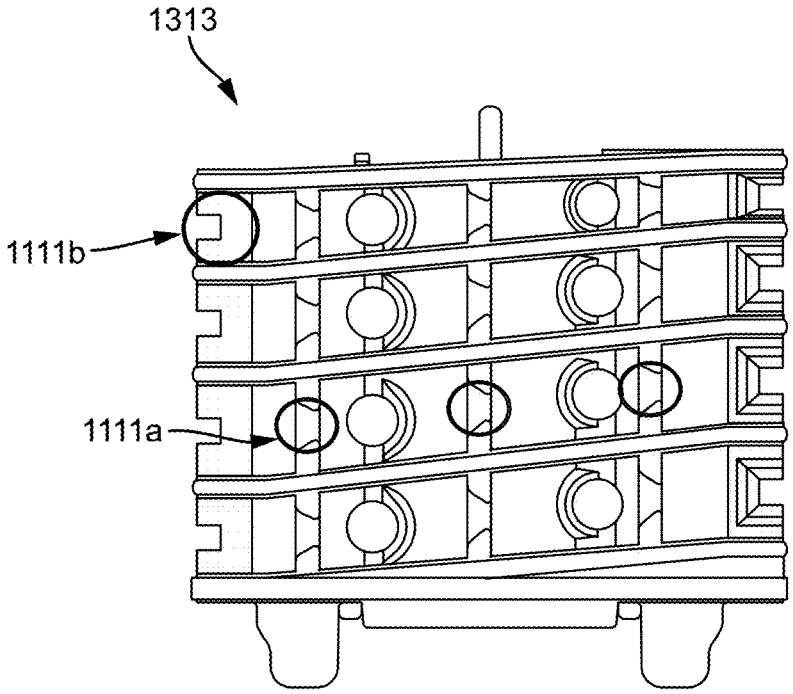
FIG. 5G depicts a front view of an example of a collector consistent with implementations of the current subject matter.

Referring now to FIGS. 5E-G, in addition to defining constriction points 1111*a* along longer length of the overflow channel 1104, or a wider side of the collector 1313, one or more extra constriction points 1111*b* may be defined along the narrower side of the collector 1313. As such, the example implementation illustrated in FIGS. 5E-5G may improve the adjusting of resistance to or encouragement of meniscus detachment in a desired direction in the overflow channel 1104 as compared to the implementation in FIG. 5D, because the overall hydraulic diameter (or flow volume) of the overflow channel 1104 is more constricted due to the addition of extra constriction points 1111*b*.

Figure 5H:
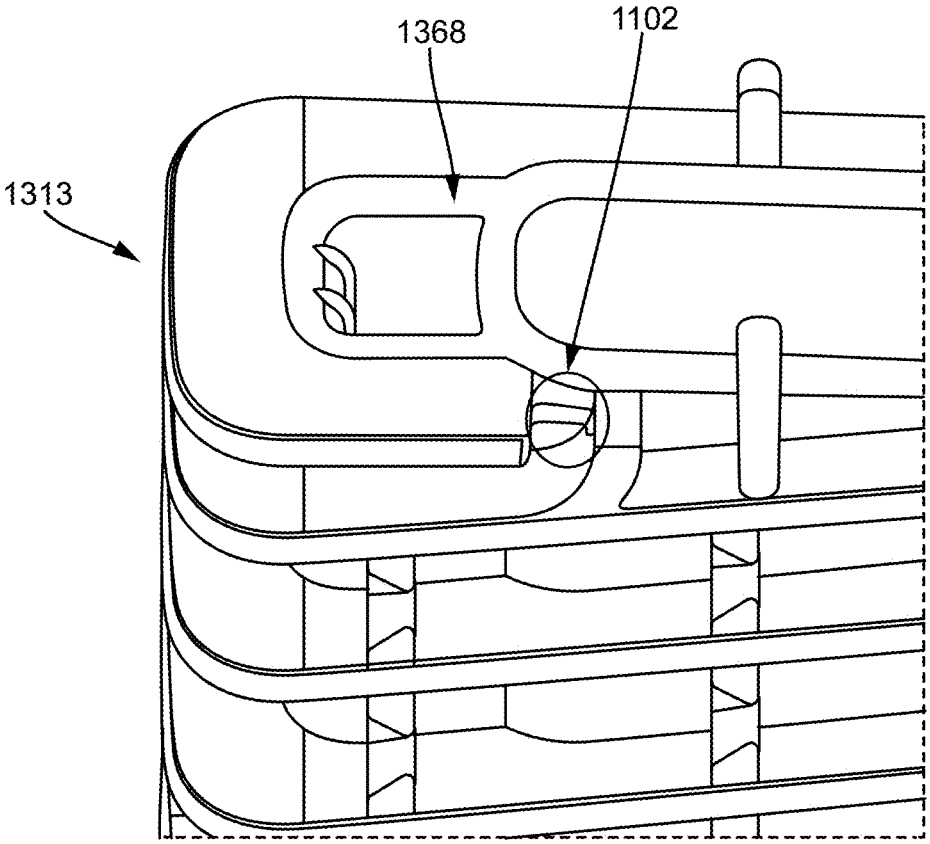
FIG. 5H depicts a perspective view of a portion of an example of a collector consistent with implementations of the current subject matter.

Referring now to FIG. 5H, in some implementations of the current subject matter, the gate 1102 may be constructed to include an aperture or opening configuration that, similar to a constriction point 1111*a* or 1111*b*, has a tapered edge, rim, or flange that is more flat in one direction. For example, the rim of the gate 1102 aperture may be shaped to be flat on one side (e.g., the side facing towards the storage chamber 1342) and rounded on another side (e.g., the side facing away from the storage chamber 1342). In such a configuration, the microfluidic forces encouraging flow back toward the storage chamber 1340 overflow away from the storage chamber 1340 may be enhanced due to easier meniscus detachment on the less-rounded side relative to the more-rounded side.

Accordingly, depending on implementation and variations in the structure or construction of the constriction points and the gate 1102, the resistance to flow of vaporizable material 1302 out of the collector 1313 may be higher than the resistance to flow of vaporizable material 1302 into the collector 1313 and toward the storage chamber 1340. In certain implementations, the gate 1102 is constructed to maintain a liquid seal such that a layer of vaporizable material 1302 is present at the medium where the storage chamber 1342 communicates with the overflow channel 1104 in the overflow volume 1344. The presence of a liquid seal may help maintain a pressure equilibrium between the storage chamber 1342 and the overflow volume 1344 to promote a sufficient level of vacuum (e.g., partial vacuum) in the storage chamber 1342 to prevent vaporizable material 1302 from completely draining into the overflow volume 1344, as well as avoiding the wicking element 1362 being deprived of adequate saturation.

In one or more example implementations, a single passageway or channel in the collector 1313 may be connected to the storage chamber 1342 by way of two vents, such that the two vents maintain a liquid seal regardless of the positioning of the cartridge 1320. The formation of a liquid seal at the gate 1102 may also help prevent the air in the collector 1313 from entering the storage chamber 1342 even when the cartridge 1320 is held diagonally with respect to the horizon or when the cartridge 1320 is positioned with the mouthpiece facing downward. This is because if air bubbles from the collector 1313 enter the reservoir, the pressure inside the storage chamber 1342 will be equalized with that of ambient pressure. That is, the partial vacuum inside the storage chamber 1342 (e.g., created as a result of vaporizable material 1302 being drained through the wick feeds 1368) would be offset, if ambient air flows into the storage chamber 1342.

In some scenarios, headspace vacuum may not be maintained when the empty space (i.e., the headspace above the vaporizable material 1302) in the storage chamber 1342 contacts the gate 1102. As a result, as noted earlier, the liquid seal established at the gate 1102 may be broken. This effect may be due to the gate 1102 being unable to maintain a fluidic film as the collector 1313 is drained and headspace comes into contact with the gate 1102, leading to a loss of partial headspace vacuum.

In certain embodiments, the headspace in the storage chamber 1342 may have ambient pressure and if there exists a hydrostatic offset between the gate 1102 and the atomizer in the cartridge 1320, the contents of the storage chamber 1342 may drain into the atomizer resulting in wick-box flooding and leaking. To avoid leakage, one or more embodiments may be implemented to remove the hydrostatic offset between the gate 1102 and the atomizer and maintain gate 1102 functionality when the storage chamber 1342 is nearly drained.

Figure 5I:
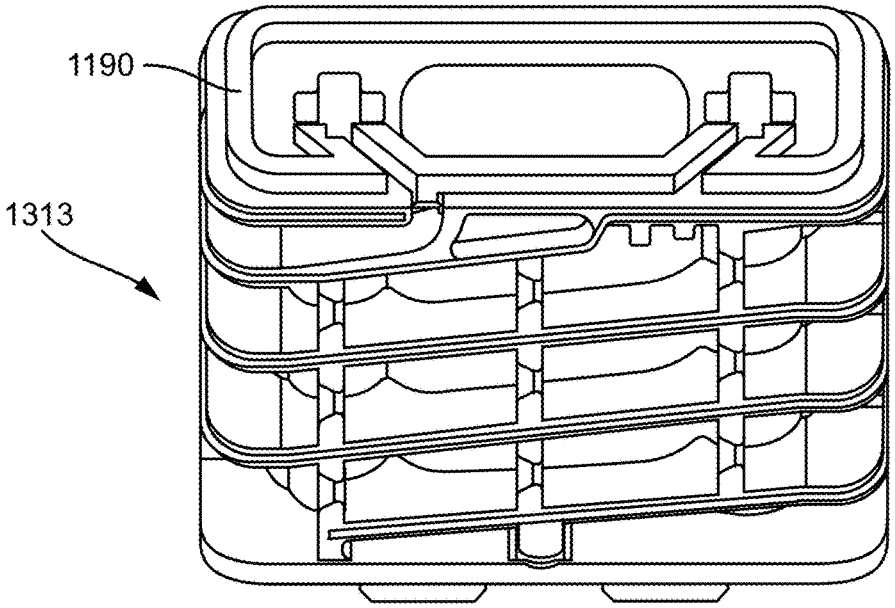
FIG. 5I depicts a top perspective view of an example of a collector consistent with implementations of the current subject matter.
Figure 5J:
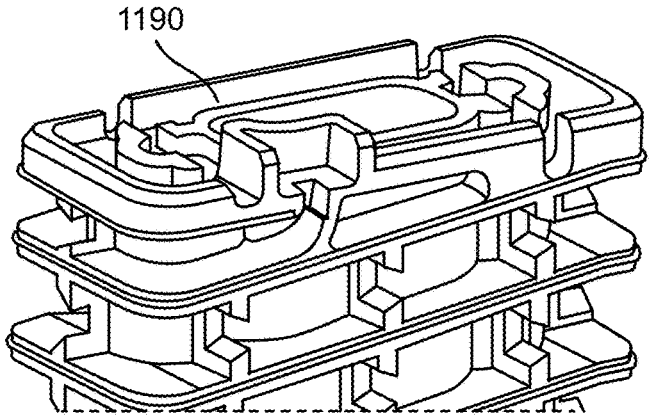
FIG. 5J depicts a side perspective view of a portion of an example of a collector consistent with implementations of the current subject matter.
Figure 5K:
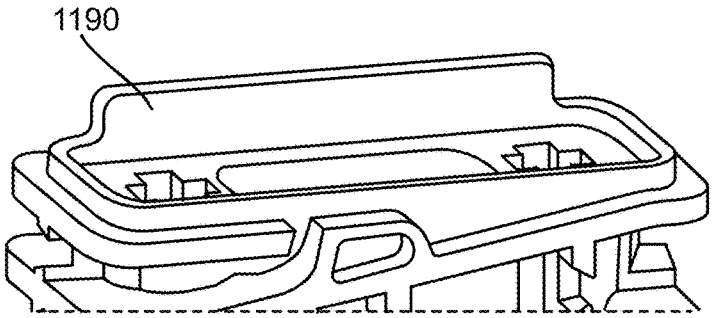
FIG. 5K depicts a top perspective view of a portion of an example of a collector consistent with implementations of the current subject matter

FIGS. 5I-K depict maze-shaped structures 1190, which may be constructed around the gate 1102 to establish a high-drive connection between the gate 1102 and the overflow channel 1104 in the collector 1313 to maintain the liquid seal at the gate 1102. In the example shown in FIG. 5J, a moat-shaped structure 1190 may be included as a means to further improve the maintenance of the liquid seal at the gate 1102 in accordance with one or more implementations.

Figure 5L:
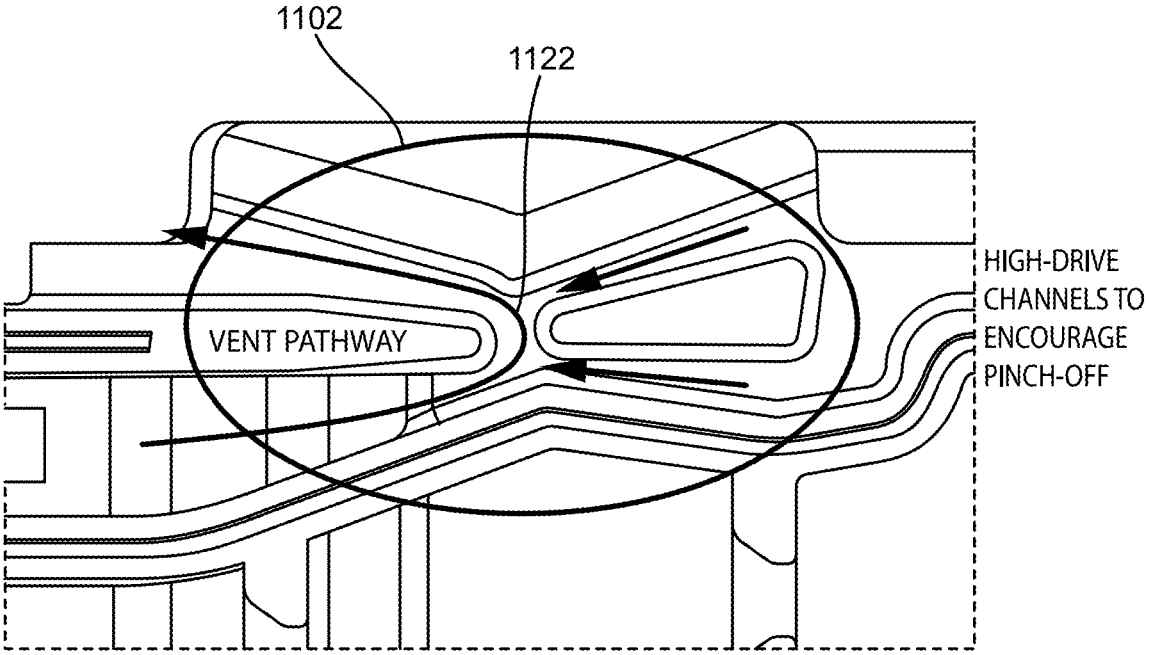
FIG. 5L depicts an example of a fluid flow management mechanism in a collector consistent with implementations of the current subject matter.
Figure 5M:
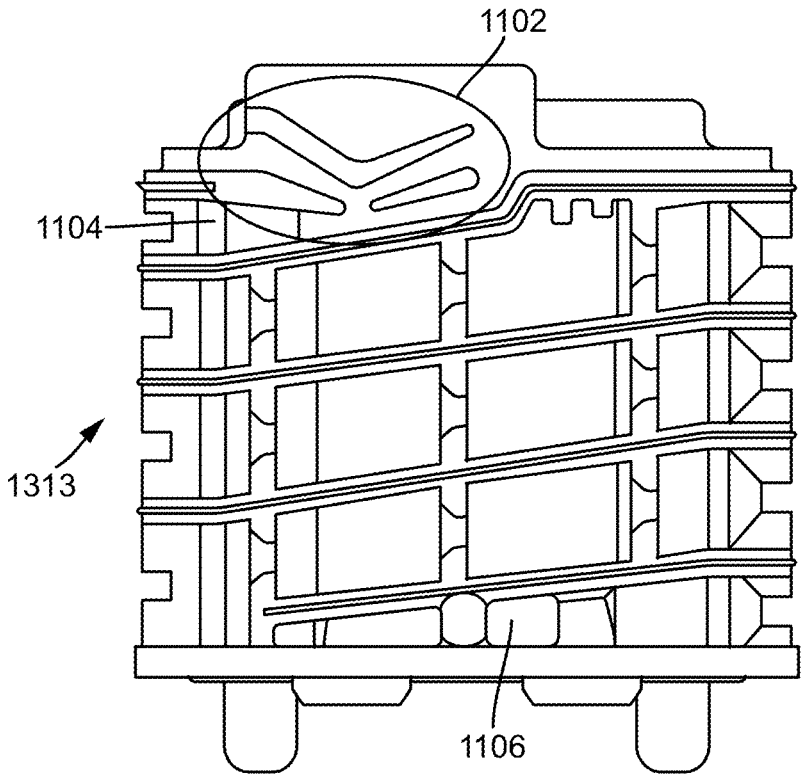
FIG. 5M depicts an example of a fluid flow management mechanism in a collector consistent with implementations of the current subject matter.
Figure 5N:
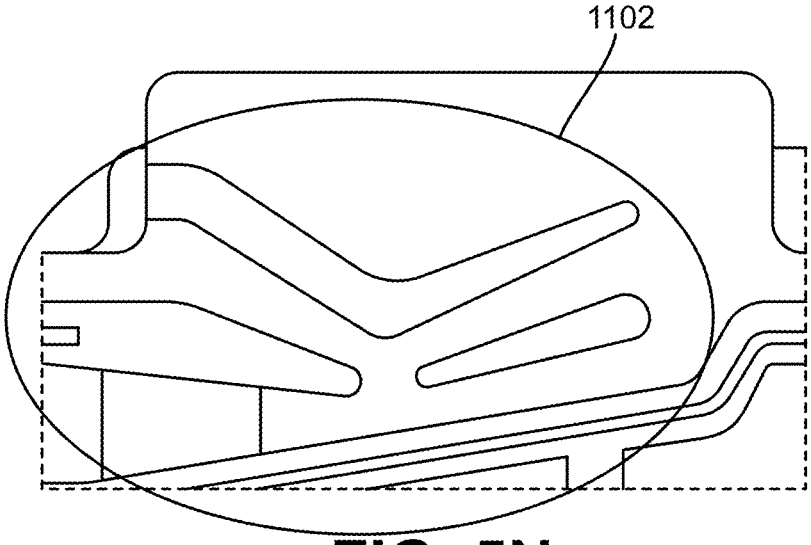
FIG. 5N depicts an example of a fluid flow management mechanism in a collector consistent with implementations of the current subject matter.

FIGS. 5L-N depicts various views of the gate 1102 consistent with implementations of the current subject matter. As shown, the overflow channel 1104 in the collector 1313 may be connected to the storage chamber 1342 by way of a V-shaped or horn-shaped controlled fluidic gate 1102, for example, such that the V-shaped gate 1102 includes at least two (and desirably three) openings that are connected to the storage chamber 1342. As provided in further detail herein, a liquid seal may be maintained at the gate 1102 regardless of the vertical or horizontal orientation of the cartridge 1320.

As shown in FIG. 5L, on a first side of the vent, a vent pathway may be maintained between the overflow channel 1104 and the gate 1102 through which air bubbles can escape from the overflow channel 1104 in the collector into the reservoir. On a second side, one or more high-drive channels connected to the reservoir may be implemented to encourage pinch-off at a pinch-off point 1122 to maintain a liquid seal that prevent the premature venting of air bubbles out of the overflow channel 1104 and into the reservoir, as well as the undesirable entry of air or vaporizable material 1302 into the overflow channel 1104 from the reservoir.

Depending on implementation, the high-drive channels, shown by way of example on the right side of FIG. 5L, are preferably maintained sealed due to the capillary pressure exerted by the liquid vaporizable material 1302 in the cartridge reservoir. The low-drive channels formed on the opposite side (i.e., shown on left side in FIG. 5L) may be configured to have a relatively lower capillary drive in comparison to the high-drive channels but still have a sufficient capillary drive such that in, a first pressure state, a liquid seal is maintained in both the high-drive channels and the low-drive channels.

Accordingly, in the first pressure state (e.g., when the pressure inside the reservoir is approximately equal to or more than the ambient air pressure), then a liquid seal is maintained in both the low-drive and high-drive channels, preventing any air bubbles from flowing into the reservoir. Conversely, in a second pressure state (e.g., when the pressure inside the reservoir is less than the ambient air pressure), air bubbles formed in the overflow channel 1104 (e.g., by way of entry through the air exchange port 1106), or more generally a leading meniscus edge of a liquid vaporizable material-air interface may travel up and toward the controlled fluidic gate 1102. As the meniscus reaches the pinch-off point 1122 positioned between the low-drive and high-drive channels of the vent 1104, the air is preferentially routed through the low-drive channel or channels, due to a higher capillary resistance being present in the high-drive channel(s).

Once the air bubbles have passed through the low-drive channel portion of the gate 1102, the air bubbles enter the reservoir and equalize the pressure inside the reservoir with that of ambient air. As such, the air exchange port 1106 in combination with the controlled fluidic gate 1102 allows for the ambient air entering through the overflow channel 1104 to pass through into the reservoir, until an equilibrium pressure state is established between the reservoir and the ambient air. As noted earlier, this process may be referred to as the reservoir venting. Once an equilibrium pressure state is established (e.g., a transition from a second pressure state back to a first pressure state) then a liquid seal is again established at the pinch-off point 1122, due to the presence of liquid in both the high-drive channels and the low-drive channels that are fed by the liquid vaporizable material 1302 stored in the reservoir.

In some implementations, tapered channels may be designed to increase drive towards the controlled vent. Considering the pinch-off of the two advancing menisci, the reservoir's tank wall and channel bottom may be configured to continue to provide drive, while the sidewalls provide a pinch-off location for the menisci. In one configuration, the net drive of the advancing menisci does not exceed that of the receding menisci, thus maintaining the system statically stable.

Referring back to FIGS. 4C-D and 5B, in certain variations, the collector 1313 may be configured to be insertably received by a receiving end of the storage chamber 1342. The end of the collector 1313 that is opposite to the end that is received by the storage chamber 1342 may be configured to receive the wicking element 1362. For example, fork-shaped constriction points may be formed to securely receive the wicking element 1362. The wick housing 1315 may be used to further secure the wicking element 1362 in a fixed position between the constriction points. This configuration may also help prevent the wicking element 1362 from substantial swelling and becoming weak due to over saturation.

Referring to FIGS. 5C-E, depending on implementation, one or more additional ducts, channels, tubes or cavities that travel through the collector 1313 and may be constructed or configured as paths that feed the wicking element 1362 with vaporizable material 1302 stored in the storage chamber 1342. In certain configurations, such as those discussed in further detail herein, the wick feeding ducts, tubes or cavities (i.e., wick feeds 1368) may run approximately parallel to the central tunnel 1100. In at least one configuration, one or more wick feeds may be present that run diagonally along the length of the collector 1313, for example, either independently or in connection with a wick exchange, optionally including one or more other wick feeds.

In certain embodiments, a plurality of wick feeds may be interactively connected in a multi-linked configuration such that an interchange of feeding paths, possibly crossing one another, may lead to the wick housing area. This configuration may help prevent complete blockage of the wick feeding mechanism if, for example, one or more feeding paths in the wick feed interchange are obstructed by way of the formation of gas bubbles or other types of clogging. Advantageously, instrumentation of multiple feeding paths may allow for vaporizable material 1302 to safely travel through one or more paths (or crossover to a different but open path) toward the wick housing area, even if some of the paths or certain routes in the wick feed interchange are fully or partially clogged or blocked.

Depending on implementation, a wick feed path may be shaped to be tubular with, for example, a circular or multi-faceted cross-diameter shape. For example, the hollow cross-section of the wick feed may be triangular, rectangular, pentagonal or in any other suitable geometrical shape. In one or more embodiments, the cross-sectional perimeter of the wick feed may be in shape of a hollow cross, for example, such that the arms of the cross have a narrower width in relationship to the diameter of the central crossover portion of the cross from which the arms extend. More generally, a wick feed channel (also referred to herein as a first channel) may have a cross-sectional shape with at least one irregularity (e.g., a protrusion, a side channel, etc.) that provides an alternative path for liquid vaporizable material to flow through in the event that an air bubble blocks the remainder of the cross-sectional area of the wick feed. The cross-shaped cross-section of the current example is an example of such a structure, but a skilled artisan will understand that other shapes are also contemplated and feasible consistent with the current disclosure.

A cross-shaped duct or tube implementation that is formed through a wick feed path may overcome clogging problems because a cross-shaped tube may be essentially considered as including five separate pathways (e.g., a central pathway formed at the hollow center of the cross and four additional pathways formed in the hollow arms of the cross). In such implementation, a blockage in the feeding tube by way of a gas bubble, for example, will likely be formed at the central portion of the cross-shaped tube, leaving sub-pathways (i.e., pathways that go through the arms of the cross-shaped tube) open to flow.

In accordance with one or more aspects, wick-feeding pathways may be sufficiently wide to allow the vaporizable material 1302 to travel freely through the feeding pathways and toward the wick. In some embodiments, the flow through the wick feed may be enhanced or accommodated by way of devising the relative diameter of certain portions of the wick feed to enforce capillary pull or pressure on the vaporizable material 1302 travelling through a wick feed path. In other words, depending on the shape and other structural or material factors, some wick feeding pathways may rely on gravitational or capillary forces to induce movement of vaporizable material 1302 toward the wick-housing portion.

In the cross-shaped tube implementation, for example, the feeding paths that go through the arms of the cross-shaped tube may be configured to feed the wick by way of capillary pressure instead of reliance on gravitational force. In such implementation, the central portion of the cross-shaped tube may feed the wick due to gravitational force, for example, while the flow of vaporizable material 1302 in the arms of the cross-shaped tube may be supported by capillary pressure. It is noted that the cross-shaped tube disclosed herein is for the purpose of providing an example embodiment.

It will be understood that a cross-shaped cross section of a wick feed path is only of multiple potential configurations consistent with implementations of the current subject matter. In other words, the concepts and functionality implemented in this example embodiment may be extended to wick feed paths with different cross-sectional shapes (e.g., tubes with hollow star-shaped cross-sections having two or more arms extending from a central tunnel running along a wick feed path). A general feature consistent with this aspect of the current subject matter is a cross-sectional shape that, for a wetting angle of the material forming the wick feed path and the liquid vaporizable material to be used, preferentially results in an air bubble being unable to fully block the entirety of the cross section, for example, because one or more protruding shapes in the cross-section are sized such that a meniscus forms across the protruding shape to maintain a continuous liquid flow path (e.g., in the portion of the wick feed path that forms the protruding part of the cross section) around any such bubble.

Referring again to FIG. 5C, an example collector 1313 construction is shown in which two wick feeds 1368 are positioned on two opposite sides of the central tunnel 1100 such that vaporizable material 1302 may enter the feeds and flow directly towards the cavity area at the other end of the collector 1313, where the housing for the wick is formed.

Wick feed mechanisms may be formed through the collector 1313 such that at least one wick feed path in the collector 1313 may be shaped as a multifaceted cross-diameter hollow tube. For example, the hollow cross-section of the wick feed may be in shape of a plus sign (e.g., a hollow cross-shaped wick feed if viewed from a top cross-sectional view), such that the arms of the cross have a narrower width in relationship to the diameter of the central crossover portion of the cross from which the arms extend.

Such central positioning of the gas bubble would ultimately leave sub-pathways (i.e., pathways that go through the arms of the cross-shaped tube) that remain open to flow of vaporizable material 1302, even when the central path is blocked by the gas bubble. Other implementations for a wick feed passageway structure are possible that can accomplish the same or similar objective as that disclosed above with respect to trapping gas bubbles or avoiding trapped gas bubbles from fully clogging the wick feed passageway.

The addition of more vents in the structure of the collector 1313 may allow for faster flow rates, depending on implementation, as a relatively larger collective volume of the vaporizable material 1302 may be displaced when additional vents are available. As such, even though not explicitly shown, embodiments with more than two vents (e.g., triple-vent implementations, quadruple-vent implementations, etc.) are also within the scope of the disclosed subject matter.

Figure 8A:
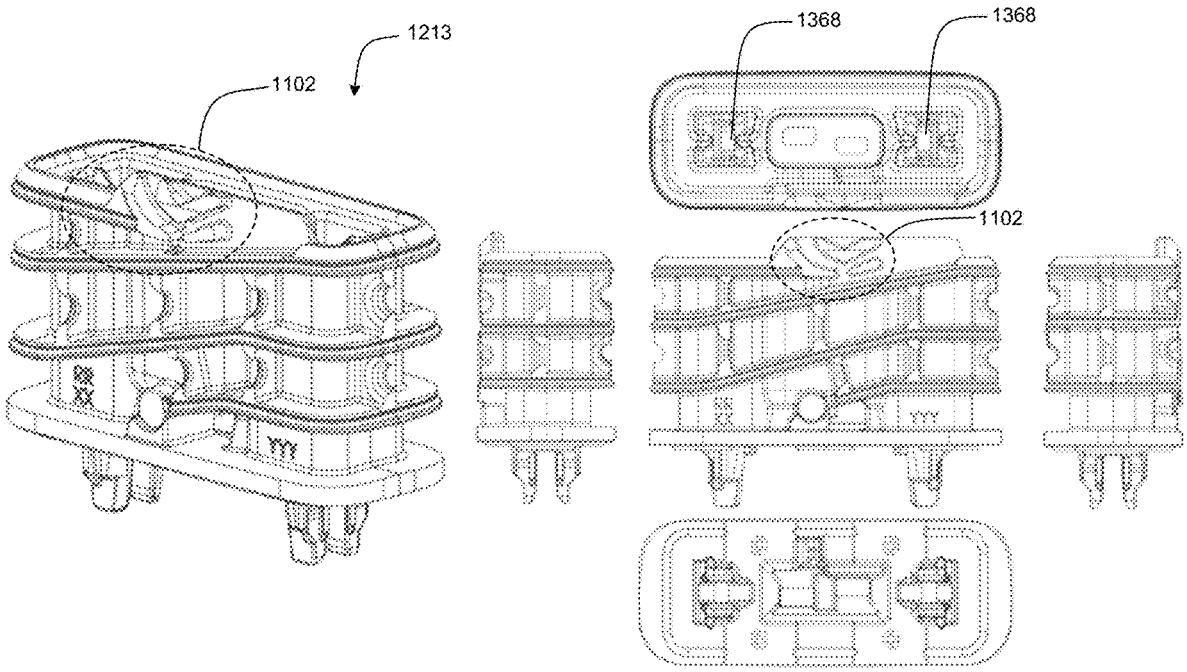
FIG. 8A depicts a perspective view, a frontal view, a side view, a bottom view, and a top view of an example a collector consistent with implementations of the current subject matter.

FIG. 8A depicts a perspective view, a frontal view, a side view, a bottom view, and a top view of an example the collector 1313 consistent with implementations of the current subject matter. In the example of the collector 1313 shown in FIG. 8A, the gate 1102 may be V-shaped. The collector 1313 may be fitted inside a hollow cavity in the cartridge 1320 along with the additional components (e.g., wicking element 1362, heating element 1350, and wick housing 1315). The wicking element 1362 may be positioned between a second end of the collector 1313 with the heating element 1350 wrapped around the wicking element 1362. During assembly, the collector 1313, wicking element 1362 and heating element 1350 may be fit together and covered by the wick housing 1315 before being inserted into the cavity inside the cartridge 1320.

The wick housing 1315 may be inserted along with the other noted components into an end of the cartridge 1320 that is opposite to the mouthpiece to hold the components inside in a pressure-sealed or pressure-fit manner. The seal or fit of the wick housing 1315 and collector 1313 inside the inner walls of the receiving sleeve of the cartridge 1320 is desirably sufficiently tight to prevent leakage of vaporizable material 1302 held in the reservoir of the cartridge 1320. In some embodiments, the pressure seal between the wick housing 1315 and the collector 1313 and the inner walls of the receiving sleeve of the cartridge 1320 is also sufficiently tight to prevent the manual disassembly of the components with a user's bare hands.

Figure 8B:
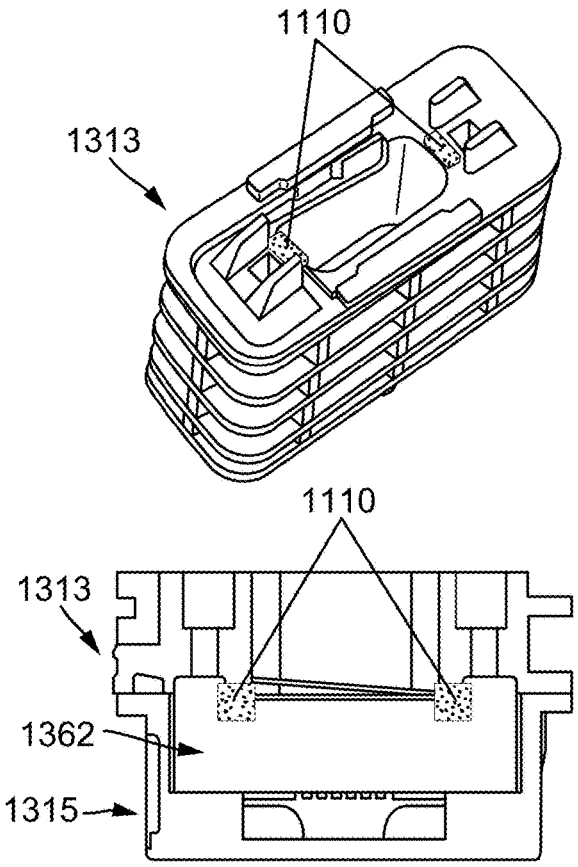
FIG. 8B depicts a perspective view and a cross-sectional view of an example a collector consistent with implementations of the current subject matter.
Figure 8C:
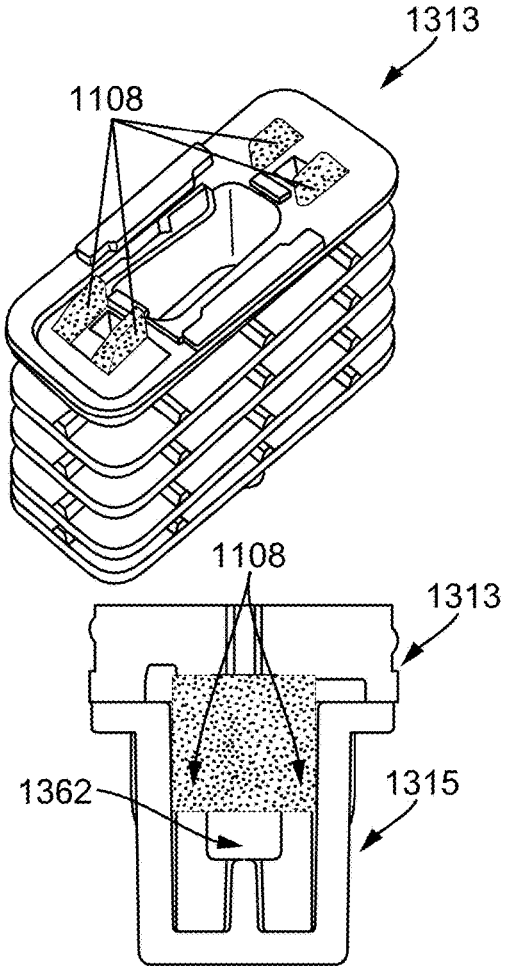
FIG. 8C depicts a perspective view and a cross-sectional view of an example a collector consistent with implementations of the current subject matter.

Referring now to FIGS. 8B-C, in some implementations of the current subject matter, the wicking element 1362 may be constrained or compressed in certain locations along its length (e.g., toward the longitudinal distal ends of the wicking element 1362 positioned directly under wick feeds 1368) by way of compression ribs 1110 to help prevent leakage by, for example, maintaining a larger saturation area of the vaporizable material 1302 toward the ends of the wicking element 1362, so that the central part of the wicking element 1362 remains more dry and less leak prone. Further, use of compression ribs 1110 may further press the wicking element 1362 into the atomizer housing to prevent leakage into the atomizer.

Figure 8D:
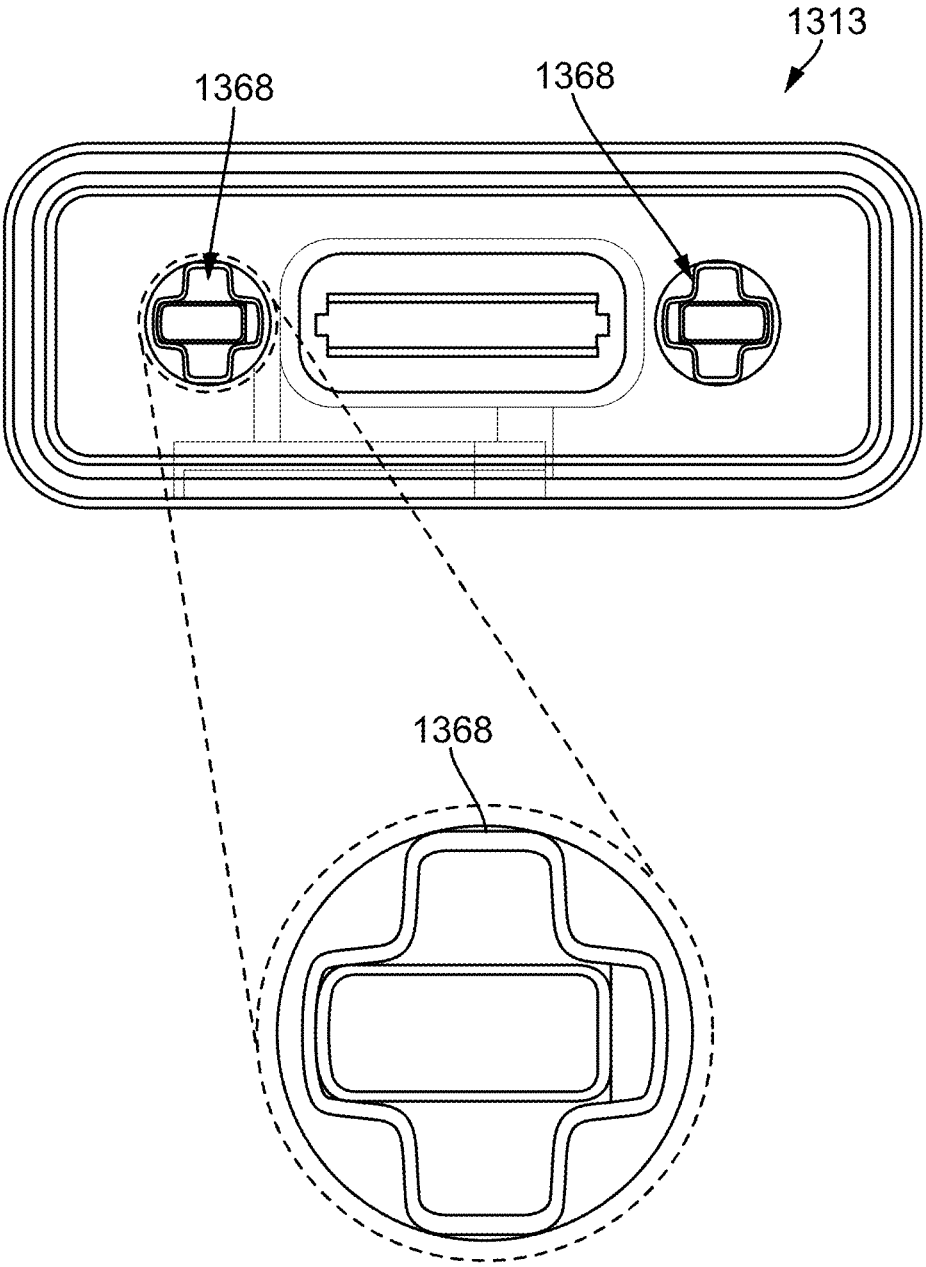
FIG. 8D depicts a top planar view of an example of a wick feed mechanism consistent with implementations of the current subject matter.
Figure 8E:
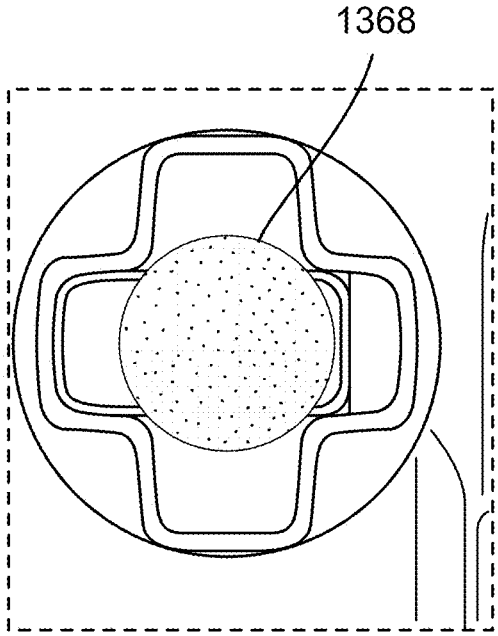
FIG. 8E depicts a top planar view of an example of a wick feed mechanism consistent with implementations of the current subject matter.
Figure 8F:
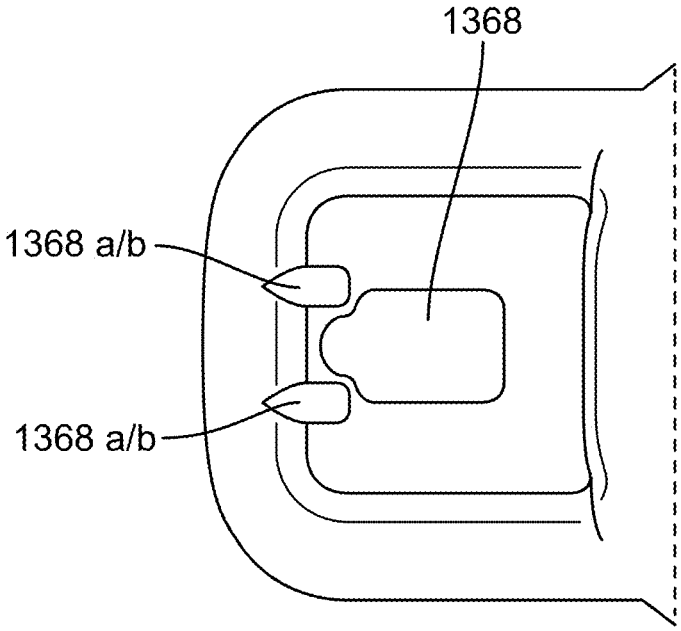
FIG. 8F depicts a top planar view of an example of a wick feed mechanism consistent with implementations of the current subject matter.

FIGS. 8D-F depict top planar view of examples of wick feed mechanisms, which may be formed by or structured through the collector 1313. In the example shown in FIG. 8D, at least one wick feed 1368 path in the collector 1313 may be shaped as a multifaceted cross-diameter hollow tube. For example, the hollow cross-section of the wick feed 1368 path may be in shape of a plus sign (e.g., a hollow cross-shaped wick feed if viewed from a top cross-sectional view), such that the arms of the cross have a narrower width in relationship to the diameter of the central crossover portion of the cross from which the arms extend. Meanwhile, in the example shown in FIG. 8E, a duct or tube with a cross-shaped diameter formed through a wick feed 1368 path may overcome clogging problems because a tube with a cross-shaped diameter may be considered as including five separate pathways (e.g., a central pathway formed at the hollow center of the cross and four additional pathways formed in the hollow arms of the cross). In such implementations, a blockage in the feeding tube by way of a gas bubble (e.g., air bubble) will likely be formed at the central portion of the cross-shaped tube as shown in FIG. 8E. A central positioning of the gas bubble would ultimately leave sub-pathways (i.e., pathways that go through the arms of the cross-shaped tube) that remain open to flow of vaporizable material 1302, even when the central path is blocked by the gas bubble.

Referring to now to FIG. 8F, the wick feedback mechanism may also be a wick feed 1368 path structure capable of trapping gas bubbles or avoiding trapped gas bubbles from fully clogging the wick feed 1368 path. As shown in the example illustration of FIG. 8F, one or more droplet-shaped constriction points 1368*a* and/or 1368*b* (e.g., similar in shape to one or more separated nipples with a wick feed 1368 path therebetween) may be formed at an end of the wick feed 1368 path through which vaporizable material 1302 flows from the storage chamber 1342 into the collector 1313 to help lead the vaporizable material 1302 through the wick feed 1368 path, if a gas bubble is trapped in the central region of the wick feed 1368 path. In this manner, a reasonably controllable and consistent flow of vaporizable material 1302 may be streamed towards the wick, preventing a scenario in which the wick is inadequately saturated with the vaporizable material 1302.

Figure 7:
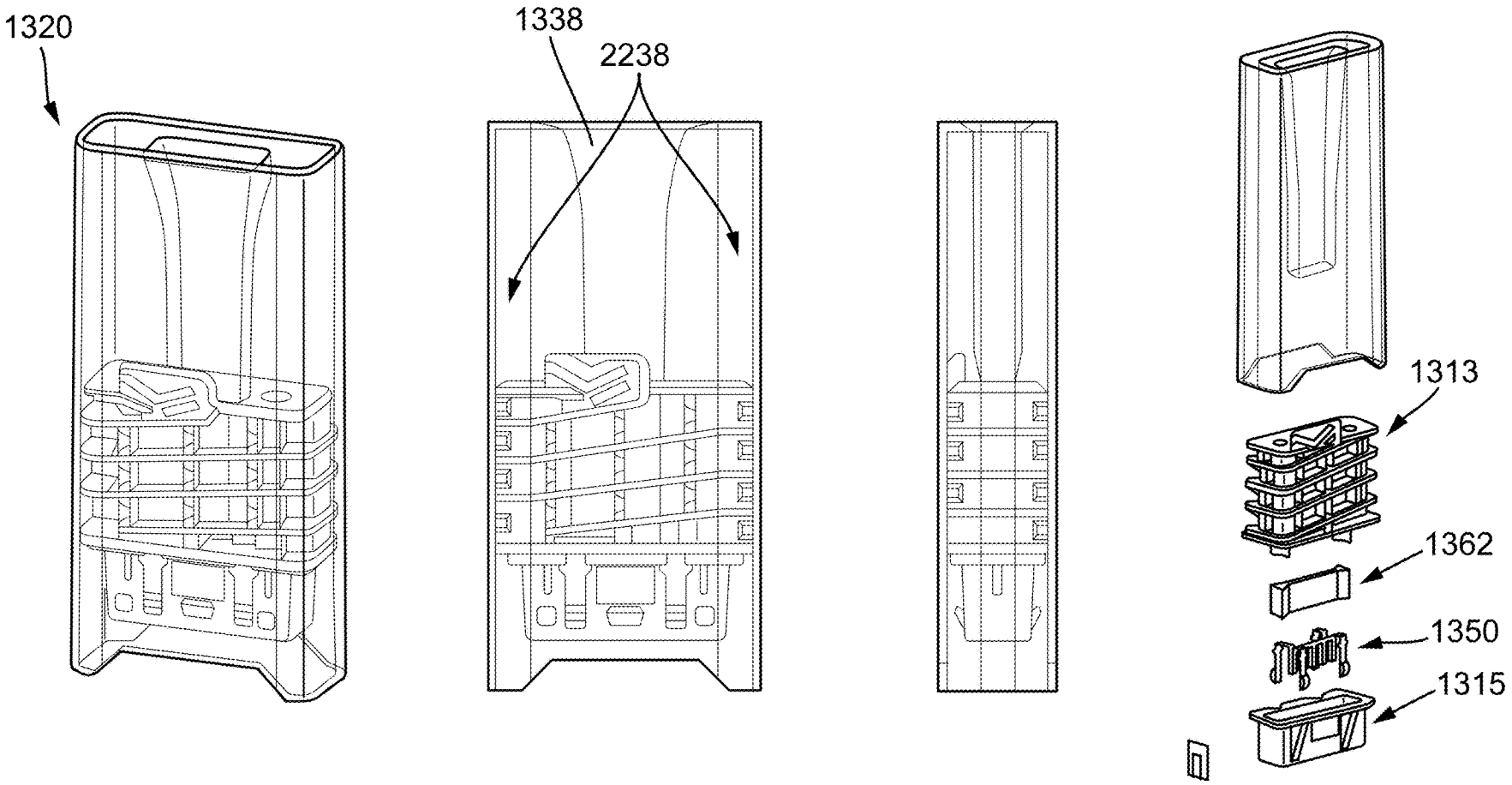
FIG. 7 depicts a perspective view, a frontal view, a side view, and an exploded view of an example of a cartridge consistent with implementations of the current subject matter.

FIG. 7 depicts a perspective view, a frontal view, a side view, and an exploded view of an example of the cartridge 1320 consistent with implementations of the current subject matter. As shown, the cartridge 1320 may include a mouthpiece-reservoir combination shaped in the form of a sleeve with an airflow passageway 1338 defined through the sleeve. An area in the cartridge 1320 houses the collector 1313, the wicking element 1362, the heating element 1350, and the wick housing 1315. An opening at a first end of the collector 1313 leads to the airflow passageway 1338 in the mouthpiece and provides a route for the vaporized vaporizable material 1302 to travel from the heating element 1350 area to the mouthpiece from which a user inhales.

Figure 9C:
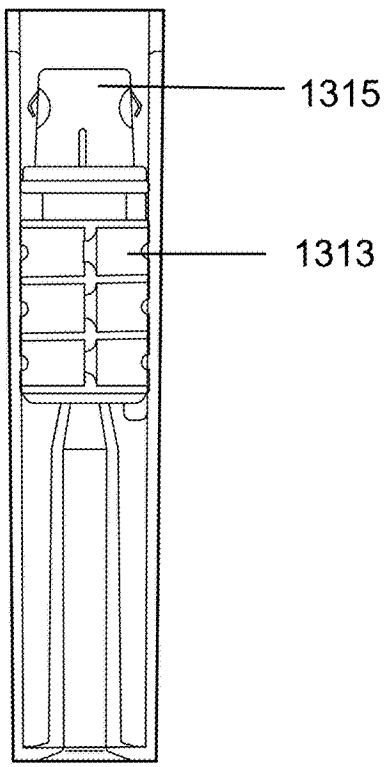
FIG. 9C depicts a side view of an example of a cartridge consistent with implementations of the current subject matter.
Figure 9B:
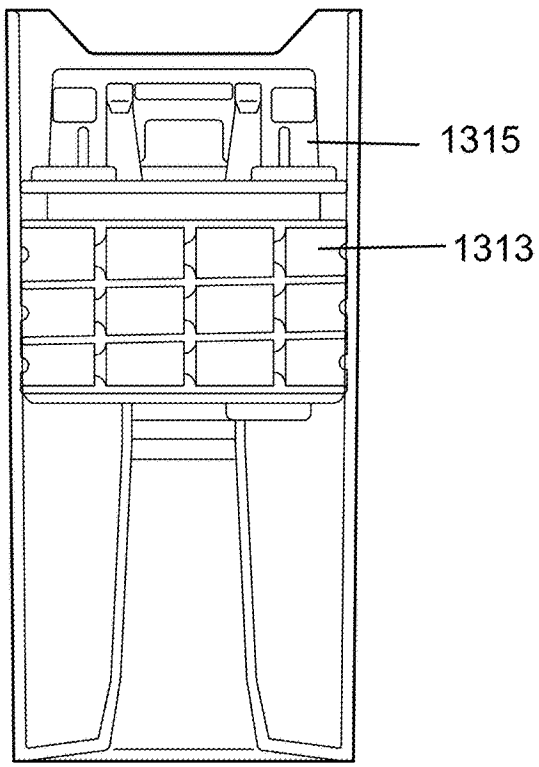
FIG. 9B depicts a frontal view of an example of a cartridge consistent with implementations of the current subject matter.
Figure 9A:
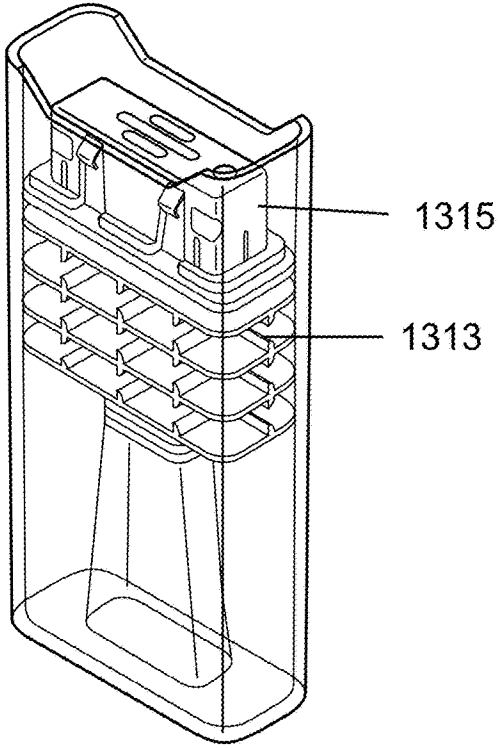
FIG. 9A depicts a perspective view of an example of a cartridge consistent with implementations of the current subject matter.
Figure 10A:
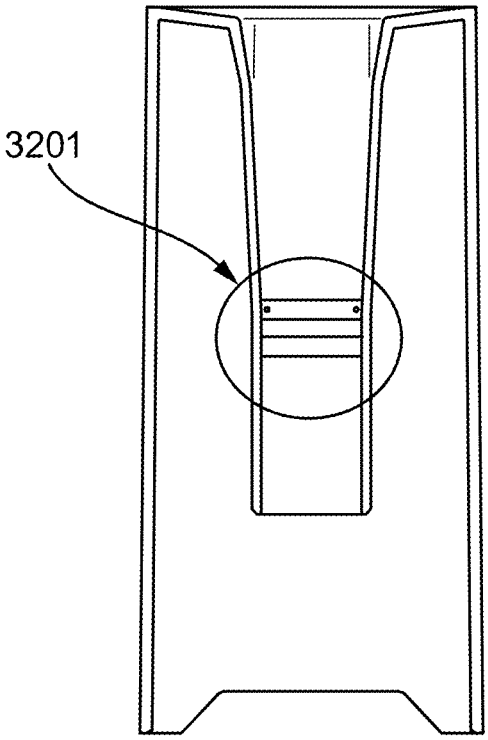
FIG. 10A depicts a frontal view of a cartridge having an example of a condensate recycling system consistent with implementations of the current subject matter.
Figure 10B:
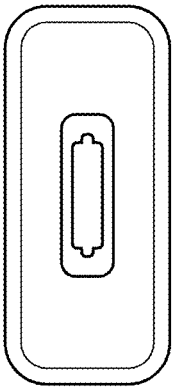
FIG. 10B depicts a top view of a cartridge having an example of a condensate recycling system consistent with implementations of the current subject matter.
Figure 10C:
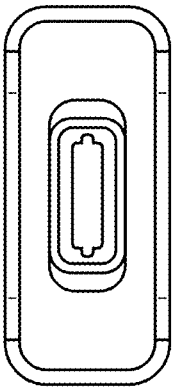
FIG. 10C depicts a bottom view of a cartridge having an example of a condensate recycling system consistent with implementations of the current subject matter.
Figure 10D:
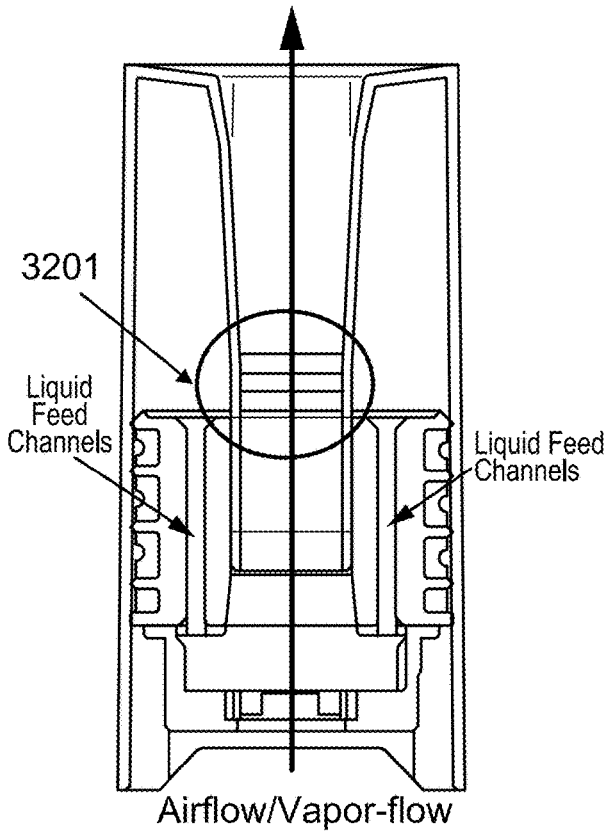
FIG. 10D depicts another frontal view a cartridge having an example of a condensate recycling system consistent with implementations of the current subject matter.
Figure 10E:
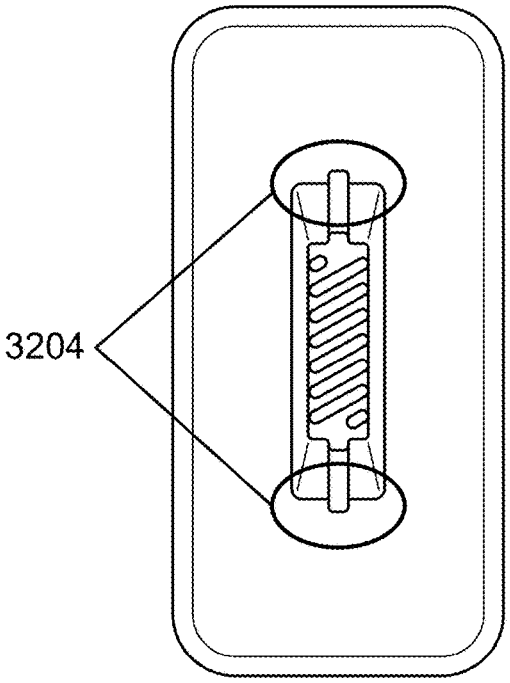
FIG. 10E depicts another top view of a cartridge having an example of a condensate recycling system consistent with implementations of the current subject matter.

FIGS. 9A-C depict a perspective view, a frontal view, and a side view of an example of the cartridge 1320 consistent with implementations of the current subject matter. Referring to FIGS. 9A-C, the cartridge 1320 as shown may be assembled from multiple components including the collector 1313, the heating element 1350, and the wick housing 1315 for holding the cartridge components in place as the components are inserted into a body of a cartridge. In one embodiment, a laser weld may be implemented at a circumferential juncture positioned at approximately the point at which one end of the collector 1313 meets the wick housing 1313. A laser weld between the collector 1313 and the heating chamber 1315 may prevent the liquid vaporizable material 1302 in the collector 1313 from flowing into the heating chamber 1315 where the atomizer is placed.

Vaporizing vaporizable material into an aerosol may result in condensate collecting along one or more internal channels and outlets (e.g., along a mouthpiece) of some vaporizers. For example, such condensate may include vaporizable material that was drawn from a reservoir, formed into an aerosol, and condensed into the condensate prior to exiting the vaporizer. Additionally, vaporizable material that has circumvented the vaporization process may also accumulate along the one or more internal channels and/or air outlets. This can result in the condensate and/or unvaporized vaporizable material exiting the mouthpiece outlet and depositing into the mouth of a user thereby creating both an unpleasant user experience as well as decreasing the amount of inhalable aerosol otherwise available. Furthermore, the buildup and loss of condensate can ultimately result in the inability to draw all of the vaporizable material from the reservoir into the vaporization chamber, thereby wasting vaporizable material. For example, as vaporizable material particulates accumulate in the internal channels of an air tube downstream of a vaporization chamber, the effective cross-sectional area of the airflow passageway narrows, thus increasing the flow rate of the air and thereby applying drag forces onto the accumulated fluid consequently amplifying the potential to entrain fluid from the internal channels and through the mouthpiece outlet. As such, in some implementations of the current subject matter, the vaporizer cartridge 1320 may include a condensate recycling system including, for example, a condensate collector 3201 and condensate recycling channels 3204 (e.g., micro-fluidic channels) that extend from the opening of the mouthpiece to the wicking element 1362. To further illustrate, FIGS. 10A-E depict various views of the cartridge 1320 including an example of a condensate recycling system consistent with implementations of the current subject matter.

Referring to FIGS. 10A-E, the condensate collector 3201 may act on vaporized vaporizable material 1302 that are cooled and turned into droplets in the mouthpiece to collect and route the condensed droplets to the condensate recycler channels 3204. The condensate recycler channels 3204 collect and return condensate and large vapor droplets to the wick, and prevent the liquid vaporizable material formed in the mouthpiece from being deposited into the user's mouth, during the user puffing or inhaling from the mouthpiece. The condensate recycler channels 3204 may be implemented as micro-fluidic channels to trap any liquid droplet condensates and thereby eliminate the direct inhalation of vaporizable material, in liquid form, and avoid an undesirable sensation or taste in the user's mouth.

Figure 45A:
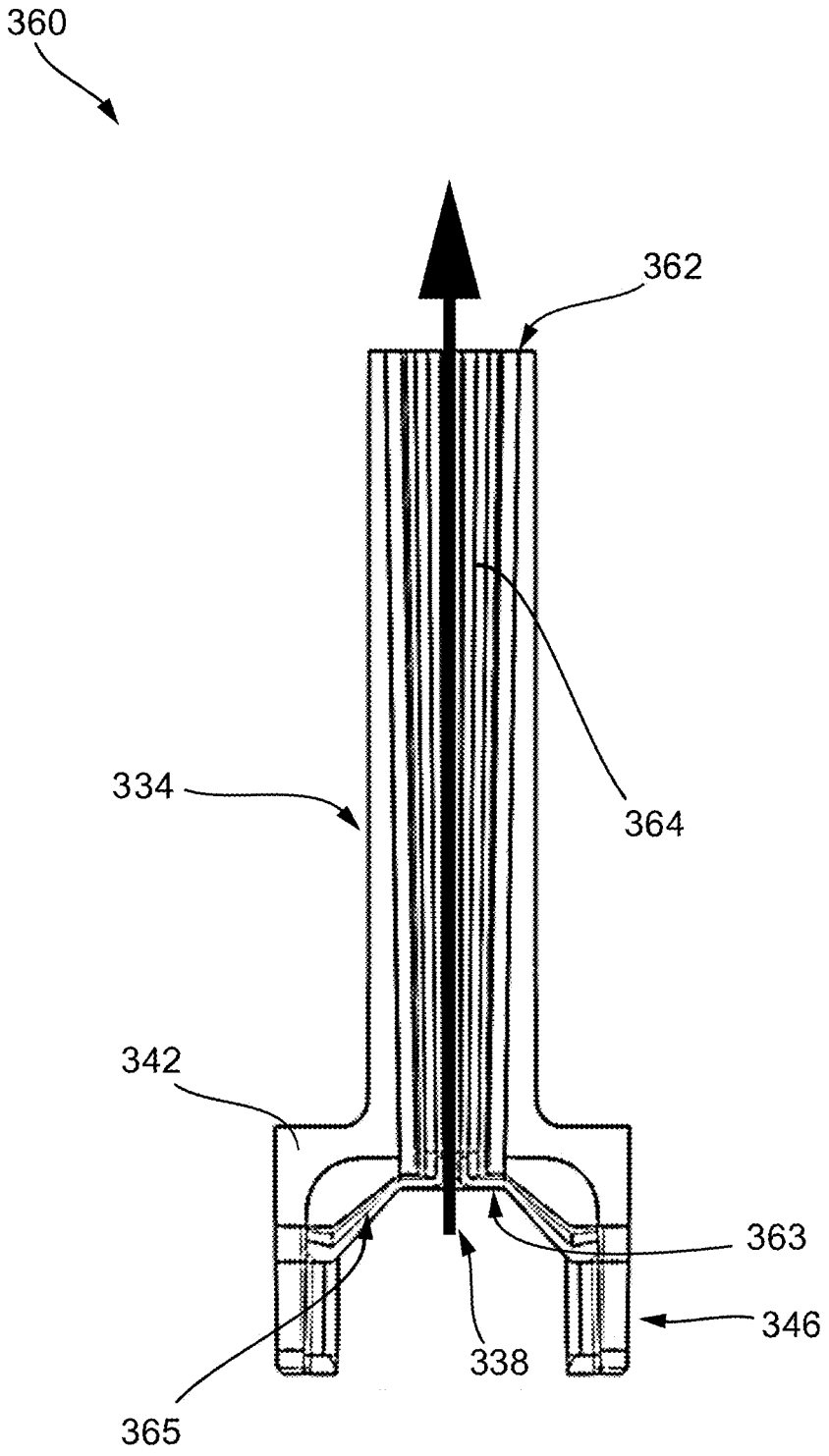
FIG. 45A depicts a side cross-sectional view of an example of a condensate recycler system consistent with implementations of the current subject matter.
Figure 45B:
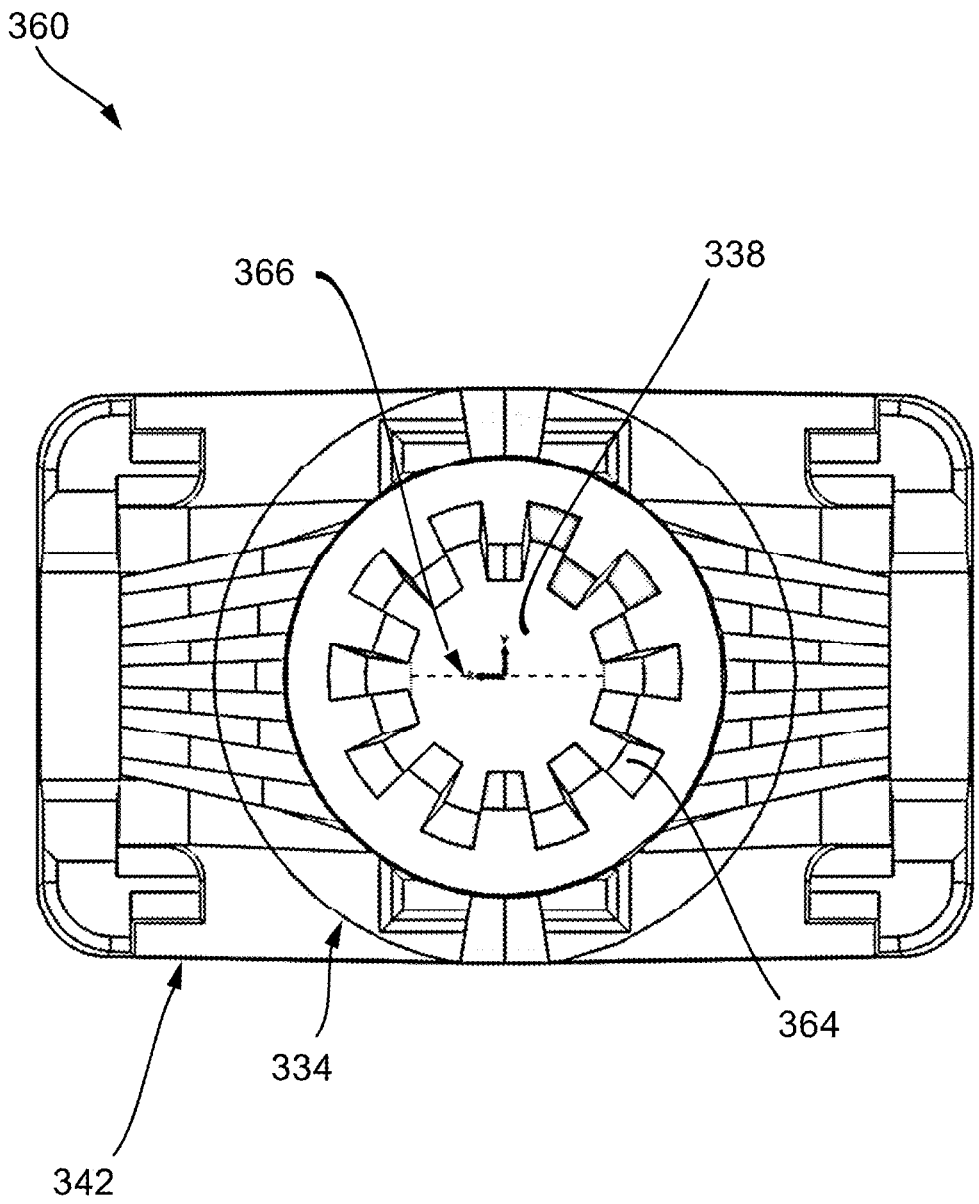
FIG. 45B depicts a first perspective view of an example of a condensate recycler system consistent with implementations of the current subject matter.
Figure 45C:
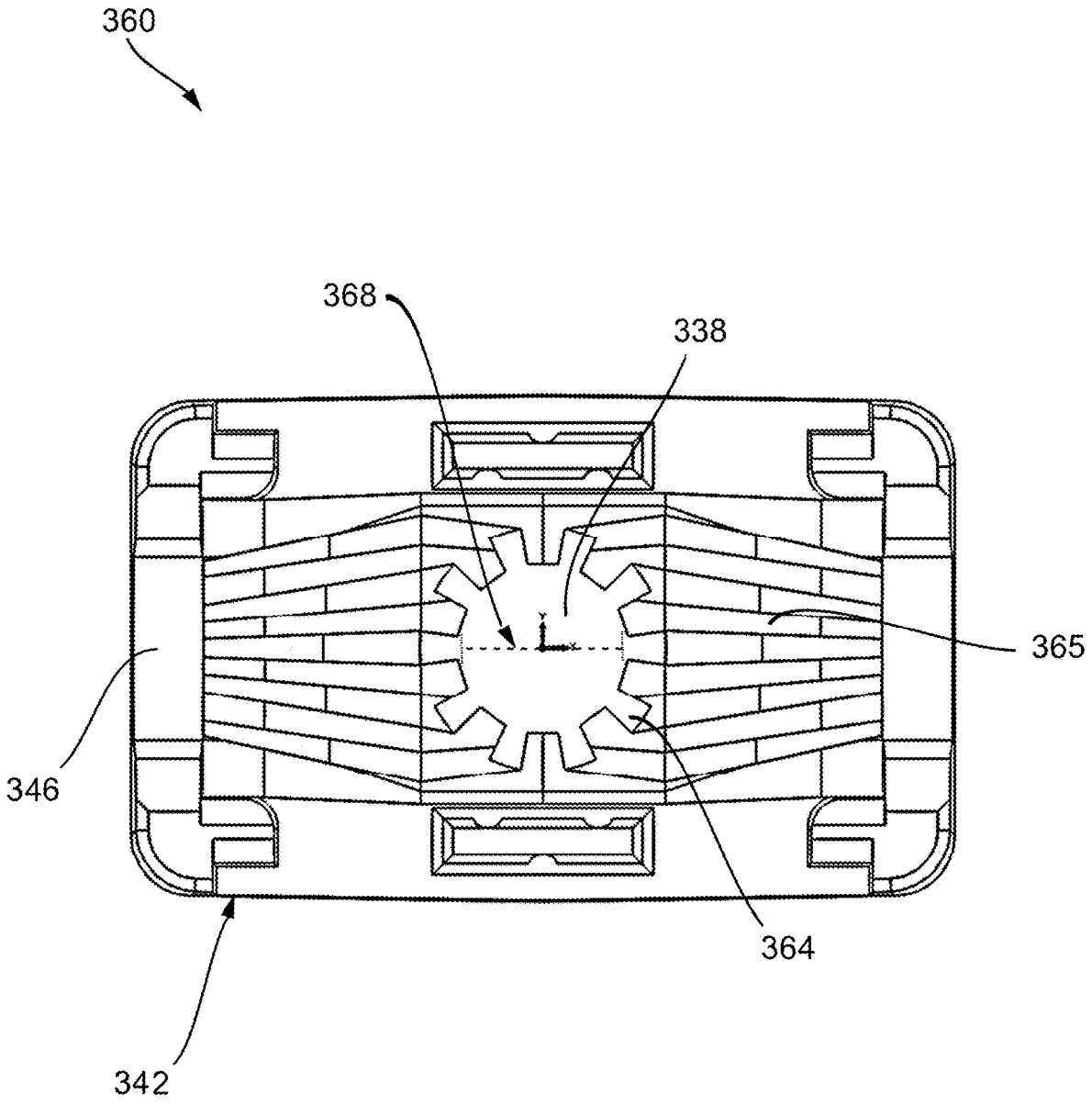
FIG. 45C depicts a second perspective view of an example of a condensate recycler system consistent with implementations of the current subject matter.

Additional and/or alternative embodiments of the condensate recycler channels, and/or one or more other features for controlling, collecting, and/or recycling condensate in a vaporizer device are described and shown with respect to FIGS. 45A-C. For example, FIGS. 45A-C depicts another example of a condensate recycler system 360 consistent with implementations of the current subject matter. The condensate recycler system 360 may be configured to collect vaporizable material condensate and direct the condensate back to the wick for reuse. As shown in FIGS. 45A-C, the condensate recycler system 360 may include an internally grooved air tube 334 creating an airflow passageway 338 which extends from the mouthpiece toward the vaporization chamber 342 and may be configured to collect any vaporizable material condensate and direct it (via capillary action) back to the wick for reuse.

One function of the grooves may include that vaporizable material condensate becomes trapped or is otherwise positioned within the grooves. The condensate, once positioned within the grooves, drains down to the wick due to the capillary action created by the wicking element. The draining of the condensate within the grooves may at least partially be achieved via capillary action. If any condensation exists inside the air tube, the vaporizable material particulates may fill into the grooves rather than forming or building a wall of condensate inside the air tube if the grooves were not present. When the grooves are filled enough to establish fluid communication with the wick, the condensate drains through and from the grooves and can be reused as vaporizable material. In some embodiments, the grooves may be tapered such that the grooves are narrower towards the wick and wider towards the mouthpiece. Such tapering may encourage fluid to move toward the vaporization chamber as more condensate collects in the grooves via higher capillary action at the narrower point.

FIG. 45A shows a cross-sectional view of air tube 334. The air tube 334 includes an airflow passageway 338 and one or more internal grooves having a decreasing hydraulic diameter toward the vaporization chamber 342. The grooves are sized and shaped such that fluid (such as condensate) disposed within the grooves can be transported from a first location to a second location via capillary action. The internal grooves include air tube grooves 364 and chamber grooves 365. The air tube grooves 364 may be disposed inside of air tube 334 and may taper such that the cross-section of the air tube grooves 364 at an air tube first end 362 may be greater than the cross-section of the air tube grooves 364 at an air tube second end 363. The chamber grooves 365 may be disposed proximate to the air tube second end 363 and coupled with air tube grooves 364. The internal grooves may be in fluid communication with the wick and configured to allow the wick to continually drain vaporizable material condensate from the internal grooves, thus preventing the buildup of a film of condensate in the airflow passageway 338. The condensate may preferentially enter the internal grooves due to the capillary drive of the internal grooves. The gradient of capillary drive in the internal grooves directs fluid migration toward wick housing 346, where the vaporizable material condensate is recycled by resaturating the wick.

FIGS. 45B and 45C show an internal view of the condensate recycler system 360 as seen from the air tube first end 362, and the air tube second end 363, respectively. The air tube first end 362 may be disposed proximate to the mouthpiece and/or air outlet. The air tube second end 363 may be disposed proximate to the vaporization chamber 342 and/or wick housing 346, and may be in fluid communication with the chamber grooves 365 and/or the wick. The air tube grooves 364 may have a first diameter 366 and a second diameter 368. The second diameter 368 may be narrower than the first diameter 366.

As the effective cross-section of the air flow passageway narrows, either by accumulation of condensate in the airflow passageway or by design as discussed herein, the flow rate of the air moving through the air tube increases, applying drag forces on the accumulated fluid (e.g., condensate). Fluid exits the air outlet when the drag forces pulling the fluid out toward the user (e.g., responsive to inhalation on the vaporizer) are higher than the capillary forces pulling the fluid toward the wick.

To overcome this issue and encourage the condensate away from the mouthpiece outlet and back toward the vaporization chamber 342 and/or the wick, a tapered airflow passageway is provided such that a cross-section of the air tube grooves 364 proximate to the vaporization chamber 342 is narrower than a cross-section of the air tube grooves 364 proximate to the mouthpiece. Further, each of the internal grooves narrows such that the width of the internal grooves proximate to the air tube first end 362 may be wider than the width of the internal grooves proximate to the air tube second end 363. As such, the narrowing passageway increases the capillary drive of the air tube grooves 364 and encourages fluid movement of the condensate toward the chamber grooves 365. Further yet, the chamber grooves 365 proximate to the air tube second end 363 may be wider than the width of the chamber grooves 365 proximate to the wick. That is, each groove channel progressively narrows approaching the wick in addition to the airflow passageway itself narrowing toward the wick end.

To maximize the effectiveness of the capillary action provided by the condensate recycler system design, the air tube cross-sectional size relative to the groove size may be considered. While capillary drive may increase as groove width narrows, smaller groove sizes may result in the condensate overflowing the grooves and clogging the air tube. As such, groove width may range from approximately 0.1 mm to approximately 0.8 mm.

In some embodiments, the geometry or number of grooves may vary. For example, the grooves may not necessarily have a decreasing hydraulic diameter toward the wick. In some embodiments, a decreasing hydraulic diameter toward the wick may improve performance of the capillary drive, but other embodiments may be considered. For example, the internal grooves and channels may have a substantially straight structure, a tapered structure, a helical structure, and/or other arrangements.

Figure 11A:
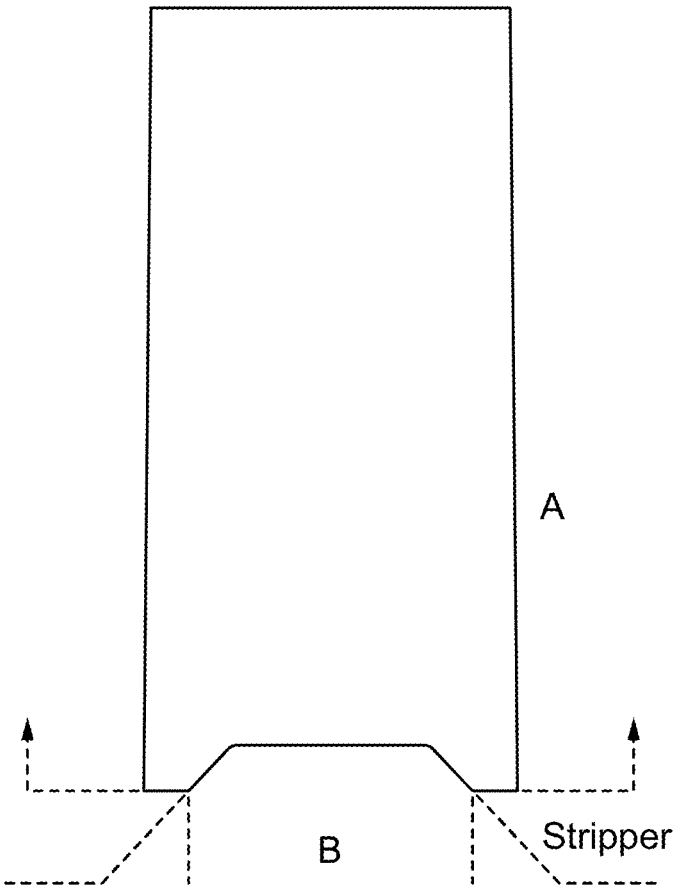
FIG. 11A depicts a frontal view of a cartridge having an example of an external airflow path consistent with implementations of the current subject matter.
Figure 11B:
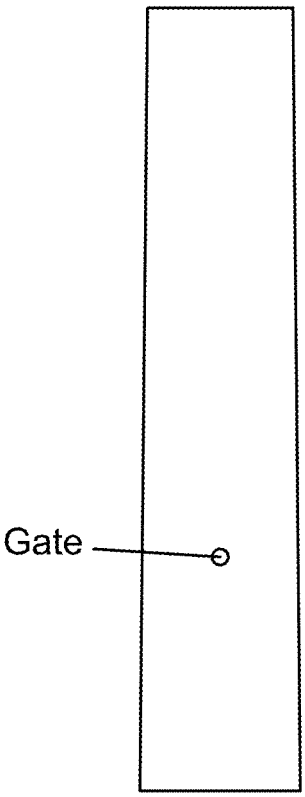
FIG. 11B depicts a frontal view of a cartridge having an example of an external airflow path consistent with implementations of the current subject matter.

FIGS. 11A-B depict a frontal view and a side view of the cartridge 1310 having an example of an external airflow path consistent with implementations of the current subject matter. For example, as shown in FIGS. 11A-B, one or more gates, also referred to as air inlet holes, may be provided on the vaporizer body 110. The inlet holes may be positioned inside of an air inlet channel with a width, height, and depth that is sized to prevent the user from unintentionally blocking the individual air inlet holes, when the user is holding the vaporizer 100 coupled with the cartridge 1320. In one aspect, the air inlet channel construction may be sufficiently long so as not to significantly block or restrict airflow through the air inlet channel, when for example a user's fingers block an area of the air inlet channel.

In some implementations of the current subject matter, the geometric construction of the air inlet channel may provide for at least one of a minimum length, a minimum depth, or a maximum width, for example, to ensure a user can't completely cover or block the air inlet holes in the air inlet channel with a finger, a hand, and/or another body part. For example, the length of the air inlet channel may be longer than the width of an average human finger and the width and depth of the air inlet channel may be such that when a user's finger is pressed on top of the channel, the skin folds created does not interface with the air inlet holes inside the air inlet channel.

The air inlet channel may be constructed or formed as having rounded edges or shaped to wrap around one or more corners or areas of the vaporizer body 110, so that the air inlet channel cannot be easily covered by a user's finger or body part. In some implementations of the current subject matter, an optional cover may be provisioned to protect the air inlet channel so that a user's finger cannot not block or completely limit airflow into the air inlet channel. Alternatively and/or additionally, the air inlet channel may be disposed at an interface between the vaporizer cartridge 1320 and the vaporizer body 110. For example, the air inlet channel may be disposed within a recessed area, for example, a seam, a cavity, a groove, a gap, and/or the like, that is formed between the vaporizer cartridge 1320 and the vaporizer body 110 when the vaporizer cartridge 1320 is coupled with the vaporizer body 110. This recessed area may extend at least partially around the circumference of the vaporizer cartridge 1320 and the vaporizer body 110 such that a user's finger (or other body part) is able to cover only a portion of the recessed area and air may still enter the air inlet channel through the uncovered portion of the recessed area.

Figure 12A:
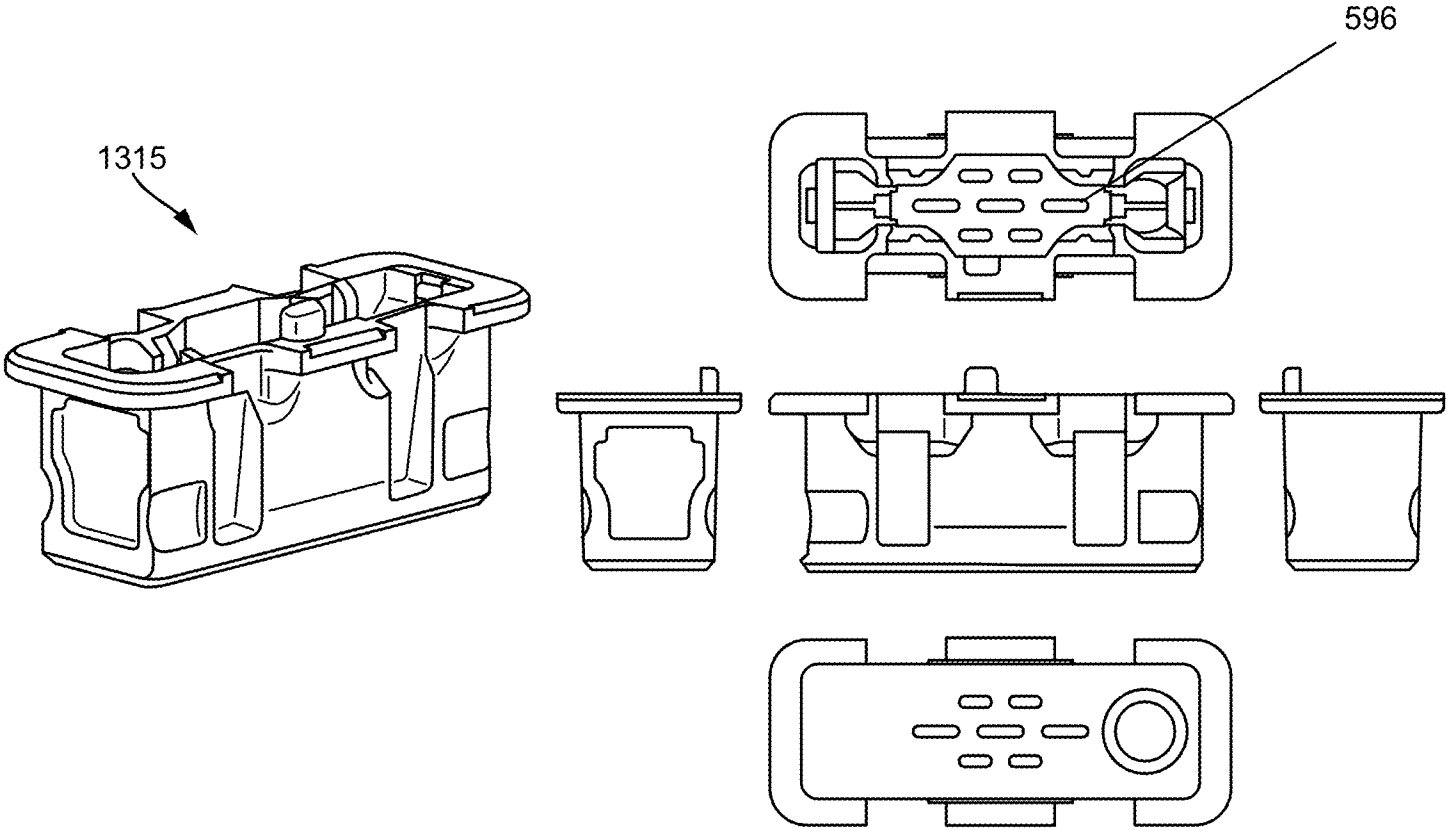
FIG. 12A depicts a perspective view, a top view, a bottom view, and various side views of an example of a wick housing consistent with implementations of the current subject matter.

FIG. 12A depicts a perspective view, a top view, a bottom view, and various side views of an example of the wick housing 1315 consistent with implementations of the current subject matter. As shown, one or more perforations, holes, or slots 596 may be formed in the lower portion of the wick housing 1315 to enable air to flow into the wick housing 1315 and around and/or past the wick element 1362 positioned in the wick housing 1315. A sufficient number of the slots 596 may promote adequate airflow through the wick housing 1315, which may be necessary to provide for a proper and timely vaporization of vaporizable material 1302 absorbed into the wicking element 1362 in reaction to the heat generated by the heating element 1350 positioned near or around the wicking element 1362.

Figure 50A:
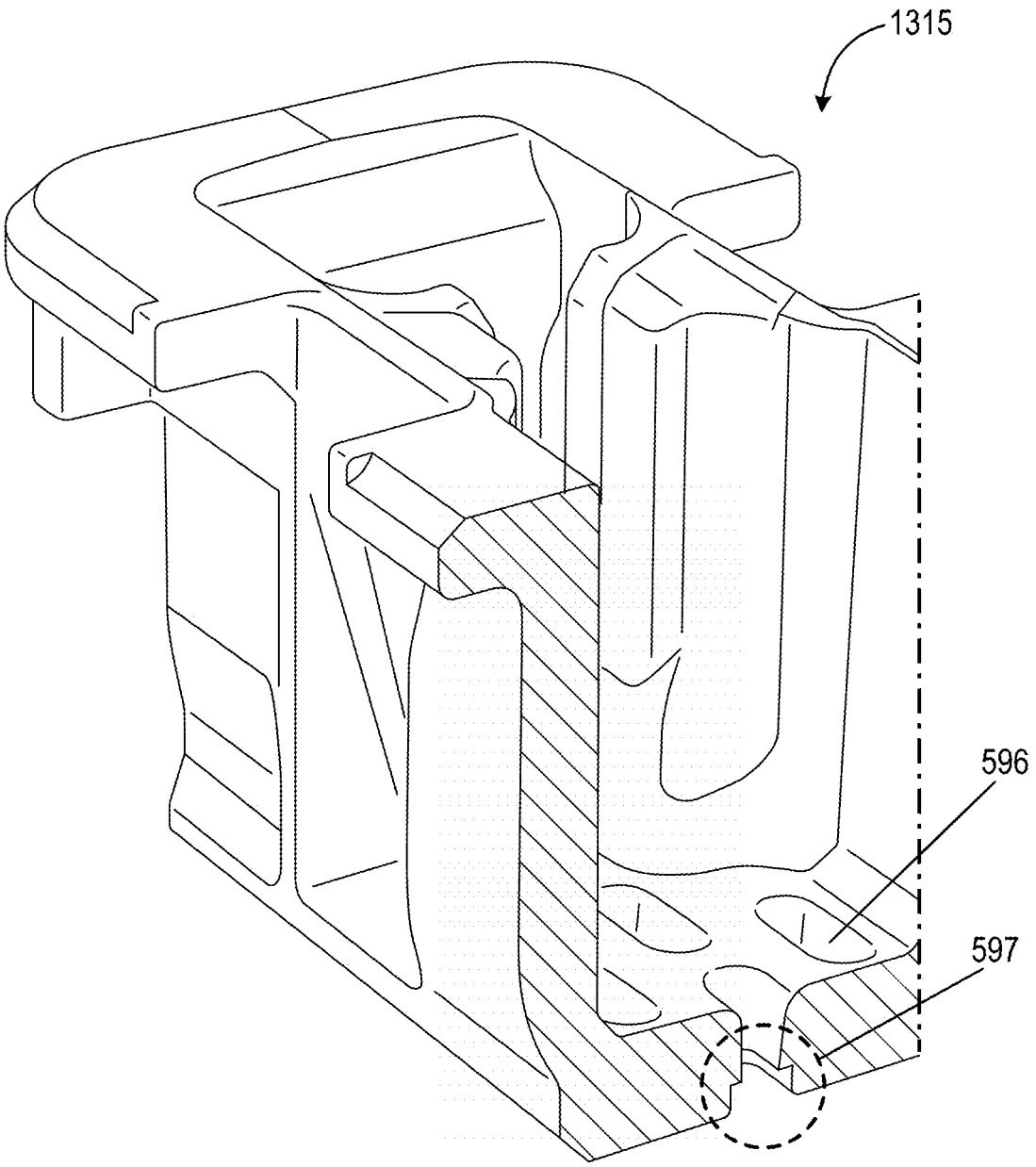
FIG. 50A depicts a cross-sectional view of a wick housing consistent with implementations of the current subject matter.
Figure 50B:
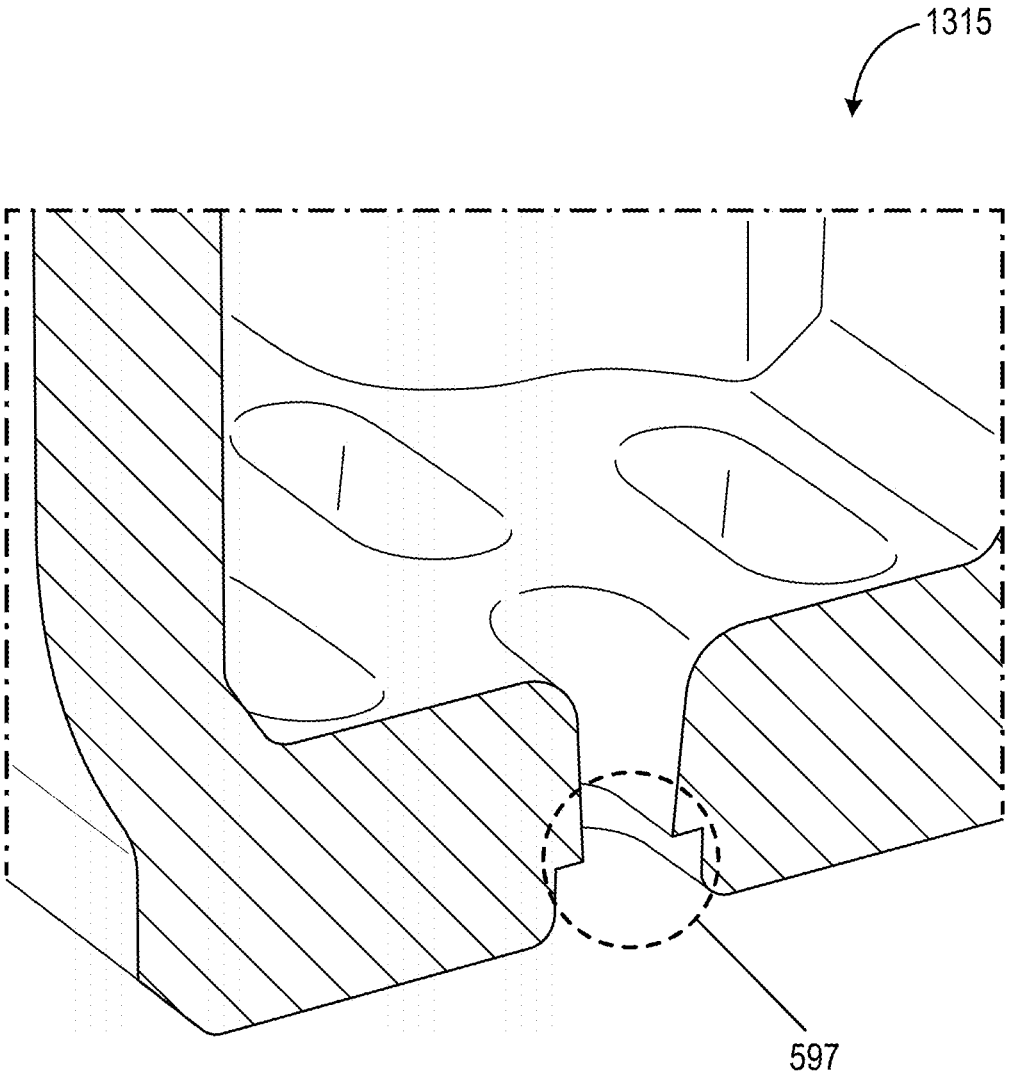
FIG. 50B depicts another cross-sectional view of a wick housing consistent with implementations of the current subject matter.

To prevent the vaporizable material 1302 that are present in the wick housing 1315, for example, the vaporizable material 1302 drawn into the wicking element 1362, from flowing out of the wick housing 1315, the interior dimensions (e.g., cross-sectional area, diameter, width, length, and/or the like) of the slots 596 may be stepped in order to provide, for example, one or more constriction points at which a meniscus may form to prevent the further egress of the vaporizable material 1302. To further illustrate, FIGS. 50A-B depict cross-sectional views of the wick housing 1315 consistent with implementations of the current subject matter. As shown in FIGS. 50A-B, the slots 596 may be stepped in that an inner dimension of the slots 596 may be less than the dimensions of the slots 596 at a bottom of the wick housing 1315 such that the interior of the slots 596 exhibits at least one step.

In some implementations of the current subject matter, the dimensions of the slots 596 at the bottom of the wick housing 1315 may be between 1.0-1.4 millimeters long by 0.3-0.7 millimeters wide. For example, the slots 596 may be 1.2 millimeters long by 0.5 millimeters wide at the bottom of the wick housing 1315 but may exhibit a stepped interior such that the inner dimensions of the slots are approximately 1.0 millimeters long by 0.3 millimeters wide. The step may provide a constriction point at which a meniscus may form to prevent a further egress of the vaporizable material 1302 out of the slots 596. In particular, maintaining an air-liquid interface within the stepped interiors of the slots 596 may prevent the liquid vaporizable material 1302 from breaching the bottom of the wick housing 1315 and contaminating an external environment, including, for example, the vaporizer body 110 at locations (e.g., the cartridge receptacle 118) proximate to where the vaporizer cartridge 1320 couples with the vaporizer body 110.

Figure 12B:
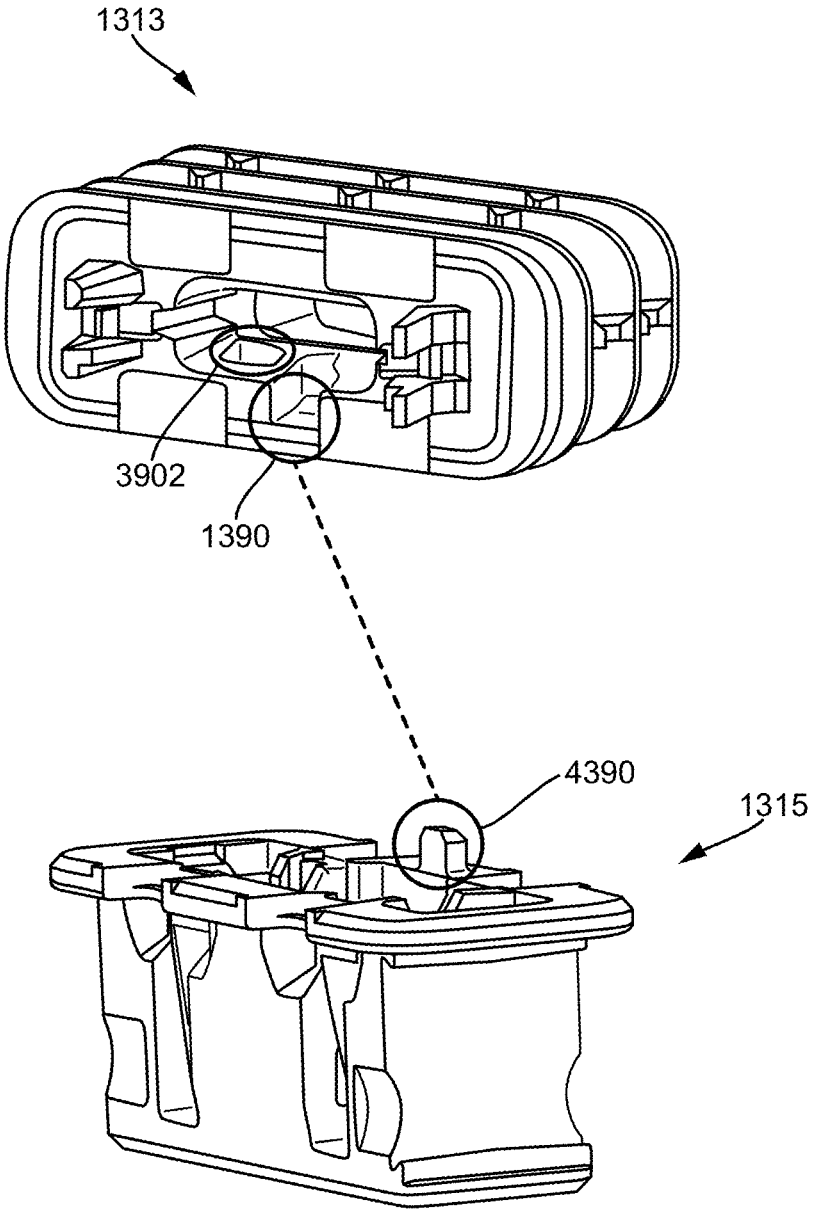
FIG. 12B depicts perspective views of an example of a collector and wick housing consistent with implementations of the current subject matter.

FIG. 12B depicts perspective view of the collector 1313 and the wick housing 1315, which may be coupled, for example, to form at least a portion of the cartridge 1320. As shown, the wick housing 1315 (which includes the wick-housing portion of the cartridge) may be implemented to include one or more protruding members or tabs 4390. The tab 4390 may be configured to extend from the upper end of the wick housing 1315, which during assembly mates with a receiving end of the collector 1313. The tab 4390 may include one or more facets that correspond to or match one or more facets in a receiving notch or receiving cavity 1390 in, for example, the bottom portion of the collector 1313. The receiving cavity 1390 may be configured to removably receive the tab 4390 for a snap-fit engagement, for example. The snap-fit arrangement may assist with holding the collector 1313 and the wick housing 1315 together during or after assembly.

In certain embodiments, the tab 4390 may be utilized to direct the orientation of the wick housing 1315 during assembly. For example, in one embodiment one or more vibrating mechanisms (e.g., vibrating bowls) may be utilized to temporarily store or stage the various components of the cartridge 1320. According to some implementations, the tab 4390 may be helpful in orienting the upper portion of the wick housing 1315 for a mechanical gripper for the purpose of easy engagement and correct automated assembly.

In some implementations of the current subject matter, the collector 1313 may include one or more features configured to encourage a mixing of the vaporized vaporizable material 1302 in the airflow passageway 1338. As noted, the central tunnel 1100 may traverse the collector 1313 to form a fluid connection between the airflow passageway 1338 and the wick housing 1315 in which the heating element 1350 and the wicking element 1362 are disposed. Accordingly, aerosol generated by the heating element 1350 heating the vaporizable material 1302 drawn into the wicking element 1362 may travel from the wick housing 1315 into the central tunnel 1100 in the collector 1313 before flowing into the airflow passageway 1338 for delivery to the user. To encourage mixing of the vaporized vaporizable material 1302 as the vaporized vaporizable material 1302 travels through the central tunnel 1100 and the airflow passageway 1338, the bottom surface of the collector 1313, which serves as an interface between the collector 1313 and the wick housing 1315, may include one or more features configured to direct the flow of the vaporized vaporizable material 1302.

To further illustrate, FIGS. 52A-E depicts the collector 1313 with an example of a flow controller 5220 consistent with implementations of the current subject matter. Referring to FIGS. 52A-E, the collector 1313 may include, on its bottom surface, the flow controller 5220. The bottom surface of the collector 1313 may further include one or more coupling mechanisms for securing the collector 1313 to the wick housing 1315 including, for example, a first coupling mechanism 5210*a* and a second coupling mechanism 5210*b*. The first coupling mechanism 5210*a* and the second coupling mechanism 5210*b* may be male connectors (e.g., forks) that are configured to be inserted into and frictionally engage with corresponding female connectors (e.g., receptacles) in the wick housing 1315. In the example of the collector 1313 shown in FIGS. 52A-E, the bottom surface of the collector 1313 may further include one or more wick interfaces including, for example, a first wick interface 5230*a* and a second wick interface 5230*b*. The first wick interface 5230*a* and the second wick interface 5230*b* may be coupled with the wick feeds 1368. For instance, the first wick interface 5230*a* may be disposed between an end of a first wick feed 1368*a* and the wick housing 1315 while the second wick interface 5230*b* may be disposed between an end of a second wick feed 1368*b* and the wick housing 1315. The first wick interface 5230*a* and the second wick interface 5230*b* may each be configured to serve as a conduit for delivering, to the wicking element 1360 disposed in the wick housing 1315, at least a portion of the vaporizable material 1302 flowing through the wick feeds 1368.

Referring again to FIGS. 52A-E, the flow controller 5220 may be fluidically coupled with the central tunnel 1100, which is in turn in fluid communication with the airflow passageway 1338. In some implementations of the current subject matter, the flow controller 5220 may be configured to direct the flow of the vaporized vaporizable material 1302 in a manner that encourages the mixing of the vaporized vaporizable material 1302 in the central tunnel 1100 and/or the airflow passageway 1338. Mixing of the vaporized vaporizable material 1302 may be desirable for a variety of reasons including, for example, to regulate a temperature and/or a distribution of the vaporized particulates in the aerosol delivered to the user.

In some implementations of the current subject matter, the flow controller 5220 may include one or more channels including, for example, a first channel 5225*a* and a second channel 5225*b*. In the example of the collector 1313 shown in FIGS. 52A-E, the relative positions of the first channel 5225*a* and the second channel 5225*b* may be offset (or staggered) such that a first opening of the first channel 5225*a* into the central tunnel 1100 is at least partially offset from a second opening of the second channel 5226*b* into the central tunnel 1100. Moreover, the first channel 5225*a* and the second channel 5225*b* may be tapered, for example, to form separate funnel-like structures. The cross-sectional dimensions of the first channel 5225*a* and the second channel 5225*b* may also taper towards the end where the first channel 5225*a* and the second channel 5225*b* meet the central tunnel 1100. For example, the first channel 5225*a* and the second channel 5225*b* may each taper from 2.62 millimeters by 5.85 millimeters (at a bottom of the collector 1313) to 1.35 millimeters by 0.70 millimeters over a height of approximately 2.25 millimeters. Moreover, the interior walls of the first channel 5225*a* and the second channel 5225*b* may be sloped toward a center of the central tunnel 1100. Accordingly, the first channel 5225*a* and the second channel 5225*b* may each form, from the vaporized vaporizable material 1302 entering the flow controller 5220 from the wick housing 1315, a separate column of the vaporized vaporizable material 1302.

Moreover, each column of the vaporized vaporizable material 1302 may flow in a direction that is offset by the sloped interior contours of the first channel 5225*a* and the second channel 5225*b*. For example, instead of traveling straight up towards the airflow passageway 1338, the columns of the vaporized vaporizable material 1302 may be directed towards the walls of the central tunnel 1100 and the airflow passageway 1338. That is, the flow controller 5220 may be configured to disrupt the laminar flow of the vaporized vaporizable material 1302 in which layers of the vaporized vaporizable material 1302, each of which traveling at its own velocity and having its own temperature, travel independently without any disruption or comingling between the layers. Lateral mixing between the layers of the vaporized vaporizable material 1302 in a laminar flow may be minimal as well as slow (e.g., through diffusion mixing). As such, without the disruption introduced by the flow controller 5220, the vaporized vaporizable material 1302 may fail to undergo sufficient mixing before existing the airflow passageway 1338 for delivery to the user.

Contrastingly, because the first channel 5225*a* and the second channel 5225*b* are configured to offset the flow of the vaporized vaporizable material 1302, the flow controller 5220 may introduce turbulent flow into the vaporized vaporizable material 1302 passing through the flow controller 5220. For example, offsetting the flow direction of the vaporized vaporizable material 1302 may force each column of the vaporized vaporizable material 1302 to interact with the walls of the central tunnel 1100 and the airflow passageway 1338 as well as with each other. These interactions may disrupt the layers of the vaporized vaporizable material 1302 traveling at different velocities and having different temperatures to encourage a mixing of the layers of the vaporized vaporizable material 1302.

Figure 52A:
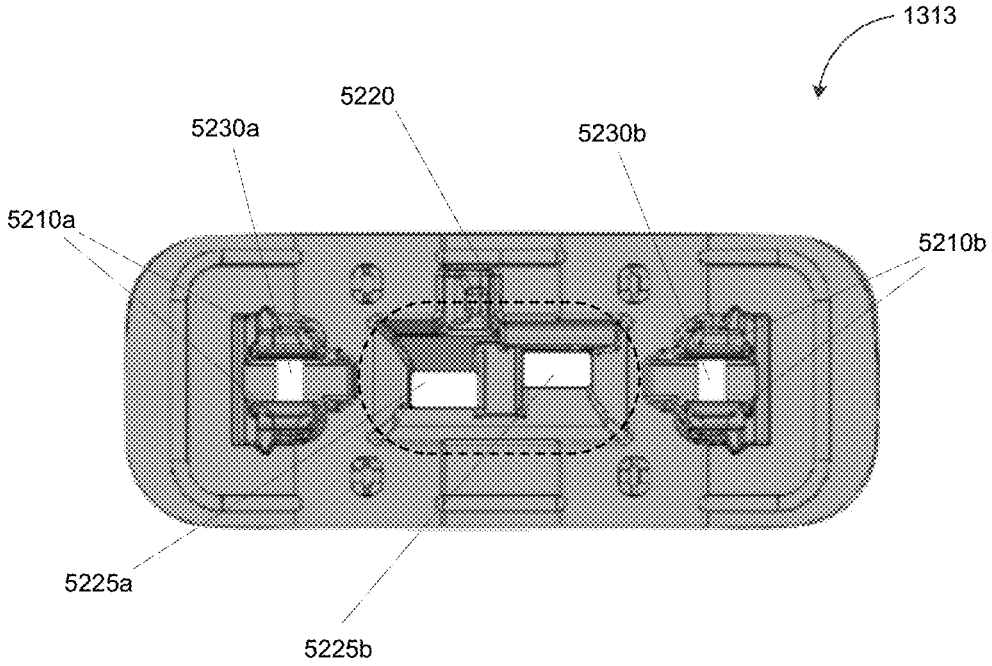
FIG. 52A depicts a bottom view of an example of a collector consistent with implementations of the current subject matter.
Figure 52B:
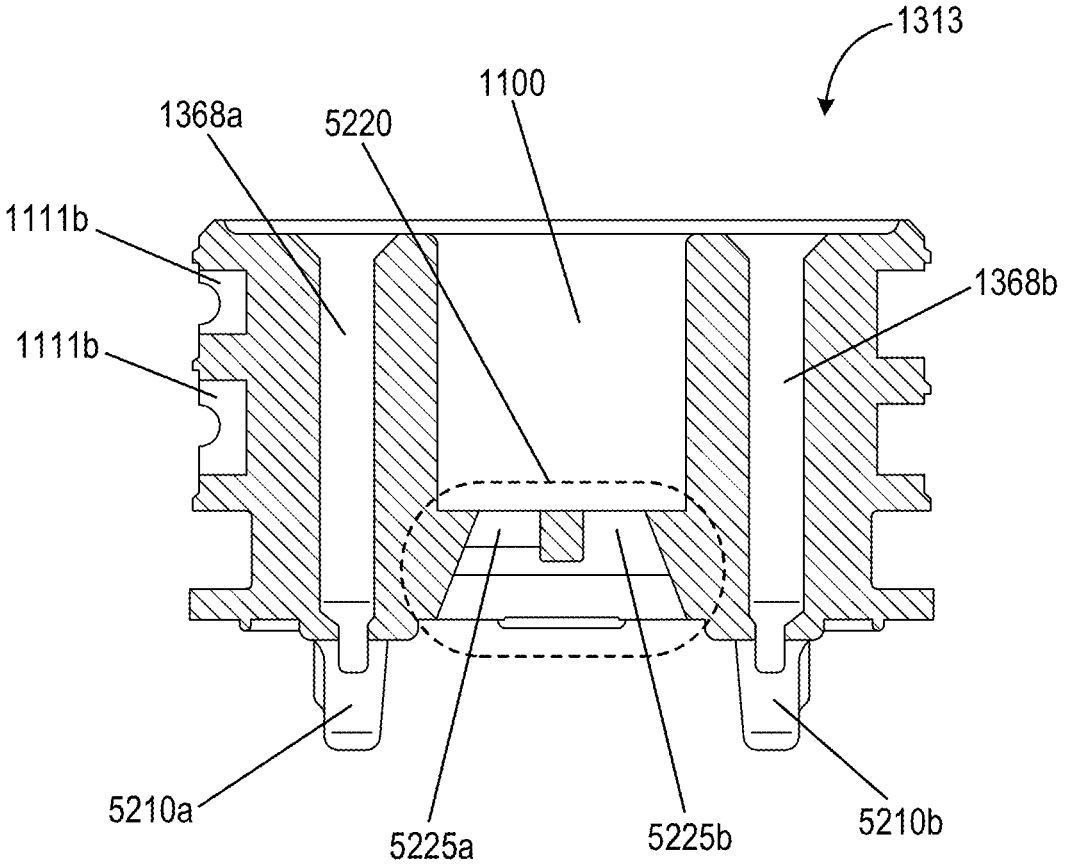
FIG. 52B depicts a front cross-sectional view of an example of a collector consistent with implementations of the current subject matter.
Figure 52C:
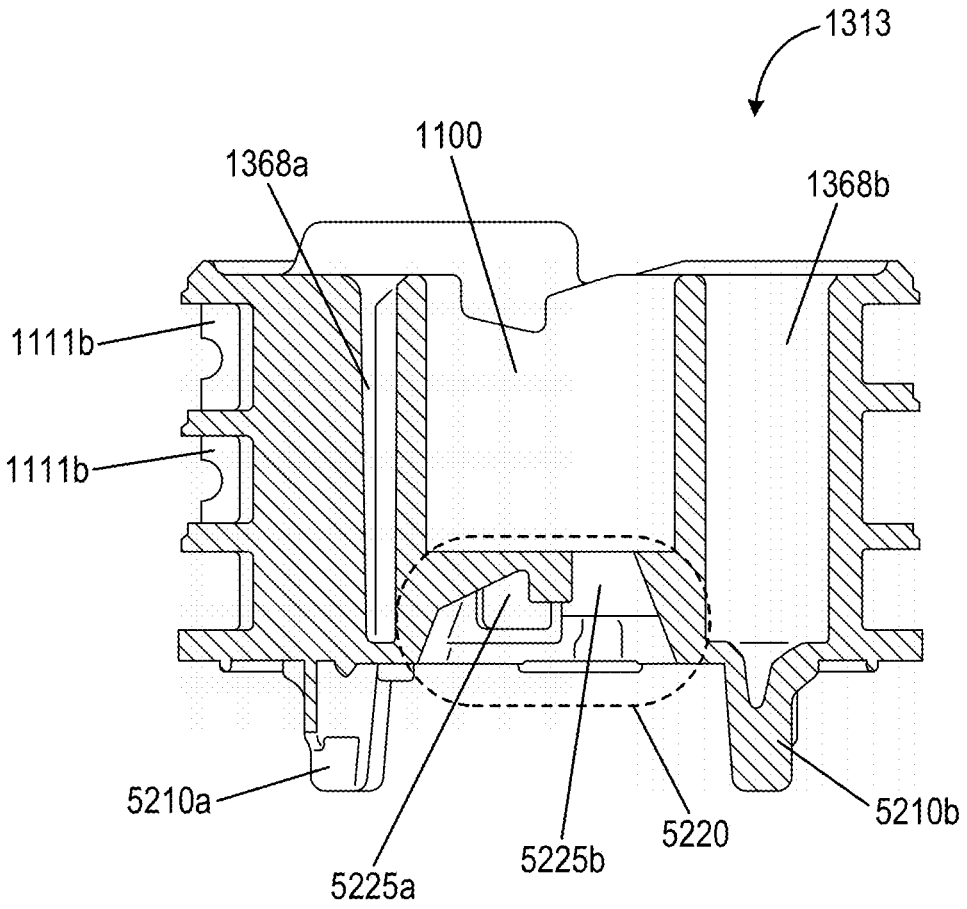
FIG. 52C depicts another front cross-sectional view of an example of a collector consistent with implementations of the current subject matter.
Figure 52D:
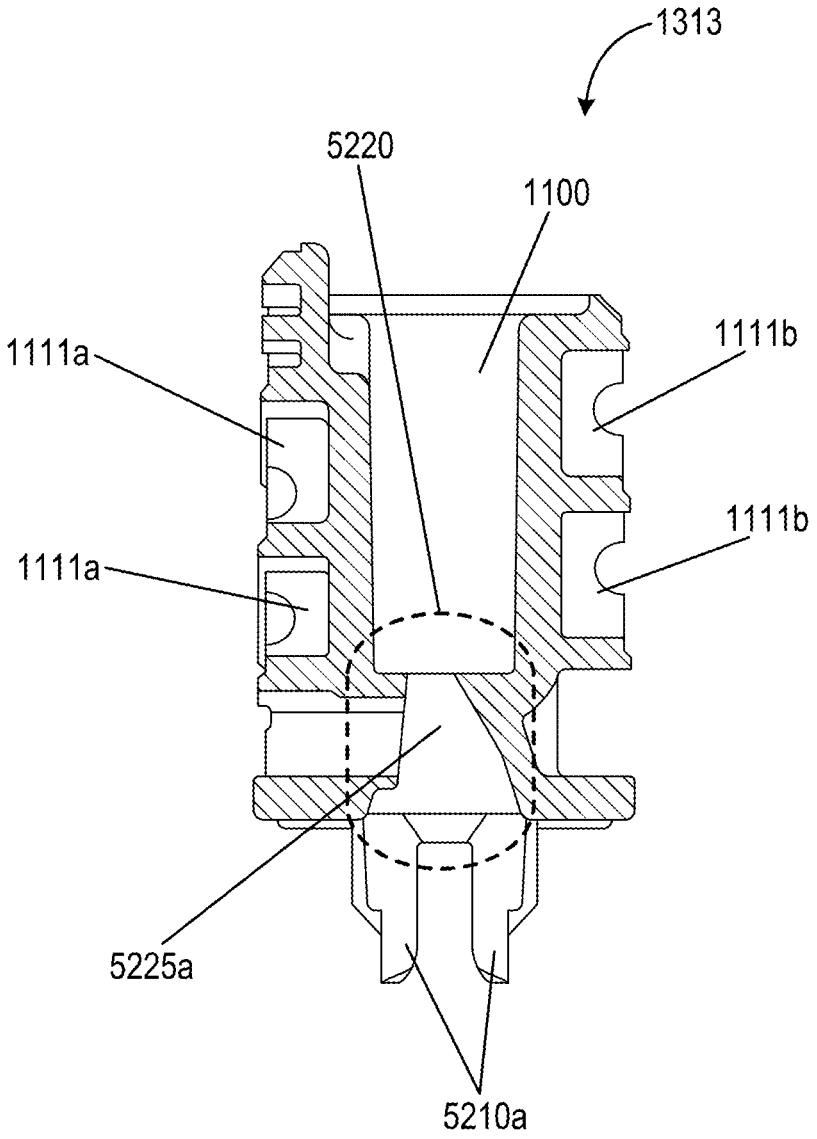
FIG. 52D depicts a side cross-sectional view of an example of a collector consistent with implementations of the current subject matter.
Figure 52E:
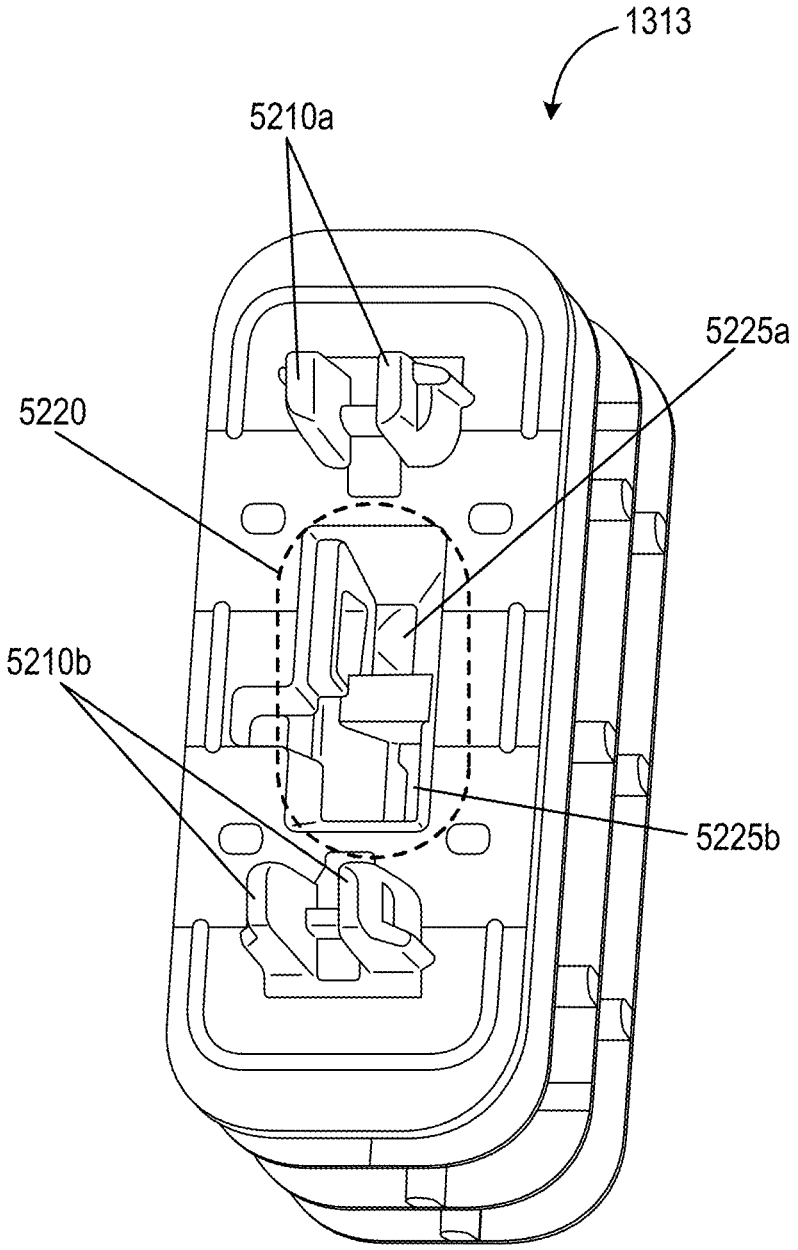
FIG. 52E depicts a perspective view of an example of a collector consistent with implementations of the current subject matter.
Figure 52F:
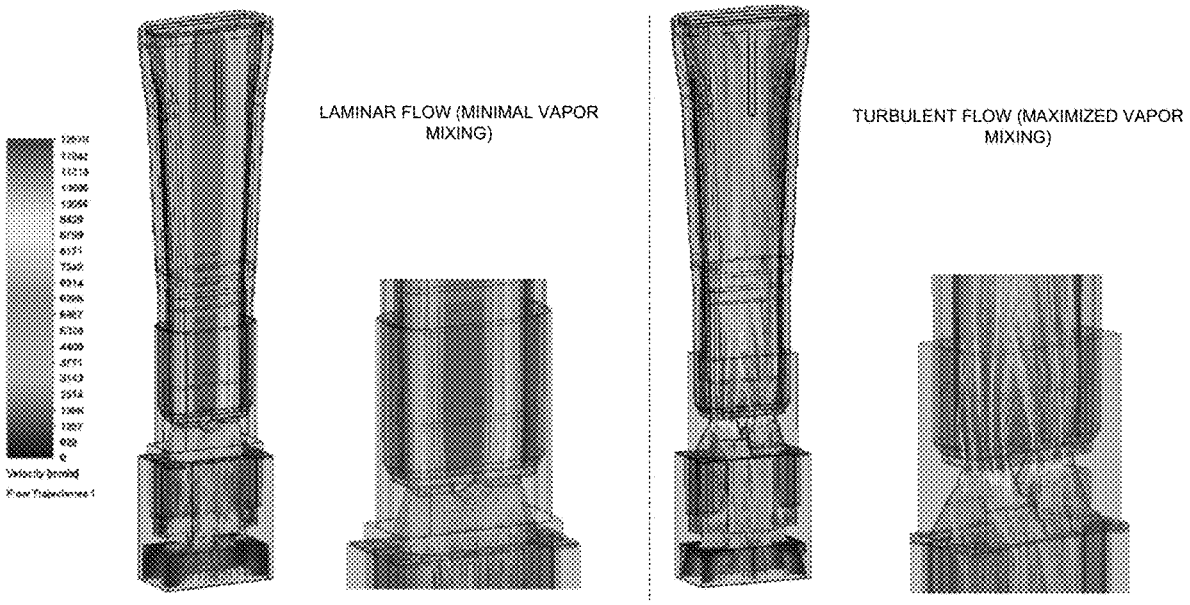
FIG. 52F depicts an example of laminar flow and an example of turbulent flow consistent with implementations of the current subject matter.

To further illustrate, FIG. 52F depicts an example of laminar flow and an example of turbulent flow through the central tunnel 1100 and the airflow passageway 1338. On the left of FIG. 52F, the columns of the vaporized vaporizable material 1302 remain separate as the columns of the vaporized vaporizable material 1302 travels through the central tunnel 1100 and the airflow passageway 1338. As such, the vaporized vaporizable material 1302 maintains a substantially laminar flow in which minimal mixing occurs between the layers of the vaporized vaporizable material 1302. Contrastingly, on the right of FIG. 52F, the flow controller 5220 introduced turbulent flow into the vaporized vaporizable material 1302 including by offsetting the flow direction of the columns of the vaporized vaporizable material 1302 such that the columns of the vaporized vaporizable material 1302 interact with the walls of the central tunnel 1100 and the airflow passageway 1338 as well as each other. As noted, turbulent flow of the vaporized vaporizable material 1302 may encourage a mixing of the different layers of the vaporized vaporizable material 1302 such that the resulting aerosol delivered to the user may exhibit more homogeneity in temperature and/or distribution of vaporized particulates.

As noted above, the vaporizer cartridge 1320 consistent with implementations of the current subject matter may include one or more heating elements such as, for example, the heating element 1350. According to some implementations of the current subject matter, the heating element 1350 may desirably be shaped to receive the wicking element 1362 and/or crimped or pressed at least partially around the wicking element 1362. The heating element 1350 may be bent such that the heating element 1350 is configured to secure the wicking element 1362 between at least two or three portions of the heating element 1350. The heating element 1350 may be bent to conform to a shape of at least a portion of the wicking element 1362. The heating element 1350 may be manufactured more easily than typical heating elements. The heating element consistent with implementations of the current subject matter may also be made of an electrically conductive metal suitable for resistive heating and in some implementations, the heating element may include selective plating of another material to allow the heating element (and thus, the vaporizable material) to be more efficiently heated.

Figure 13C:
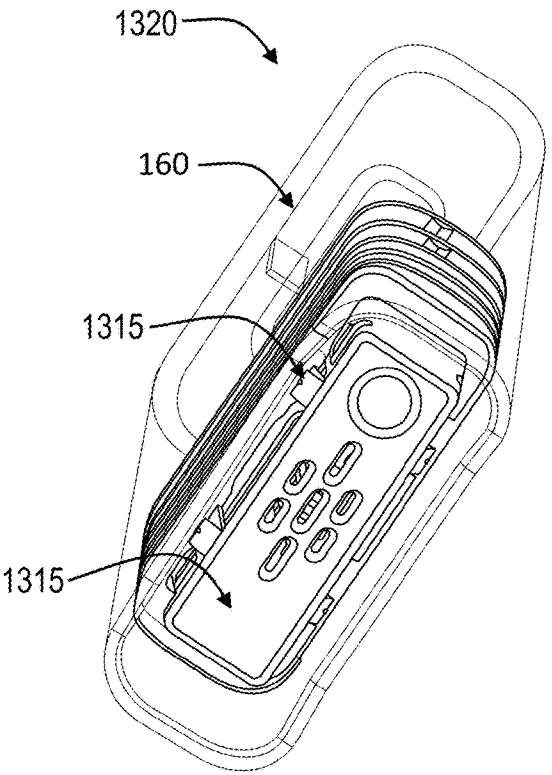
FIG. 13C depicts a bottom perspective view of an example of a cartridge consistent with implementations of the current subject matter.
Figure 13B:
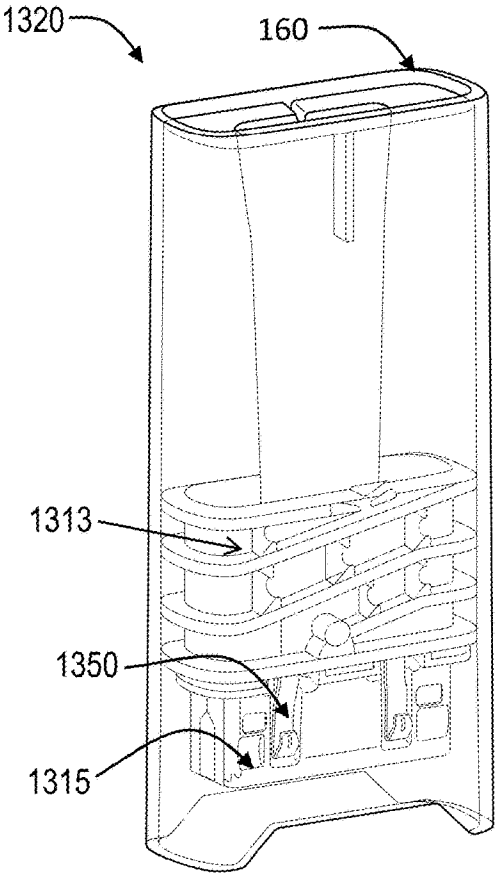
FIG. 13B depicts a top perspective view of an example of a cartridge consistent with implementations of the current subject matter.
Figure 13A:
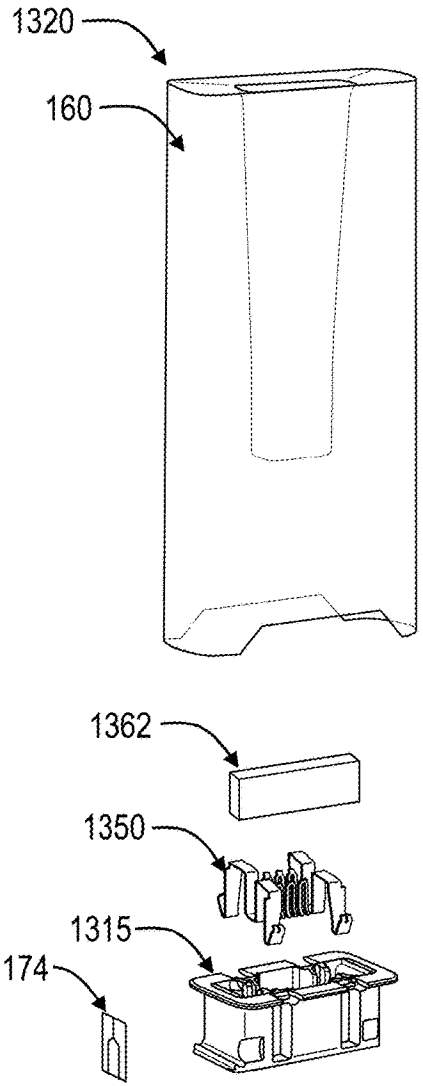
FIG. 13A depicts a perspective exploded view of an example of a cartridge consistent with implementations of the current subject matter.

FIG. 13A illustrates an exploded view of an example of the vaporizer cartridge 1320, FIG. 13B depicts a perspective view of an embodiment of the vaporizer cartridge 1320, and FIG. 13C depicts a bottom perspective view of an example of the vaporizer cartridge 1320. As shown in FIGS. 44A-C, the vaporizer cartridge 1320 may include a housing 160 that is configured to accommodate the collector 1313, the wick housing 1315, and the heating element 1350 (disposed at least partially inside the wicking housing 1315). In some implementations of the current subject matter, the wick housing 1315, the heating element 1350, and the wicking element 1362 may form the atomizer assembly 141 shown in FIG. 1.

As explained in more detail below, at least a portion of the heating element 1350 is positioned between the housing 160 and the wick housing 1315 and is exposed to be coupled with a portion of the vaporizer body 110 (e.g., electrically coupled with the receptacle contacts 125). The wick housing 1315 may include four sides. For example, the wick housing 1315 may include two opposing short sides and two opposing long sides. The two opposing long sides may each include at least one (two or more) recess. The recesses may be positioned along the long side of the wick housing 1315 and adjacent to respective intersections between the long sides and the short sides of the wick housing 1315. The recesses may be shaped to releasably couple with a corresponding feature (e.g., a spring) on the vaporizer body 110 to secure the vaporizer cartridge 1320 to the vaporizer body 110 within the cartridge receptacle 118. The recesses provide a mechanically stable securement means to couple the vaporizer cartridge 1320 to the vaporizer body 110.

In some implementations, the wick housing 1315 also includes an identification chip 174, which may be configured to communicate with a corresponding chip reader located on the vaporizer. The identification chip 174 may be glued and/or otherwise adhered to the wick housing 1315, such as on a short side of the wick housing 1315. The wick housing 1315 may additionally or alternatively include a chip recess that is configured to receive the identification chip 174. The chip recess may be surrounded by two, four, or more walls. The chip recess may be shaped to secure the identification chip 174 to the wick housing 1315.

Figure 14:
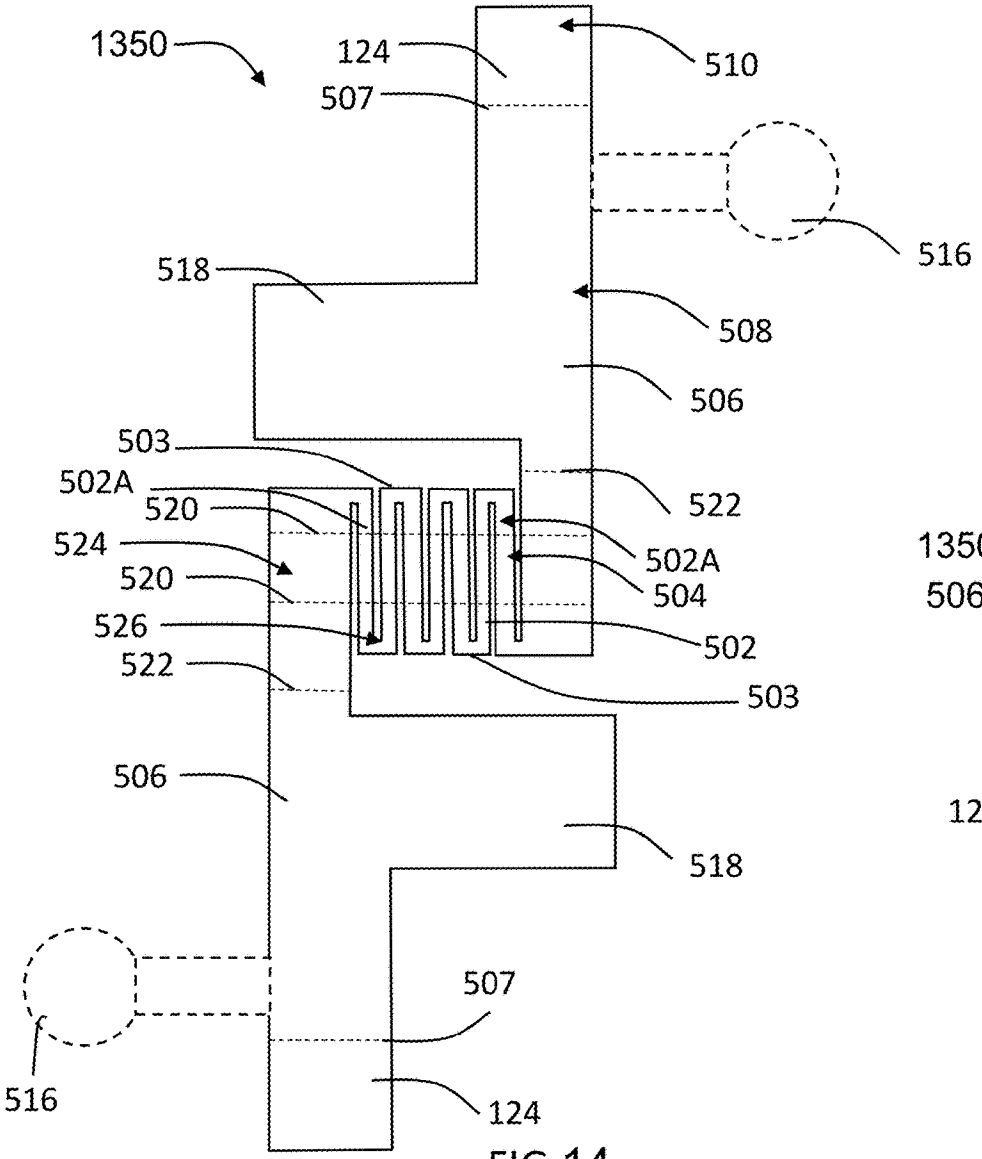
FIG. 14 depicts a schematic view of a heating element for use in a vaporizer device consistent with implementations of the current subject matter.
Figure 17:
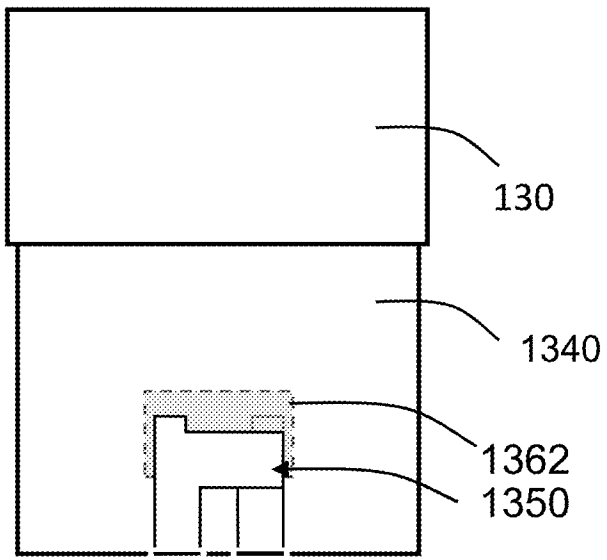
FIG. 17 depicts a schematic view of a heating element positioned in a vaporizer cartridge for use in a vaporizer device consistent with implementations of the current subject matter.
Figure 16:
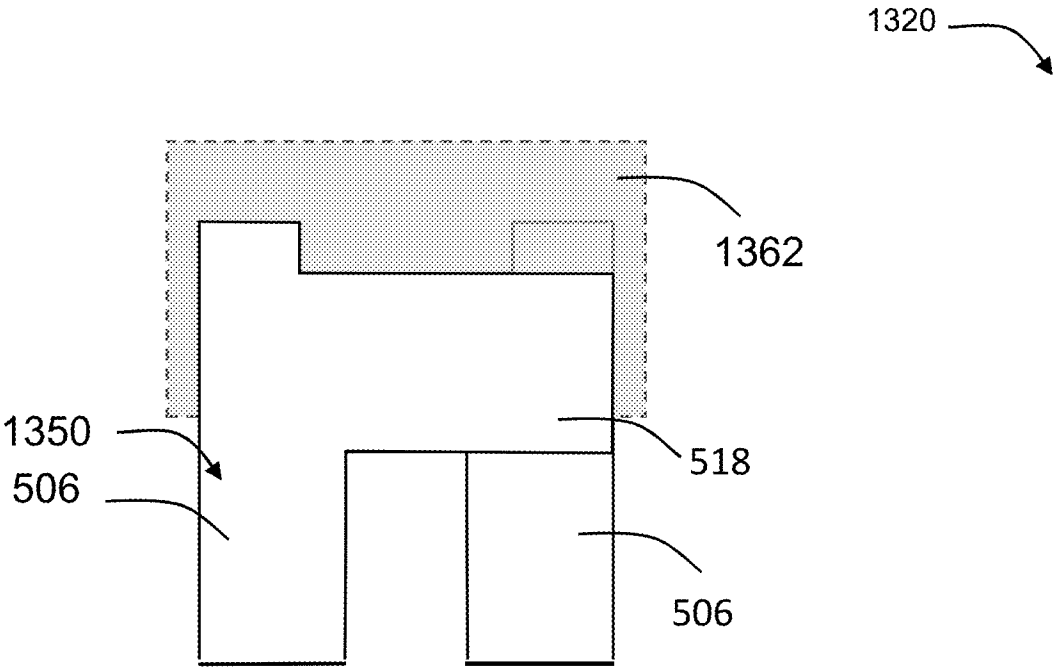
FIG. 16 depicts a schematic view of a heating element for use in a vaporizer device consistent with implementations of the current subject matter.
Figure 18B:
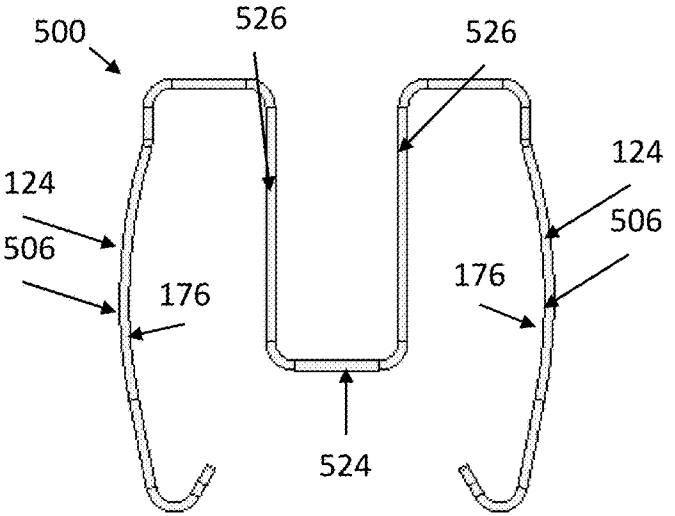
FIG. 18B depicts a side view of a heating element consistent with implementations of the current subject matter.
Figure 18C:
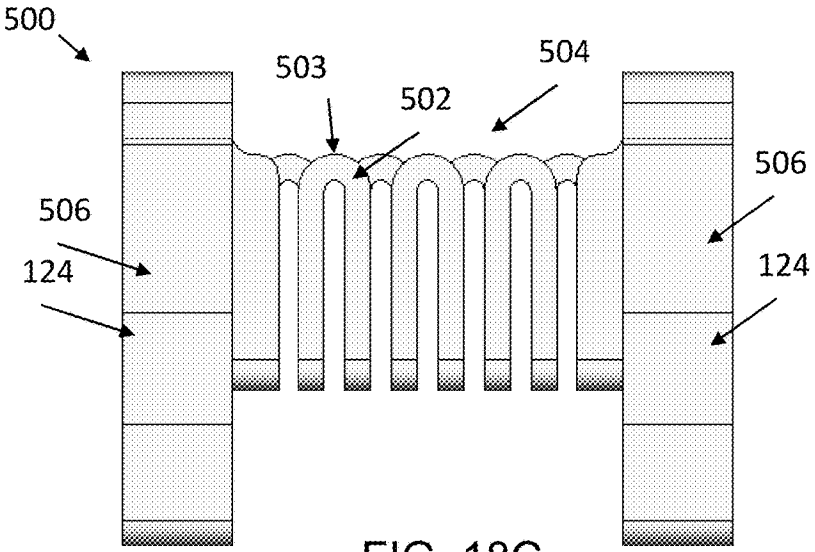
FIG. 18C depicts a frontal view of a heating element consistent with implementations of the current subject matter.
Figure 18A:
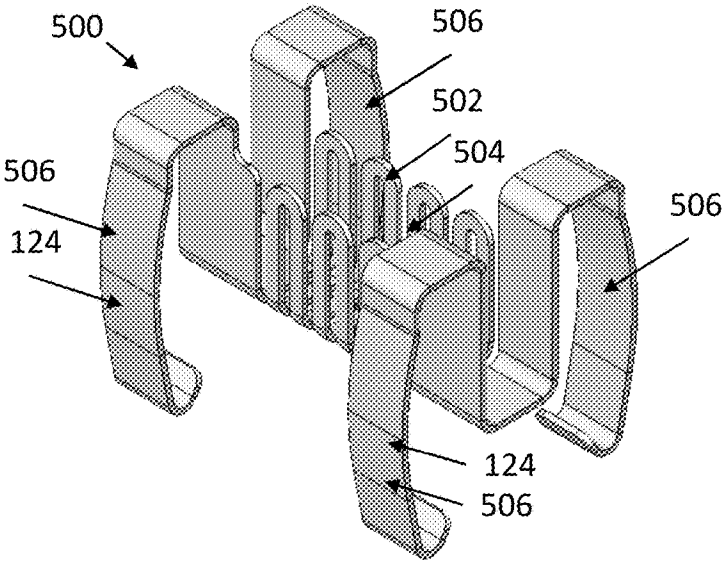
FIG. 18A depicts a perspective view of a heating element consistent with implementations of the current subject matter.
Figure 18D:
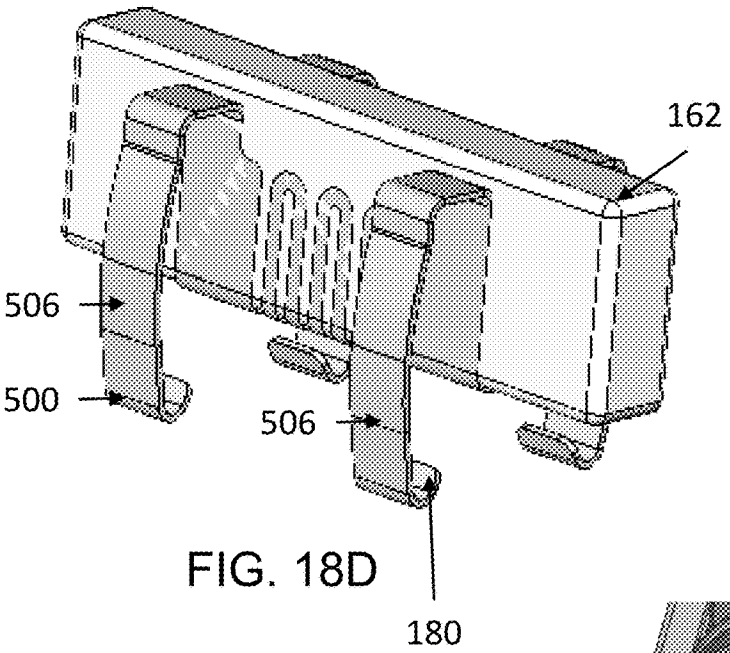
FIG. 18D depicts a perspective view of a heating element and a wicking element consistent with implementations of the current subject matter.
Figure 18E:
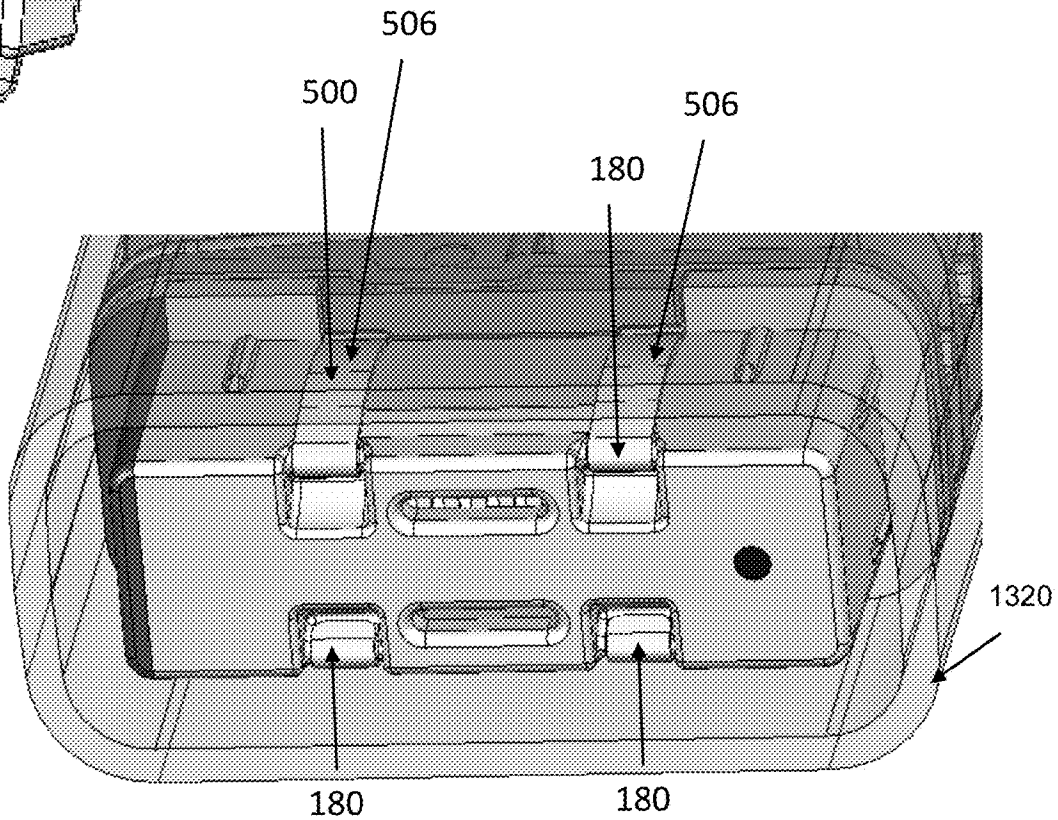
FIG. 18E depicts a bottom perspective view of a wick housing including a heating element consistent with implementations of the current subject matter.
Figure 19:
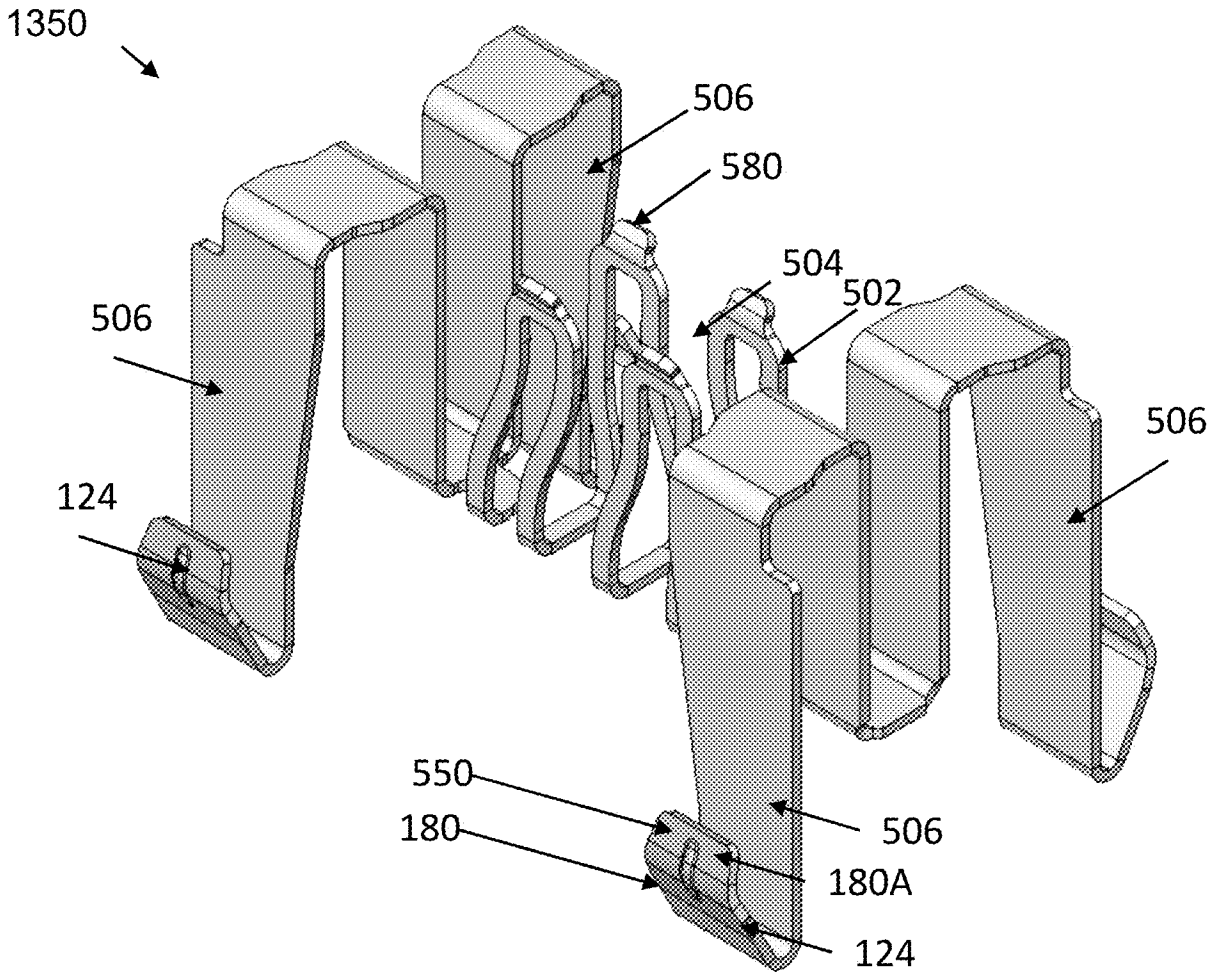
FIG. 19 depicts a perspective view of a heating element in a bent position consistent with implementations of the current subject matter.
Figure 20:
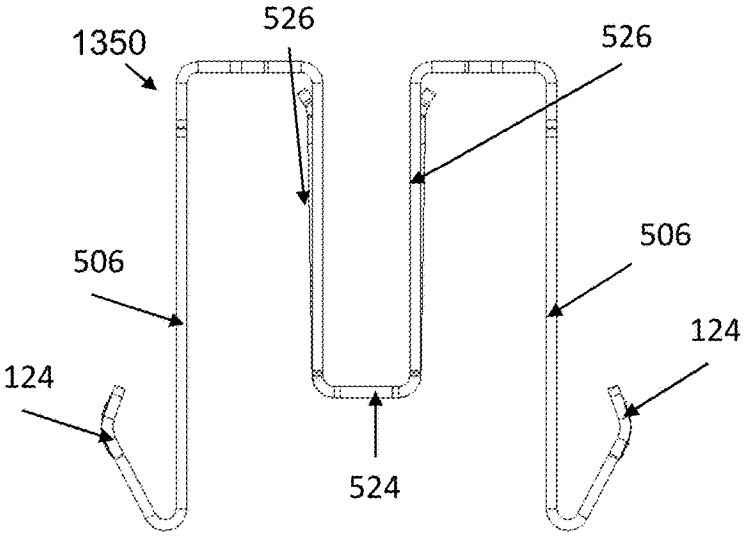
FIG. 20 depicts a side view of a heating element in a bent position consistent with implementations of the current subject matter.
Figure 21:
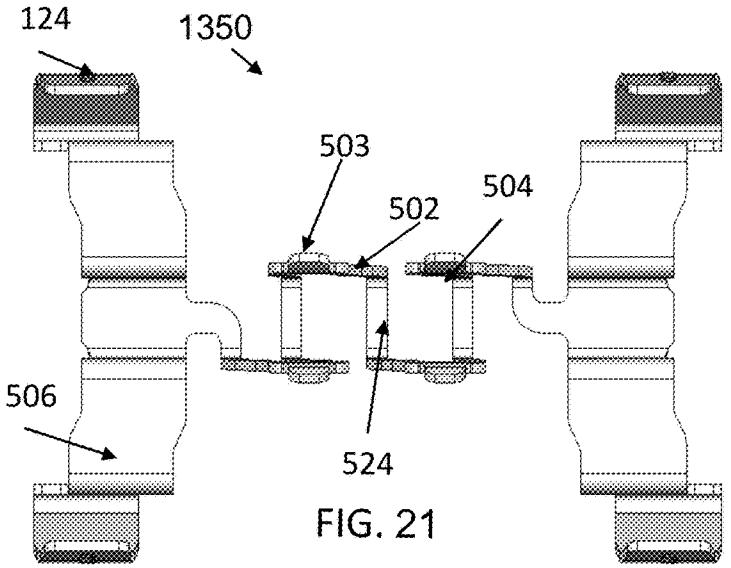
FIG. 21 depicts a top view of a heating element in a bent position consistent with implementations of the current subject matter.
Figure 22:
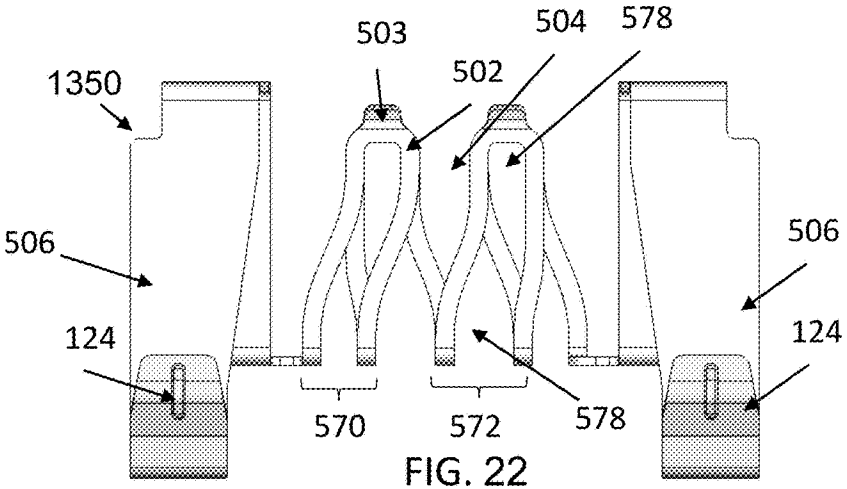
FIG. 22 depicts a front view of a heating element in a bent position consistent with implementations of the current subject matter.

FIGS. 14-17 illustrate schematic views of a heating element 1350 consistent with implementations of the current subject matter. For example, FIG. 14 illustrates a schematic view of a heating element 1350 in an unfolded position. As shown, in the unfolded position, the heating element 1350 forms a planar heating element. The heating element 1350 may be initially formed of a substrate material. The substrate material is then cut and/or stamped into the proper shape via various mechanical processes, including but not limited to stamping, laser cutting, photo-etching, chemical etching, and/or the like.

The substrate material may be made of an electrically conductive metal suitable for resistive heating. In some implementations, the heating element 1350 includes a nickel-chromium alloy, a nickel alloy, stainless steel, and/or the like. As discussed below, the heating element 1350 may be plated with a coating in one or more locations on a surface of the substrate material to enhance, limit, or otherwise alter the resistivity of the heating element in the one or more locations of the substrate material (which can be all or a portion of the heating element 1350).

The heating element 1350 includes one or more tines 502 (e.g., heating segments) located in a heating portion 504, one or more connecting portions or legs 506 (e.g., one, two, or more) located in a transition region 508, and a cartridge contact 124 located in an electrical contact region 510 and formed at an end portion of each of the one or more legs 506. The tines 502, the legs 506, and the cartridge contacts 124 may be integrally formed. For example, the tines 502, the legs 506, and the cartridge contacts 124 form portions of the heating element 1350 that is stamped and/or cut from the substrate material. In some implementations, the heating element 1350 also includes a heat shield 518 that extends from one or more of the legs 506 and also may be integrally formed with the tines 502, the legs 506, and the cartridge contacts 124.

In some implementations, at least a portion of the heating portion 504 of the heating element 1350 is configured to interface with the vaporizable material drawn into the wicking element from the reservoir 1340 of the vaporizer cartridge 1320. The heating portion 504 of the heating element 1350 may be shaped, sized, and/or otherwise treated to create a desired resistance. For example, the tines 502 located in the heating portion 504 may be designed so that the resistance of the tines 502 matches the appropriate amount of resistance to influence localized heating in the heating portion 504 to more efficiently and effectively heat the vaporizable material from the wicking element. The tines 502 form thin path heating segments or traces in series and/or in parallel to provide the desired amount of resistance.

The tines 502 (e.g., traces) may include various shapes, sizes, and configurations. In some configurations, one or more of the tines 502 may be spaced to allow the vaporizable material to be wicked out of the wicking element and from there, vaporized off side edges of each of the tines 502. The shape, length, width, composition, etc., among other properties of the tines 502 may be optimized to maximize the efficiency of generating an aerosol by vaporizing vaporizable material from within the heating portion of the heating element 1350 and to maximize electrical efficiency. The shape, length, width, composition, etc., among other properties of the tines 502 may additionally or alternatively be optimized to uniformly distribute heat across the length of the tines 502 (or a portion of the tines 502, such as at the heating portion 504). For example, the width of the tines 502 may be uniform or variable along a length of the tines 502 to control the temperature profile across at least the heating portion 504 of the heating element 1350. In some examples, the length of the tines 502 may be controlled to achieve a desired resistance along at least a portion of the heating element 1350, such as at the heating portion 504. As shown in FIGS. 45-48, the tines 502 each have the same size and shape. For example, the tines 502 include an outer edge 503 that is approximately aligned and have a generally rectangular shape, with flat or squared outer edges 503 or rounded outer edges 503. In some implementations, one or more of the tines 502 may include outer edges 503 that are not aligned and/or may be differently sized or shaped. In some implementations, the tines 502 may be evenly spaced or have variable spacing between adjacent tines 502. The particular geometry of the tines 502 may be desirably selected to produce a particular localized resistance for heating the heating portion 504, and to maximize performance of the heating element 1350 to heat the vaporizable material and generate an aerosol.

The heating element 1350 may include portions of wider and/or thicker geometry, and/or differing composition relative to the tines 502. These portions may form electrical contact areas and/or more conductive parts, and/or may include features for mounting the heating element 1350 within the vaporizer cartridge. The legs 506 of the heating element 1350 extend from an end of each outermost tine 502A. The legs 506 form a portion of the heating element 1350 that has a width and/or thickness that is typically wider than a width of each of the tines 502. Though, in some implementations, the legs 506 have a width and/or thickness that is the same as or narrower than the width of each of the tines 502. The legs 506 couple the heating element 1350 to the wick housing 1315 or another portion of the vaporizer cartridge 1320, so that the heating element 1350 is at least partially or fully enclosed by the housing 160. The legs 506 provide rigidity to encourage the heating element 1350 to be mechanically stable during and after manufacturing. The legs 506 also connect the cartridge contacts 124 with the tines 502 located in the heating portion 504. The legs 506 are shaped and sized to allow the heating element 1350 to maintain the electrical requirements of the heating portion 504. As shown in FIG. 18, the legs 506 space the heating portion 504 from an end of the vaporizer cartridge 1320 when the heating element 1350 is assembled with the vaporizer cartridge 1320. The legs 506 may also include a capillary feature configured to limit and/or prevent the vaporizable material 1302 from flowing out of the heating portion 504 to other portions of the heating element 1350.

In some implementations, one or more of the legs 506 includes one or more locating features 516. The locating features 516 may be used for relative locating of the heating element 1350 or portions thereof during and/or after assembly by interfacing with other (e.g., adjacent) components of the vaporizer cartridge 1320. In some implementations, the locating features 516 may be used during or after manufacturing to properly position the substrate material for cutting and/or stamping the substrate material to form the heating element 1350 or post-processing of the heating element 1350. The locating features 516 may be sheared off and/or cut off before crimping or otherwise bending the heating element 1350.

In some implementations, the heating element 1350 includes one or more heat shields 518. The heat shields 518 form a portion of the heating element 1350 that extends laterally from the legs 506. When folded and/or crimped, the heat shields 518 are positioned offset in a first direction and/or a second direction opposite the first direction in the same plane from the tines 502. When the heating element 1350 is assembled in the vaporizer cartridge 1320, the heat shields 518 are configured to be positioned between the tines 502 (and the heating portion 504) and the body (e.g., plastic body) of the vaporizer cartridge 1320. The heat shields 518 can help to insulate the heating portion 504 from the body of the vaporizer cartridge 1320. The heat shields 518 help to minimize the effects of the heat emanating from the heating portion 504 on the body of the vaporizer cartridge 1320 to protect the structural integrity of the body of the vaporizer cartridge 1320 and to prevent melting or other deformation of the vaporizer cartridge 1320. The heat shields 518 may also help to maintain a consistent temperature at the heating portion 504 by retaining heat within the heating portion 504, thereby preventing or limiting heat losses while vaporization is occurring. In some implementations, the vaporizer cartridge 1320 may also or alternatively include a heat shield 518A that is separate from the heating element 1350.

As noted above, the heating element 1350 includes at least two cartridge contacts 124 that form an end portion of each of the legs 506. For example, as shown in FIGS. 14-17, the cartridge contacts 124 may form the portion of the legs 506 that is folded along a fold line 507. The cartridge contacts 124 may be folded at an angle of approximately 90 degrees relative to the legs 506. In some implementations, the cartridge contacts 124 may be folded at other angles, such as at an angle of approximately 15 degrees, 25 degrees, 35 degrees, 45 degrees, 55 degrees, 65 degrees, 75 degrees or other ranges therebetween, relative to the legs 506. The cartridge contacts 124 may be folded towards or away from the heating portion 504, depending on the implementation. The cartridge contacts 124 may also be formed on another portion of the heating element 1350, such as along a length of at least one of the legs 506. The cartridge contacts 124 are configured to be exposed to the environment when assembled in the vaporizer cartridge 1320.

The cartridge contacts 124 may form conductive pins, tabs, posts, receiving holes, or surfaces for pins or posts, or other contact configurations. Some types of cartridge contacts 124 may include springs or other urging features to cause better physical and electrical contact between the cartridge contacts 124 on the vaporizer cartridge and receptacle contacts 125 on the vaporizer body 110. In some implementations, the cartridge contacts 124 include wiping contacts that are configured to clean the connection between the cartridge contacts 124 and other contacts or power source. For example, the wiping contacts would include two parallel, but offset, bosses that frictionally engage and slide against one another in a direction that is parallel or perpendicular to the insertion direction.

The cartridge contacts 124 are configured to interface with the receptacle contacts 125 disposed near a base of the cartridge receptacle of the vaporizer 100 such that the cartridge contacts 124 and the receptacle contacts 125 make electrical connections when the vaporizer cartridge 1320 is inserted into and coupled with the cartridge receptacle 118. The cartridge contacts 124 may electrically communicate with the power source 112 of the vaporizer device (such as via the receptacle contacts 125, etc.). The circuit completed by these electrical connections can allow delivery of electrical current to the resistive heating element to heat at least a portion of the heating element 1350 and may further be used for additional functions, such as for example for measuring a resistance of the resistive heating element for use in determining and/or controlling a temperature of the resistive heating element based on a thermal coefficient of resistivity of the resistive heating element, for identifying a cartridge based on one or more electrical characteristics of a resistive heating element or the other circuitry of the vaporizer cartridge, etc. The cartridge contacts 124 may be treated, as explained in more detail below, to provide improved electrical properties (e.g., contact resistance) using, for example, conductive plating, surface treatment, and/or deposited materials.

In some implementations, the heating element 1350 may be processed through a series of crimping and/or bending operations to shape the heating element 1350 into a desired three-dimensional shape. For example, the heating element 1350 may be performed to receive or crimped about a wicking element 1362 to secure the wicking element between at least two portions (e.g., approximately parallel portions) of the heating element 1350 (such as between opposing portions of the heating portion 504). To crimp the heating element 1350, the heating element 1350 may be bent along fold lines 520 towards one another. Folding the heating element 1350 along fold lines 520 forms a platform tine portion 524 defined by the region between the fold lines 520 and side tine portions 526 defined by the region between the fold lines 520 and the outer edges 503 of the tines 502. The platform tine portion 524 is configured to contact one end of the wicking element 1362. The side tine portions 526 are configured to contact opposite sides of the wicking element 1362. The platform tine portion 524 and the side tine portions 526 form a pocket that is shaped to receive the wicking element 1362 and/or conform to the shape of at least a portion of the wicking element 1362. The pocket allows the wicking element 1362 to be secured and retained by the heating element 1350 within the pocket. The platform tine portion 524 and the side tine portions 526 contact the wicking element 1362 to provide a multi-dimensional contact between the heating element 1350 and the wicking element 1362. Multi-dimensional contact between the heating element 1350 and the wicking element 1362 provides for a more efficient and/or faster transfer of the vaporizable material from the reservoir 1340 of the vaporizer cartridge 1320 to the heating portion 504 (via the wicking element 1362) to be vaporized.

Figure 15:
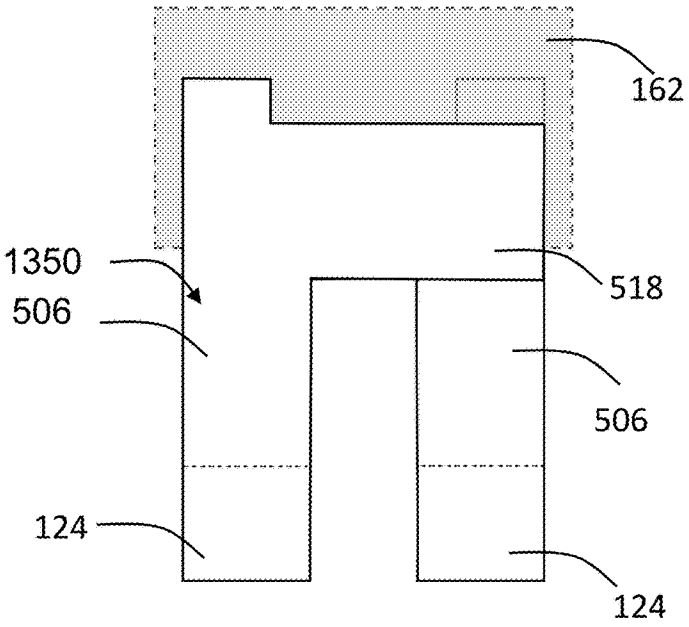
FIG. 15 depicts a schematic view of a heating element for use in a vaporizer device consistent with implementations of the current subject matter.

In some implementations, portions of the legs 506 of the heating element 1350 may also be bent along fold lines 522 away from one another. Folding the portions of the legs 506 of the heating element 1350 along fold lines 522 away from one another locates the legs 506 at a position spaced away from the heating portion 504 (and tines 502) of the heating element 1350 in a first and/or second direction opposite the first direction (e.g., in the same plane). Thus, folding the portions of the legs 506 of the heating element 1350 along fold lines 522 away from one another spaces the heating portion 504 from the body of the vaporizer cartridge 1320. FIG. 15 illustrates a schematic of the heating element 1350 that has been folded along the fold lines 520 and fold lines 522 about the wicking element 1362. As shown in FIG. 15, the wicking element is positioned within the pocket formed by folding the heating element 1350 along fold lines 520 and 522.

In some implementations of the current subject matter, the heating element 1350 may also be bent along fold lines 523. For example, the cartridge contacts 124 may be bent towards one another (into and out of the page shown in FIG. 16) along the fold lines 523. The contact portion of the heating element 1350 including the cartridge contacts 124 may be disposed at least partially outside of the wick housing 1315 such that the cartridge contacts 124 are exposed to the external environment and able to engage the receptacle contacts 125. Meanwhile, the heating portion of the heating element 1350 may be disposed at least partially within the wick housing 1350.

In use, when a user puffs on the mouthpiece 130 of the vaporizer cartridge 1320 when the heating element 1350 is assembled into the vaporizer cartridge 1320, air flows into the vaporizer cartridge and along an air path. In association with the user puff, the heating element 1350 may be activated, e.g., by automatic detection of the puff via a pressure sensor, by detection of a pushing of a button by the user, by signals generated from a motion sensor, a flow sensor, a capacitive lip sensor, and/or another approach capable of detecting that a user is taking or about to be taking a puff or otherwise inhaling to cause air to enter the vaporizer 100 and travel at least along the air path. Power can be supplied from the vaporizer device to the heating element 1350 at the cartridge contacts 124, when the heating element 1350 is activated.

When the heating element 1350 is activated, a temperature increase results due to current flowing through the heating element 1350 to generate heat. The heat is transferred to some amount of the vaporizable material through conductive, convective, and/or radiative heat transfer such that at least a portion of the vaporizable material vaporizes. The heat transfer can occur to vaporizable material in the reservoir and/or to vaporizable material drawn into the wicking element 1362 retained by the heating element 1350. In some implementations, the vaporizable material can vaporize along one or more edges of the tines 502, as mentioned above. The air passing into the vaporizer device flows along the air path across the heating element 1350, stripping away the vaporized vaporizable material from the heating element 1350. The vaporized vaporizable material can be condensed due to cooling, pressure changes, etc., such that it exits the mouthpiece 130 as an aerosol for inhalation by a user.

As noted above, the heating element 1350 may be made of various materials, such as nichrome, stainless steel, or other resistive heater materials. Combinations of two or more materials may be included in the heating element 1350, and such combinations can include both homogeneous distributions of the two or more materials throughout the heating element or other configurations in which relative amounts of the two or more materials are spatially heterogeneous. For example, the tines 502 may have portions that are more resistive and thereby be designed to grow hotter than other sections of the tines or heating element 1350. In some implementations, at least the tines 502 (such as within the heating portion 504) may include a material that has high conductivity and heat resistance.

The heating element 1350 may be entirely or selectively plated with one or more materials. Since the heating element 1350 is made of a thermally and/or electrically conductive material, such as stainless steel, nichrome, or other thermally and/or electrically conductive alloy, the heating element 1350 may experience electrical or heating losses in the path between the cartridge contacts 124 and the tines 502 in the heating portion 504 of the heating element 1350. To help to reduce heating and/or electrical losses, at least a portion of the heating element 1350 may be plated with one or more materials to reduce resistance in the electrical path leading to the heating portion 504. In some implementations consistent with the current subject matter, it is beneficial for the heating portion 504 (e.g., the tines 502) to remain unplated, with at least a portion of the legs 506 and/or cartridge contacts 124 being plated with a plating material that reduces resistance (e.g., either or both of bulk and contact resistance) in those portions.

For example, the heating element 1350 may include various portions that are plated with different materials. In another example, the heating element 1350 may be plated with layered materials. Plating at least a portion of the heating element 1350 helps to concentrate current flowing to the heating portion 504 to reduce electrical and/or heat losses in other portions of the heating element 1350. In some implementations, it is desirable to maintain a low resistance in the electrical path between the cartridge contacts 124 and the tines 502 of the heating element 1350 to reduce electrical and/or heat losses in the electrical path and to compensate for the voltage drop that is concentrated across the heating portion 504.

In some implementations, the cartridge contacts 124 may be selectively plated. Selectively plating the cartridge contacts 124 with certain materials may minimize or eliminate contact resistance at the point where the measurements are taken and the electrical contact is made between the cartridge contacts 124 and the receptacle contacts. Providing a low resistance at the cartridge contacts 124 can provide more accurate voltage, current, and/or resistance measurements and readings, which can be beneficial for accurately determining the current actual temperature of the heating portion 504 of the heating element 1350.

In some implementations, at least a portion of the cartridge contacts 124 and/or at least a portion of the legs 506 may be plated with one or more outer plating materials 550. For example, at least a portion of the cartridge contacts 124 and/or at least a portion of the legs 506 may be plated with at least gold, or another material that provides low contact resistance, such as platinum, palladium, silver, copper, or the like.

In some implementations, in order for the low resistance outer plating material to be secured to the heating element 1350, a surface of the heating element 1350 may be plated with an adhering plating material. In such configurations, the adhering plating material may be deposited onto the surface of the heating element 1350 and the outer plating material may be deposited onto the adhering plating material, defining first and second plating layers, respectively. The adhering plating material includes a material with adhesive properties when the outer plating material is deposited onto the adhering plating material. For example, the adhering plating material may include nickel, zinc, aluminum, iron, alloys thereof, or the like.

In some implementations, the surface of the heating element 1350 may be primed for the outer plating material to be deposited onto the heating element 1350 using non-plating priming, rather than by plating the surface of the heating element 1350 with the adhering plating material. For example, the surface of the heating element 1350 may be primed using etching rather than by depositing the adhering plating material.

In some implementations, all or a portion of the legs 506 and the cartridge contacts 124 may be plated with the adhering plating material and/or the outer plating material. In some examples, the cartridge contacts 124 may include at least a portion that has an outer plating material having a greater thickness relative to the remaining portions of the cartridge contacts 124 and/or the legs 506 of the heating element 1350. In some implementations, the cartridge contacts 124 and/or the legs 506 may have a greater thickness relative to the tines 502 and/or the heating portion 504.

In some implementations, rather than forming the heating element 1350 of a single substrate material and plating the substrate material, the heating element 1350 may be formed of various materials that are coupled together (e.g., via laser welding, diffusion processes, etc.). The materials of each portion of the heating element 1350 that is coupled together may be selected to provide a low or no resistance at the cartridge contacts 124 and a high resistance at the tines 502 or heating portion 504 relative to the other portions of the heating element 1350.

In some implementations, the heating element 1350 may be electroplated with silver ink and/or spray coated with one or more plating materials, such as the adhering plating material and the outer plating material.

As mentioned above, the heating element 1350 may include various shapes, sizes, and geometries to more efficiently heat the heating portion 504 of the heating element 1350 and more efficiently vaporize the vaporizable material 1302.

FIGS. 19-24 depict another example of the heating element 1350 consistent with implementations of the current subject matter. As shown, the heating element 1350 may include the one or more tines 502 located in the heating portion 504, the one or more legs 506 extending from the tines 502, and the cartridge contacts 124 formed at the end portion and/or as part of each of the one or more legs 506.

The tines 502 may be folded and/or crimped to define the pocket in which a wicking element 1362 (e.g., a flat pad) resides. The tines 502 include a platform tine portion 524 and side tine portions 526. The platform tine portion 524 is configured to contact one side of the wicking element 1362 and the side tine portions 526 are configured to contact other opposite sides of the wicking element 1362. The platform tine portion 524 and the side tine portions 526 form the pocket that is shaped to receive the wicking element 1362 and/or conform to the shape of at least a portion of the wicking element 1362. The pocket allows the wicking element 1362 to be secured and retained by the heating element 1350 within the pocket.

In this example, the tines 502 have various shapes and size, and are spaced apart from one another at the same or varying distances. For example, as shown, each of the side tine portions 526 includes at least four tines 502. In a first pair 570 of adjacent tines 502, each of the adjacent tines 502 is spaced apart at an equal distance from an inner region 576 positioned near the platform tine portion 524 to an outer region 578 positioned near the outer edge 503. In a second pair 572 of adjacent tines 502, the adjacent tines 502 are spaced apart by a varying distance from the inner region 576 to the outer region 578. For example, the adjacent tines 502 of the second pair 572 are spaced apart by a width that is greater at the inner region 576 than at the outer region 578. These configurations may help to maintain a constant and uniform temperature along the length of the tines 502 of the heating portion 504. Maintaining a constant temperature along the length of the tines 502 may provide higher quality aerosol, as the maximum temperature is more uniformly maintainable across the entire heating portion 504.

As noted above, each of the legs 506 may include and/or define a cartridge contact 124 that is configured to contact a corresponding receptacle contact 125 of the vaporizer 100. In some implementations, each pair of legs 506 (and the cartridge contacts 124) may contact a single receptacle contact 125. In some implementations, the legs 506 include retainer portions 180 that are configured to be bent and generally extend away from the heating portion 504. The retainer portions 180 are configured to be positioned within a corresponding recess in the wick housing 1315. The retainer portions 180 form an end of the legs 506. The retainer portions 180 help to secure the heating element 1350 and wicking element 1362 to the wick housing 1315 (and the vaporizer cartridge 1320). The retainer portions 180 may have a tip portion 180A that extends from an end of the retainer portion 180 towards the heating portion 504 of the heating element 1350. This configuration reduces the likelihood that the retainer portion will contact another portion of the vaporizer cartridge 1320, or a cleaning device for cleaning the vaporizer cartridge 1320.

The outer edge 503 of the tines 502 in the heating portion 504 may include a tab 580. The tab 580 may include one, two, three, four, or more tabs 580. The tab 580 may extend outwardly from the outer edge 503 and extend away from a center of the heating element 1350. For example, the tab 580 may be positioned along an edge of the heating element 1350 surrounding an internal volume defined by at least the side tine portions 526 for receiving the wicking element 1362. The tab 580 may extend outwardly away from the internal volume of the wicking element 1362. The tab 580 may also extend away in a direction opposite the platform tine portion 524. In some implementations, tabs 580 positioned on opposing sides of the internal volume of the wicking element 1362 may extend away from one another. This configuration helps to widen the opening leading to the internal volume of the wicking element 1362, thereby helping to reduce the likelihood that the wicking element 1362 will catch, tear, and/or become damaged when assembled with the heating element 1350. Due to the material of the wicking element 1362, the wicking element 1362 may easily catch, tear, and/or otherwise become damaged when assembled (e.g., positioned within or inserted into) with the heating element 1350. Contact between the wicking element 1362 and the outer edge 503 of the tines 502 may also cause damage to the heating element. The shape and/or positioning of the tab 580 may allow the wicking element 1362 to more easily be positioned within or into the pocket (e.g., the internal volume of the heating element 1350) formed by the tines 502, thereby preventing or reducing the likelihood that the wicking element 1362 and/or the heating element will be damaged. Thus, the tabs 580 help to reduce or prevent damage caused to the heating element 1350 and/or the wicking element 1362 upon entry of the wicking element 1362 into thermal contact with the heating element 1350. The shape of the tab 580 also helps to minimize impact on the resistance of the heating portion 504.

In some implementations, at least a portion of the cartridge contacts 124 and/or at least a portion of the legs 506 may be plated with one or more outer plating materials 550 to reduce contact resistance at the point where the heating element 1350 contacts the receptacle contacts 125.

FIGS. 25A-B, 26-28, 29A-B, and 30A-B depict another example of the heating element 1350 consistent with implementations of the current subject matter. As shown, the heating element 1350 includes the one or more tines 502 located in the heating portion 504, the one or more legs 506 extending from the tines 502, and the cartridge contacts 124 formed at the end portion and/or as part of each of the one or more legs 506.

The tines 502 may be folded and/or crimped to define the pocket in which a wicking element 1362 (e.g., flat pad) resides. The tines 502 include a platform tine portion 524 and side tine portions 526. The platform tine portion 524 is configured to contact one side of the wicking element 1362 and the side tine portions 526 are configured to contact other opposite sides of the wicking element 1362. The platform tine portion 524 and the side tine portions 526 form the pocket that is shaped to receive the wicking element 1362 and/or conform to the shape of at least a portion of the wicking element 1362. The pocket allows the wicking element 1362 to be secured and retained by the heating element 1350 within the pocket.

In this example, the tines 502 have the same shape and size and are spaced apart from one another at equal distances. Here, the tines 502 include a first side tine portion 526A and a second side tine portion 526B that are spaced apart by the platform tine portion 524. Each of the first and second side tine portions 526A, 526B include an inner region 576 positioned near the platform tine portion 524 to an outer region 578 positioned near the outer edge 503. At the outer region 578, the first side tine portion 526A is positioned approximately parallel to the second tine portion 526A. At the inner region 576, the first side tine portion 526A is positioned offset from the second tine portion 526B and the first and second side tine portions 526A, 526B are not parallel. This configuration may help to maintain a constant and uniform temperature along the length of the tines 502 of the heating portion 504. Maintaining a constant temperature along the length of the tines 502 may provide higher quality aerosol, as the maximum temperature is more uniformly maintainable across the entire heating portion 504.

As noted above, each of the legs 506 may include and/or define a cartridge contact 124 that is configured to contact a corresponding receptacle contact 125 of the vaporizer 100. In some implementations, each pair of legs 506 (and the cartridge contacts 124) may contact a single receptacle contact 125. In some implementations, the legs 506 include retainer portions 180 that are configured to be bent and generally extend away from the heating portion 504. The retainer portions 180 are configured to be positioned within a corresponding recess in the wick housing 1315. The retainer portions 180 form an end of the legs 506. The retainer portions 180 help to secure the heating element 1350 and wicking element 1362 to the wick housing 1315 (and the vaporizer cartridge 1320). The retainer portions 180 may have a tip portion 180A that extends from an end of the retainer portion 180 towards the heating portion 504 of the heating element 1350. This configuration reduces the likelihood that the retainer portion will contact another portion of the vaporizer cartridge 1320, or a cleaning device for cleaning the vaporizer cartridge 1320.

The outer edge 503 of the tines 502 in the heating portion 504 may include a tab 580. The tab 580 may extend outwardly from the outer edge 503 and extend away from a center of the heating element 1350. The tab 580 may be shaped to allow the wicking element 1362 to more easily be positioned within the pocket formed by the tines 502, thereby preventing or reducing the likelihood that the wicking element 1362 will get caught on the outer edge 503. The shape of the tab 580 helps to minimize impact on the resistance of the heating portion 504.

In some implementations of the current subject matter, at least a portion of the cartridge contacts 124 and/or at least a portion of the legs 506 may be plated with one or more outer plating materials 550 to reduce contact resistance at the point where the heating element 1350 contacts the receptacle contacts 125.

Figure 24:
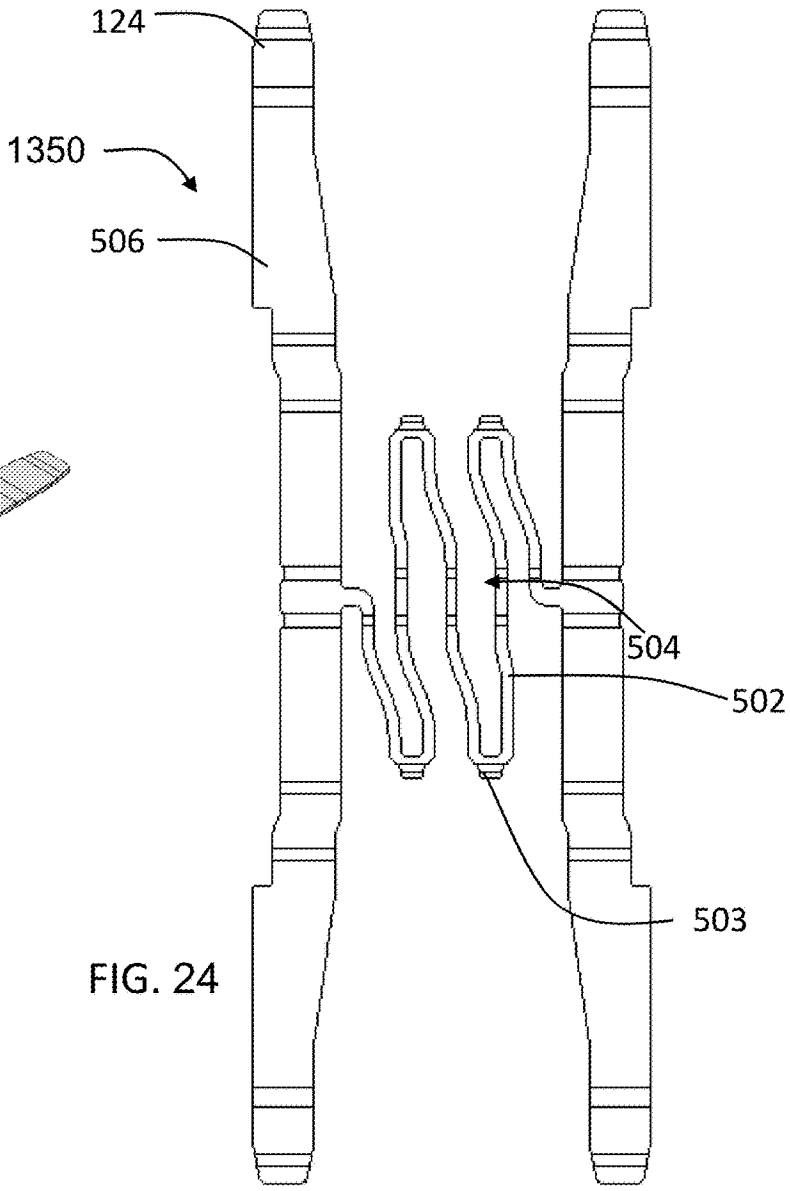
FIG. 24 depicts a top view of a heating element in an unbent position consistent with implementations of the current subject matter.
Figure 23:
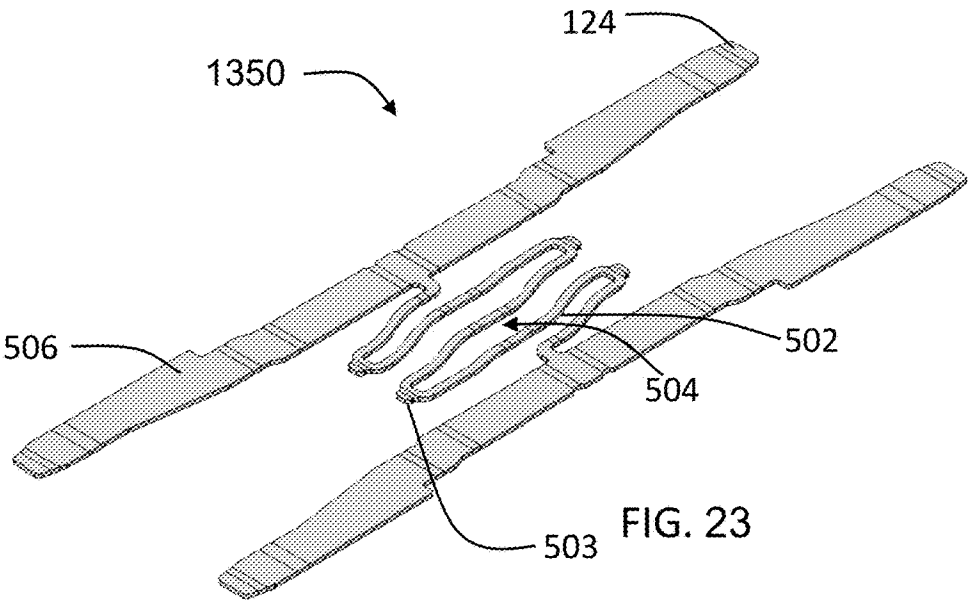
FIG. 23 depicts a perspective view of a heating element in an unbent position consistent with implementations of the current subject matter.
Figure 25A:
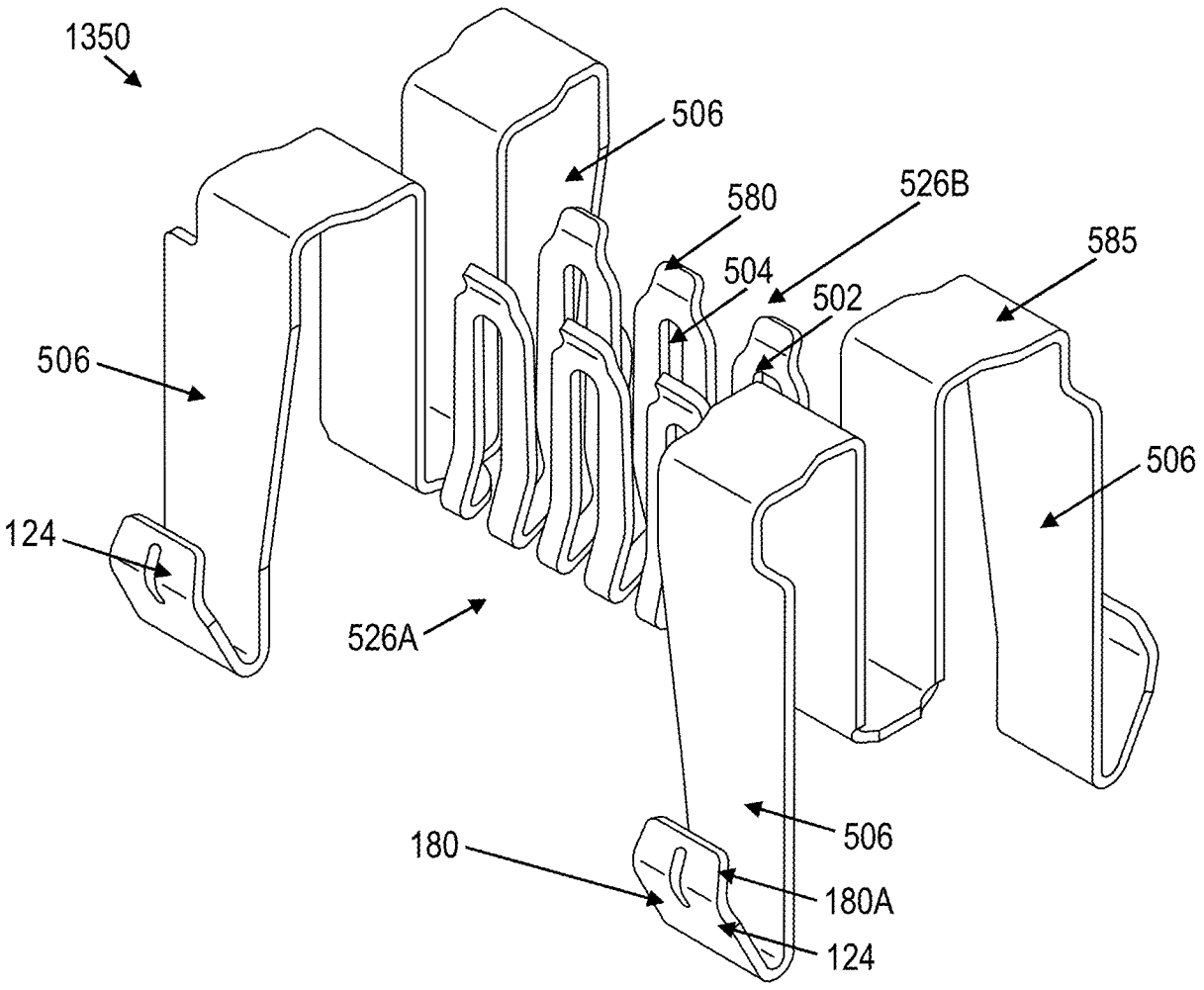
FIG. 25A depicts a perspective view of a heating element in a bent position consistent with implementations of the current subject matter.
Figure 25B:
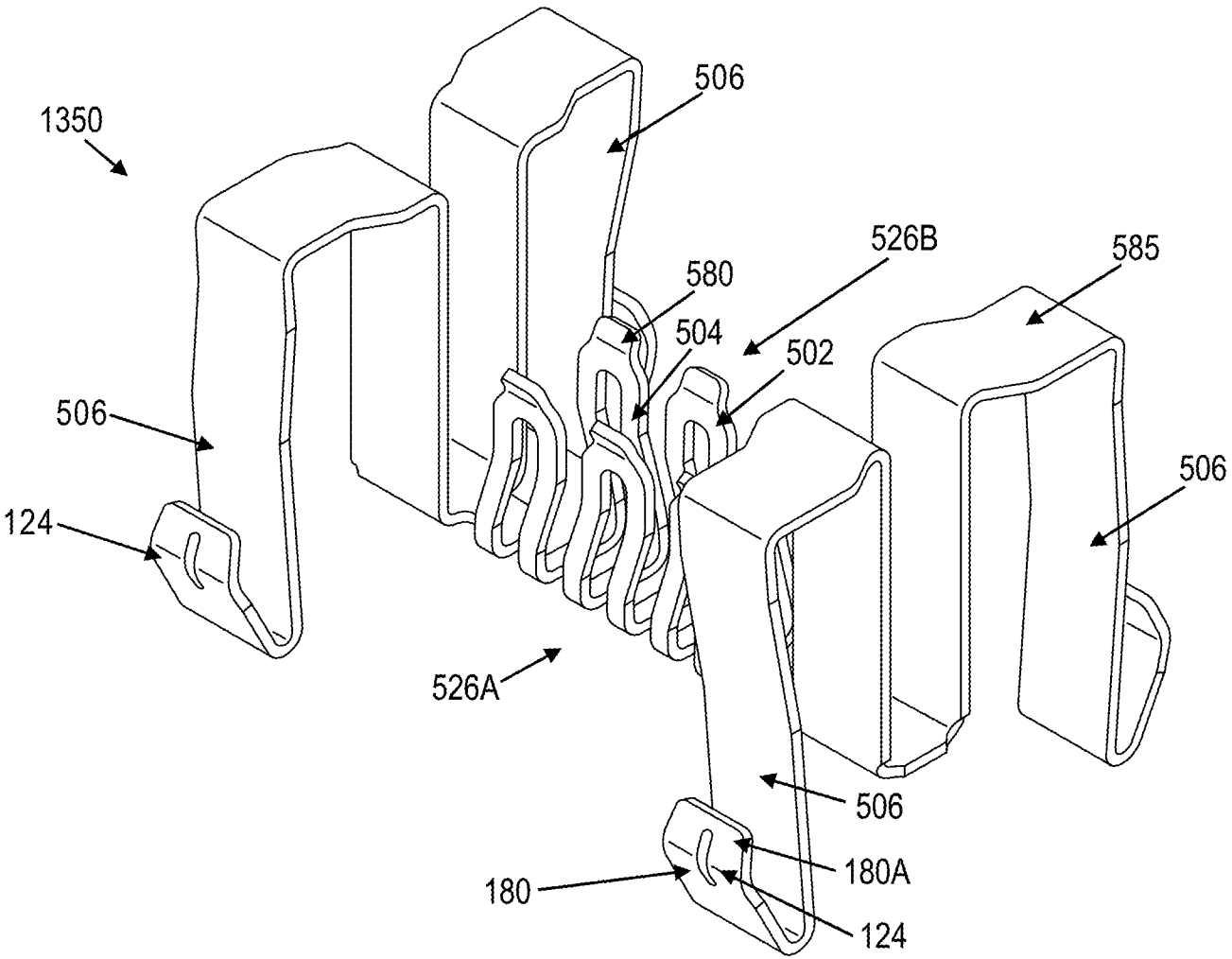
FIG. 25B depicts a perspective view of a heating element in a bent position consistent with implementations of the current subject matter.
Figure 26:
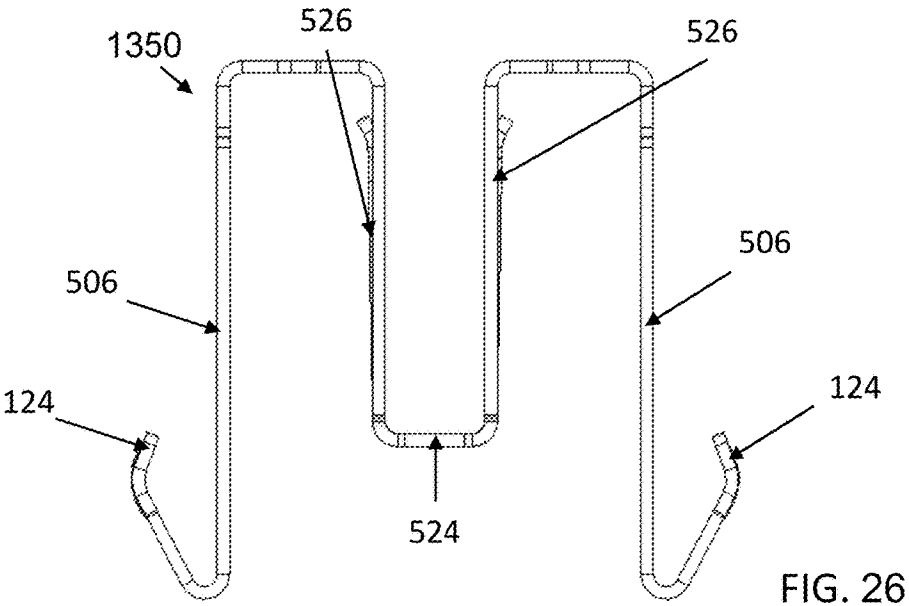
FIG. 26 depicts a side view of a heating element in a bent position consistent with implementations of the current subject matter.
Figure 28:
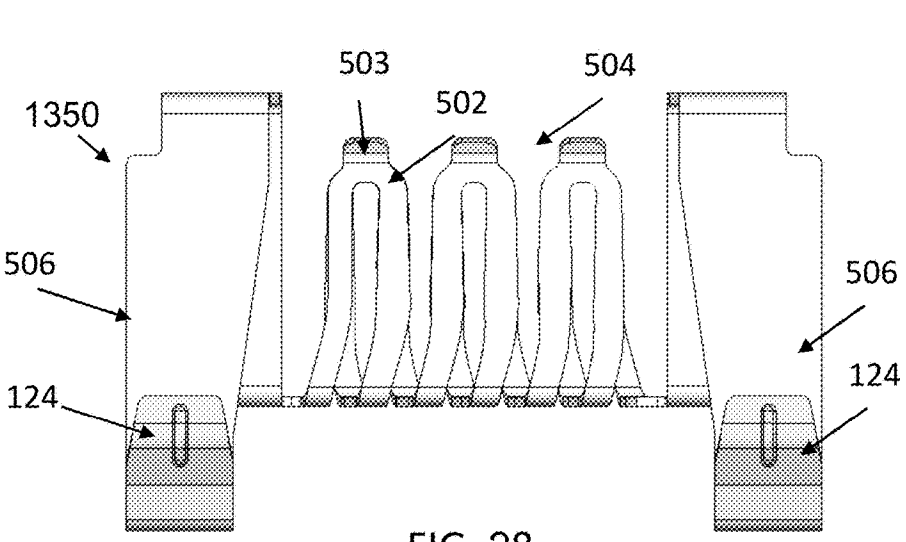
FIG. 28 depicts a front view of a heating element in a bent position consistent with implementations of the current subject matter.
Figure 27:
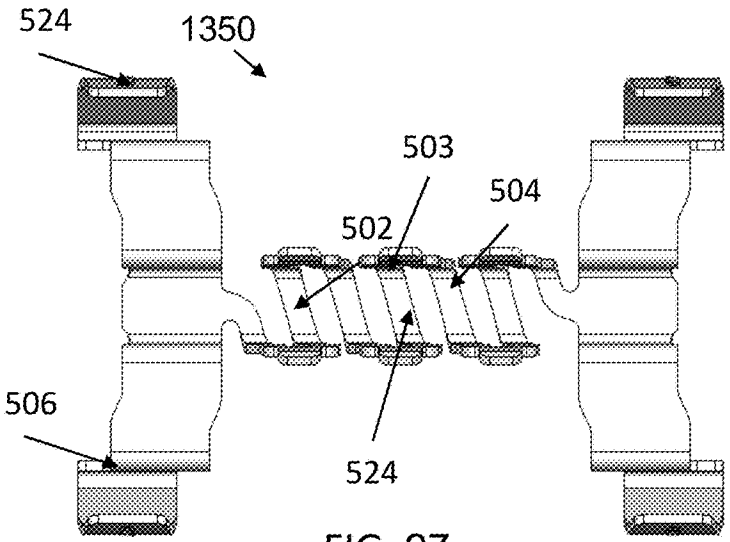
FIG. 27 depicts a top view of a heating element in a bent position consistent with implementations of the current subject matter.
Figure 30A:
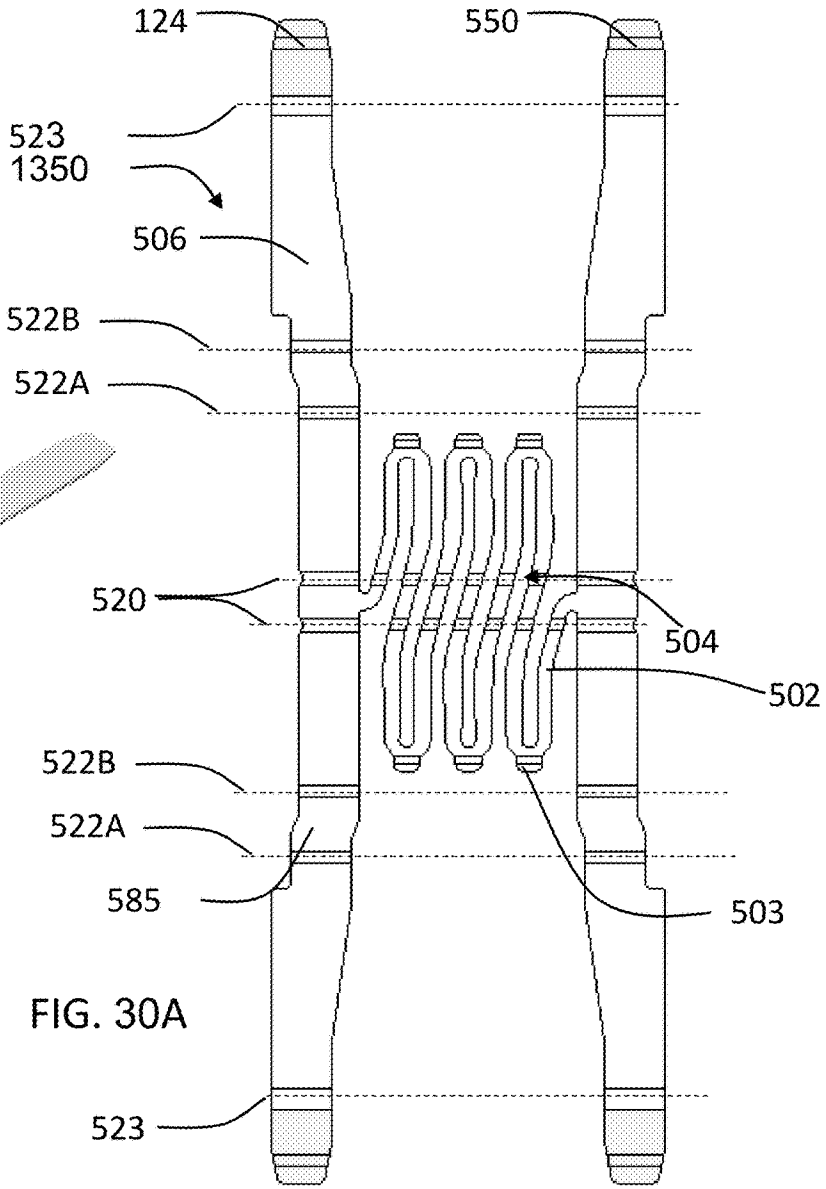
FIG. 30A depicts a top view of a heating element in an unbent position consistent with implementations of the current subject matter.
Figure 29A:
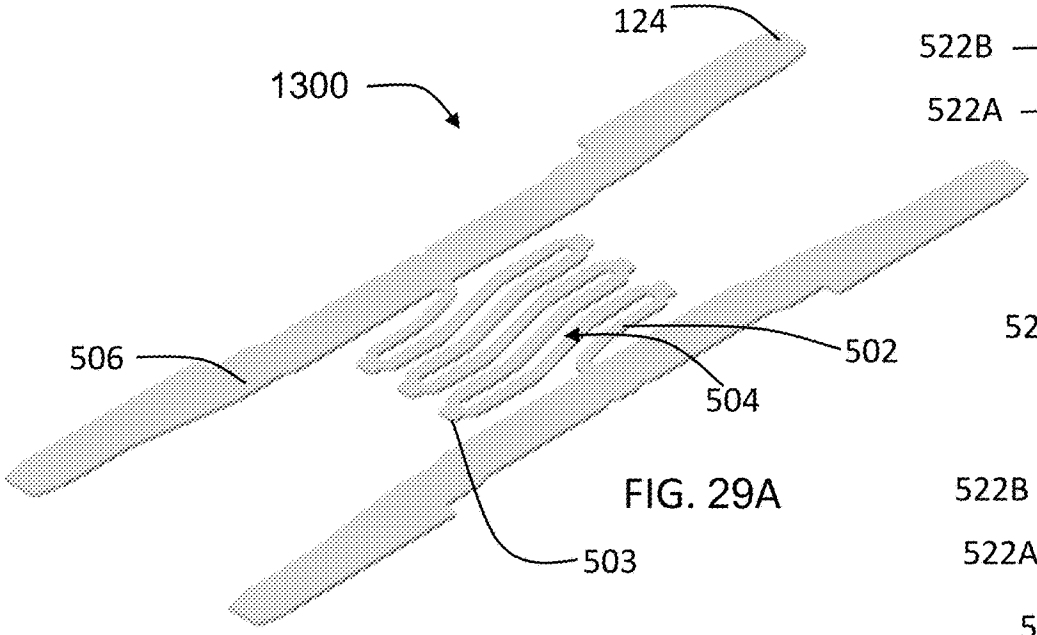
FIG. 29A depicts a perspective view of a heating element in an unbent position consistent with implementations of the current subject matter.
Figure 30B:
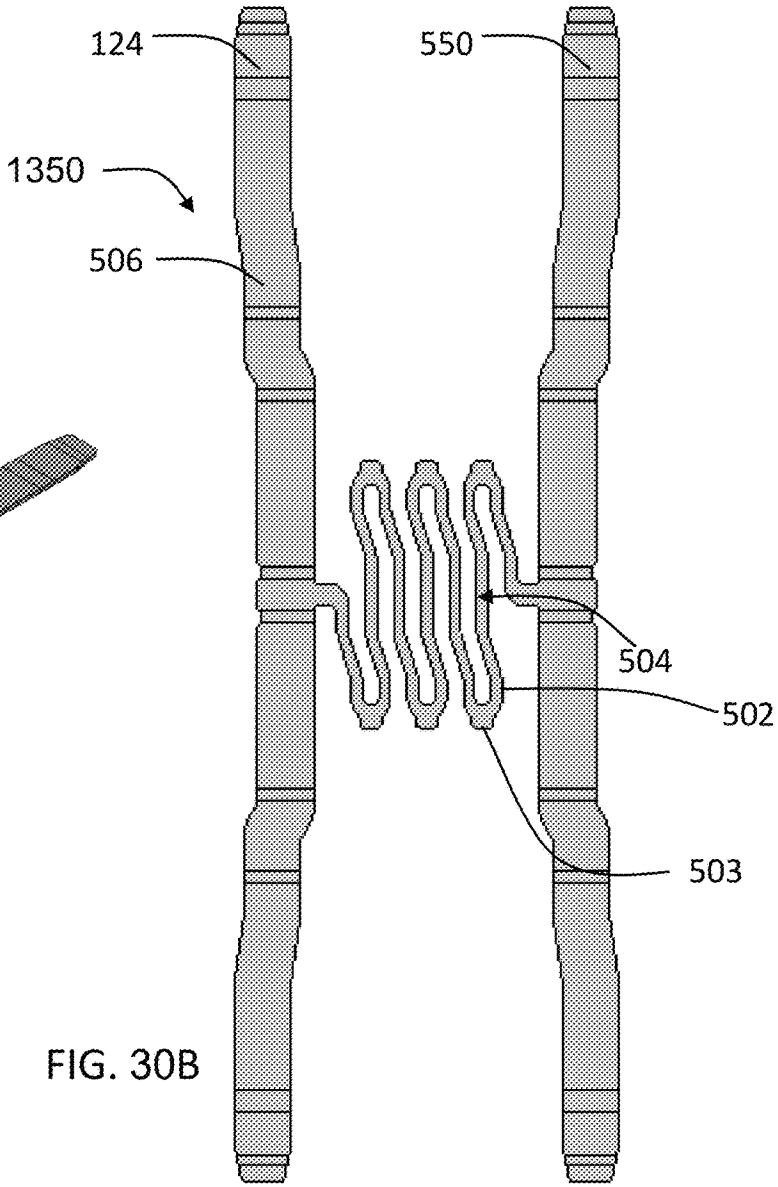
FIG. 30B depicts a top view of a heating element in an unbent position consistent with implementations of the current subject matter.
Figure 29B:
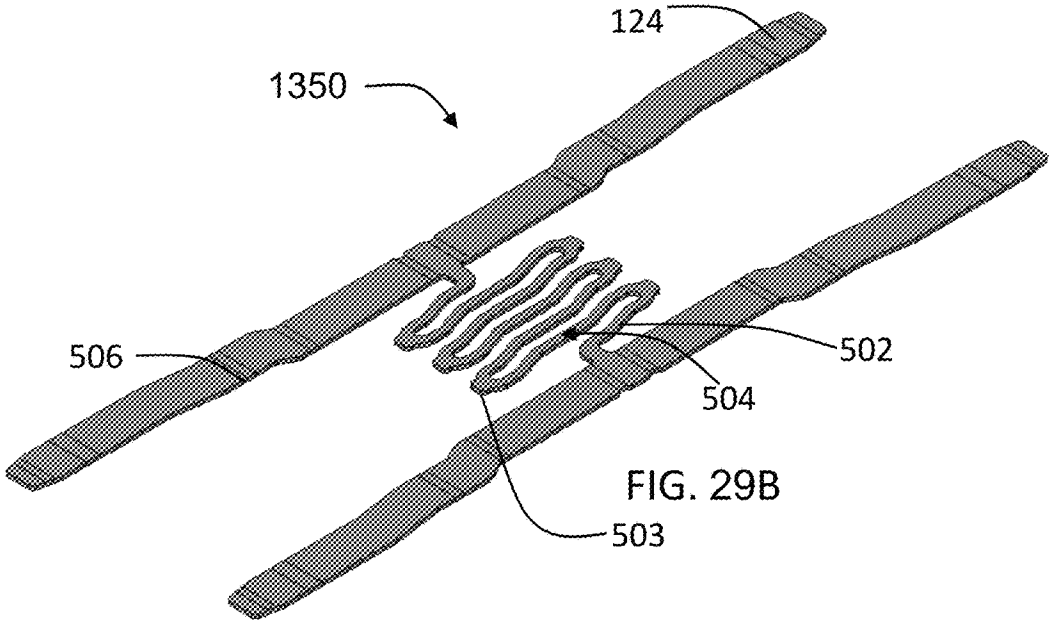
FIG. 29B depicts a perspective view of a heating element in an unbent position consistent with implementations of the current subject matter.

Referring to FIGS. 24 and 30A-B, the geometry of the heating element 1350 may, in an unfolded state, resemble the letter "H" with the heating portion 504 disposed at substantially across a center of the legs 506. The temperature of the heating element 1350 may correspond to a resistance of the heating element 1350, for example, across the heating portion 504 of the heating element 1350. For example, the temperature of the heating element 1350 may be determined based on the thermal coefficient of resistivity and the resistance of the heating element 1350. Accordingly, the temperature of the heating element 1350 may be determined and/or controlled (e.g., by the controller 104) by at least measuring the resistance across the heating element 1350, for example, across the heating portion 504 of the heating element 1350. It should be appreciated that in some implementations of the current subject matter, the geometric configuration of the heating element 1350 may enable a measurement of the resistance across the heating portion 504 of the heating element 1350. That is, the resistance across the heating portion 504 may be measured in isolation (e.g., from other portions of the heating element 1350), thereby increasing the accuracy of the resistance measurement as well as the accuracy of the corresponding temperature determination.

Figure 53:
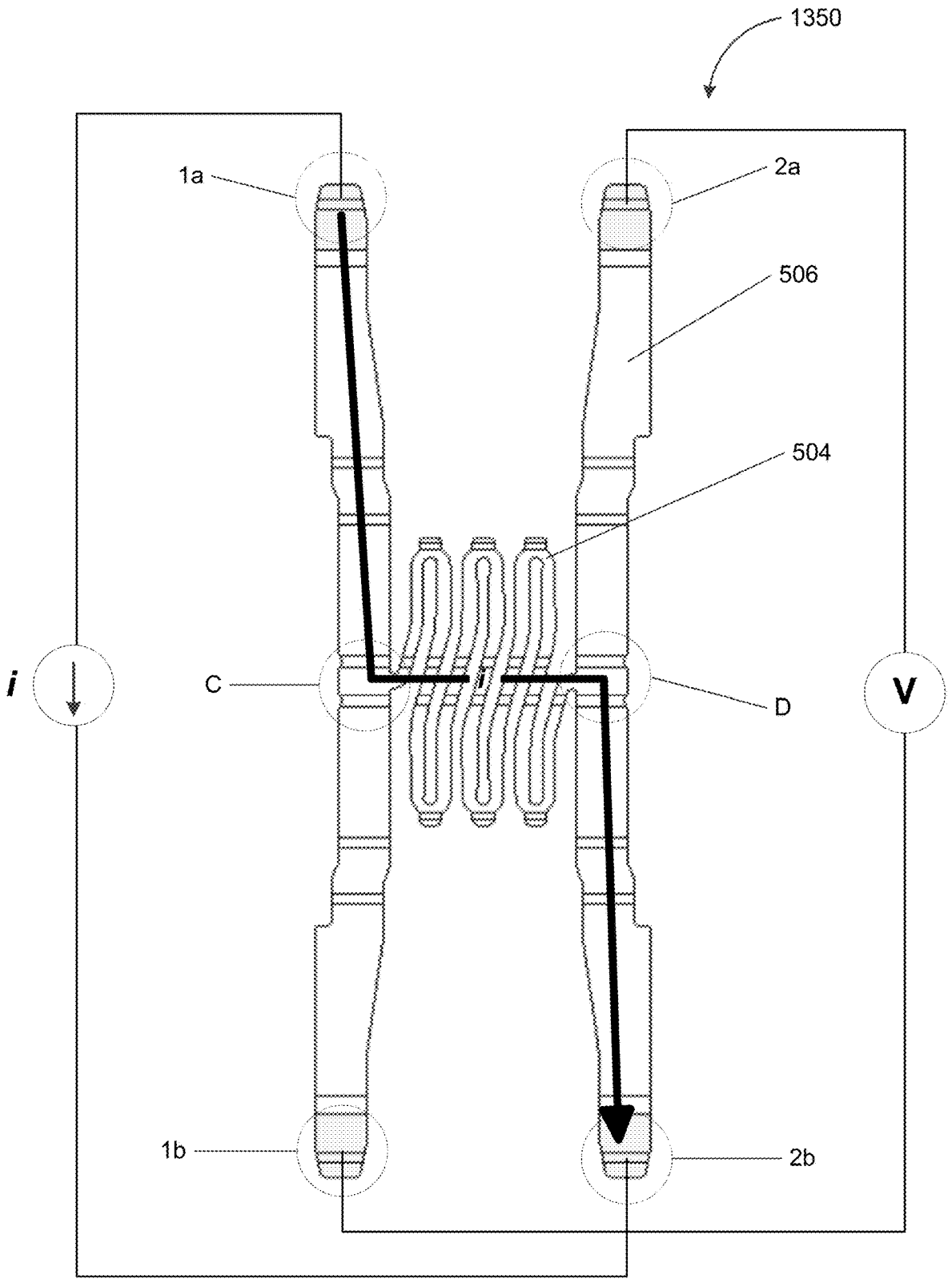
FIG. 53 depicts a resistance measurement for an example of a heating element consistent with implementations of the current subject matter.

To further illustrate, FIG. 53 depicts a resistance measurement for an example of the heating element 1350 consistent with implementations of the current subject matter. Referring to FIG. 53, the resistance across the heating portion 504 of the heating element 1350 may be measured by at least applying a current from a first point 1*a* to a second point 2*b* located at, for example, a respective tip portion 180A of the legs 506 of the heating element 1350. While the current may flow from the first point 1*a* to the second point 2*b*, no current may flow between a third point 2*a* and a fourth point 1*b*.

The resulting voltage drop between the fourth point 1*b* and the third point 2*a* may correspond to a voltage drop between a fifth point C and a sixth point D. As shown in FIG. 53, the fifth point C and the sixth point D are located at a respective end portion of the heating portion 504 of the heating element 1350. Accordingly, the voltage drop across the fifth point C and the sixth point D may correspond to the voltage drop across the heating portion 504 of the heating element 1350. Moreover, measuring the voltage drop across the fourth point 1*b* and the third point 2*a* may correspond to measuring the voltage drop across the fifth point C and the sixth point D. The resistance R across the heating portion 504 of the heating element 1350 may be determined based on Equation (1) below, which relates the resistance R across the heating portion 504 to a voltage V and current I across the heating portion 504 of the heating element 1350.

$$R=VI \tag{1}$$

In some implementations of the current subject matter, the first point 1*a* and the third point 2*a*, which are located at the tip portion 180A of the legs 506 of the heating element 1350, may coincide at least partially with the cartridge contacts 124 that form an electric coupling with the receptacle contacts 125 in the cartridge receptacle 118 of the vaporizer body 110. As such, the geometric configuration of the heating element 1350 may enable an isolated measurement of the resistance across the heating portion 504 of the heating element 1350 by measuring the voltage drop across the tip portion 180A of the legs 506 (e.g., the first point 1*a* and the third point 2*a*), which is disposed outside of the wick housing 1315 and more accessible than the heating portion 504 disposed at least partially inside the wick housing 1315.

Figure 31:
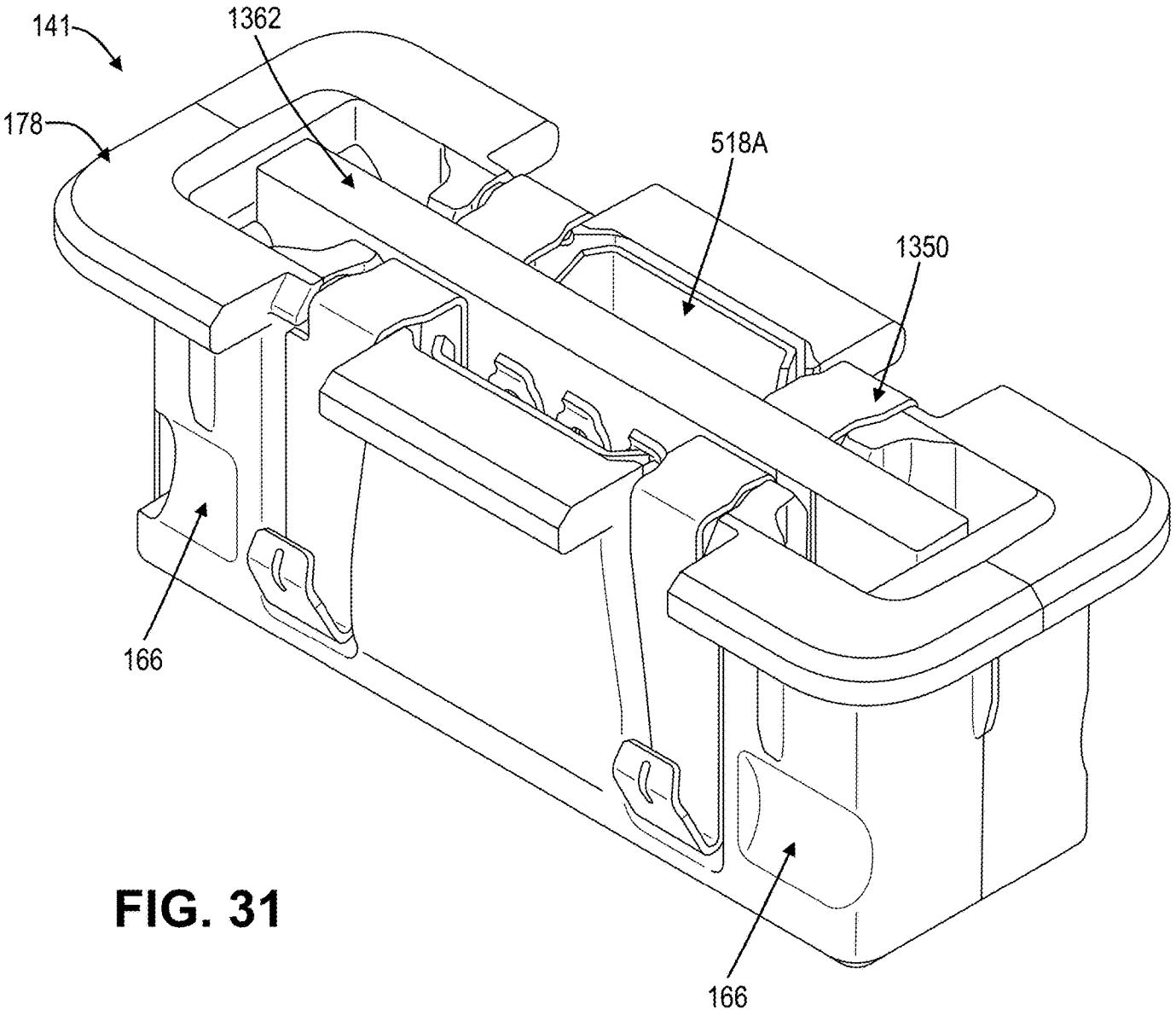
FIG. 31 shows a top perspective view of an atomizer assembly consistent with implementations of the current subject matter.
Figure 32:
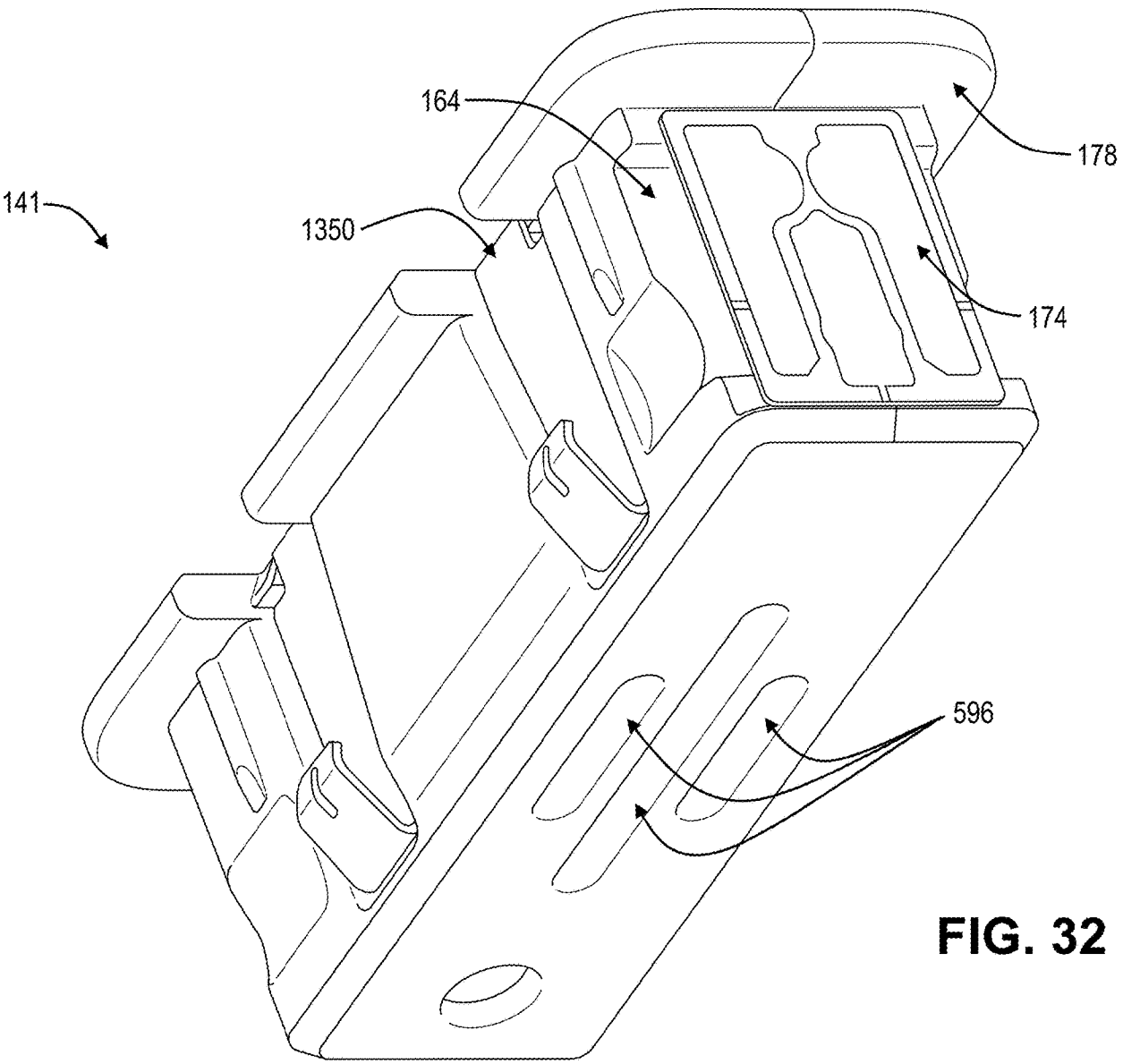
FIG. 32 shows a bottom perspective view of an atomizer assembly consistent with implementations of the current subject matter.
Figure 33:
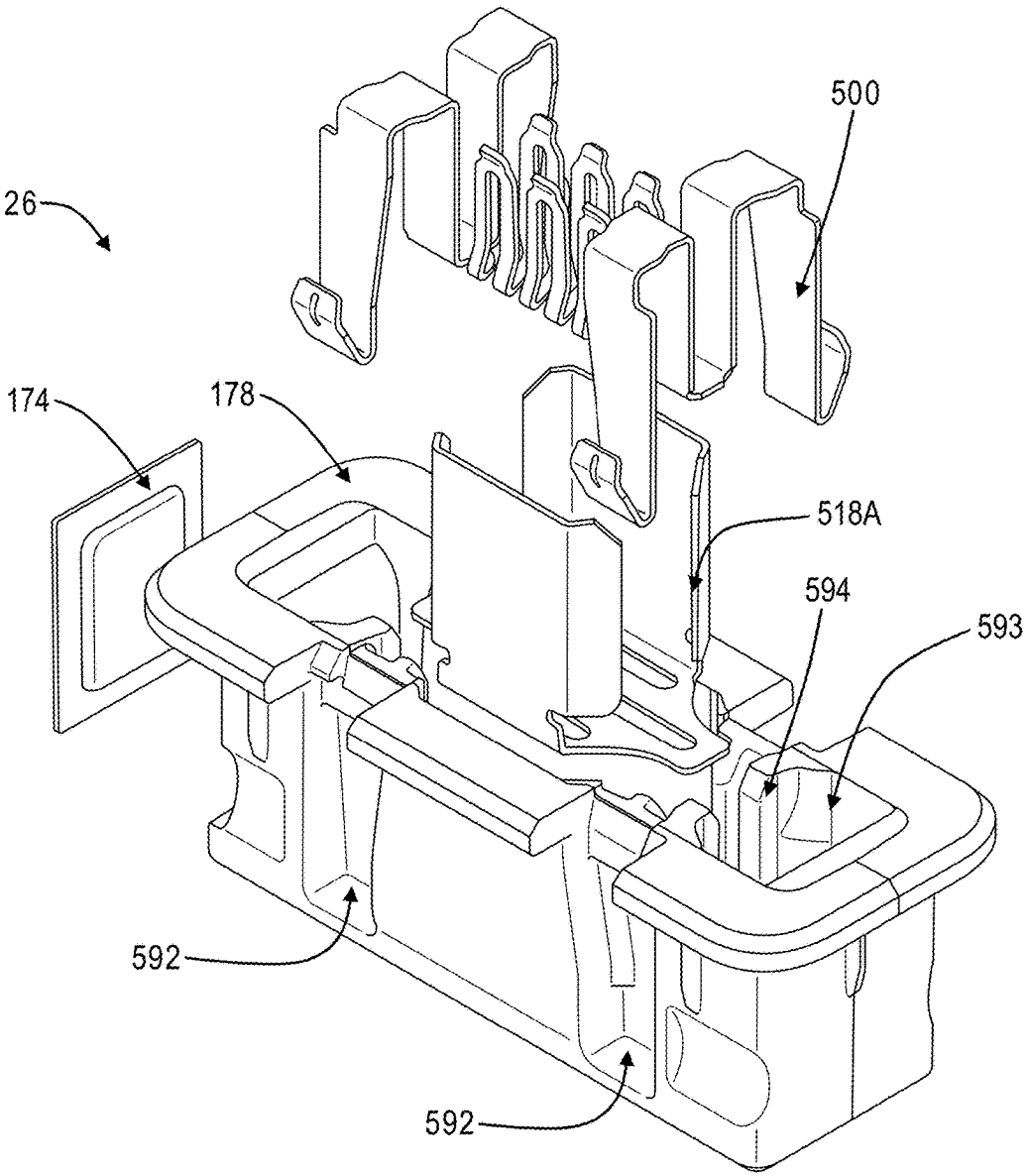
FIG. 33 depicts an exploded perspective view of an atomizer assembly consistent with implementations of the current subject matter.

FIGS. 31-32 depict an example of the atomizer assembly 141, with the heating element 1350 assembled with the wick housing 1315, and FIG. 33 depicts an exploded view of the atomizer assembly 141, consistent with implementations of the current subject matter. The wick housing 1315 may be made of plastic, polypropylene, and the like. The wick housing 1315 includes four recesses 592 in which at least a portion of each of the legs 506 of the heating element 1350 may be positioned and secured. As shown, the wick housing 1315 also includes an opening 593 providing access to an internal volume 594, in which at least the heating portion 504 of the heating element 1350 and the wicking element 1362 are positioned.

The wick housing 1315 may also include a separate heat shield 518A. The heat shield 518A is positioned within the internal volume 594 within the wick housing 1315 between the walls of the wick housing 1315 and the heating element 1350. The heat shield 518A is shaped to at least partially surround the heating portion 504 of the heating element 1350 and to space the heating element 1350 from the side walls of the wick housing 1315. The heat shield 518A can help to insulate the heating portion 504 from the body of the vaporizer cartridge 1320 and/or the wick housing 1315. The heat shield 518A helps to minimize the effects of the heat emanating from the heating portion 504 on the of the vaporizer cartridge 1320 and/or the wick housing 1315 to protect the structural integrity of the body of the vaporizer cartridge 1320 and/or the wick housing 1315 and to prevent melting or other deformation of the vaporizer cartridge 1320 and/or the wick housing 1315. The heat shield 518A may also help to maintain a consistent temperature at the heating portion 504 by retaining heat within the heating portion 504, thereby preventing or limiting heat losses.

Figure 43:
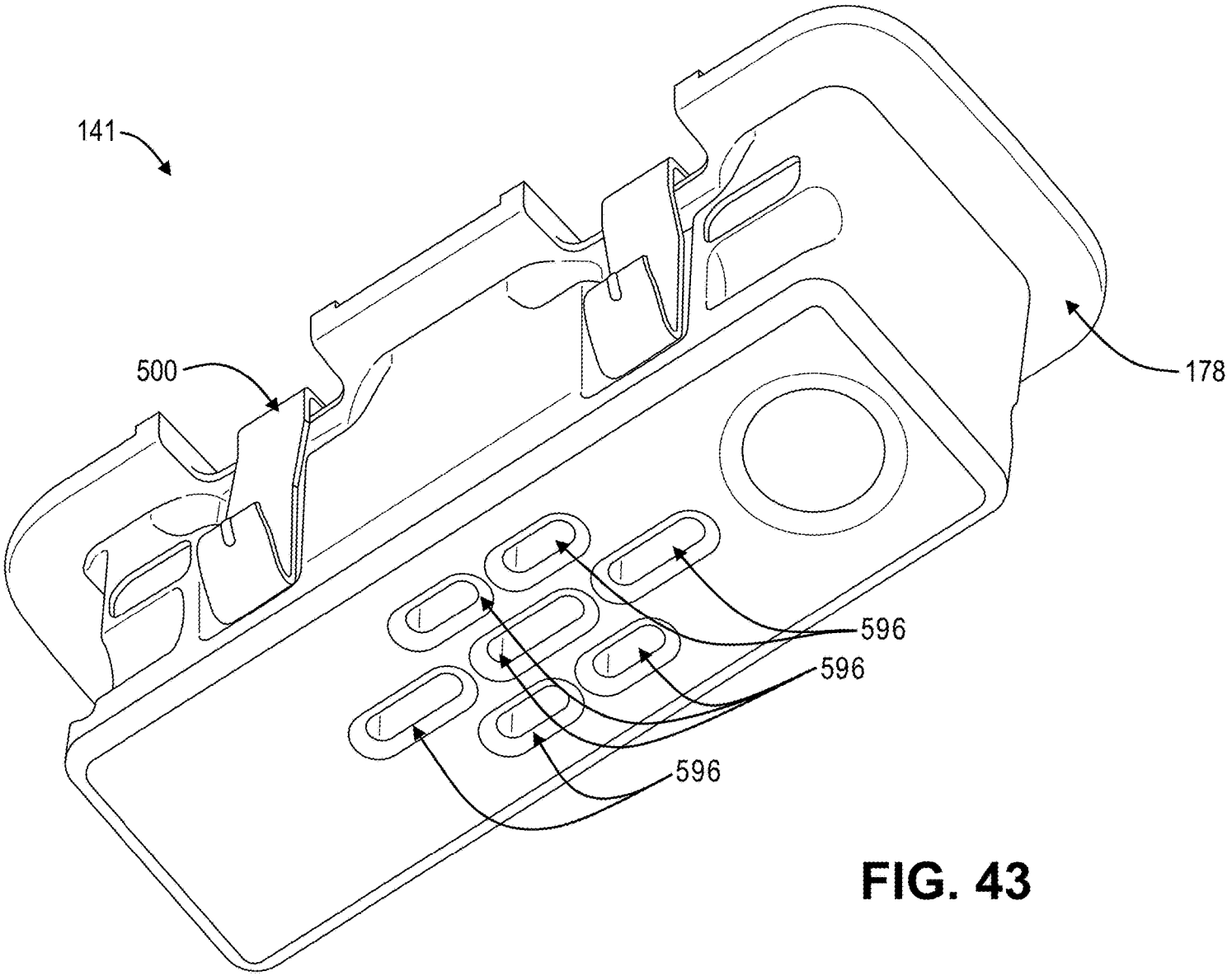
FIG. 43 depicts a bottom perspective view of an atomizer assembly consistent with implementations of the current subject matter.

The heat shield 518A includes one or more slots 590 (e.g., three slots) at one end that align with one or more slots (e.g., one, two, three, four, five, six, or seven or more slots) 596 formed in a portion of the wick housing 1315 opposite the opening 593, such as a base of the wick housing 1315 (see FIGS. 32 and 43). The one or more slots 590, 596 allow for the escape of pressure caused by the flow of liquid vaporizable material within the heating portion 504 and vaporization of vaporizable material, without affecting liquid flow of the vaporizable material.

In some implementations, flooding may occur between the heating element 1350 (e.g., the legs 506) and an outer wall of the wick housing 1315 (or between portions of the heating element 1350). For example, liquid vaporizable material may build up due to capillary pressure between the legs 506 of the heating element 1350 and the outer wall of the wick housing 1315, as indicated by liquid path 599. In such cases, there may be sufficient capillary pressure to draw the liquid vaporizable material out of the reservoir and/or the heating portion 504. To help limit and/or prevent liquid vaporizable material from escaping the internal volume of the wick housing 1315 (or the heating portion 504), the wick housing 1315 and/or the heating element 1350 may include a capillary feature that causes an abrupt change in capillary pressure, thereby forming a liquid barrier that prevents the liquid vaporizable material from passing the feature without the use of an additional seal (e.g., a hermetic seal). The capillary feature may define a capillary break, formed by a sharp point, bend, curved surface, or other surface in the wick housing 1315 and/or the heating element 1350. The capillary feature allows a conductive element (e.g., the heating element 1350) to be positioned within both a wet and dry region.

The capillary feature may be positioned on and/or form a part of the heating element 1350 and/or the wick housing 1315 and causes an abrupt change in capillary pressure. For example, the capillary feature may include a bend, sharp point, curved surface, angled surface, or other surface feature that causes an abrupt change in capillary pressure between the heating element and the wick housing, along a length of the heating element, or another component of the vaporizer cartridge. The capillary feature may also include a protrusion or other portion of the heating element and/or wick housing that widens a capillary channel, such as a capillary channel formed between portions of the heating element, between the heating element and the wick housing, and the like, that is sufficient to reduce the capillary pressure within the capillary channel (e.g., the capillary feature spaces the heating element from the wick housing) such that the capillary channel does not draw liquid into the capillary channel. Thus, the capillary feature prevents or limits liquid from flowing along a liquid path beyond the capillary feature, due at least in part to the abrupt change and/or reduction in capillary pressure. The size and/or shape of the capillary feature (e.g., the bend, sharp point, curved surface, angled surface, protrusion, and the like) may be a function of a wetting angle formed between materials, such as the heating element and wick housing, or other walls of a capillary channel formed between components, may be a function of a material of the heating element and/or the wick housing or other component, and/or may be a function of a size of a gap formed between two components, such as the heating element and/or wick housing defining the capillary channel, among other properties.

Figure 34B:
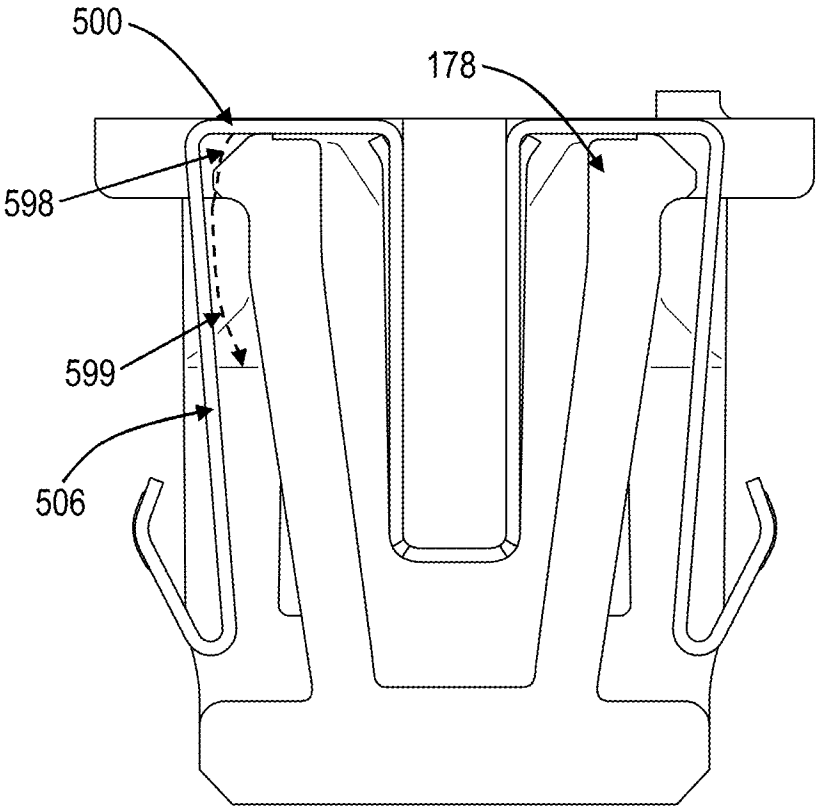
FIG. 34B depicts another side cross-sectional view of an atomizer assembly consistent with implementations of the current subject matter.
Figure 34A:
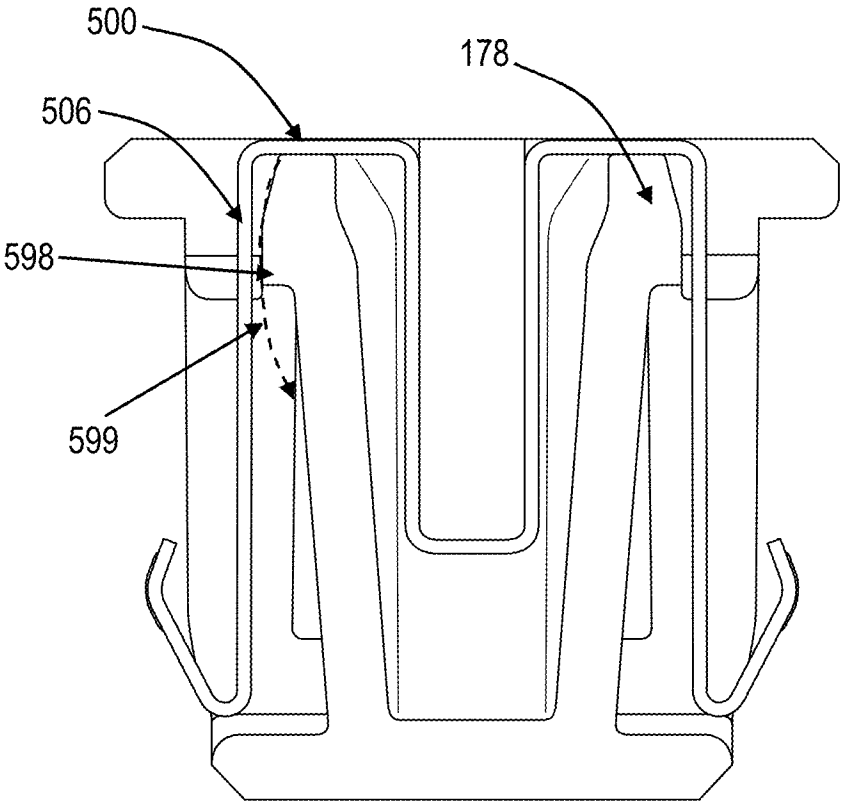
FIG. 34A depicts a side cross-sectional view of an atomizer assembly consistent with implementations of the current subject matter.

As an example, FIGS. 34A and 34B depict the wick housing 1315 having a capillary feature 598 that causes an abrupt change in capillary pressure. The capillary feature 598 prevents or limits liquid from flowing along the liquid path 599 beyond the capillary feature 598, and helps to prevent liquid from pooling between the legs 506 and the wick housing 1315. The capillary feature 598 on the wick housing 1315 spaces the heating element 1350 (e.g., a component made of metal, etc.) away from the wick housing 1315 (e.g., a component made of plastic, etc.), thereby reducing the capillary strength between the two components. The capillary feature 598 shown in FIGS. 34A and 34B also includes a sharp edge at an end of an angled surface of the wick housing that limits or prevents liquid from flowing beyond the capillary feature 598.

As shown in FIG. 34B, the legs 506 of the heating element 1350 may also be angled inwardly towards the interior volume of the heating element 1350 and/or wick housing 1315. The angled legs 506 may form a capillary feature that helps to limit or prevent liquid from flowing over an outer surface of the heating element and along the legs 506 of the heating element 1350.

As another example, the heating element 1350 may include a capillary feature (e.g., a bridge 585) that is formed with the one or more legs 506 and spaces the legs 506 away from the heating portion 504. The bridge 585 may be formed by folding the heating element 1350 along the fold lines 520, 522. In some implementations, the bridge 585 helps to reduce or eliminate overflow of vaporizable material from the heating portion 504, such as due to capillary action. In some examples, such as the example heating elements 1350 shown in FIGS. 25A-30B, the bridge 585 is angled and/or includes a bend to help limit fluid flow out of the heating portion 504.

As another example, the heating element 1350 may include a capillary feature 598 that defines a sharp point to causes an abrupt change in capillary pressure, thereby preventing liquid vaporizable material from flowing beyond the capillary feature 598. The capillary feature 598 may form an end of the bridge 585 that extends outwardly away from the heating portion by a distance that is greater than a distance between the legs 506 and the heating portion 504. The end of the bridge 585 may be a sharp edge to further help prevent liquid vaporizable material from passing to the legs 506 and/or out of the heating portion 504, thereby reducing leaking and increasing the amount of vaporizable material that remains within the heating portion 504.

Figure 35:
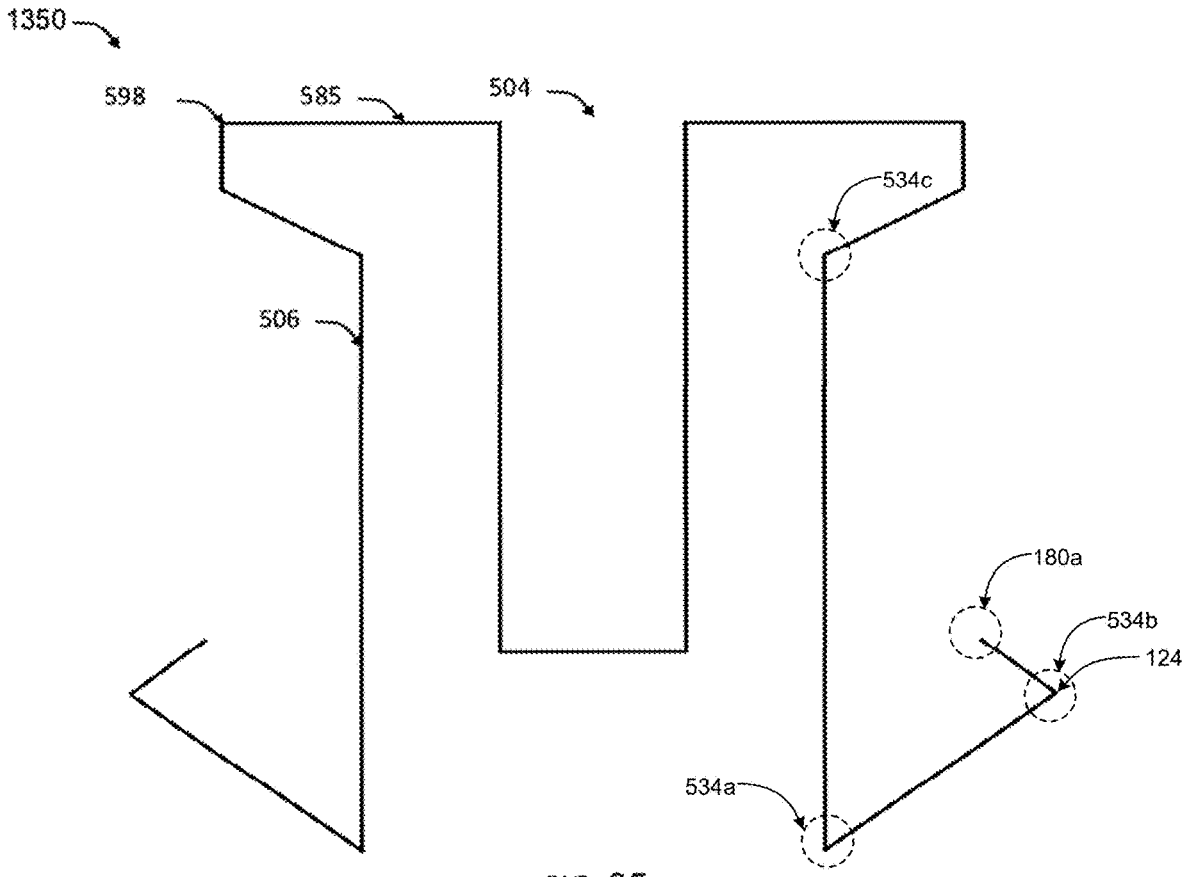
FIG. 35 depicts a schematic diagram illustrating an example of a heating element consistent with implementations of the current subject matter.
Figure 36:
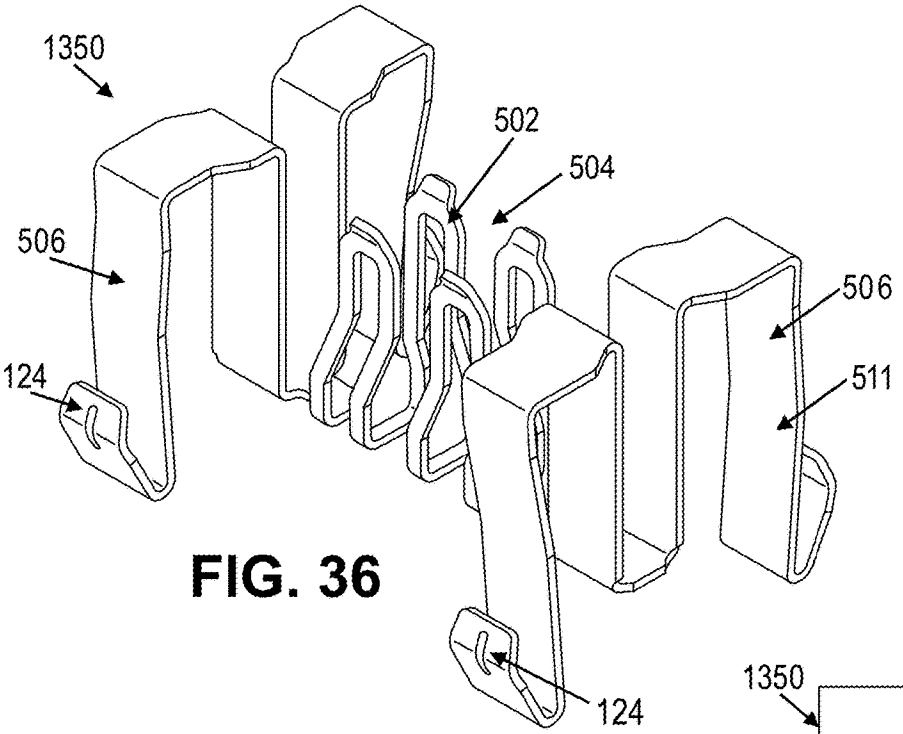
FIG. 36 depicts a perspective view of a heating element in a bent position consistent with implementations of the current subject matter.
Figure 37:
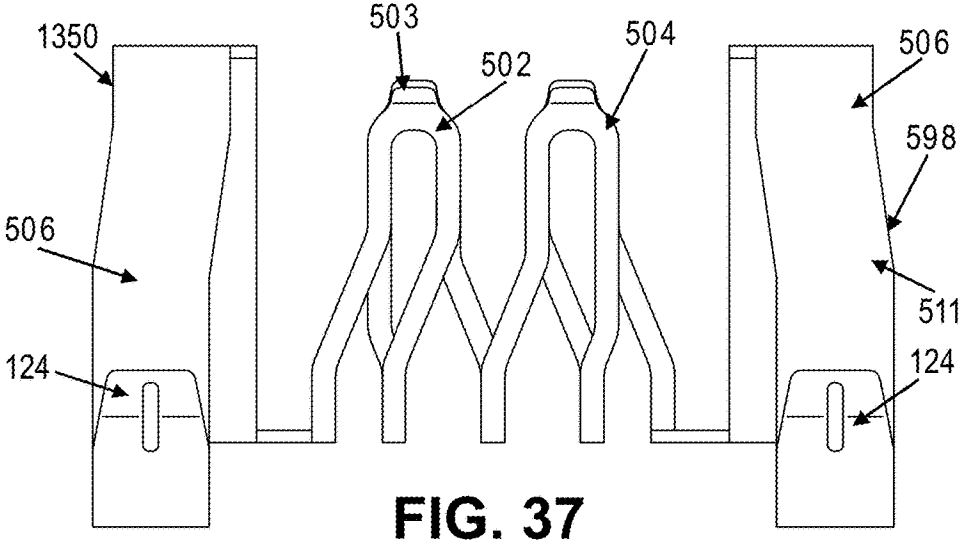
FIG. 37 depicts a side view of a heating element in a bent position consistent with implementations of the current subject matter.

FIGS. 35-37 illustrate a variation of the heating element 1350 shown in FIGS. 19-24. In this variation of the heating element 1350, the legs 506 of the heating element 1350 include a bend at an inflection region 511. The bend in the legs 506 may form a capillary feature 598, which helps to prevent liquid vaporizable material from flowing beyond the capillary feature 598. For example, the bend may create an abrupt change in capillary pressure, which may also help to limit or prevent liquid vaporizable material from flowing beyond the bend and/or from pooling between the legs 506 and the wick housing 1315, and may help to limit or prevent liquid vaporizable material from flowing out of the heating portion 504.

As shown in FIG. 35, the legs 506 may be bent to create one or more joints including, for example, a first joint 534*a*, a second joint 534*b*, and a third joint 534*c*. In the example of the heating element 1350 shown in FIG. 35-37, the legs 506 may be bent such that the first joint 534*a* may be disposed between the second joint 534*b* and the third joint 534*c* while the second joint may be disposed between the tip 180*a* (of the legs 506) and the first joint 534*a*. Moreover, the plating material 550 and the cartridge contact 124 may be disposed at the second joint 534*b*. Bending the legs 506 in this manner may at least spring load the legs 506 such that the legs of the 506 may form a mechanical coupling (e.g., a frictional engagement) with the receptacle contacts 125 in the receptacle 118 of the vaporizer body 110.

Figure 38:
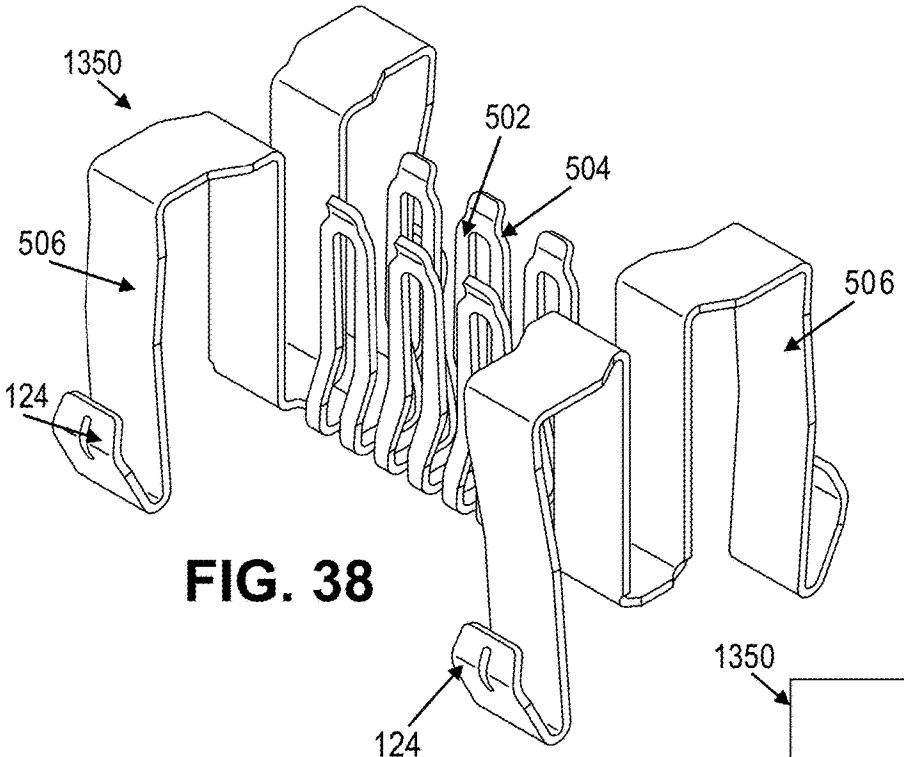
FIG. 38 depicts a perspective view of a heating element in a bent position consistent with implementations of the current subject matter.
Figure 39:
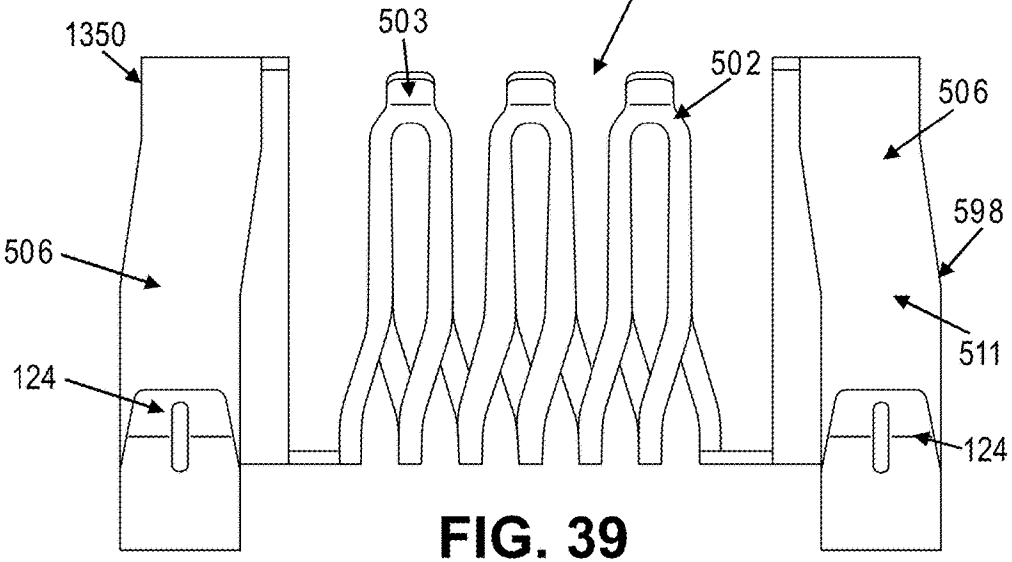
FIG. 39 depicts a side view of a heating element in a bent position consistent with implementations of the current subject matter.
Figure 41:
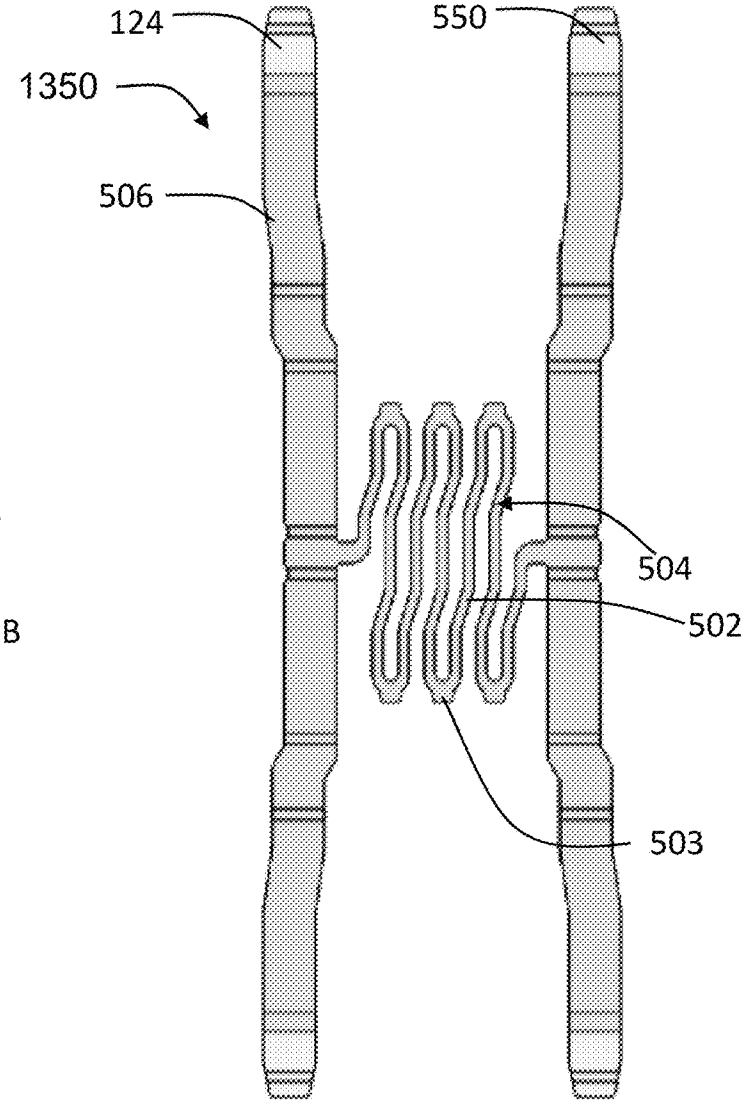
FIG. 41 depicts a top view of a heating element in an unbent position consistent with implementations of the current subject matter.
Figure 40:
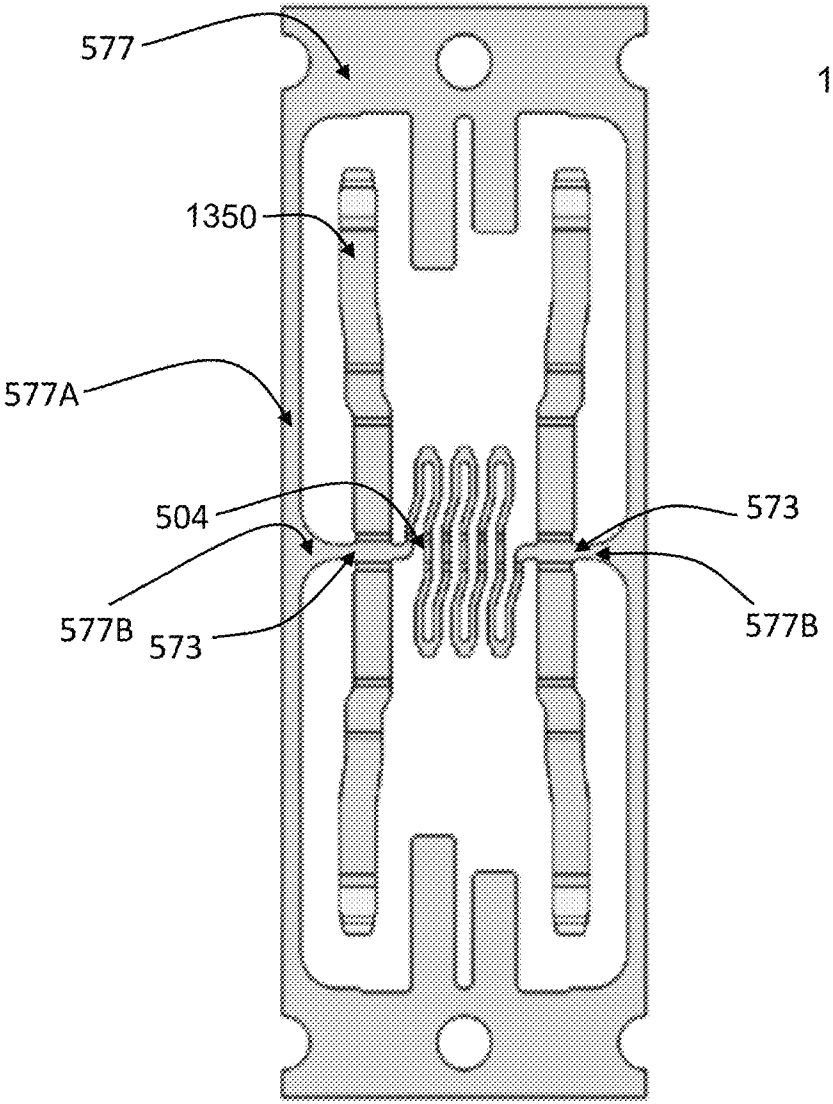
FIG. 40 depicts a top view of a substrate material with a heating element consistent with implementations of the current subject matter.

FIGS. 38-39 illustrate another variation of the heating elements 1350 consistent with implementations of the current subject matter. In this variation of the heating element 1350, the legs 506 of the heating element 1350 include a bend at an inflection region 511. The bend in the legs 506 may form a capillary feature 598, which helps to prevent liquid vaporizable material from flowing beyond the capillary feature 598. For example, the bend may create an abrupt change in capillary pressure, which also helps to limit or prevent liquid vaporizable material from flowing beyond the bend and/or from pooling between the legs 506 and the wick housing 1315, and may help to limit or prevent liquid vaporizable material from flowing out of the heating portion 504.

FIGS. 18A-E depicts another variation of the heating element 1350 consistent with implementations of the current subject matter. In some implementations of the current subject matter, the tip portions 180A of the retainer portions 180 of the legs 506 of the heating element 1350 are bent inward (instead of outward in the manner shown, for example, in FIGS. 19-22). Each of the legs 506 may include and/or define a cartridge contact 124 that is configured to contact a corresponding receptacle contact 125 of the vaporizer 100. For example, each pair of legs 506 (and the cartridge contacts 124) may contact a single receptacle contact 125. The legs 506 may be spring-loaded to allow the legs 506 to maintain contact with the receptacle contacts 125. The legs 506 may include a portion that extends along a length of the legs 506 that is curved to help to maintain contact with the receptacle contacts 125. Spring-loading the legs 506 and/or the curvature of the legs 506 may help to increase and/or maintain consistent pressure between the legs 506 and the receptacle contacts 125. In some implementations, the legs 506 are coupled with a support 176 that helps to increase and/or maintain consistent pressure between the legs 506 and the receptacle contacts 125. The support 176 may include plastic, rubber, or other materials to help maintain contact between the legs 506 and the receptacle contacts 125. In some implementations, the support 176 is formed as a part of the legs 506.

Figure 51A:
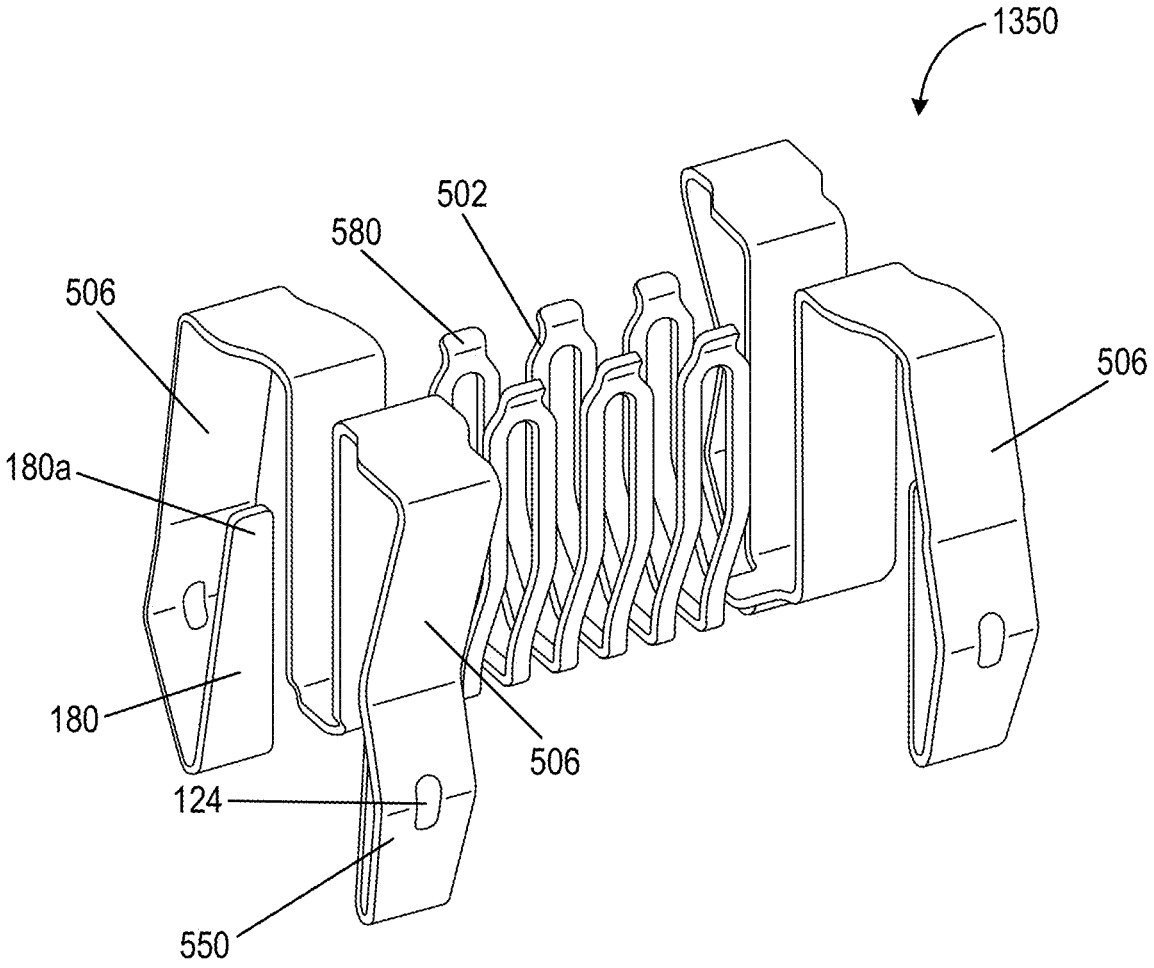
FIG. 51A depicts a perspective view of another example of a heating element consistent with implementations of the current subject matter.
Figure 51B:
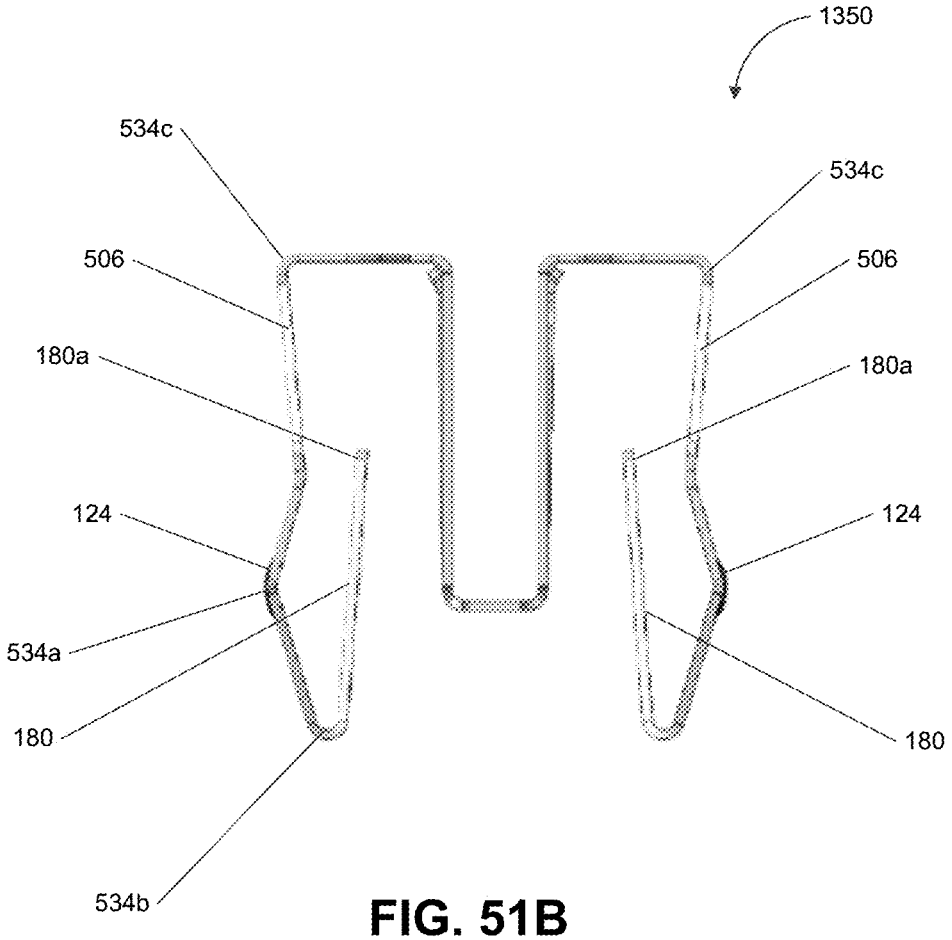
FIG. 51B depicts a side view of another example of a heating element consistent with implementations of the current subject matter.
Figure 51C:
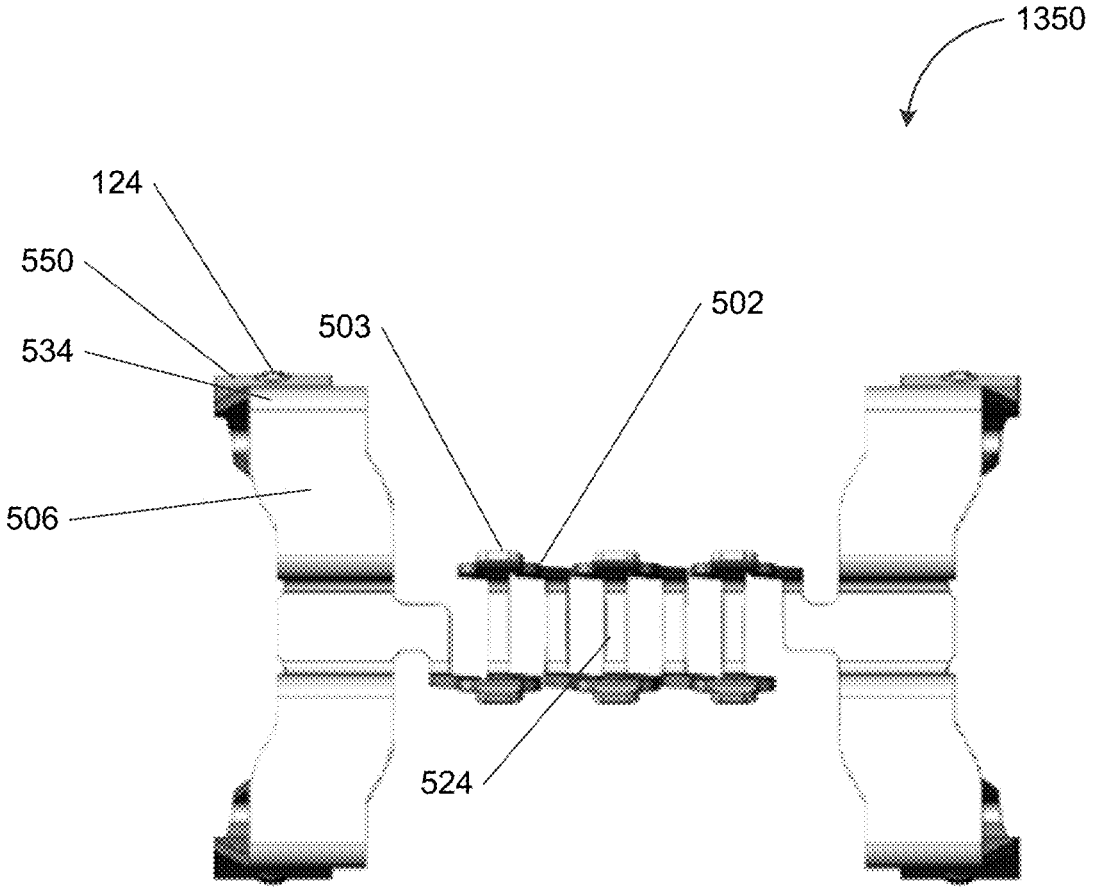
FIG. 51C depicts a frontal view of another example of a heating element consistent with implementations of the current subject matter.
Figure 51D:
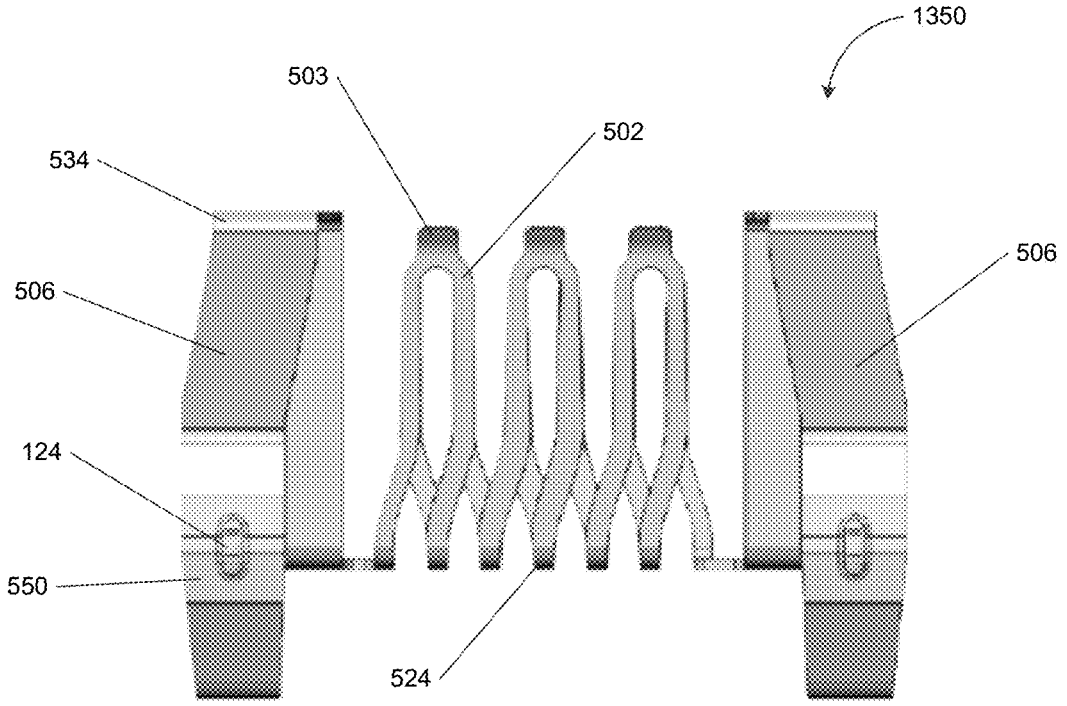
FIG. 51D depicts a top view of another example of a heating element consistent with implementations of the current subject matter.

FIGS. 51A-D depict another variation of the heating element 1350 consistent with implementations of the current subject matter. In some implementations of the current subject matter, the tip portions 180A of the retainer portions 180 of the legs 506 of the heating element 1350 are bent inward (instead of outward in the manner shown, for example, in FIGS. 19-22). While the retainer portions 180 of the legs 506 are positioned within a corresponding recess in the wick housing 1315, the tip portions 180A of the retainer portions 180 may contact the wick housing 1315. As shown in FIG. 51B, folding the legs 506 in this manner may form one or more joints including, for example, a first joint 534*a*, a second joint 534*b*, and a third joint 534*c*. Further as shown in FIG. 51B, the first joint 534*a* may be disposed between the second joint 534*b* and the third joint 534*c* while the second joint 534*b* may be disposed between the tip 180*a* and the first joint 534*a*. In the example of the heating element 1350 shown in FIGS. 51A-D, the cartridge contacts 124 and the plating material 550 may be disposed at the first joint 534*a* in the legs 506. Bending the legs 506 of the heating element 1350 in this manner may spring load the legs 506 such that the legs of the 506 may form a mechanical coupling (e.g., a frictional engagement) with the receptacle contacts 125 in the receptacle 118 of the vaporizer body 110.

For example, as shown in FIG. 51B, a first fold in the legs 506 of the heating element 1350 may bend the tip portions 180A of the retainer portions 180 of the legs 506 inward and form the second joint 534*b*. While the retainer portions 180 of the legs 506 may secure the heating element 1315 to the wick housing 1315 (e.g., by being disposed in corresponding recesses in the wick housing 1315), a second fold in the legs 506 of the heating element 1350, which may form the first joint 534*a*, may provide spring tension to further secure the vaporizer cartridge 1320 to the vaporizer body 110. That is, while the cartridge contacts 124 are electrically coupled with the receptacle contacts 125, the first joint 534*a* formed by the second fold in the legs 506 may exert sufficient pressure against the cartridge receptacle 118 to secure the vaporizer cartridge 1320 to the vaporizer body 110. It should be appreciated that this configuration of the heating element 1350 may be associated with a minimal stress at the third joint 534*c* in the heating element 1350 where the heating element 1350 is folded a third time at least because of the force of the legs 506 against the cartridge receptacle 118 being distributed more evenly along the length of the legs 506.

Figure 42A:
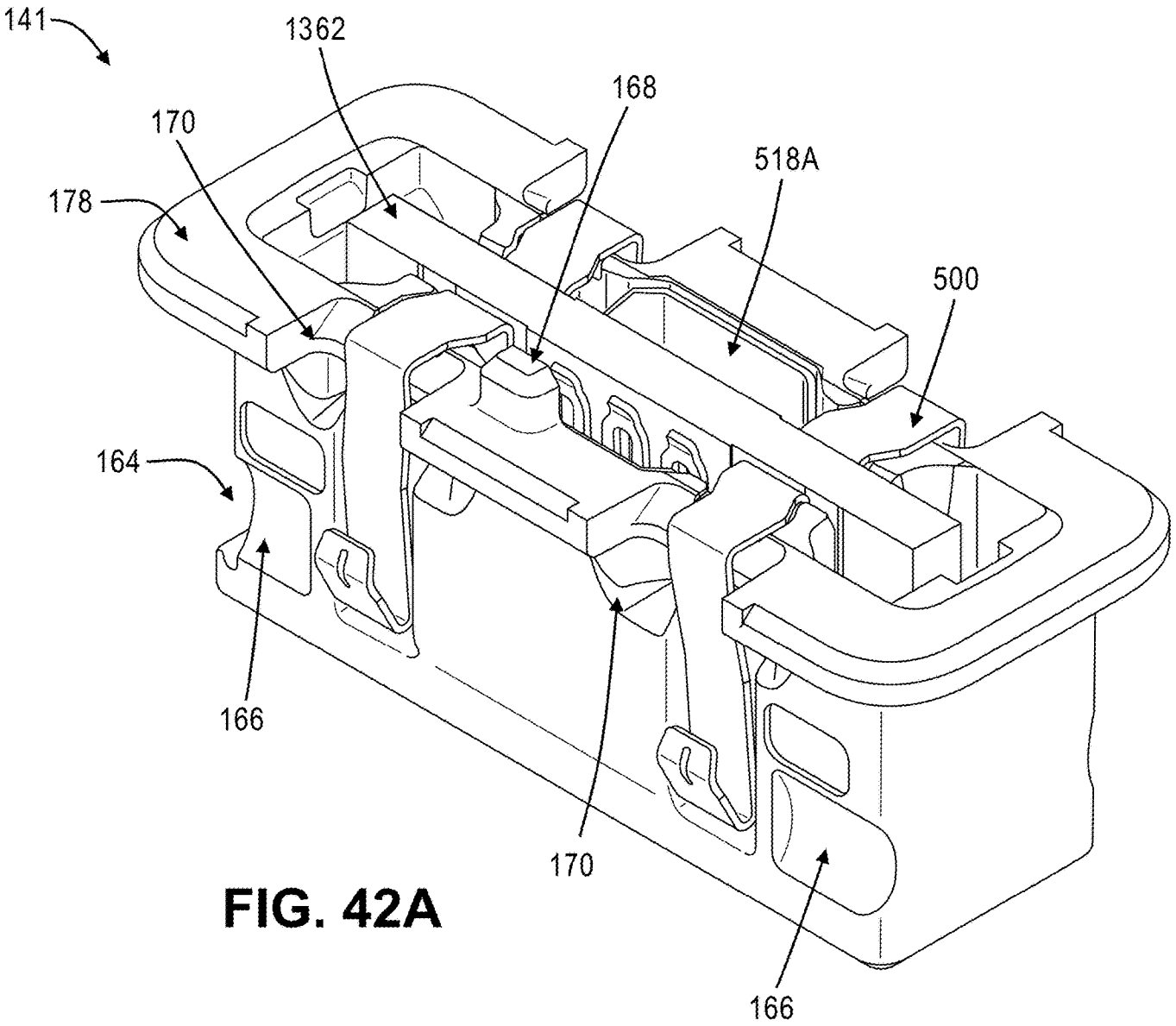
FIG. 42A depicts a top perspective view of an atomizer assembly consistent with implementations of the current subject matter.
Figure 42B:
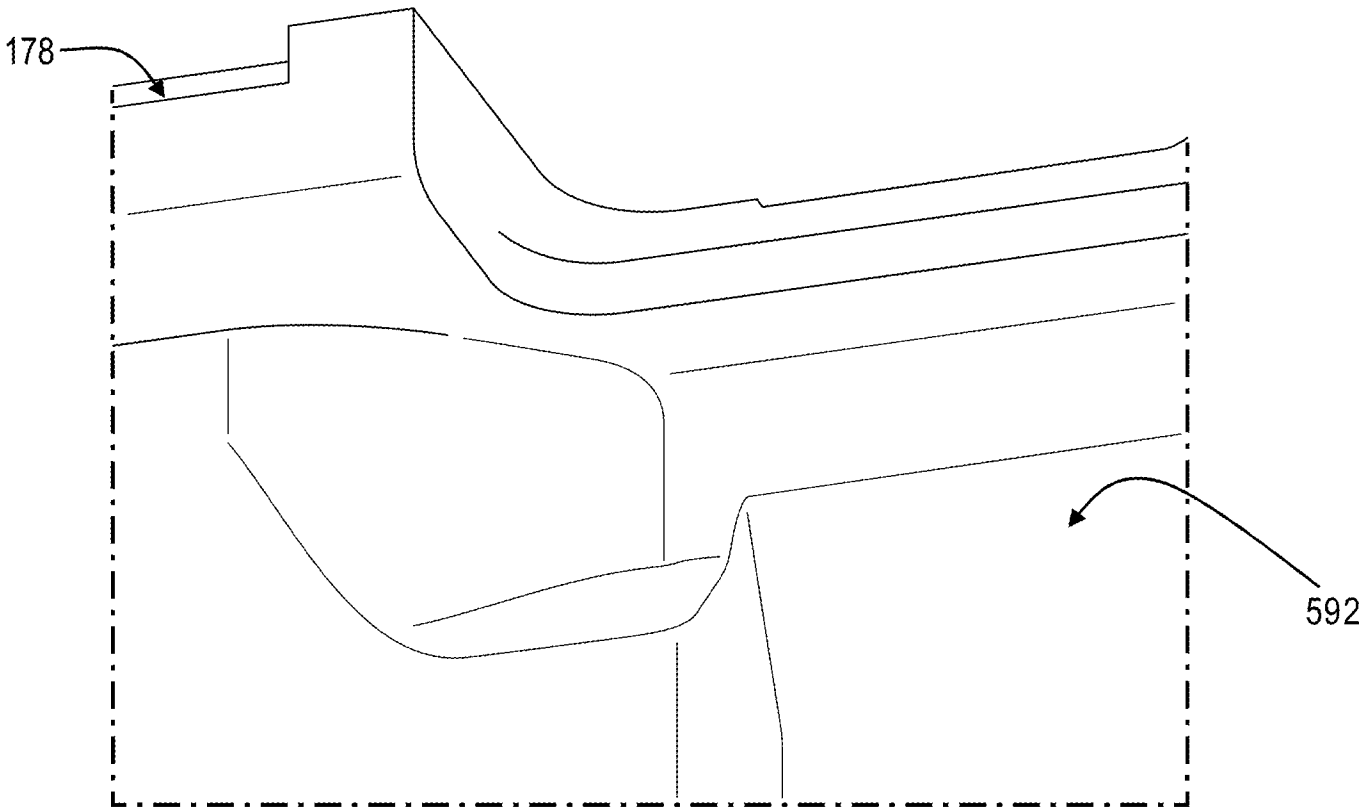
FIG. 42B depicts a close-up view of a portion of a wick housing of an atomizer assembly consistent with implementations of the current subject matter.
Figure 44:
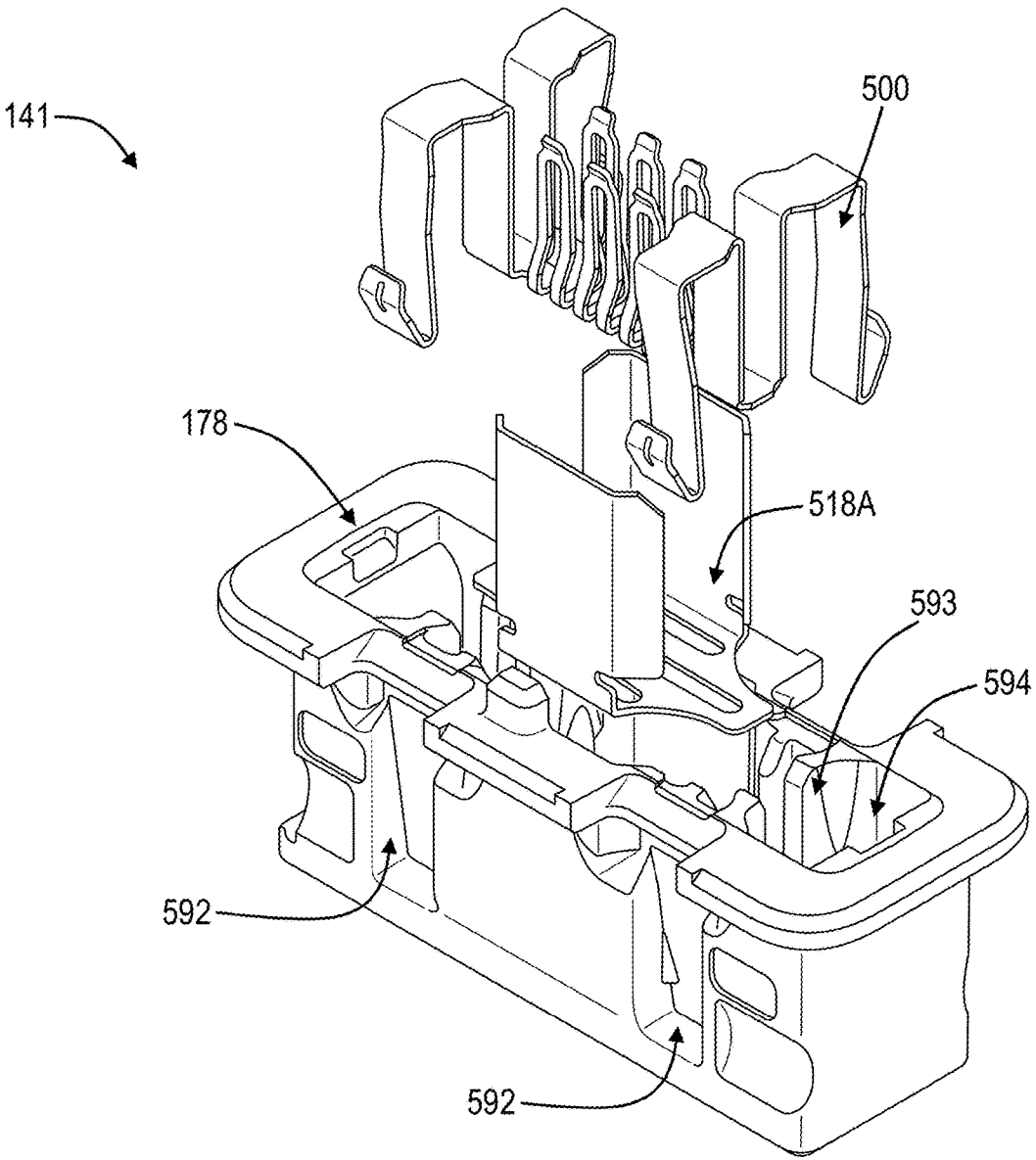
FIG. 44 depicts an exploded perspective view of an atomizer assembly consistent with implementations of the current subject matter.

FIGS. 42A-B and 43 depict another example of the atomizer assembly 141, with the heating element 1350 assembled with the wick housing 1315 and the heat shield 518A, and FIG. 44 illustrates an exploded view of the atomizer assembly 141, consistent with implementations of the current subject matter. The wick housing 1315 may be made of plastic, polypropylene, and the like. The wick housing 1315 includes four recesses 592 in which at least a portion of each of the legs 506 of the heating element 1350 may be positioned and secured. Within the recesses 592, the wick housing 1315 may include one or more wick housing retention features 172 configured to secure the heating element 1350 to the wick housing 1315, such as, for example, via a snap-fit arrangement between at least a portion of the legs 506 of the heating element 1350 and the wick housing retention features 172. The wick housing retention features 172 may also help to space the heating element 1350 from a surface of the wick housing 1315, to help prevent heat from acting on the wick housing and melting a portion of the wick housing 1315.

As shown, the wick housing 1315 also includes an opening 593 providing access to an internal volume 594, in which at least the heating portion 504 of the heating element 1350 and the wicking element 1362 are positioned.

The wick housing 1315 may also include one or more other cutouts that help to space the heating element 1350 from a surface of the wick housing 1315 to reduce the amount of heat that contacts the surface of the wick housing 1315. For example, the wick housing 1315 may include cutouts 170. The cutouts 170 may be formed along an outer surface of the wick housing 1315 proximate to the opening 593. The cutouts 170 may also include a capillary feature, such as the capillary feature 598. The capillary feature of the cutouts 170 may define a surface (e.g., curved surface) that breaks tangency points between adjacent (or intersecting) walls (such as the walls of the wick housing). The curved surface may have a radius that is sufficient to reduce or eliminate the capillarity formed between the adjacent outer walls of the wick housing.

Referring to FIG. 42A, the wick housing 1315 may include a tab 168. The tab 168 may help to properly position and/or orient the wick housing during assembly of the vaporizer cartridge, with respect to one or more other components of the vaporizer cartridge. For example, added material forming the tab 168 shifts the center of mass of the wick housing 1315. Due to the shifted center of mass, the wick housing 1315 may rotate or slide in a certain orientation to align with a corresponding feature of another component of the vaporizer cartridge during assembly.

Figure 46:
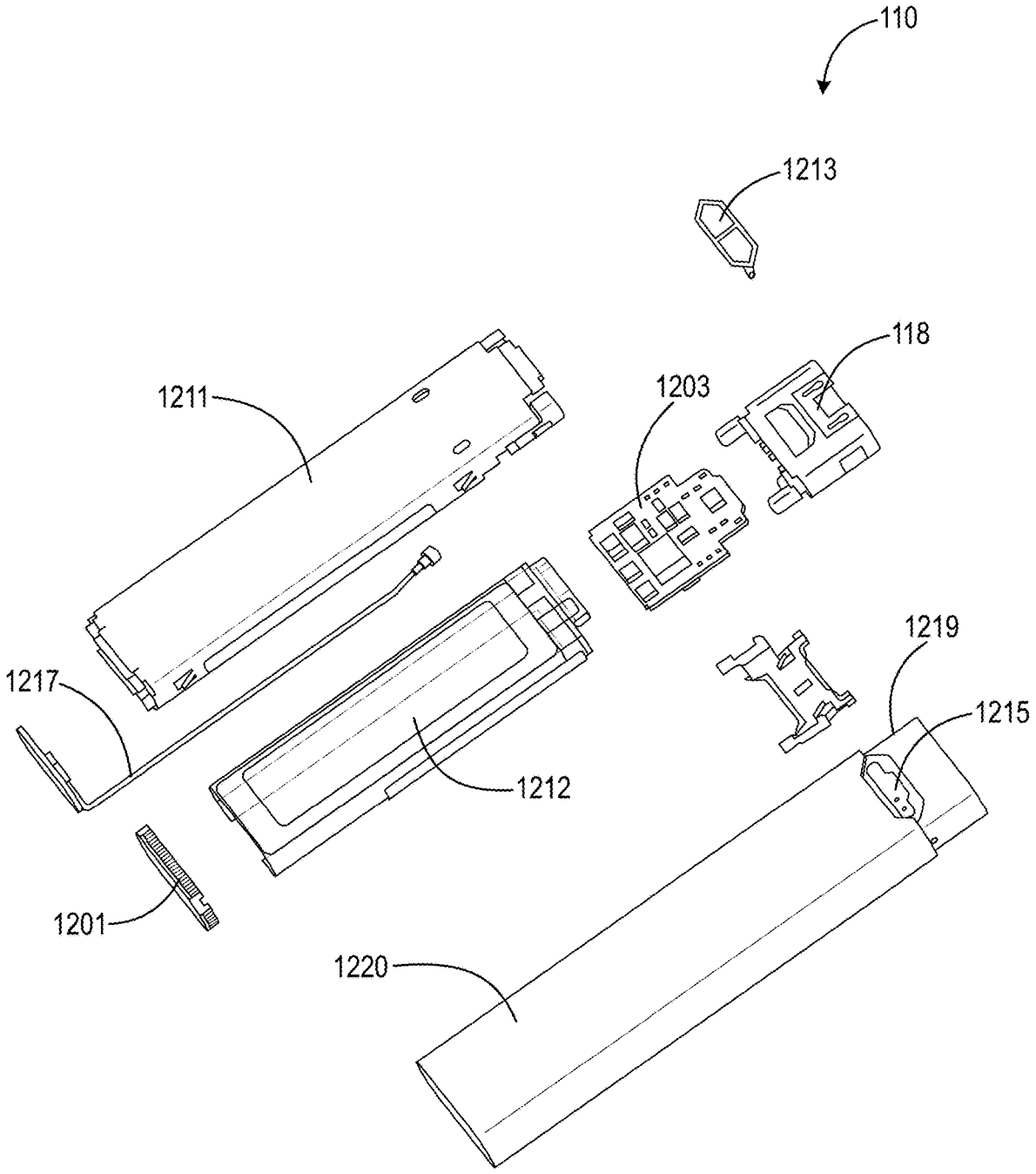
FIG. 46 depicts an exploded view of a vaporizer device consistent with implementations of the current subject matter.

FIG. 46 illustrates an exploded view of an example of the vaporizer body 110 consistent with implementations of the current subject matter. In some implementations of the current subject matter, the vaporizer body 110 may be configured to receive and/or couple with a cartridge having various features described above including, for example, the cartridge 1320 having the collector 1313, the finned condensate collector 352, and/or the like.

As shown in FIG. 46, the vaporizer body 110 may include a shell 1220 including a cosmetic sheath 1219, a battery 1212, a printed circuit board assembly (PCBA) 1203, an antenna 1217, a skeleton 1211, a charge badge 1213, the cartridge receptacle 118, and end cap 1201, and an LED badge 1215. In some aspects, assembly of the vaporizer body 110 includes placing the battery 1212 within the skeleton 1211 at an inferior end of the skeleton 1211 (left-hand side of FIG. 46). The antenna 1217 may be coupled to an inferior end of the battery 1212. The cartridge receptacle 118, the PCBA 1203, and the battery 1212 may be mechanically coupled, for example, via one or more coupling means. For example, an inferior end of the PCBA 1203 may be coupled to a superior end of the battery 1212 and a superior end of the PCBA 1203 may be coupled to the cartridge receptacle 118 using press fits, solder joints, and/or any other coupling means. The cosmetic sheath 1219 may be configured to at least partially surround the cartridge receptacle 118 when the cartridge receptacle 118 is disposed in the cosmetic sheath 1219.

As shown in FIG. 46, the cosmetic sheath 1219 may include an aperture sized and shaped to receive the charge badge 1213 on a first side of the cosmetic sheath 1219. A second side of the cosmetic sheath 1219 may include the LED badge 1215, which may be built into the cosmetic sheath 1219 or disposed in another aperture sized and shaped to receive the LED badge 1215. In some aspects, the cosmetic sheath 1219 may include a stainless steel material and may have a thickness of approximately 0.2 mm. The LED badge 1215 may be molded with a black printed circuit. In some aspects, the charge badge 1213 may include a liquid crystal polymer (LCP), polycarbonate, and/or phosphor bronze contacts. The charge badge 1213 may minimize distance between charge pads by using a mylar film. A plating of the charge badge may include palladium-nickel, black nickel, physical vapor deposition (PVD), or another black plating option. In some implementations, the assembled battery 1212, PCBA 1203, a cartridge receptacle 118, and cosmetic sheath 1219 may be configured to fit within the skeleton 1211 and the skeleton 1211 may be configured to fit within the shell 1220. In some aspects, the cosmetic sheath 1219 may include a stainless steel material with a thickness of 0.2 mm. The shell 1220 may include grounding pads, an endcap datum, an LED interface, one or more air inlets (that are in fluid communication with the slots 596 at the bottom of the wick housing 1315 when the cartridge 1320 is coupled with the vaporizer body 110), and a skeleton snap feature where the skeleton 1211 snaps into place when inserted into the shell 1220. The end cap 1201 may be disposed at an inferior end of the shell 1220 opposite the cosmetic sheath 1219. The end cap 1201 may be configured to retain the interior components of the vaporizer body 210 within the shell 1220 and may also serve as a vent on the inferior end of the shell 1220.

In vaporizers in which the power source 112 is part of a vaporizer body 110 and a heating element is disposed in a vaporizer cartridge 1320 configured to couple with the vaporizer body 110, the vaporizer 100 may include electrical connection features (e.g., means for completing a circuit) for completing a circuit that includes the controller 104 (e.g., a printed circuit board, a microcontroller, or the like), the power source, and the heating element. These features may include at least two contacts 124 on a bottom surface of the vaporizer cartridge 1320 (referred to herein as cartridge contacts 124) and at least two contacts 125 disposed near a base of the cartridge receptacle (referred to herein as receptacle contacts 125) of the vaporizer 100 such that the cartridge contacts 124 and the receptacle contacts 125 make electrical connections when the vaporizer cartridge 1320 is inserted into and coupled with the cartridge receptacle 118. The circuit completed by these electrical connections can allow delivery of electrical current to the resistive heating element and may further be used for additional functions, such as for example for measuring a resistance of the resistive heating element for use in determining and/or controlling a temperature of the resistive heating element based on a thermal coefficient of resistivity of the resistive heating element, for identifying a cartridge based on one or more electrical characteristics of a resistive heating element or the other circuitry of the vaporizer cartridge, etc.

In some examples of the current subject matter, the at least two cartridge contacts and the at least two receptacle contacts can be configured to electrically connect in either of at least two orientations. For example, one or more circuits necessary for operation of the vaporizer can be completed by insertion of a vaporizer cartridge 1320 in the cartridge receptacle 118 in a first rotational orientation (around an axis along which the end of the vaporizer cartridge having the cartridge is inserted into the cartridge receptacle 118 of the vaporizer body 110) such that a first set of cartridge contacts of the at least two cartridge contacts 124 is electrically connected to a first set of receptacle contacts of the at least two receptacle contacts 125 and a second set of cartridge contacts of the at least two cartridge contacts 124 is electrically connected to a second set of receptacle contacts of the at least two receptacle contacts 125. Furthermore, the one or more circuits necessary for operation of the vaporizer can be completed by insertion of a vaporizer cartridge 1320 in the cartridge receptacle 118 in a second rotational orientation such that the first set of cartridge contacts of the at least two cartridge contacts 124 is electrically connected to the second set of receptacle contacts of the at least two receptacle contacts 125 and the second set of cartridge contacts of the at least two cartridge contacts 124 is electrically connected to the first set of receptacle contacts of the at least two receptacle contacts 125. This feature of a vaporizer cartridge 1320 being reversible insertable into a cartridge receptacle 118 of the vaporizer body 110 is described further below.

In one example of an attachment structure for coupling a vaporizer cartridge 1320 to the vaporizer body 110, the vaporizer body 110 includes one or more detents (e.g., a dimple, protrusion, spring connector, etc.) protruding inwardly from an inner surface the cartridge receptacle 118. One or more exterior surfaces of the vaporizer cartridge 1320 can include corresponding recesses (not shown in FIG. 1) that can fit and/or otherwise snap over such detents when an end of the vaporizer cartridge 1320 inserted into the cartridge receptacle 118 on the vaporizer body 110. When the vaporizer cartridge 1320 and the vaporizer body 110 are coupled (e.g., by insertion of an end of the vaporizer cartridge 1320 into the cartridge receptacle 118 of the vaporizer body 110), the detent into the vaporizer body 110 may fit within and/or otherwise be held within the recesses of the vaporizer cartridge 1320 to hold the vaporizer cartridge 1320 in place when assembled. Such a detent-recess assembly can provide enough support to hold the vaporizer cartridge 1320 in place to ensure good contact between the at least two cartridge contacts 124 and the at least two receptacle contacts 125, while allowing release of the vaporizer cartridge 1320 from the vaporizer body 110 when a user pulls with reasonable force on the vaporizer cartridge 1320 to disengage the vaporizer cartridge 1320 from the cartridge receptacle 118. For example, in one implementation of the current subject matter, at least two detents may be disposed on an exterior of the cosmetic sheath 1219. The detents on the exterior of the cosmetic sheath 1219 may be configured to engage one or more corresponding recesses in the vaporizer cartridge 1320, for example, in an interior surface of a portion of the housing of the vaporizer cartridge 1320 that extends below an open top of the cosmetic sheath 1219 (and cartridge receptacle 118) to cover at least a portion of the cosmetic sheath 1219 (and cartridge receptacle 118).

Further to the discussion above about the electrical connections between a vaporizer cartridge and a vaporizer body being reversible such that at least two rotational orientations of the vaporizer cartridge in the cartridge receptacle are possible, in some vaporizers the shape of the vaporizer cartridge, or at least a shape of the end of the vaporizer cartridge that is configured for insertion into the cartridge receptacle may have rotational symmetry of at least order two. In other words, the vaporizer cartridge or at least the insertable end of the vaporizer cartridge may be symmetric upon a rotation of 180° around an axis along which the vaporizer cartridge is inserted into the cartridge receptacle. In such a configuration, the circuitry of the vaporizer may support identical operation regardless of which symmetrical orientation of the vaporizer cartridge occurs. In some aspects, the first rotational position may be more than or less than 180° from the second rotational position.

In some examples, the vaporizer cartridge, or at least an end of the vaporizer cartridge configured for insertion in the cartridge receptacle may have a non-circular cross section transverse to the axis along which the vaporizer cartridge is inserted into the cartridge receptacle. For example, the non-circular cross section may be approximately rectangular, approximately elliptical (e.g., have an approximately oval shape), non-rectangular but with two sets of parallel or approximately parallel opposing sides (e.g., having a parallelogram-like shape), or other shapes having rotational symmetry of at least order two. In this context, approximately having a shape indicates that a basic likeness to the described shape is apparent, but that sides of the shape in question need not be completely linear and vertices need not be completely sharp. Rounding of both or either of edges or vertices of the cross-sectional shape is contemplated in the description of any non-circular cross section referred to herein.

Figure 47C:
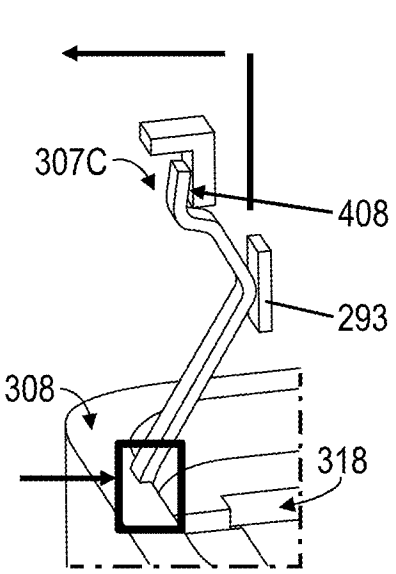
FIG. 47C depicts another example of receptacle contacts consistent with implementations of the current subject matter.
Figure 47B:
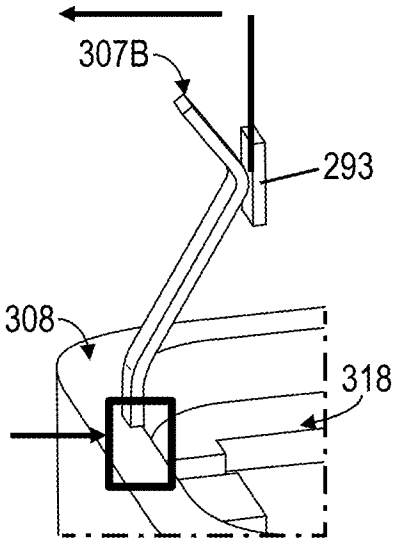
FIG. 47B depicts another example of receptacle contacts consistent with implementations of the current subject matter.
Figure 47A:
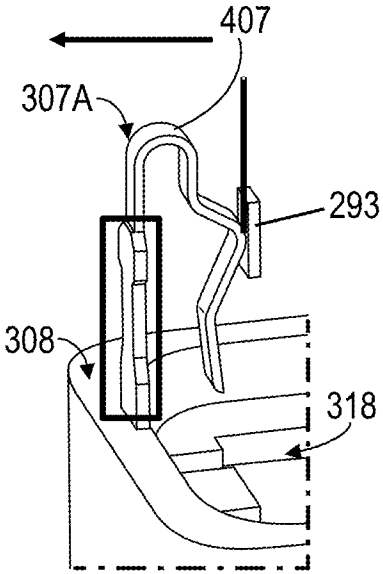
FIG. 47A depicts an example of receptacle contacts consistent with implementations of the current subject matter

FIGS. 47A-C depicts various examples of receptacle contacts 125 consistent with implementations of the current subject matter. FIG. 47A shows an example pod ID contact 307A extending from the pod ID overmold 308. The pod ID contact 307A may be configured to couple to a contact 293 of the identification chip 174. FIG. 47B shows another example pod ID contact 307B extending from the pod ID overmold 308. FIG. 47C depicts another example pod ID contact 307C extending from the pod ID overmold 308.

As shown in FIGS. 47A-C, the cartridge 1320 may be inserted into the cartridge receptacle 318 from the top of the page. In some aspects, as the cartridge 1320 is being inserted into the cartridge receptacle 318 the pod ID contacts 307A-

307C may compress inward, or to the left of the page, in response to the cartridge 1320 insertion. Additionally, the pod ID contacts 307A-307C may be configured to couple to one or more cartridge contacts 124 (e.g., contacts 293) after the cartridge 1320 has been fully inserted into the cartridge receptacle 318.

As shown in FIG. 47A, the pod ID contact 307A includes a 180° bend in the pod ID contact 307 a material at location 407. Pod ID contact 307C of FIG. 47C is similar to and adapted from pod ID contact 307B of FIG. 47B. As shown in FIG. 47C, the pod ID contact 307C includes a protective member, (e.g. foot or boot) 408 at least partially surrounding a portion of the pod ID contact 307C.

Figure 47D:
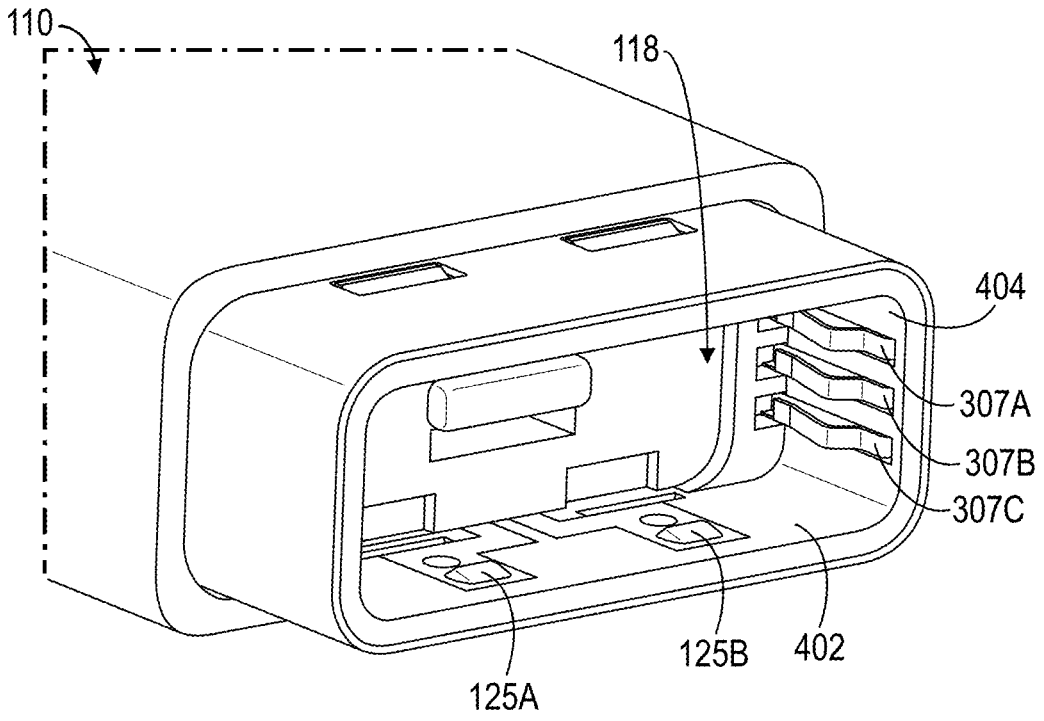
FIG. 47D depicts a perspective view of an example of a cartridge receptacle consistent with implementations of the current subject matter.

FIG. 47D shows an assembled cartridge receptacle 118 of the vaporizer body 110. As shown in FIG. 47D, the cartridge receptacle 118 includes one or more pod ID contacts including, for example, the pod ID contacts 307A, 307B, and 307C, on a first side 404 of the cartridge receptacle 418. FIG. 47D further illustrates two heater/cartridge receptacle contacts 125A and 125B on a second side 402 of the cartridge receptacle 118.

Figure 47E:
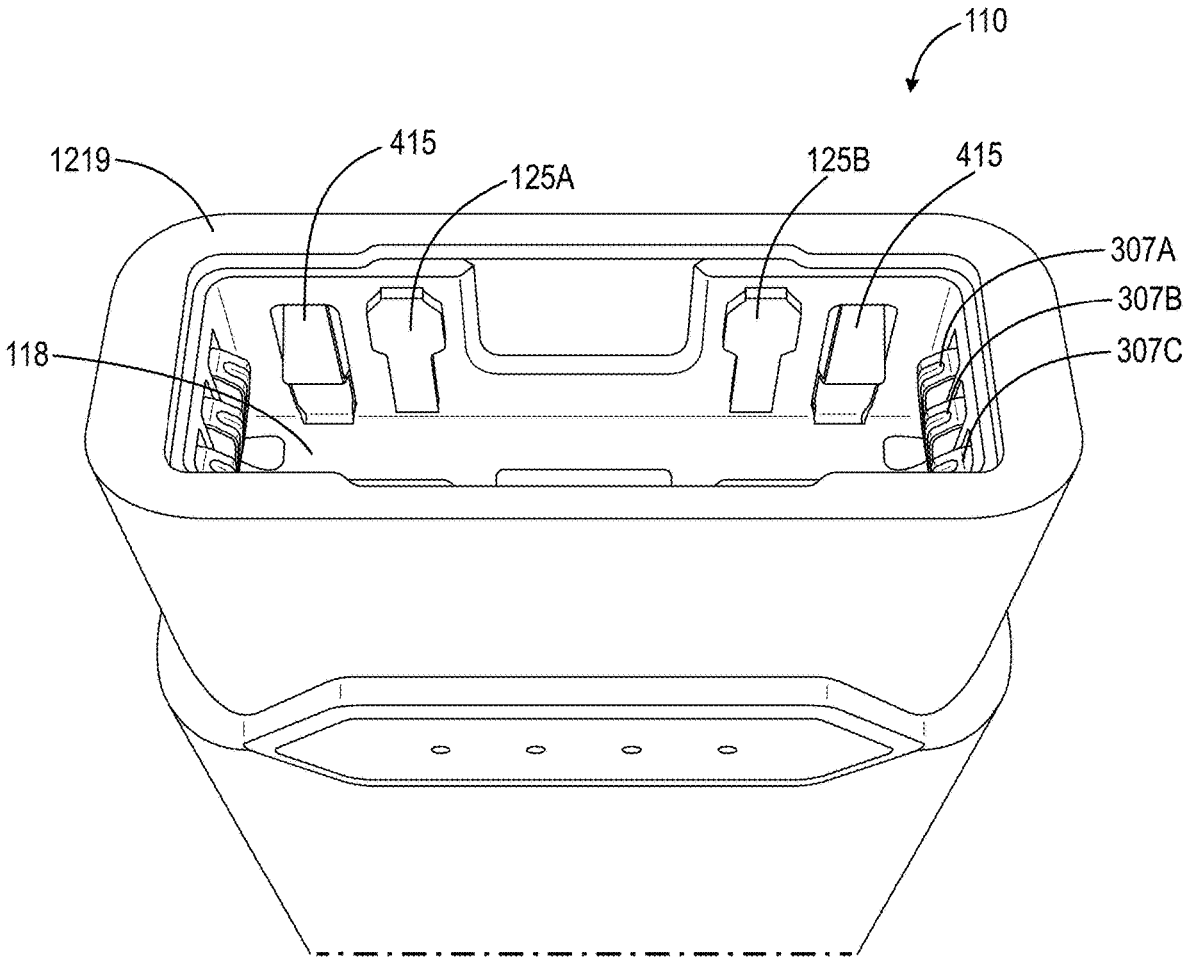
FIG. 47E depicts a top perspective view of a vaporizer body including an example of a cartridge receptacle consistent with implementations of the current subject matter.

FIG. 47E depicts a top perspective view of the vaporizer body 110 including an example of the cartridge receptacle 118 consistent with implementations of the current subject matter. As shown in FIG. 47E, the cartridge receptacle 118 may be disposed at least partially within the cosmetic sheath 1219. For example, in the example shown in FIG. 47E, the top rim of the cartridge receptacle 118 and the cosmetic sheath 1219 may be substantially flush. The interior of the cartridge receptacle 118 may include one or more pod ID contacts (e.g., the pod ID contacts 307A, 307B, and 307C) and one or more receptacle contacts (e.g., the receptacle contacts 125A and 125B). Moreover, the vaporizer body 110 may also include one or more pod retention features 415, which may be disposed on an interior of the cartridge receptacle 118 and/or an exterior of the cosmetic sheath 1219. Examples of the pod retention features 415 may include pins, clips, protrusions, detents, and/or the like. The pod retention features 415 may be configured to secure the cartridge 1320 within the cartridge receptacle 118 including by applying, against the cartridge 1320, a magnetic force, an adhesive force, a compressive force, a friction force, and/or the like.

In implementations where the pod retention features 415 are disposed inside the cartridge receptacle 118, the pod retention features 415 may be configured to form a mechanical coupling with, for example, at least a portion of the heating element 1350 (e.g., a portion of the one or more legs 506 disposed outside of the wick housing 1315) and/or a portion of the wick housing 1315 (e.g., the recesses in the wick housing 1315). Alternatively and/or additionally, in example implementations where the pod retention features 415 are disposed on an exterior of the cosmetic sheath 1219, the pod retention features 415 may be configured to form a mechanical coupling with the housing of the vaporizer cartridge 1320. It should be appreciated that the pod retention features 415 may include various means of securing the cartridge 1320 within the cartridge receptacle 118. Moreover, the pod retention features 415 may be disposed at any suitable location in the vaporizer body 110.

Figure 48A:
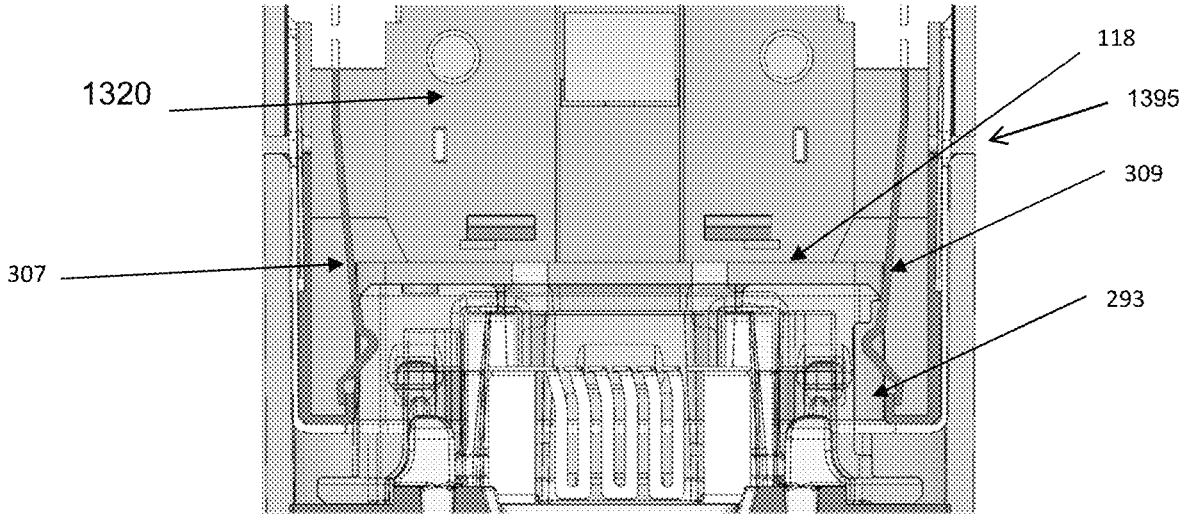
FIG. 48A depicts a side cut out view of a cartridge disposed within a cartridge receptacle consistent with implementations of the current subject matter.
Figure 48B:
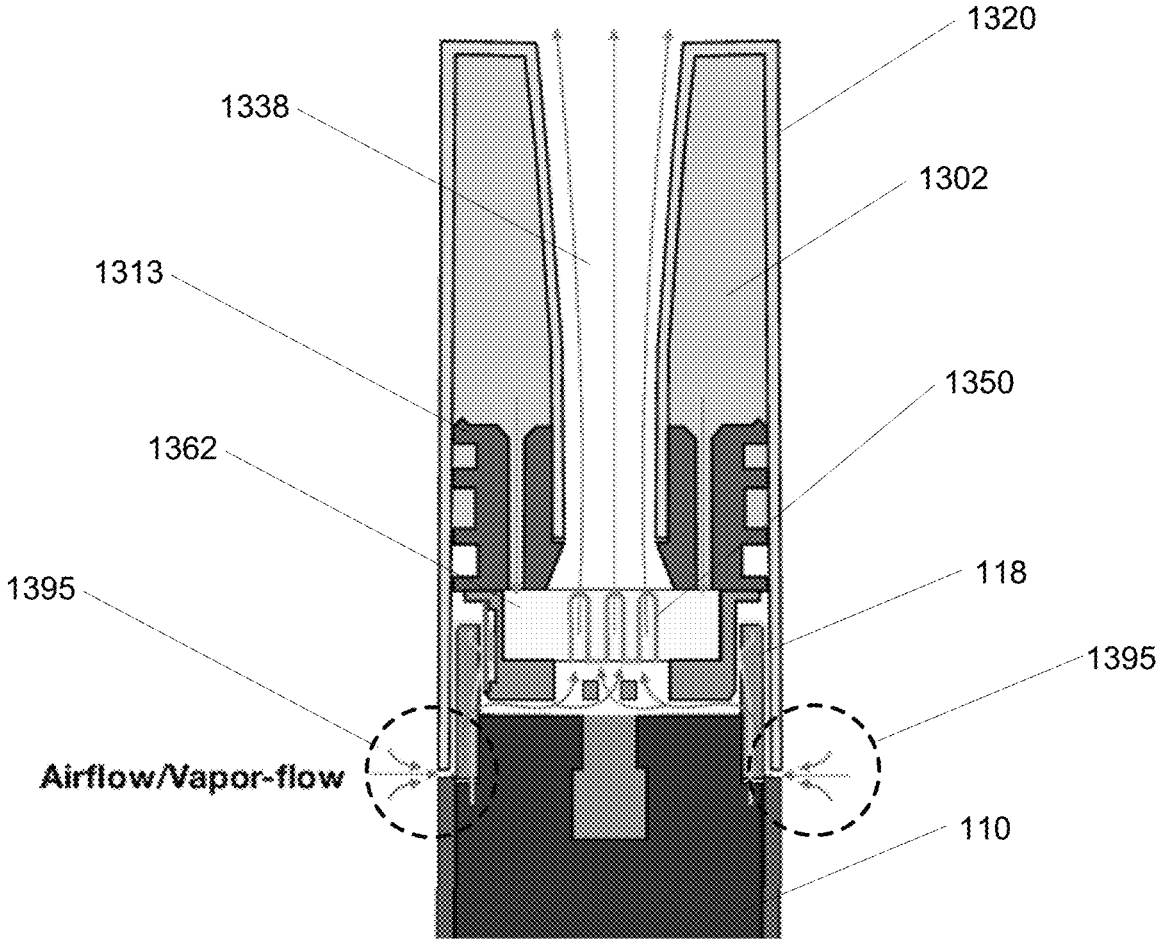
FIG. 48B depicts another side cut out view of a cartridge disposed within a cartridge receptacle consistent with implementations of the current subject matter.
Figure 48C:
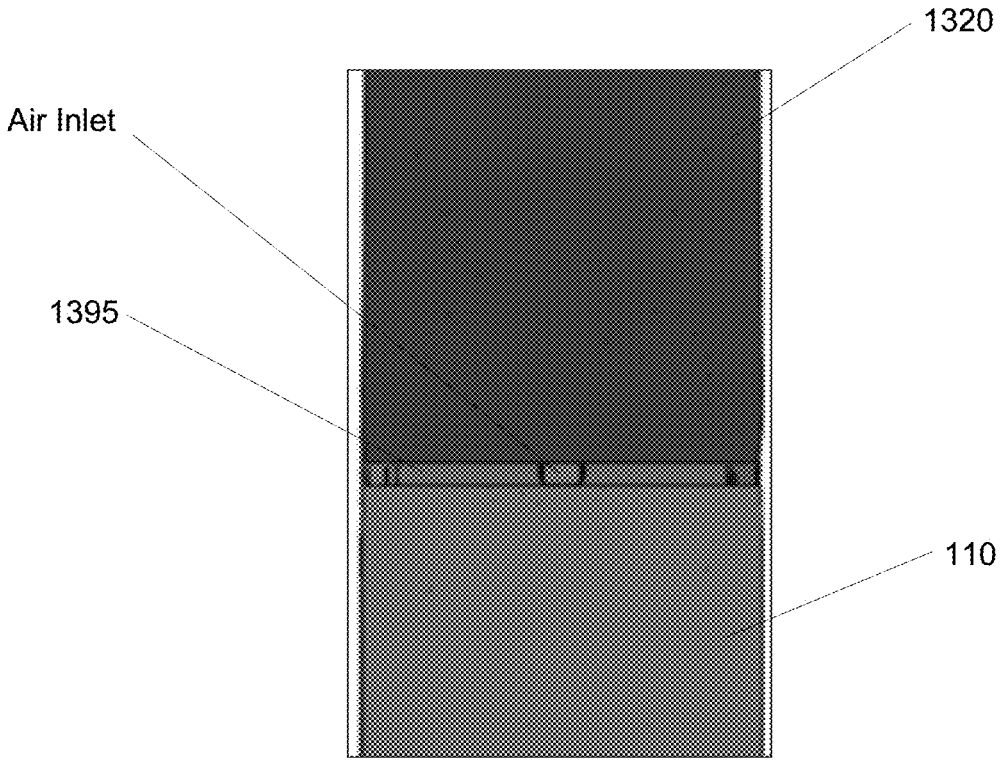
FIG. 48C depicts a partial view of a side of a vaporizer cartridge coupled with a vaporizer body consistent with implementations of the current subject matter.
Figure 48D:
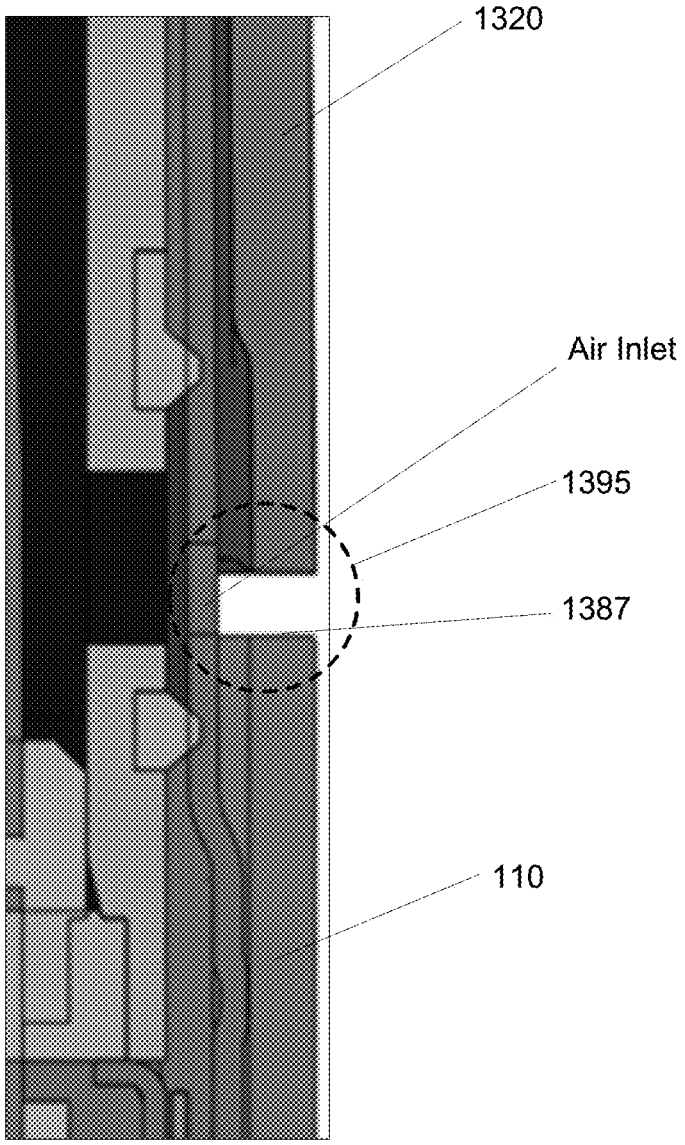
FIG. 48D depicts another partial view of a side of a vaporizer cartridge coupled with a vaporizer body consistent with implementations of the current subject matter.

FIGS. 48A-B depict side cut-out views of the cartridge 1320 disposed within the cartridge receptacle 118 consistent with implementations of the current subject matter. As shown in FIG. 48A, the pod ID contact 307 may be disposed on a first side the cartridge receptacle 118 and may be coupled to the identification chip 174 on the cartridge 1320. Additionally, the pod ID contact 309 may be located on a second side of the cartridge receptacle 118 (opposite to the first side of the cartridge receptacle 118) and may be coupled to the cartridge 1320. FIG. 48A further shows the pod ID contact 309 as being coupled to a contact 293 of the identification chip 250. It should be appreciated that the cartridge receptacle 118 may be sized to receive at least a portion of the cartridge 1320 including, for example, at least a portion of the wick housing 1315. For example, the cartridge receptacle 118 may be approximately 4.5 millimeters deep such that the wick housing 1315, which has a height of approximately 5.3 millimeters including a flange disposed at least partially around its upper perimeter, may be disposed partially within the cartridge receptacle 118 (e.g., up to the flange). The flange may remain outside of the cartridge receptacle 118 when the vaporizer cartridge 1320 is coupled with the vaporizer body 110 and may extend, at least partially, over a rim of the cartridge receptacle 118 and the cosmetic sheath 1219.

As noted, one or more air inlets may be formed and/or maintained while the cartridge 1320 is coupled with the vaporizer body 110, for example, by being inserted into the cartridge receptacle 118. The one or more air inlets may be in fluid communication with the one or more slots 596 in the wick housing 1315 such that air entering through the one or more air inlets may further enter the wick housing 1315 through the one or more slots 596 to flow past and/or around the wicking element 1362. As noted, adequate airflow through the wick housing 1315 may be necessary to enable a proper and timely vaporization of the vaporizable material 1302 drawn into the wicking element 1362. In examples in which there are more than one air inlet, this plurality of air inlets may be disposed around the assembly including the cartridge 1320 and the vaporizer body 110. For example, two or more air inlets may be disposed on substantially opposite sides of the assembly including the vaporizer cartridge 1320 and the vaporizer body 110. It is also within the scope of the current subject matter to have more than one air inlet disposed on a same side of the assembly including the vaporizer cartridge 1320 and the vaporizer body 110 or to have air inlets on different, but not substantially opposite (e.g., adjacent), sides of such an assembly.

Figure 48E:
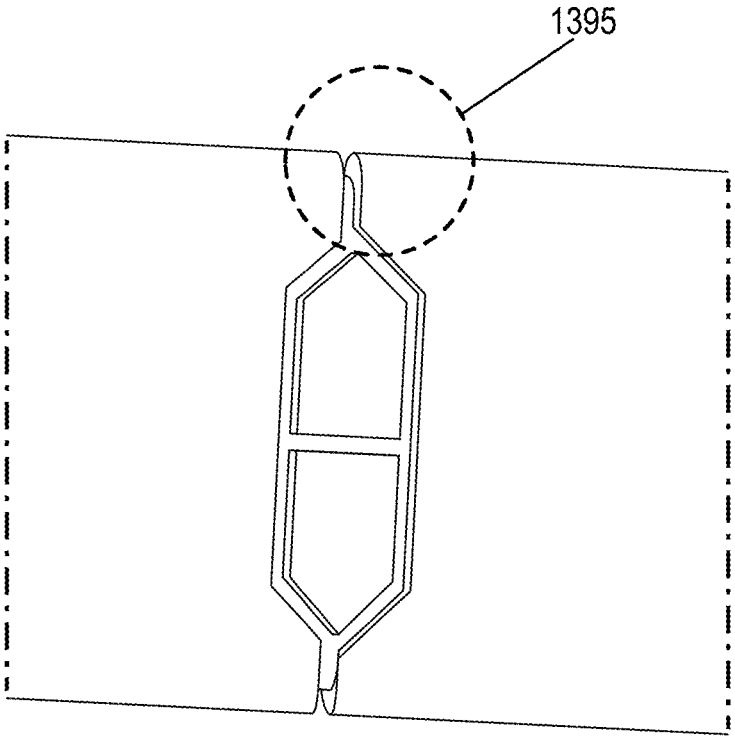
FIG. 48E depicts another partial view of a side of a vaporizer cartridge coupled with a vaporizer body consistent with implementations of the current subject matter.
Figure 48F:
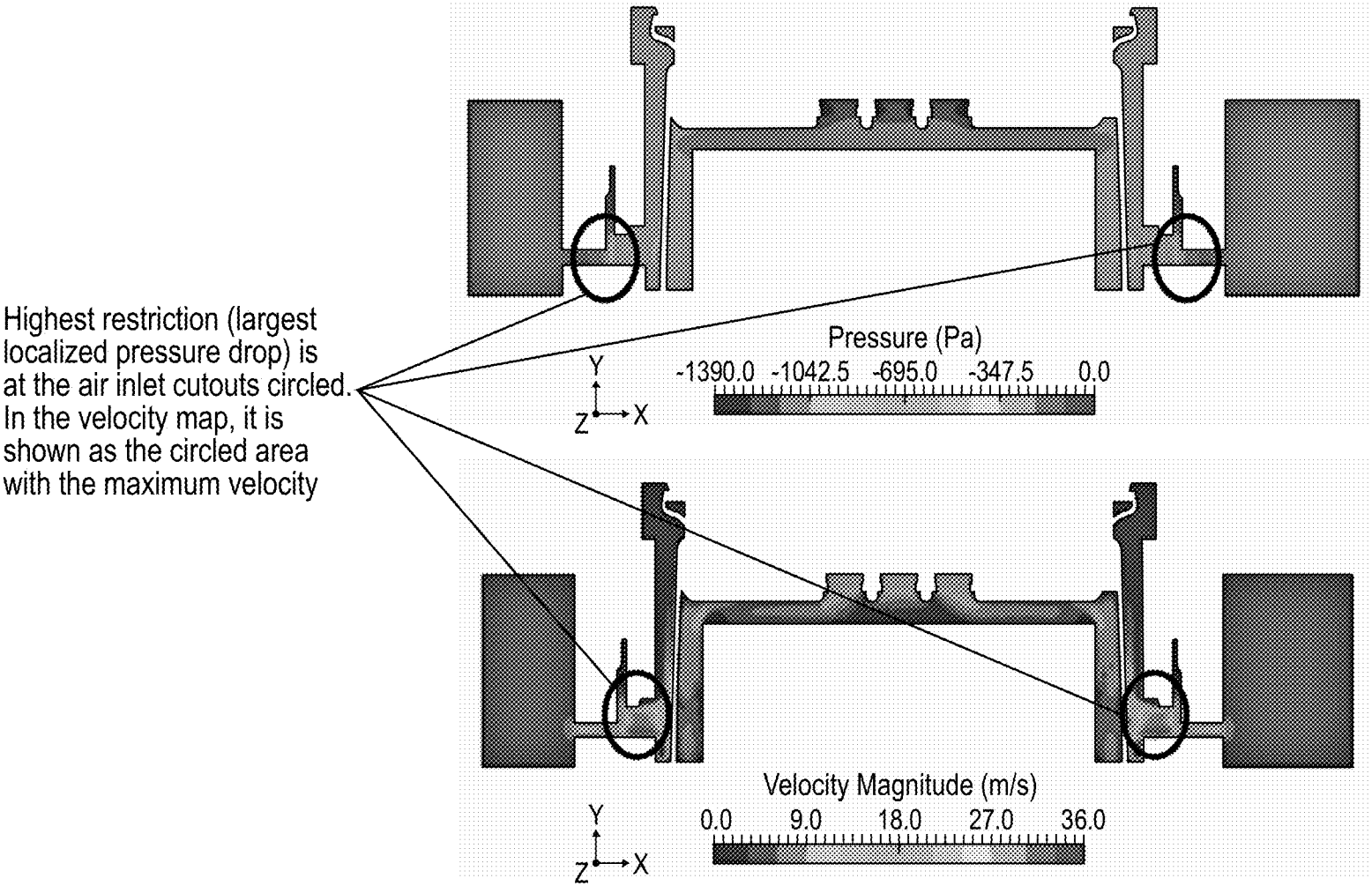
FIG. 48F depicts heat maps illustrating the distribution of air pressure and airflow velocity around air inlets consistent with implementations of the current subject matter.

In some implementations of the current subject matter, the air inlets may be configured to admit sufficient air to enable the vaporization of the vaporizable material 1302 and the generation of an inhalable aerosol. Further as noted, the one or more air inlet may be configured to be resistant to blockage, for example, by a user's finger, hand, or other body part. For example, the one or more the air inlets may be disposed at an interface between the vaporizer cartridge 1320 and the vaporizer body 110. As shown in FIGS. 48A-D, a recessed area 1395 (e.g., a cavity, a groove, a gap, a seam, and/or the like) may be formed between the vaporizer cartridge 1320 and the vaporizer body 110 when the vaporizer cartridge 1320 is coupled with the vaporizer body 110. The one or more air inlets may be disposed within the recessed area 1395 such that portions of the cartridge 1320 (e.g., the housing 160) and the vaporizer body 110 may extend beyond the area including the one or more air inlets. Moreover, the recessed area 1395 may extend at least partially around the circumference of the vaporizer cartridge 1320 and the vaporizer body 110 to provide clearance for the one or more air inlets because a user's finger (or other body part) may be able to cover only a portion of the recessed area 1395. Thus, as shown in FIG. 48E, even when a user's finger (or other body part) is covering one portion of the recessed area 1395, air may still enter the one or more air inlet through an uncovered portion of the recessed area.

It should be appreciated that the air inlets may present at least some constriction to airflow into the vaporizer cartridge 1320. For example, in the pressure maps shown in FIG. 48F, the largest localized pressure drop is observed at the air inlets where, as noted, ambient air may enter the cartridge 1320 to provide sufficient air to enable the vaporization of the vaporizable material 1320 and the generation of an inhalable aerosol. A maximum velocity of airflow may also be observed through the air inlets as ambient air enters the constricted space of the air inlets. A drop in the velocity of airflow is observed subsequent to the intake through the air inlets.

Figure 49B:
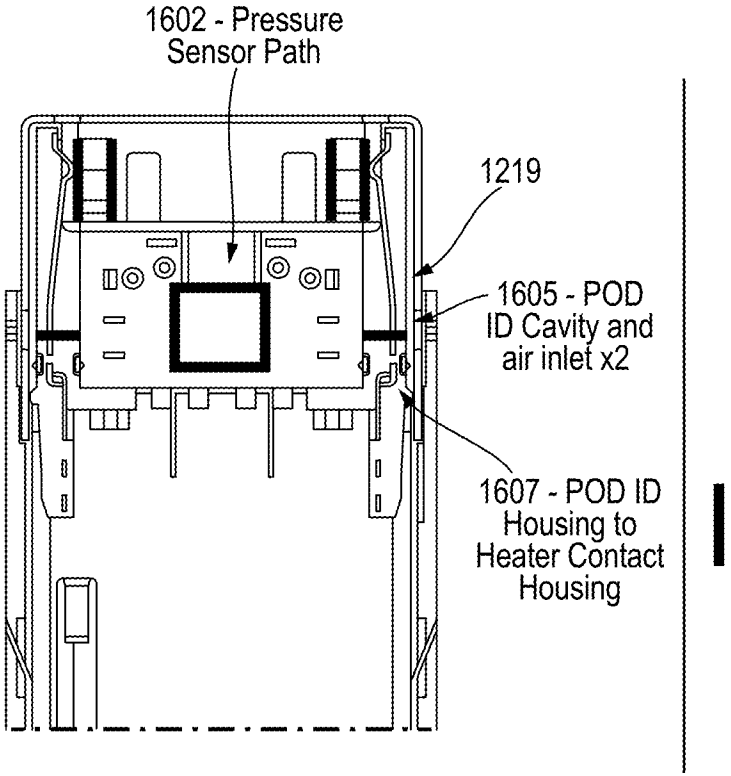
FIG. 49B depicts a cross-sectional view of an example of an assembled vaporizer body shell consistent with implementations of the current subject matter.
Figure 49A:
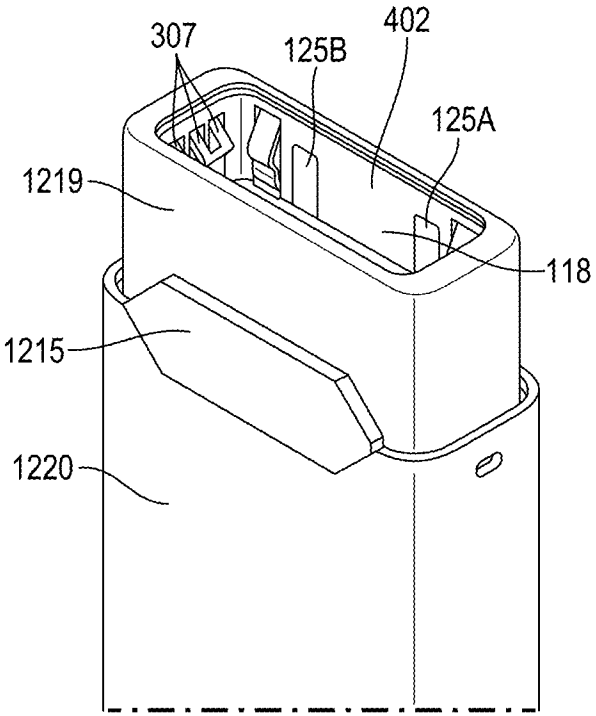
FIG. 49A depicts a top perspective view of an example of a vaporizer body shell consistent with implementations of the current subject matter.

FIG. 49A depicts a perspective view of an assembled vaporizer body shell 1220 with the LED badge 1215 facing the front. As shown in FIG. 49A, the shell 1220 may include the cartridge receptacle 118 having a second side 402 with one or more pod retention features, the cartridge receptacle contacts 125A and 125B, and the pod ID contacts 307. FIG. 49A further shows the shell 1220 as including at least one air inlet 1605 on the right-hand side of the shell 1220, but it should be appreciated that the shell 1220 may include additional air inlets disposed at different locations than shown. For example, in some implementations of the current subject matter, the air inlet 1605 may be positioned above a ridge 1387 in the shell 1220 that is formed by a first portion of the shell 1220 (including the cosmetic sheath 1219) having a smaller cross-sectional dimension than a second portion of the shell 1220 beneath the cosmetic sheath 1219 configured to accommodate at least a portion of the power source 112 (e.g., the battery 1212). The air inlet 1605 may be configured to allow ambient air to enter the cartridge 1320 and mix with the vapor generated in the atomizer 141. For example, the air inlet 1605 may be in fluid communication with the airflow passageway 1338 extending through the body of the cartridge 1320 such that ambient air may enter the airflow passageway 1338 via the air inlet 1605 when the cartridge 1320 is coupled with the shell 1220. The mixture of ambient air and the vapor generated in the atomizer 141 may be drawn through the air passageway 1338 for inhalation (e.g., into the user's mouth) through the mouthpiece 130.

Alternatively and/or additionally, the air inlet 1605 may be in fluid communication with the air vent 1318 disposed at one end of the overflow channel 1104 in the overflow volume 1344 of the collector 1313. As noted, air may travel into and out of the collector 1313 via the air vent 1318. For example, air bubbles trapped inside the collector 1313 may be released via the air vent 1318. Moreover, air may also enter the collector 1313 via the air vent 1318 in order to increase the pressure inside the reservoir 1340. Accordingly, it should be appreciated that the dimensions of the air inlet 1605, the shape of the air inlet 1605, and/or the position of the air inlet 1605 on the shell 1220 may be such that at least a portion of ambient air entering the air inlet 1605 may enter the collector 1313 via the air vent 1318 and that at least a portion of the air released from the collector 1313 from the air vent 1318 may exit via the air inlet 1605. The air inlet 1605 may be substantially round and have a diameter between 0.6 millimeters and 1.0 millimeters. For example, in some implementations of the current subject matter, the air inlet 1605 may be substantially round and have a diameter of approximately 0.8 millimeters. In some implementations of the current subject matter, the air vent 1318 may also be in fluid communication with the air passageway 1338. Accordingly, ambient air entering the air inlet 1605 may supply the collector 1313 (e.g., via the air vent 1318) and the air passageway 1338 (e.g., to create an inhalable aerosol).

FIG. 49B depicts a cross-sectional view of the vaporizer body shell 1220 consistent with implementations of the current subject matter. As shown in FIG. 49B, the shell 1220 may include a pressure sensor path 1602, the cosmetic sheath 1219, the air inlet 1605 which may also include a pod identification cavity, and a pod ID housing 1607 which may include connections to the pod ID springs 307 or 309 and/or the heater contacts 125A and 125B (or 302).

Terminology

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on,"

above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A cartridge for a vaporizer device, the cartridge comprising:

a cartridge housing, the cartridge housing configured to extend below an open top of a receptacle in the vaporizer device when the cartridge is coupled with the vaporizer device;

a reservoir disposed within the cartridge housing, the reservoir configured to contain a vaporizable material;

a wick housing disposed within the cartridge housing, the cartridge housing extending below a top of the wick housing to encircle at least a portion of a perimeter of the wick housing;

a heating element comprising a substrate material that is folded to form a heating portion and a contact portion, the heating portion being disposed at least partially inside the wick housing, the contact portion being disposed at least partially outside the wick housing, the contact portion extending over the top of the wick housing to form one or more cartridge contacts configured to form an electric coupling with one or more receptacle contacts in the receptacle of the vaporizer device; and a wicking element disposed within the wick housing and proximate to the heating portion of the heating element, the wicking element configured to draw the vaporizable material from the reservoir to the wick housing for vaporization by the heating element, the wick housing being disposed at least partially inside the receptacle when the cartridge is coupled with the vaporizer device such that a wall of the receptacle is interposed at least partially between the cartridge housing and the wick housing.

2. The cartridge of claim 1, wherein the contact portion is further configured to form a mechanical coupling with the receptacle of the vaporizer device, and wherein the mechanical coupling secures the cartridge in the receptacle of the vaporizer device.

3. The cartridge of claim 1, wherein the receptacle comprises a first portion of a body of the vaporizer device having a smaller cross-sectional dimension than a second portion of the body of the vaporizer device, and wherein a recessed area is formed between the cartridge housing and the second portion of the body of the vaporizer device when the cartridge is coupled with the vaporizer device.

4. The cartridge of claim 3, wherein the receptacle includes one or more air inlets that form a fluid coupling with one or more slots in a bottom of the wick housing when the cartridge is coupled with the vaporizer device, wherein the one or more slots are configured to allow air entering the one or more air inlets to further enter the wick housing, and wherein the one or more air inlets are disposed in the recessed area.

5. The cartridge of claim 4, wherein the one or more air inlets have a diameter between approximately 0.6 millimeters and 1.0 millimeters.

6. The cartridge of claim 4, wherein an interior of each of the one or more slots include at least one step formed by an inner dimension of the one or more slots being less than a dimension of the one or more slots at the bottom of the wick housing, and wherein the at least one step provides a constriction point at which a meniscus forms to prevent the vaporizable material in the wick housing from flowing out of the one or more slots.

7. The cartridge of claim 6, wherein the dimension of the one or more slots at the bottom of the wick housing is approximately 1.2 millimeters long by 0.5 millimeters wide, and wherein the inner dimension of the one or more slots is approximately 1.0 millimeters long by 0.30 millimeters wide.

8. The cartridge of claim 1, wherein the substrate material is cut to include one or more tines for forming the heating portion of the heating element, and wherein the substrate material is further cut to include one or more legs for forming the contact portion of the heating element.

9. The cartridge of claim 8, wherein the contact portion of the heating element is formed by folding each of the one or more legs to form at least a first joint, a second joint, and a third joint, wherein the first joint is disposed between the second joint and the third joint, and wherein the second joint is disposed between a tip of each of the one or more legs and the first joint.

10. The cartridge of claim 9, wherein the one or more cartridge contacts are disposed at the second joint, wherein the heating element is secured to the wicking housing by a first mechanical coupling between an exterior of the wick housing and a portion of each of the one or more legs between the first joint and the third joint, and wherein the cartridge is secured to the receptacle of the vaporizer device by a second mechanical coupling between the second joint and the receptacle of the vaporizer device.

11. The cartridge of claim 9, wherein the one or more cartridge contacts are disposed at the first joint, wherein the heating element is secured to the wick housing by a first mechanical coupling between an exterior of the wick housing and a portion of each of the one or more legs between the tip and the second joint, and wherein the cartridge is secured to the receptacle of the vaporizer device by a second mechanical coupling between the first joint and the receptacle of the vaporizer device.

12. The cartridge of claim 1, wherein the reservoir includes a storage chamber and a collector, wherein the collector comprises an overflow channel configured to retain a volume of the vaporizable material in fluid contact with the storage chamber, wherein one or more microfluidic features are disposed along a length of the overflow channel, and wherein each of the one or more microfluidic features are configured to provide a constriction point at which a meniscus forms to prevent air entering the reservoir from passing the vaporizable material in the overflow channel.

13. The cartridge of claim 12, wherein the cartridge housing includes an airflow passageway leading to an outlet for an aerosol that is formed by the heating element vaporizing the vaporizable material, wherein the collector includes a central tunnel in fluid communication with the airflow passageway, and wherein a bottom surface of the collector includes a flow controller configured to mix the aerosol generated by the heating element vaporizing the vaporizable material.

14. The cartridge of claim 13, wherein an interior surface of the airflow passageway includes one or more channels that extend from the outlet to the wicking element, and wherein the one or more channels are configured to collect a condensate formed by the aerosol and direct at least a portion the collected condensate towards the wicking element.

15. The cartridge of claim 13, wherein the flow controller includes a first channel and a second channel, wherein the first channel is offset from the second channel, and wherein a first interior surface of the first channel is sloped in a different direction from a second interior surface of the second channel to direct a first column of the aerosol entering the central tunnel through the first channel in a different direction than a second column of the aerosol entering the central tunnel through the second channel.

16. The cartridge of claim 13, wherein the bottom surface of the controller further includes one or more wick interfaces, wherein the one or more wick interfaces are in fluid communication with one or more wick feeds in the collector, and wherein the one or more wick feeds are configured to deliver, to the wicking element disposed in the wick housing, at least a portion of the vaporizable material contained in the storage chamber.

17. The cartridge of claim 1, wherein the wick housing is disposed at least partially inside the receptacle of the vaporizer device when the cartridge is coupled with the vaporizer device, wherein a flange is disposed at least partially around an upper perimeter of the wick housing, and wherein the flange extends over at least a portion of a rim of the cartridge receptacle.

18. A vaporizer device, the vaporizer device comprising:

a receptacle comprising a first portion of a body of the vaporizer device, the receptacle including one or more receptacle contacts, the receptacle configured to receive a wick housing of a cartridge containing a vaporizable material when the cartridge is coupled with the vaporizer device, a housing of the cartridge extending below an open top of the receptacle when the cartridge is coupled with the vaporizer device, the housing of the cartridge further extending below a top of the wick housing to encircle at least a portion of a perimeter of the wick housing, the wick housing including a heating element and a wicking element, the heating element comprising a substrate material that is folded to form a heating portion and a contact portion, the heating portion being disposed at least partially inside the wick housing, the contact portion being disposed at least partially outside of the wick house, the contact portion extending over a top of the wick housing to form one or more cartridge contacts configured to form an electric coupling with the one or more receptacle contacts, the wick housing being disposed at least partially inside the receptacle when the cartridge is coupled with the vaporizer device such that a wall of the receptacle is interposed at least partially between the cartridge housing and the wick housing;

a power source disposed at least partially within a second portion of the body of the vaporizer device; and a controller configured to control a discharge of an electric current from the power source to the heating element included in the cartridge when the cartridge is coupled with the vaporizer device, the electric current being discharged to the heating element to vaporize at least a portion of the vaporizable material saturating the wicking element disposed within the wick housing and proximate to a heating portion of the heating element.

19. The vaporizer device of claim 18, wherein the receptacle is further configured to form a mechanical coupling with the contact portion of the heating element, and wherein the mechanical coupling secures the cartridge in the receptacle of the vaporizer device.

20. The vaporizer device of claim 18, wherein the first portion of the body of the vaporizer device has a smaller cross-sectional dimension than the second portion of the body of the vaporizer device, and wherein a recessed area is formed between the second portion of the body of the vaporizer device and the housing of the cartridge when the cartridge is coupled with the vaporizer device.

21. The vaporizer device of claim 20, wherein the receptacle includes one or more air inlets that form a fluid coupling with one or more slots in a bottom of the wick housing when the cartridge is coupled with the vaporizer device, wherein the one or more slots are configured to allow air entering the one or more air inlets to further enter the wick housing, and wherein the one or more air inlets are disposed in the recessed area.

22. The vaporizer device of claim 21, wherein the one or more air inlets have a diameter between approximately 0.6 millimeters and 1.0 millimeters.

23. The vaporizer device of claim 18, wherein the receptacle is disposed within the first portion of the body of the vaporizer device such that a top rim of the receptacle is substantially flush with a top rim of the first portion of the body of the vaporizer device.

24. The vaporizer device of claim 23, wherein the receptacle is configured receive a portion of the wick housing such that a flange disposed at least partially around an upper perimeter of the wick housing extends over at least a portion of the top rim of the cartridge receptacle and/or the top rim of the first portion of the body of the vaporizer device.

25. The vaporizer device of claim 18, wherein the receptacle is approximately 4.5 millimeters deep.

26. The cartridge of claim 1, wherein the contact portion of the heating element includes four legs, and wherein each of the four legs form a contact configured to form the electrical coupling with a receptacle contact in the receptacle of the vaporizer device.

27. The vaporizer device of claim 18, wherein the contact portion of the heating element includes four legs, and wherein each of the four legs form a contact configured to form the electrical coupling with a receptacle contact in the receptacle of the vaporizer device.

28. The cartridge of claim 1, wherein the wick housing includes a capillary feature configured to prevent the flow of the vaporizable material beyond the capillary feature by at least spacing the heating element away from the housing to reduce a capillary strength therebetween.

29. The vaporizer device of claim 18, wherein the wick housing includes a capillary feature configured to prevent the flow of the vaporizable material beyond the capillary feature by at least spacing the heating element away from the housing to reduce a capillary strength therebetween.

* * * * *